US011337533B1

(12) United States Patent
Perrelli et al.

(10) Patent No.: US 11,337,533 B1
(45) Date of Patent: May 24, 2022

(54) PORTABLE SYSTEM FOR DISPENSING CONTROLLED QUANTITIES OF ADDITIVES INTO A BEVERAGE

(71) Applicant: INFUZE, L.L.C., Logan, UT (US)

(72) Inventors: Jonathon Perrelli, Leesburg, VA (US); Robert Lawson-Shanks, Reston, VA (US); Elizabeth Hubler, Santa Monica, CA (US); Mark Lyons, Ashburn, VA (US)

(73) Assignee: Infuze, L.L.C., Logan, UT (US)

( * ) Notice: Subject to any disclaimer, the term of this patent is extended or adjusted under 35 U.S.C. 154(b) by 0 days.

(21) Appl. No.: 16/436,656

(22) Filed: Jun. 10, 2019

Related U.S. Application Data

(60) Provisional application No. 62/682,779, filed on Jun. 8, 2018.

(51) Int. Cl.

| | |
|---|---|
| ***A47G 19/22*** | (2006.01) |
| ***B65D 51/28*** | (2006.01) |
| ***A47G 19/12*** | (2006.01) |
| ***B65D 47/12*** | (2006.01) |

(52) U.S. Cl.
CPC ..... *A47G 19/2227* (2013.01); *A47G 19/12* (2013.01); *B65D 47/122* (2013.01); *B65D 51/28* (2013.01); *A47G 2019/122* (2013.01); *A47G 2019/2244* (2013.01)

(58) Field of Classification Search
None
See application file for complete search history.

(56) References Cited

U.S. PATENT DOCUMENTS

| | | | |
|---|---|---|---|
| D95,559 | S | 5/1935 | Vogel |
| D97,347 | S | 10/1935 | Gambell |
| 2,071,399 | A | 2/1937 | Gambell |
| D157,486 | S | 2/1950 | Glowacki |
| 2,682,355 | A | 6/1954 | Robbins |

(Continued)

FOREIGN PATENT DOCUMENTS

| | | |
|---|---|---|
| CN | 1942392 | 4/2007 |
| CN | 100575206 | 12/2009 |

(Continued)

*Primary Examiner* — Mohammad Ali
*Assistant Examiner* — Kelvin Booker
(74) *Attorney, Agent, or Firm* — Kenealy Vaidya LLP

(57) ABSTRACT

A portable, self-contained beverage apparatus includes a container assembly having a known storage capacity for storing a consumable liquid, and a dispensing assembly disposed within the container assembly that dispenses variable, non-zero quantities of additives into the consumable liquid. The dispensing assembly includes multiple apertures structured and arranged to retain vessels containing the additives to be dispensed into the consumable liquid. The beverage apparatus also includes a level sensor disposed within the container assembly that determines a consumable liquid level of the consumable liquid stored in the container assembly. In certain embodiments, one or more positive displacement pumping mechanisms are configured to pump additive liquid from additive containers into a beverage chamber. Other features relate to audio engagement processing. Other features relate to situational processing. Other features relate to group engagement processing.

19 Claims, 90 Drawing Sheets

(56) References Cited

U.S. PATENT DOCUMENTS

D192,814 S 5/1962 Edwin
3,319,637 A 5/1967 Gore
3,548,657 A 12/1970 Panerai
D225,364 S 12/1972 Antoni
3,727,803 A 4/1973 Cobb
D242,132 S 11/1976 Hasegawa
4,051,726 A 10/1977 Hastbacka
4,087,024 A 5/1978 Martin
4,125,187 A 11/1978 Vecchiotti
4,133,457 A 1/1979 Klassen
4,252,253 A * 2/1981 Shannon ..... B67D 1/0888 222/129.4
4,278,186 A * 7/1981 Williamson ..... B67D 3/0003 222/36
4,450,722 A 5/1984 Keyes, IV
D279,621 S 7/1985 Richer
4,688,701 A 8/1987 Sedam
4,728,006 A 3/1988 Drobish
D295,954 S 5/1988 Kirchhoff
D296,302 S 6/1988 Weber
4,800,492 A * 1/1989 Johnson ..... B67D 1/0041 222/23
4,827,426 A * 5/1989 Patton ..... B67D 1/0041 141/174
4,840,291 A * 6/1989 Merlin ..... G07F 13/10 221/282
4,898,306 A 2/1990 Pardes
4,938,387 A 7/1990 Kervefors
4,964,541 A * 10/1990 Gueret ..... B65D 35/242 222/129
5,080,260 A 1/1992 Doring
5,119,279 A 6/1992 Makowsky
5,139,169 A 8/1992 Boyer
5,174,458 A 12/1992 Segati
5,182,084 A 1/1993 Plester
D336,216 S 6/1993 Rohrbeck
5,282,131 A * 1/1994 Rudd ..... D21C 7/12 162/253
5,325,765 A 7/1994 Sylvan
5,344,034 A 9/1994 Eagan
D352,204 S 11/1994 Hayes
5,377,877 A 1/1995 Brown et al.
5,379,916 A 1/1995 Martindale
5,398,853 A 3/1995 Latham
5,474,211 A 12/1995 Hellenberg
D372,867 S 8/1996 Lambelet
5,588,557 A * 12/1996 Topar ..... B67D 7/08 222/129.1
D382,808 S 8/1997 Fenton
D383,383 S 9/1997 Prestia
D387,992 S 12/1997 Kotoucek
5,725,125 A 3/1998 Bessette
5,747,824 A 5/1998 Jung
D396,603 S 8/1998 Gasser
5,810,062 A 9/1998 Bonora
D399,098 S 10/1998 Yang
D400,050 S 10/1998 Littmann
D404,253 S 1/1999 Littmann
5,938,080 A 8/1999 Haaser
5,960,701 A * 10/1999 Reese ..... B67D 1/0039 222/135
5,967,367 A * 10/1999 Orsborn ..... B67D 1/0041 222/129.1
6,077,579 A 6/2000 De Laforcade
6,140,932 A 10/2000 Frank
6,142,063 A 11/2000 Beaulieu
6,170,712 B1 1/2001 Kasboske
6,230,884 B1 5/2001 Coory
6,372,270 B1 * 4/2002 Denny ..... A47G 19/22 206/219
6,422,422 B1 7/2002 Forbes
6,424,884 B1 * 7/2002 Brooke, Jr ..... G06Q 20/327 700/232
6,446,049 B1 9/2002 Janning
6,504,481 B2 1/2003 Teller
6,529,446 B1 3/2003 de la Huerga
6,574,575 B2 * 6/2003 Deng ..... A47J 31/402 702/100
D477,791 S 7/2003 Wells
D478,073 S 8/2003 Topinka
6,615,881 B2 9/2003 Bartholomew
6,644,471 B1 11/2003 Anderson
6,703,935 B1 3/2004 Chung
6,722,530 B1 4/2004 King
6,761,318 B2 7/2004 Dudek
D499,603 S 12/2004 Nikkhah
D500,936 S 1/2005 Nikkhah
6,889,872 B2 5/2005 Herman
6,921,911 B2 7/2005 Siepmann
6,925,871 B2 8/2005 Frank
6,935,493 B2 8/2005 Cho
D514,385 S 2/2006 Smith
7,004,213 B2 2/2006 Hansen
D517,852 S 3/2006 Jalet
7,009,519 B2 3/2006 Leonard
7,032,818 B2 4/2006 Thomas
D522,860 S 6/2006 LaFortune
D523,332 S 6/2006 McEldowney
D525,135 S 7/2006 Bakic
7,104,184 B2 9/2006 Biderman
7,107,838 B2 9/2006 Chai
D529,340 S 10/2006 Laib
D530,968 S 10/2006 Urn
D533,018 S 12/2006 Berg
7,172,095 B2 2/2007 Marshall
7,196,624 B2 3/2007 Teller
D541,106 S 4/2007 Spiegel
D541,596 S 5/2007 Hicks
7,228,879 B2 6/2007 Miller
7,319,523 B2 1/2008 Chiarello
D565,350 S 4/2008 Gauger
7,387,239 B2 6/2008 Thomas
D572,588 S 7/2008 Osborn
D573,464 S 7/2008 Kogure
7,439,859 B2 10/2008 Humphrey
D582,767 S 12/2008 Batton
7,464,811 B2 12/2008 Patterson
7,501,933 B2 3/2009 Rousso
D591,599 S 5/2009 Okin
D593,411 S 6/2009 Bizzell
D596,487 S 7/2009 Batton
7,612,675 B2 11/2009 Miller
7,614,496 B2 11/2009 Dvorak
D608,637 S 1/2010 Getsy
D611,298 S 3/2010 Freeman
D613,183 S 4/2010 Overgaard
7,710,567 B1 5/2010 Mentzer
7,715,277 B2 5/2010 de la Huerga
D618,963 S 7/2010 Freeman
7,762,181 B2 7/2010 Boland
D621,283 S 8/2010 Overgaard
7,798,373 B1 9/2010 Wroblewski
7,825,804 B2 11/2010 Malik
D634,157 S 3/2011 Hoff
D635,823 S 4/2011 Mauffette
D635,864 S 4/2011 Lee
D639,607 S 6/2011 Bracq
RE42,937 E 11/2011 Lasher
8,083,055 B2 12/2011 Simonian
D651,474 S 1/2012 Gut
8,091,735 B2 1/2012 Girard
8,141,700 B2 3/2012 Simonian
D658,982 S 5/2012 Pauser
D659,472 S 5/2012 D'Amato
8,196,776 B2 6/2012 Doglioni Majer
8,210,396 B2 7/2012 Girard
8,240,508 B2 8/2012 Wegelin
8,302,795 B2 11/2012 Van den Broek
8,361,527 B2 1/2013 Winkler
8,378,830 B2 2/2013 Moran
8,397,519 B2 3/2013 Loibl
8,417,377 B2 4/2013 Rothchild

(56) References Cited

U.S. PATENT DOCUMENTS 8,442,674 B2 * 5/2013 Tilton ..... G06Q 30/0641 700/233
8,463,447 B2 6/2013 Newman
8,464,633 B2 6/2013 Anson
8,485,359 B2 7/2013 Anderson
D688,531 S 8/2013 Ceder
8,515,574 B2 8/2013 Studor
8,519,824 B1 * 8/2013 Rankin ..... B64D 11/04 340/10.1
8,522,968 B2 9/2013 Middleman
8,523,837 B2 9/2013 Wiggins
D690,990 S 10/2013 Boggs
D690,991 S 10/2013 Boggs
8,556,127 B2 10/2013 Olson
8,584,691 B2 11/2013 Hammonds
8,584,840 B2 11/2013 Kim
8,590,753 B2 11/2013 Marina
D699,106 S 2/2014 Glaser
D699,996 S 2/2014 De Leo
D700,008 S 2/2014 Ehrenhaus
8,678,183 B2 3/2014 Jones
D702,474 S 4/2014 Scherer
8,684,231 B2 4/2014 Lane
8,695,420 B1 4/2014 Korman
8,701,906 B1 4/2014 Anderson
8,717,182 B1 5/2014 Brashears
8,718,819 B2 5/2014 Hyde
8,751,037 B2 * 6/2014 Peters ..... G07F 9/002 700/236
8,754,769 B2 6/2014 Stein
8,757,227 B2 6/2014 Girard
D709,387 S 7/2014 Marina
8,794,485 B2 8/2014 Lunn
8,801,688 B2 8/2014 Wiggins
8,833,607 B2 9/2014 Wegelin
8,851,740 B1 10/2014 Mills
8,863,649 B1 * 10/2014 Rao ..... A47J 31/00 99/283
8,919,613 B2 12/2014 Mileti
8,940,163 B2 1/2015 Bassett
8,945,374 B2 2/2015 Chase
8,977,389 B2 3/2015 Witchell
8,979,539 B1 3/2015 Snyder
8,985,395 B2 3/2015 Tansey
8,989,673 B2 3/2015 Sandy
8,991,648 B2 3/2015 Smith
D727,171 S 4/2015 Marina
9,014,846 B2 4/2015 Newman
9,020,635 B2 4/2015 Hortin
D729,571 S 5/2015 Wilson
9,031,689 B1 5/2015 Fink
9,035,222 B2 5/2015 Alexander
9,035,765 B2 5/2015 Engelhard
D731,242 S 6/2015 Machovina
D731,243 S 6/2015 Machovina
9,051,162 B2 * 6/2015 Peters ..... B67D 1/0888
9,102,441 B1 8/2015 Orvik
9,111,324 B2 8/2015 Hyde
9,126,738 B2 9/2015 Boggs
9,134,020 B1 9/2015 Wells
9,138,091 B2 9/2015 Zhao
9,151,605 B1 10/2015 Sweeney
9,161,654 B2 10/2015 Belmont
9,169,112 B2 10/2015 Chase
D742,691 S 11/2015 Zhang
D746,046 S 12/2015 Lee
D748,955 S 2/2016 Oliver
9,254,250 B1 2/2016 Orofino
D751,865 S 3/2016 Harris
D752,391 S 3/2016 Hatherell
D752,396 S 3/2016 Tu
9,290,309 B1 3/2016 Pabon
D758,868 S 6/2016 Bretschneider
9,357,887 B2 6/2016 Wegelin
D760,537 S 7/2016 Hertaus
D768,507 S 10/2016 Hotell
9,499,385 B1 * 11/2016 Studor ..... G06Q 20/18
9,506,798 B2 11/2016 Saltzgiver
9,511,987 B2 * 12/2016 Hayakawa ..... B67D 1/0028
D779,881 S 2/2017 Lee
D813,049 S 3/2018 Richmond
9,932,217 B2 4/2018 Perrelli
D826,052 S 8/2018 Harris
10,095,972 B2 10/2018 Bhatia
D836,385 S 12/2018 Arzunyan
D837,594 S 1/2019 Palese
10,178,925 B2 * 1/2019 Rithener ..... A47J 31/4403
10,231,567 B2 3/2019 Perrelli
10,328,402 B2 6/2019 Kolar
10,363,530 B2 7/2019 Kolar
D856,083 S * 8/2019 Lawson-Shanks ..... D7/507
10,413,131 B2 9/2019 Kolar
10,489,868 B2 * 11/2019 Long, II ..... G06Q 20/18
10,512,358 B1 * 12/2019 Perrelli ..... B67D 1/0019
10,513,424 B2 * 12/2019 Tansey, Jr. ..... B67D 1/0858
D878,864 S * 3/2020 Lawson-Shanks ..... D7/507
10,621,850 B2 4/2020 Laidlaw
D887,769 S * 6/2020 Lyons ..... D7/376
10,674,857 B2 6/2020 Lyons
10,758,077 B1 * 9/2020 Wilkie ..... A47J 31/467
10,765,252 B2 9/2020 Perrelli
10,863,852 B1 * 12/2020 Lyons ..... A47G 23/16
10,881,239 B2 1/2021 Perrelli
10,888,191 B1 1/2021 Lyons
10,889,424 B1 1/2021 Lyons
10,889,425 B1 1/2021 Lyons
10,889,481 B2 1/2021 Perrelli
10,889,482 B1 1/2021 MacLean
10,913,647 B2 2/2021 Lyons
10,934,150 B1 3/2021 MacLean
10,941,030 B1 3/2021 Lyons
10,947,102 B1 3/2021 Lyons
2001/0032036 A1 * 10/2001 Sudolcan ..... B67D 1/0888 700/236
2001/0054083 A1 * 12/2001 Defosse ..... G07F 9/002 709/217
2002/0070861 A1 * 6/2002 Teller ..... G06Q 50/12 340/572.1
2002/0090426 A1 7/2002 Denny
2002/0129663 A1 9/2002 Hoyt
2003/0090892 A1 5/2003 Su
2003/0121937 A1 * 7/2003 Black ..... B67D 1/06 222/129.1
2003/0191558 A1 * 10/2003 Arellano ..... G06Q 30/02 700/237
2004/0112070 A1 * 6/2004 Schanin ..... G07F 9/02 62/132
2005/0284302 A1 * 12/2005 Levin ..... B65D 51/2828 99/275
2006/0061985 A1 3/2006 Elkins
2006/0081653 A1 * 4/2006 Boland ..... G07F 11/00 222/243
2006/0115570 A1 * 6/2006 Guerrero ..... G07F 13/065 426/590
2006/0191824 A1 * 8/2006 Arett ..... A47G 19/12 210/85
2006/0219858 A1 * 10/2006 Iacovino ..... A47G 23/02 248/311.2
2007/0024465 A1 2/2007 Howell
2007/0095859 A1 * 5/2007 Maser ..... B67D 1/1247 222/148
2007/0114244 A1 * 5/2007 Gatipon ..... B67D 1/0041 222/129.1
2007/0137643 A1 6/2007 Bonney
2007/0157576 A1 * 7/2007 Till ..... B65C 9/46 53/471
2007/0203587 A1 * 8/2007 Erlandsson ..... B65D 85/8043 700/11
2007/0214055 A1 9/2007 Temko
2008/0023488 A1 1/2008 Guerrero
2008/0178749 A1 * 7/2008 Stutman ..... G06Q 50/12 99/494
2008/0190958 A1 8/2008 Wyner

(56) References Cited

U.S. PATENT DOCUMENTS

2009/0069930 A1 3/2009 Peters
2009/0069934 A1* 3/2009 Newman ..... B67D 1/0021 700/239
2009/0069947 A1* 3/2009 Newman ..... B67D 1/0888 700/281
2009/0069949 A1* 3/2009 Carpenter ..... B67D 1/0021 700/283
2009/0120815 A1 5/2009 Mitchell
2009/0205506 A1 8/2009 Lin
2009/0206084 A1 8/2009 Woolf
2009/0228367 A1 9/2009 Hughes
2009/0272274 A1 11/2009 De Graaff
2010/0040743 A1* 2/2010 Drost ..... A47J 31/4492 426/231
2010/0055252 A1 3/2010 Marina
2010/0125362 A1* 5/2010 Canora ..... G07F 9/00 700/236
2010/0145522 A1* 6/2010 Claesson ..... B67D 1/0051 700/265
2010/0163567 A1 7/2010 Chiang
2010/0183776 A1 7/2010 Gruenwald
2010/0219151 A1 9/2010 Risheq
2010/0242497 A1* 9/2010 Bertone ..... B67D 1/0053 62/1
2010/0316434 A1* 12/2010 Maxwell ..... A46B 11/0041 401/282
2010/0318221 A1* 12/2010 Wiemer ..... B67D 1/0021 700/240
2011/0006071 A1 1/2011 Koumans
2011/0024537 A1 2/2011 Gonzalez
2011/0036803 A1* 2/2011 Mejia ..... B65D 51/28 215/228
2011/0049161 A1 3/2011 Savinsky
2011/0049195 A1* 3/2011 Russell ..... B65D 47/244 222/513
2011/0050431 A1* 3/2011 Hood ..... G01N 33/14 340/603
2011/0052764 A1 3/2011 Bulgin
2011/0060457 A1* 3/2011 De Vrught ..... A61J 1/03 700/241
2011/0166910 A1 7/2011 Marina
2011/0180563 A1 7/2011 Fitchett
2011/0220106 A1* 9/2011 Ganem ..... A61M 15/0028 128/203.21
2011/0301768 A1* 12/2011 Hammonds ..... B67D 1/07 700/285
2012/0017766 A1 1/2012 Anson
2012/0035761 A1 2/2012 Tilton
2012/0094261 A1 4/2012 Hayn
2012/0097567 A1 4/2012 Zhao
2012/0100275 A1* 4/2012 Bishop ..... A47J 31/32 426/474
2012/0104023 A1 5/2012 Anselmino
2012/0156337 A1* 6/2012 Studor ..... A23F 5/26 426/231
2012/0173164 A1 7/2012 Steuerwald
2012/0230149 A1 9/2012 Martin
2012/0234183 A1 9/2012 Edwards
2012/0267320 A1 10/2012 Baccigalopi
2012/0285985 A1* 11/2012 Jones ..... B65D 51/2821 222/1
2013/0001244 A1 1/2013 Wegelin
2013/0037506 A1 2/2013 Wahlstrom
2013/0043304 A1 2/2013 Agan
2013/0068772 A1* 3/2013 Durdon ..... B65D 51/28 220/521
2013/0082022 A1* 4/2013 Cronin ..... B65D 51/2864 215/228
2013/0085599 A1* 4/2013 Nicol ..... G06Q 20/202 700/233
2013/0092567 A1 4/2013 Lok
2013/0127748 A1 5/2013 Vertegaal
2013/0139703 A1 6/2013 Hogarth
2013/0156903 A1* 6/2013 Bombeck ..... A47J 31/30 426/231
2013/0156904 A1 6/2013 Nosier
2013/0186779 A1 7/2013 Kambouris
2013/0226337 A1 8/2013 Leech
2013/0240079 A1 9/2013 Petrini
2013/0247770 A1 9/2013 Wilder
2013/0319915 A1 12/2013 Gellibolian
2013/0325174 A1* 12/2013 Crisp, III ..... B67D 1/0857 700/236
2013/0340453 A1* 12/2013 Chan ..... F28D 1/02 62/126
2013/0341395 A1* 12/2013 Chan ..... F25D 31/003 235/381
2014/0034183 A1* 2/2014 Gross ..... B65B 29/06 141/1
2014/0044837 A1 2/2014 Weisman
2014/0079856 A1 3/2014 Hatherell
2014/0110476 A1 4/2014 Sheehan
2014/0114469 A1 4/2014 Givens
2014/0150670 A1* 6/2014 Green ..... A47J 31/407 99/323.2
2014/0154382 A1* 6/2014 Green ..... A23L 2/54 426/477
2014/0166694 A1* 6/2014 Otto ..... B67D 1/0888 222/95
2014/0170279 A1* 6/2014 Koi ..... B67D 1/0021 426/431
2014/0269154 A1 9/2014 Kolar
2014/0272019 A1 9/2014 Schuh
2014/0273925 A1 9/2014 Burgett
2014/0277707 A1 9/2014 Akdogan
2014/0303790 A1* 10/2014 Huang ..... G16H 20/60 700/281
2014/0305952 A1 10/2014 Harris
2014/0312247 A1 10/2014 McKee
2014/0324585 A1 10/2014 Mederos
2014/0335490 A1 11/2014 Baarman
2014/0352843 A1 12/2014 Solera et al.
2014/0354438 A1 12/2014 Hazen
2014/0372045 A1 12/2014 Keski-Pukkila
2014/0374438 A1 12/2014 Carpenter
2015/0014369 A1 1/2015 Hatton
2015/0024349 A1 1/2015 Bischoff
2015/0088304 A1 3/2015 Ameye
2015/0115158 A1 4/2015 Fu
2015/0060482 A1 5/2015 Murray
2015/0122688 A1 5/2015 Dias
2015/0173488 A1 6/2015 Witchell
2015/0175400 A1 6/2015 Newman
2015/0182797 A1 7/2015 Wernow
2015/0183627 A1 7/2015 Tansey, Jr.
2015/0223623 A1 8/2015 Davis
2015/0271582 A1 9/2015 Cheng
2015/0272394 A1 10/2015 Lin
2015/0284163 A1 10/2015 Manwani
2016/0055599 A1* 2/2016 Illy ..... G06Q 30/0643 705/15
2016/0143474 A1* 5/2016 Wessels ..... A47J 31/4403 426/231
2016/0159632 A1* 6/2016 Wheatley ..... B67D 1/0015 222/1
2016/0174470 A1 6/2016 Shaffer
2016/0175785 A1* 6/2016 Li ..... A47J 31/00 366/163.2
2016/0176696 A1* 6/2016 Hecht ..... B67D 1/0888 222/144.5
2016/0220973 A1 8/2016 Kolar
2016/0251234 A1 9/2016 Hayslett
2016/0257554 A1* 9/2016 Manwani ..... B67D 3/007
2016/0286993 A1* 10/2016 Pau ..... A47G 19/2288
2016/0317985 A1 11/2016 Mutschler
2016/0325980 A1* 11/2016 Sawhney ..... G06F 3/0482
2016/0364814 A1* 12/2016 Yekutiely ..... G06F 16/9535
2016/0367072 A1* 12/2016 Boone ..... A47J 43/046
2016/0376140 A1 12/2016 Tansey
2017/0066638 A1* 3/2017 Gatipon ..... B67D 1/1231
2017/0087524 A1 3/2017 Deshpande

(56) References Cited

U.S. PATENT DOCUMENTS

| | | | | |
|---|---|---|---|---|
| 2017/0088410 | A1* | 3/2017 | Wing | B67D 1/0022 |
| 2017/0101298 | A1* | 4/2017 | Renzi | B67D 1/0855 |
| 2017/0121165 | A1* | 5/2017 | Gabrieli | B67D 1/0884 |
| 2017/0156540 | A1* | 6/2017 | Wheatley | A47J 31/521 |
| 2017/0186110 | A1* | 6/2017 | Carpenter | G06K 7/1413 |
| 2017/0303744 | A1 | 10/2017 | Sutton | |
| 2017/0332829 | A1* | 11/2017 | Kim | B67D 1/0016 |
| 2017/0335256 | A1* | 11/2017 | Park | C12C 11/006 |
| 2017/0347690 | A1* | 12/2017 | Benedetti | B67D 1/0021 |
| 2017/0353820 | A1* | 12/2017 | Chiang | H04W 4/70 |
| 2017/0361984 | A1 | 12/2017 | Fouad | |
| 2017/0367522 | A1* | 12/2017 | Ackel | C12C 12/006 |
| 2018/0020875 | A1 | 1/2018 | Kolar | |
| 2018/0029859 | A1* | 2/2018 | Hevia | B67D 1/0877 |
| 2018/0042258 | A1* | 2/2018 | Roberts | A47J 31/441 |
| 2018/0044157 | A1* | 2/2018 | Cohen | B67D 1/0021 |
| 2018/0049582 | A1* | 2/2018 | Rehfuss | B67D 1/0078 |
| 2018/0059790 | A1 | 3/2018 | Kolar | |
| 2018/0072460 | A1* | 3/2018 | Wolfson | B65D 43/021 |
| 2018/0072553 | A1* | 3/2018 | Lyons | A47J 31/5253 |
| 2018/0099850 | A1 | 4/2018 | Lyons | |
| 2018/0129360 | A1* | 5/2018 | Suh | G07F 17/0064 |
| 2018/0129379 | A1* | 5/2018 | Suh | A47J 31/00 |
| 2018/0129380 | A1* | 5/2018 | Suh | C12C 13/10 |
| 2018/0132507 | A1* | 5/2018 | Siegel | A47J 31/40 |
| 2018/0168385 | A1* | 6/2018 | Boone | A47J 31/52 |
| 2018/0177325 | A1* | 6/2018 | Lyons | A47J 31/005 |
| 2018/0208447 | A1 | 7/2018 | Perrelli | |
| 2018/0344070 | A1 | 12/2018 | Perrelli | |
| 2019/0001288 | A1 | 1/2019 | Ciepiel | |
| 2019/0015803 | A1 | 1/2019 | Goodson | |
| 2019/0060849 | A1 | 2/2019 | Waggoner | |
| 2019/0185311 | A1* | 6/2019 | Karol | B67D 1/1247 |
| 2019/0208948 | A1 | 7/2019 | Perrelli | |
| 2020/0010257 | A1* | 1/2020 | Lubbe | B65D 51/28 |
| 2020/0031654 | A1* | 1/2020 | Wing | B67D 1/0878 |
| 2020/0031656 | A1* | 1/2020 | Rudick | G06F 3/04883 |
| 2020/0079637 | A1* | 3/2020 | Kaplita | B67D 1/0034 |
| 2020/0095108 | A1* | 3/2020 | Cook | B67D 1/0035 |
| 2020/0113374 | A1 | 4/2020 | Perrelli | |
| 2020/0115122 | A1* | 4/2020 | Golden | B65D 81/3211 |
| 2020/0122992 | A1 | 4/2020 | Lyons | |
| 2020/0156922 | A1* | 5/2020 | Lee | B67D 1/0882 |
| 2020/0165550 | A1* | 5/2020 | Lee | B67D 1/0425 |
| 2020/0181559 | A1* | 6/2020 | Kim | C12C 11/006 |
| 2020/0205615 | A1 | 7/2020 | Pamplin | |
| 2020/0247661 | A1* | 8/2020 | Rao | G06Q 20/20 |
| 2020/0242910 | A1 | 9/2020 | Laidlaw | |
| 2021/0007533 | A1 | 1/2021 | Lyons | |

FOREIGN PATENT DOCUMENTS

| | | |
|---|---|---|
| DE | 3428178 | 2/1986 |
| EP | 1793326 | 6/2007 |
| EP | 1671568 | 1/2008 |
| UA | 860987 | 2/1961 |
| WO | WO 2008/ 111072 | 9/2008 |
| WO | WO 2016/081387 | 5/2016 |
| WO | WO 2016201305 | 12/2016 |
| WO | WO 2017/085073 | 5/2017 |
| WO | WO 2020/077137 | 4/2020 |

* cited by examiner

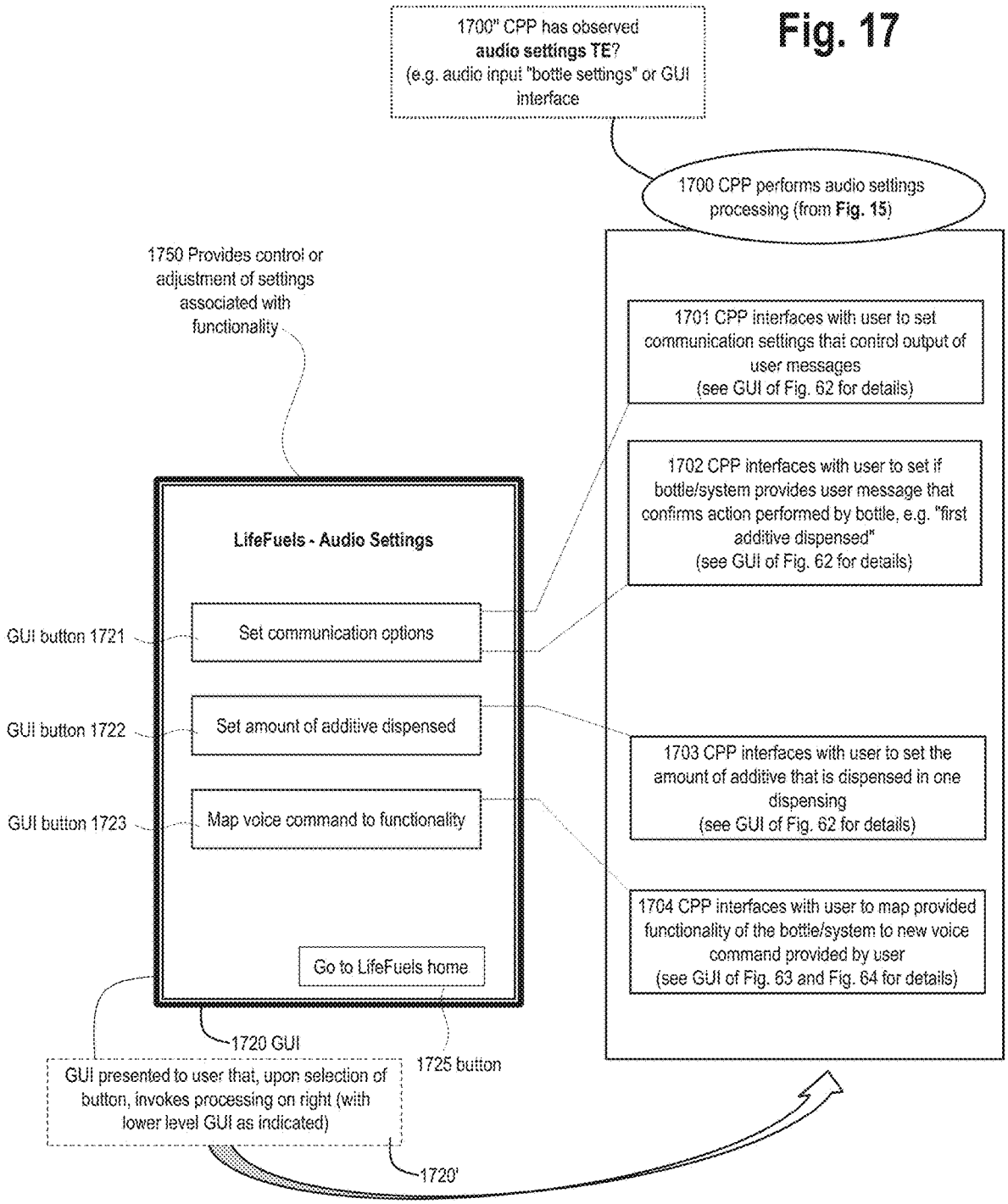
Fig. 17
1700" CPP has observed audio settings TE? (e.g. audio input "bottle settings" or GUI interface
1700 CPP performs audio settings processing (from Fig. 15)
1750 Provides control or adjustment of settings associated with functionality
1701 CPP interfaces with user to set communication settings that control output of user messages (see GUI of Fig. 62 for details)
1702 CPP interfaces with user to set if bottle/system provides user message that confirms action performed by bottle, e.g. "first additive dispensed" (see GUI of Fig. 62 for details)
LifeFuels - Audio Settings
GUI button 1721
Set communication options
GUI button 1722
Set amount of additive dispensed
GUI button 1723
Map voice command to functionality
Go to LifeFuels home
1703 CPP interfaces with user to set the amount of additive that is dispensed in one dispensing (see GUI of Fig. 62 for details)
1704 CPP interfaces with user to map provided functionality of the bottle/system to new voice command provided by user (see GUI of Fig. 63 and Fig. 64 for details)
1720 GUI
1725 button
GUI presented to user that, upon selection of button, invokes processing on right (with lower level GUI as indicated)
1720'

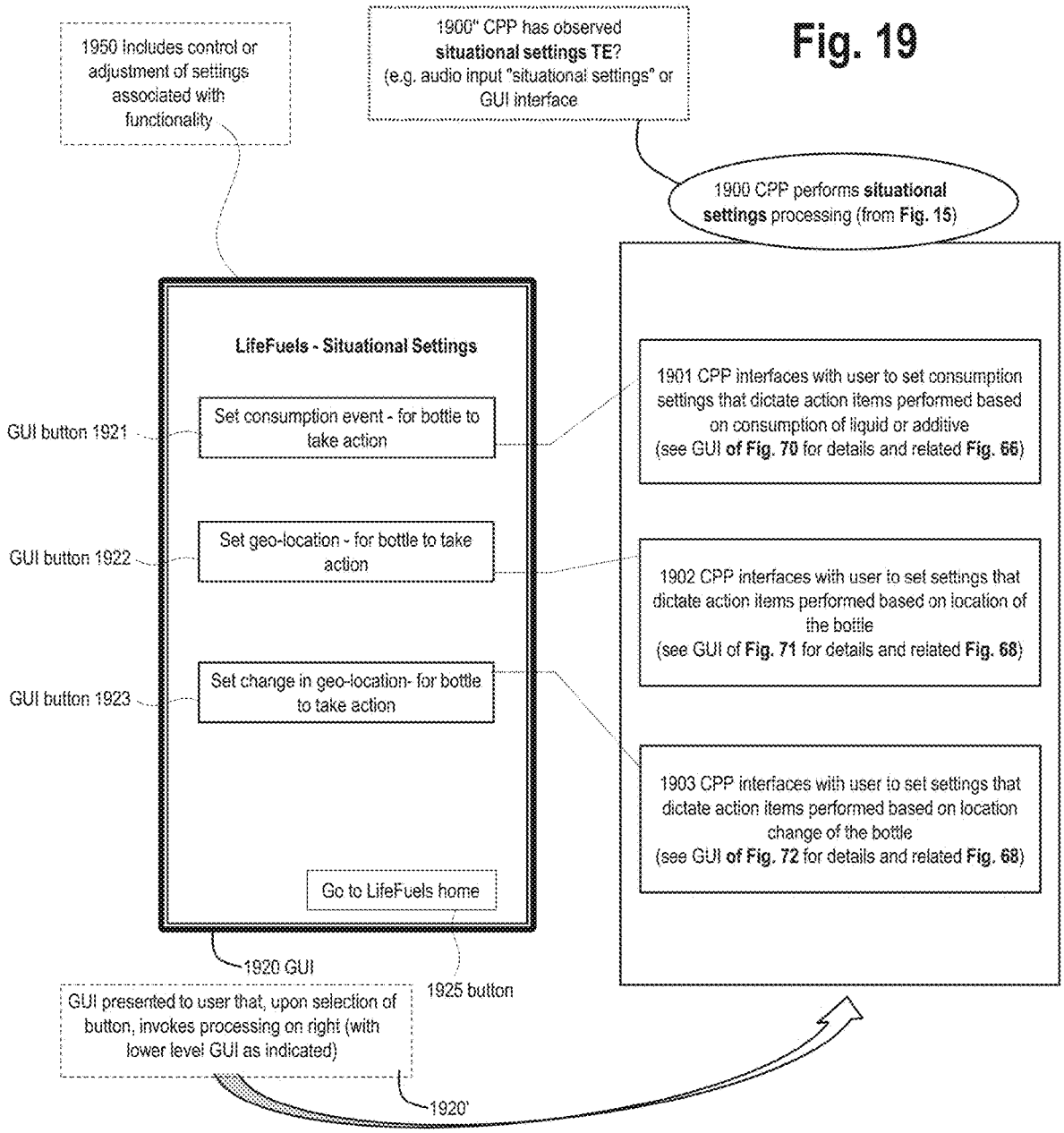
Fig. 19
1950 includes control or adjustment of settings associated with functionality
1900" CPP has observed situational settings TE? (e.g. audio input "situational settings" or GUI interface
1900 CPP performs situational settings processing (from Fig. 15)
LifeFuels - Situational Settings
GUI button 1921
Set consumption event - for bottle to take action
GUI button 1922
Set geo-location - for bottle to take action
GUI button 1923
Set change in geo-location- for bottle to take action
Go to LifeFuels home
1901 CPP interfaces with user to set consumption settings that dictate action items performed based on consumption of liquid or additive (see GUI of Fig. 70 for details and related Fig. 66)
1902 CPP interfaces with user to set settings that dictate action items performed based on location of the bottle (see GUI of Fig. 71 for details and related Fig. 68)
1903 CPP interfaces with user to set settings that dictate action items performed based on location change of the bottle (see GUI of Fig. 72 for details and related Fig. 68)
1920 GUI
1925 button
GUI presented to user that, upon selection of button, invokes processing on right (with lower level GUI as indicated)
1920'

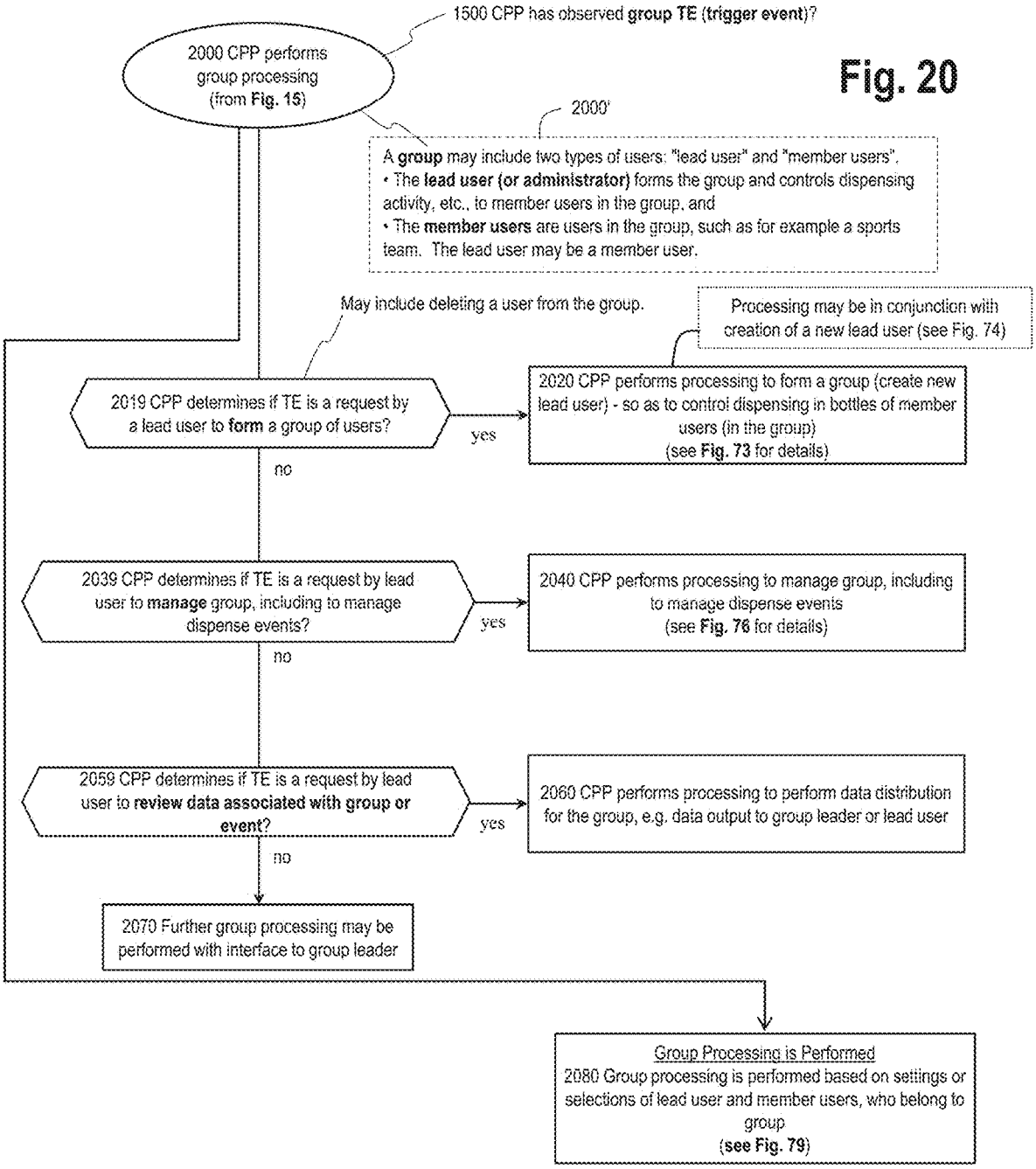
1500 CPP has observed group TE (trigger event)?
2000 CPP performs group processing (from Fig. 15)
Fig. 20
2000'
A group may include two types of users: "lead user" and "member users".
• The lead user (or administrator) forms the group and controls dispensing activity, etc., to member users in the group, and
• The member users are users in the group, such as for example a sports team. The lead user may be a member user.
May include deleting a user from the group.
Processing may be in conjunction with creation of a new lead user (see Fig. 74)
2019 CPP determines if TE is a request by a lead user to form a group of users?
yes
2020 CPP performs processing to form a group (create new lead user) - so as to control dispensing in bottles of member users (in the group) (see Fig. 73 for details)
no
2039 CPP determines if TE is a request by lead user to manage group, including to manage dispense events?
yes
2040 CPP performs processing to manage group, including to manage dispense events (see Fig. 76 for details)
no
2059 CPP determines if TE is a request by lead user to review data associated with group or event?
yes
2060 CPP performs processing to perform data distribution for the group, e.g. data output to group leader or lead user
no
2070 Further group processing may be performed with interface to group leader
Group Processing is Performed
2080 Group processing is performed based on settings or selections of lead user and member users, who belong to group (see Fig. 79)

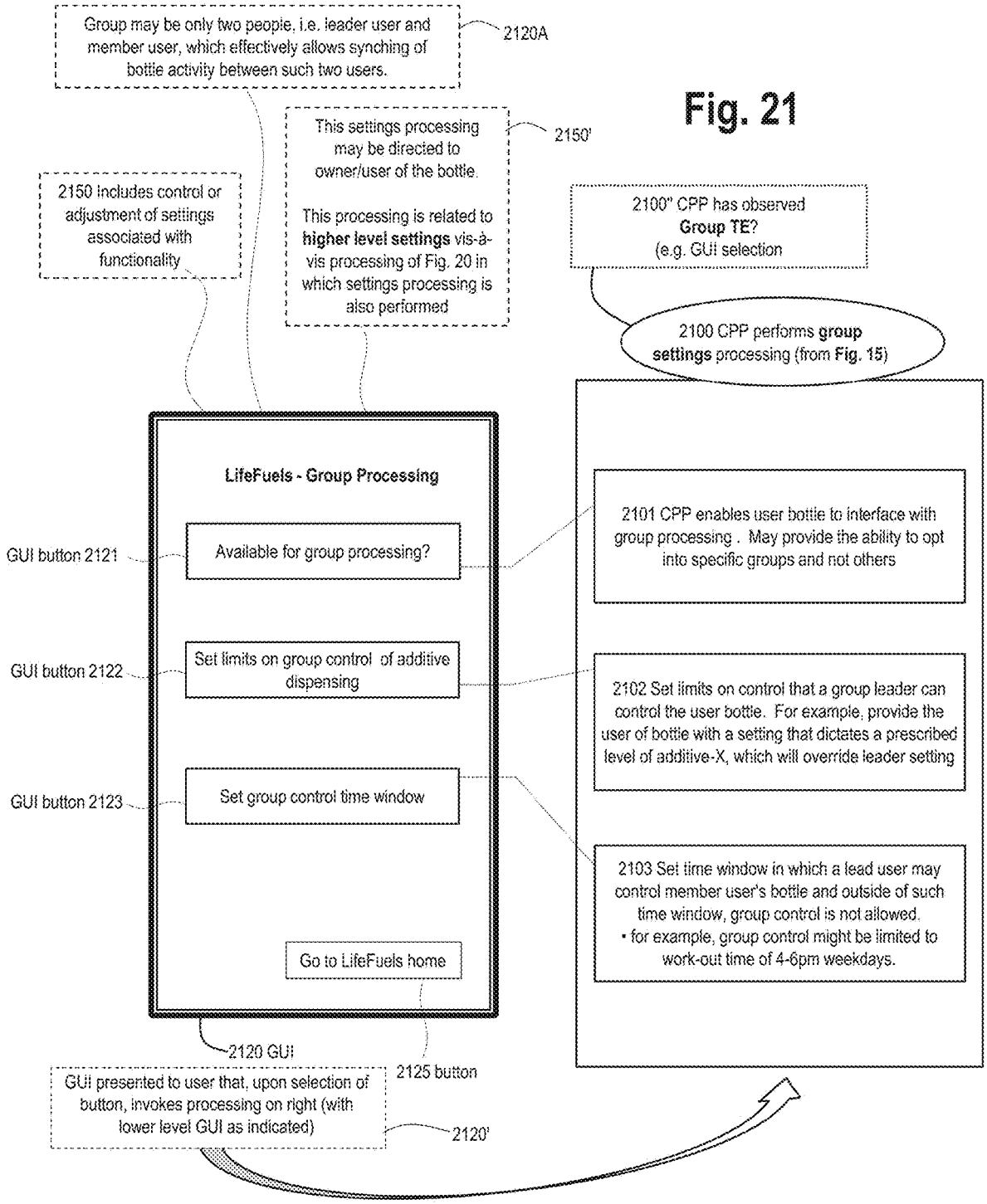
Group may be only two people, i.e. leader user and member user, which effectively allows synching of bottle activity between such two users.
2120A
Fig. 21
This settings processing may be directed to owner/user of the bottle.
This processing is related to higher level settings vis-à-vis processing of Fig. 20 in which settings processing is also performed
2150'
2150 includes control or adjustment of settings associated with functionality
2100" CPP has observed Group TE? (e.g. GUI selection
2100 CPP performs group settings processing (from Fig. 15)
LifeFuels - Group Processing
GUI button 2121
Available for group processing?
2101 CPP enables user bottle to interface with group processing . May provide the ability to opt into specific groups and not others
GUI button 2122
Set limits on group control of additive dispensing
2102 Set limits on control that a group leader can control the user bottle. For example, provide the user of bottle with a setting that dictates a prescribed level of additive-X, which will override leader setting
GUI button 2123
Set group control time window
2103 Set time window in which a lead user may control member user's bottle and outside of such time window, group control is not allowed.
• for example, group control might be limited to work-out time of 4-6pm weekdays.
Go to LifeFuels home
2120 GUI
2125 button
GUI presented to user that, upon selection of button, invokes processing on right (with lower level GUI as indicated)
2120'

Fig. 60

6000 Data records - audio trigger events (TEs)

| Audio trigger event | CPP | (Functionality ID) Functionality invoked | Related Attributes |
|---|---|---|---|
| bottle | 1410 | (1) CPP is woken up and prepares for further TE to be input | High level TE that alerts CPP that further input is expected from the user. |
| liquid consumed | 1420 | (2) CPP gathers data re amount of liquid consumed, and outputs audio message to user | Lower level TE that is mapped into a command for specific processing and gathering of data, with gathered information being output via audio output. |
| Additive A consumed | 1420 | (3) CPP gathers data re amount of additive A consumed, and outputs audio message to user | Lower level TE that is mapped into a command for specific processing and gathering of data, with gathered information being output via audio output. |
| Additive B consumed | 1420 | (4) CPP gathers data re amount of additive B consumed, and outputs audio message to user | Lower level TE that is mapped into a command for specific processing and gathering of data, with gathered information being output via audio output. |
| Add additive A | 1420 | (6) Adds a dispensed amount of additive A, and outputs audio message to user | Lower level TE that is mapped into a command for specific processing and gathering of data, with gathered information being output via audio output. |
| Add additive B | 1420 | (7) Adds a dispensed amount of additive B, and outputs audio message to user | Lower level TE that is mapped into a command for specific processing and gathering of data, with gathered information being output via audio output. |

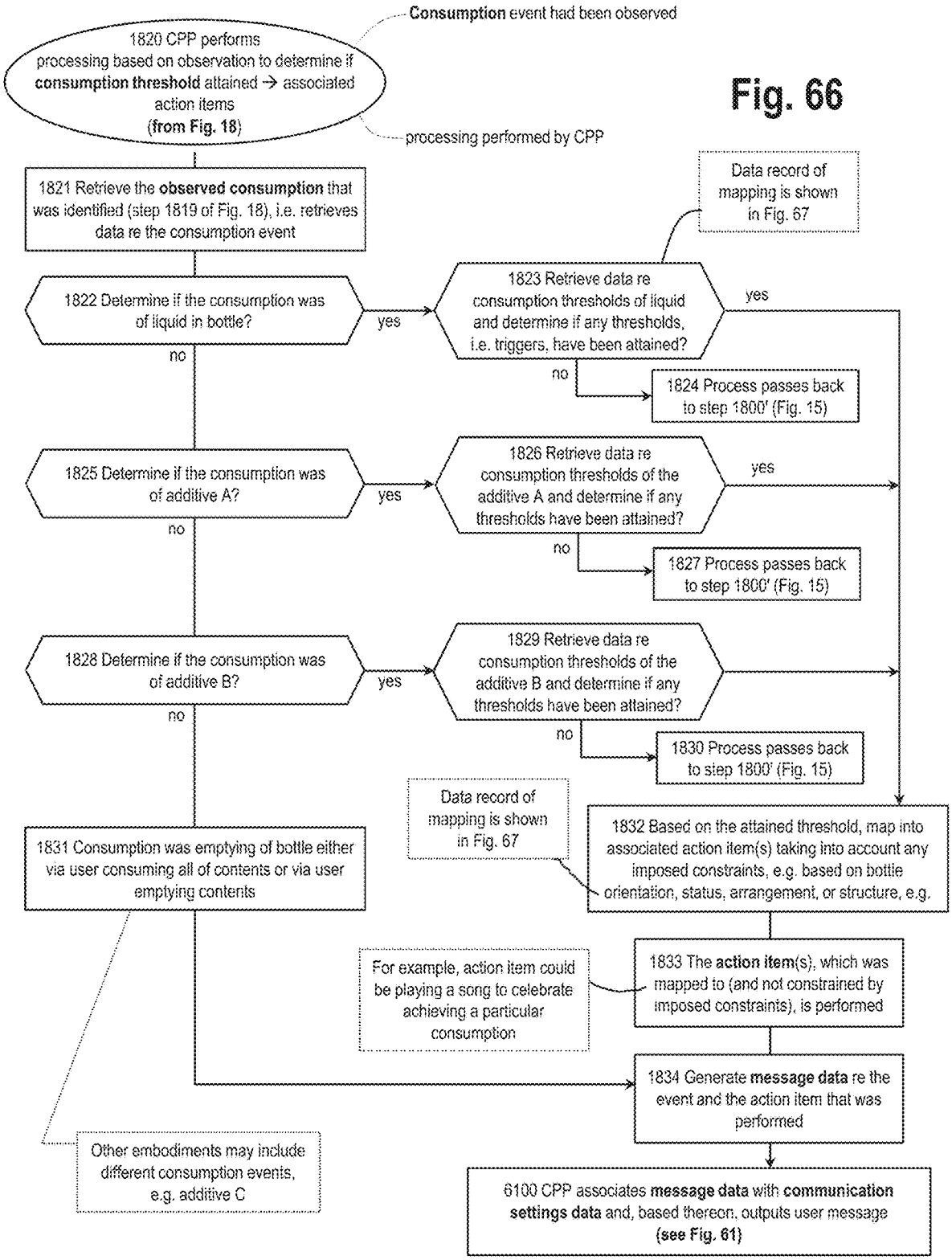
Consumption event had been observed
1820 CPP performs processing based on observation to determine if consumption threshold attained → associated action items (from Fig. 18)
processing performed by CPP
Fig. 66
1821 Retrieve the observed consumption that was identified (step 1819 of Fig. 18), i.e. retrieves data re the consumption event
Data record of mapping is shown in Fig. 67
1822 Determine if the consumption was of liquid in bottle?
yes
no
1823 Retrieve data re consumption thresholds of liquid and determine if any thresholds, i.e. triggers, have been attained?
yes
no
1824 Process passes back to step 1800' (Fig. 15)
1825 Determine if the consumption was of additive A?
yes
no
1826 Retrieve data re consumption thresholds of the additive A and determine if any thresholds have been attained?
yes
no
1827 Process passes back to step 1800' (Fig. 15)
1828 Determine if the consumption was of additive B?
yes
no
1829 Retrieve data re consumption thresholds of the additive B and determine if any thresholds have been attained?
no
1830 Process passes back to step 1800' (Fig. 15)
Data record of mapping is shown in Fig. 67
1832 Based on the attained threshold, map into associated action item(s) taking into account any imposed constraints, e.g. based on bottle orientation, status, arrangement, or structure, e.g.
1831 Consumption was emptying of bottle either via user consuming all of contents or via user emptying contents
For example, action item could be playing a song to celebrate achieving a particular consumption
1833 The action item(s), which was mapped to (and not constrained by imposed constraints), is performed
1834 Generate message data re the event and the action item that was performed
Other embodiments may include different consumption events, e.g. additive C
6100 CPP associates message data with communication settings data and, based thereon, outputs user message (see Fig. 61)

Fig. 67

6700A Data record of consumption thresholds

| Threshold Item | Threshold | Reset of count | Action Item | Constraint |
|---|---|---|---|---|
| Liquid consumed | 10 oz consumed | Sensed Refill of bottle, or upon message being sent | Output audio message to the user re amount consumed | Bottle is under motion (with user) |
| Additive A consumed | 2 oz consumed | New pod being inserted in bottle | Output audio message to the user re amount consumed | Bottle is under motion (with user) |
| Additive B consumed | 2 oz consumed | New pod being inserted in bottle | Output audio message to the user re amount consumed | Bottle is under motion (with user) |

6700B Data record of location thresholds

| Item type | Trigger | Reset upon: | Action Item |
|---|---|---|---|
| Predetermined area | Within 500 feet of 38.9N, 77.3W | Reset upon bottle is determined to be out of the trigger area | Check if Additive EnergyX is in bottle and dispense 2 ml of such additive, and output audio message to the user. (Could request confirmation from the user before the dispense.) |
| Distance traveled | 1 mile traveled in time window of 15 minutes to 25 minutes | Action item being performed | Check if Additive EnergyY is in bottle and dispense 2 ml of such additive, and output audio message to the user. (Could request confirmation from the user before the dispense.) |

6700 threshold records

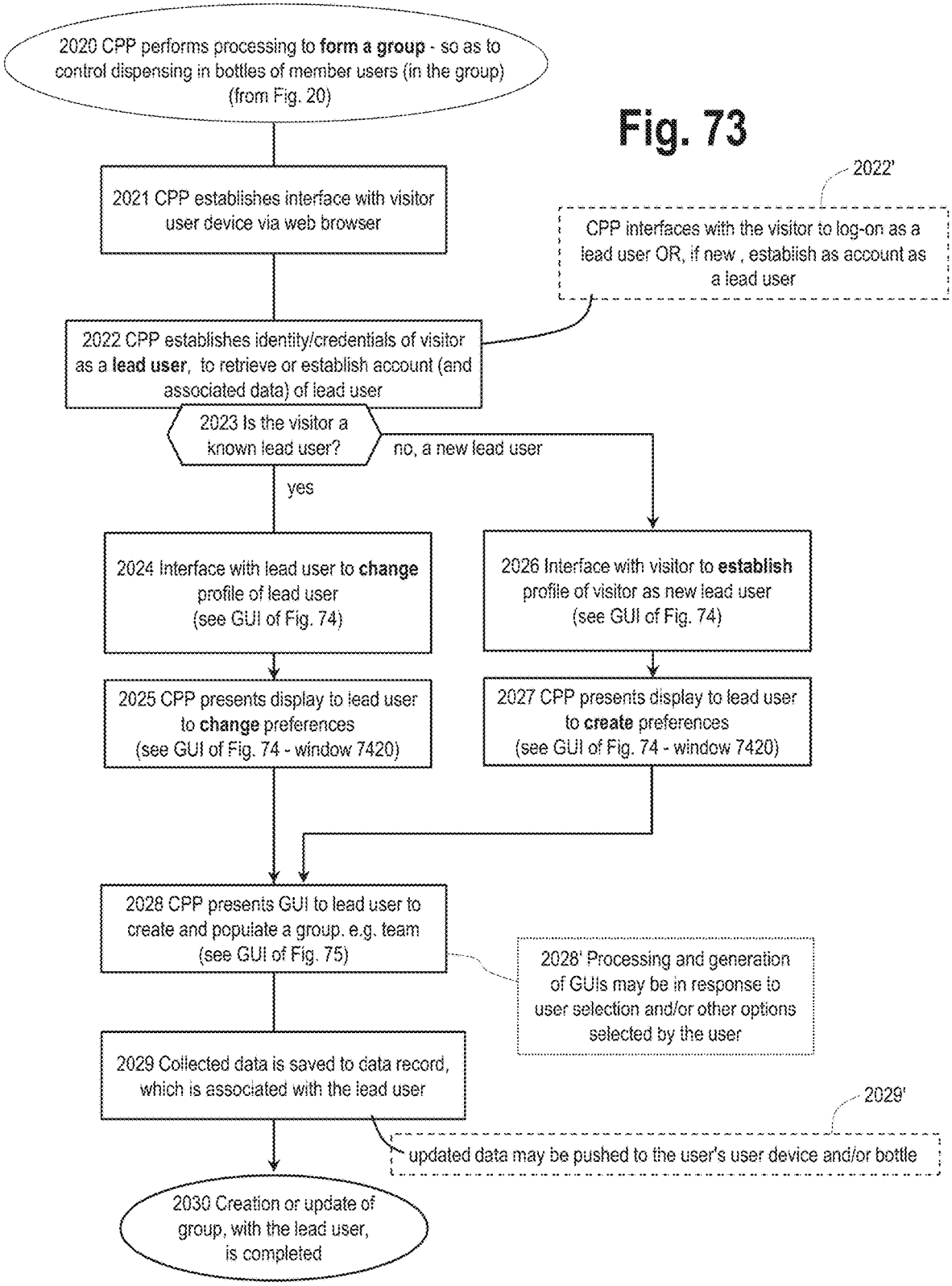
2020 CPP performs processing to form a group - so as to control dispensing in bottles of member users (in the group) (from Fig. 20)
Fig. 73
2021 CPP establishes interface with visitor user device via web browser
2022'
CPP interfaces with the visitor to log-on as a lead user OR, if new , establish as account as a lead user
2022 CPP establishes identity/credentials of visitor as a lead user, to retrieve or establish account (and associated data) of lead user
2023 Is the visitor a known lead user?
no, a new lead user
yes
2024 Interface with lead user to change profile of lead user (see GUI of Fig. 74)
2026 Interface with visitor to establish profile of visitor as new lead user (see GUI of Fig. 74)
2025 CPP presents display to lead user to change preferences (see GUI of Fig. 74 - window 7420)
2027 CPP presents display to lead user to create preferences (see GUI of Fig. 74 - window 7420)
2028 CPP presents GUI to lead user to create and populate a group, e.g. team (see GUI of Fig. 75)
2028' Processing and generation of GUIs may be in response to user selection and/or other options selected by the user
2029 Collected data is saved to data record, which is associated with the lead user
2029'
updated data may be pushed to the user's user device and/or bottle
2030 Creation or update of group, with the lead user, is completed

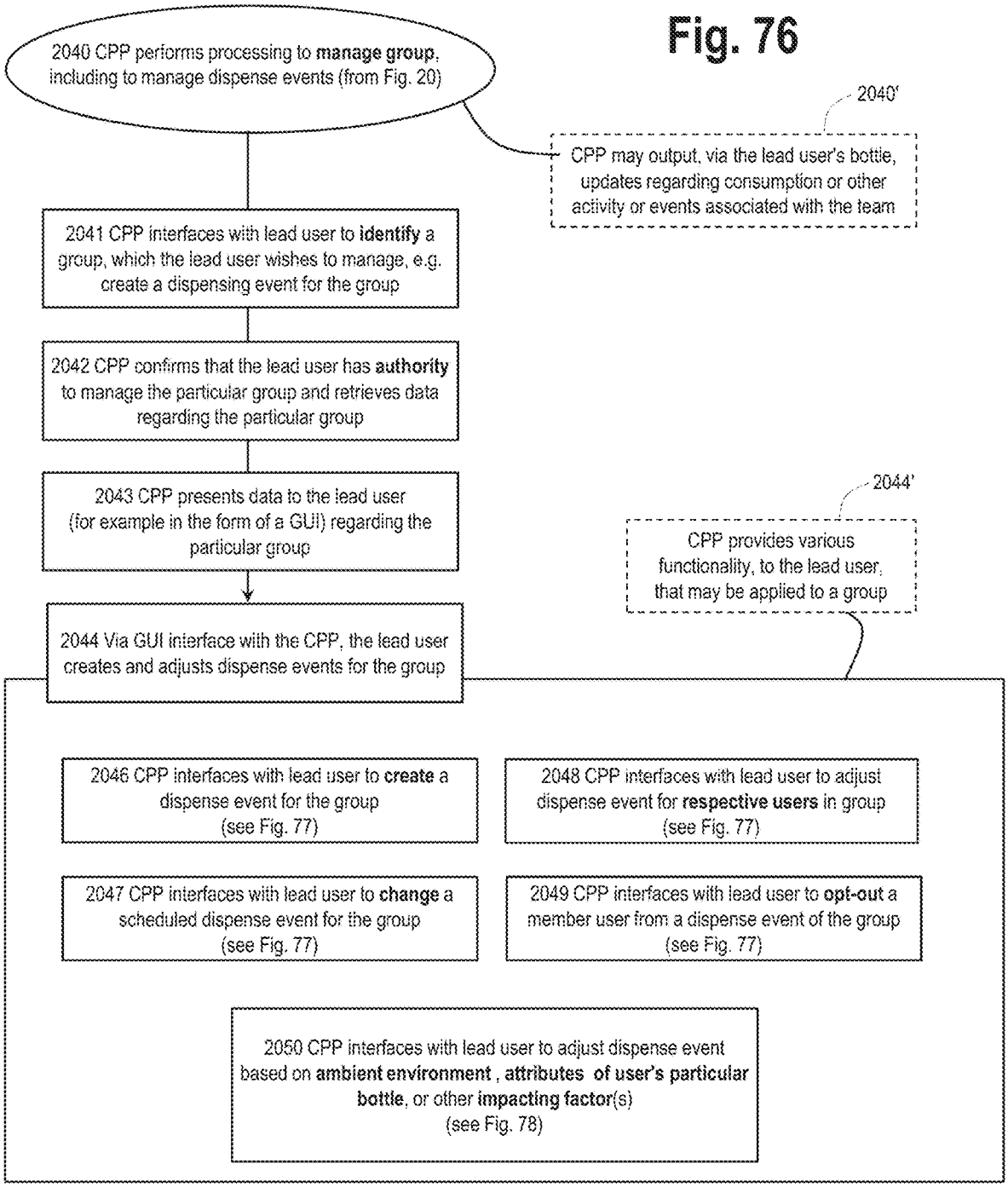
Fig. 76
2040 CPP performs processing to manage group, including to manage dispense events (from Fig. 20)
2040'
CPP may output, via the lead user's bottle, updates regarding consumption or other activity or events associated with the team
2041 CPP interfaces with lead user to identify a group, which the lead user wishes to manage, e.g. create a dispensing event for the group
2042 CPP confirms that the lead user has authority to manage the particular group and retrieves data regarding the particular group
2043 CPP presents data to the lead user (for example in the form of a GUI) regarding the particular group
2044'
CPP provides various functionality, to the lead user, that may be applied to a group
2044 Via GUI interface with the CPP, the lead user creates and adjusts dispense events for the group
2046 CPP interfaces with lead user to create a dispense event for the group (see Fig. 77)
2048 CPP interfaces with lead user to adjust dispense event for respective users in group (see Fig. 77)
2047 CPP interfaces with lead user to change a scheduled dispense event for the group (see Fig. 77)
2049 CPP interfaces with lead user to opt-out a member user from a dispense event of the group (see Fig. 77)
2050 CPP interfaces with lead user to adjust dispense event based on ambient environment , attributes of user's particular bottle, or other impacting factor(s) (see Fig. 78)

PORTABLE SYSTEM FOR DISPENSING CONTROLLED QUANTITIES OF ADDITIVES INTO A BEVERAGE

RELATED APPLICATIONS

This application claims priority to U.S. Provisional Patent Application 62/682,779 filed Jun. 8, 2018, the content of which is incorporated herein by reference in its entirety.

The subject matter of this application is related to U.S. application Ser. No. 15/694,659, filed Sep. 1, 2017 (U.S. Publication 2018/0099850), the entire disclosure of which is hereby incorporated by reference.

This application is related to U.S. application Ser. No. 15/179,709, filed Jun. 10, 2016 (U.S. Publication 2017/0156540 and now U.S. Pat. No. 10,231,567), the entire disclosure of which is hereby incorporated by reference.

This application is related to U.S. application Ser. No. 15/862,206, filed Jan. 4, 2018 (U.S. Publication 2018/0177325), the entire disclosure of which is hereby incorporated by reference.

This application is related to U.S. Provisional Patent Application Ser. No. 62/442,039, filed Jan. 4, 2017, the entire disclosure of which is hereby incorporated by reference.

The subject matter of this application is related to U.S. application Ser. No. 14/960,109, filed Dec. 4, 2015 and published Jun. 9, 2016 (U.S. Publication 2016/0159632 and now U.S. Pat. No. 9,932,217), which claims priority to U.S. Provisional Patent Application Ser. No. 62/174,935, filed Jun. 12, 2015; U.S. Provisional Patent Application Ser. No. 62/174,466, filed Jun. 11, 2015; U.S. Provisional Patent Application Ser. No. 62/174,415, filed Jun. 11, 2015; and U.S. Provisional Patent Application Ser. No. 62/088,189, filed Dec. 5, 2014, the entire disclosures of which are hereby incorporated by reference. The subject matter of this application is also related to International Application Ser. No. PCT/US2015/063974, filed Dec. 4, 2015 and published Jun. 9, 2016, the entire disclosure of which is hereby incorporated by reference.

The subject matter of this application is related to U.S. application Ser. No. 15/179,709, filed Jun. 10, 2016, which claims priority to U.S. Provisional Patent Application Ser. No. 62/174,935, filed Jun. 12, 2015; U.S. Provisional Patent Application Ser. No. 62/174,466, filed Jun. 11, 2015; U.S. Provisional Patent Application Ser. No. 62/174,459, filed Jun. 11, 2015; U.S. Provisional Patent Application Ser. No. 62/174,453, filed Jun. 11, 2015; U.S. Provisional Patent Application Ser. No. 62/174,447, filed Jun. 11, 2015; U.S. Provisional Patent Application Ser. No. 62/174,427, filed Jun. 11, 2015; U.S. Provisional Patent Application Ser. No. 62/174,415, filed Jun. 11, 2015; U.S. Provisional Patent Application Ser. No. 62/174,343, filed Jun. 11, 2015; U.S. Provisional Patent Application Ser. No. 62/174,336, filed Jun. 11, 2015; U.S. Provisional Patent Application Ser. No. 62/174,254, filed Jun. 11, 2015; and U.S. Provisional Patent Application Ser. No. 62/174,440, filed Jun. 11, 2015, the entire disclosures of which are hereby incorporated by reference.

The subject matter of this application is also related to International Application Ser. No. PCT/US2016/036992, filed Jun. 10, 2016 and published Dec. 15, 2016, the entire disclosure of which is hereby incorporated by reference.

BACKGROUND

Portable refillable bottles and other containers used for water and other beverages are widely used and are important for health and hydration. Such bottles and containers are used with increasing frequency to consume functional ingredients, such as, for example, energy, protein, and sleep supplements. However, one limitation of such bottles and hydration containers is that the consumable contents remain constant and unchanged except for changes in quantity as the contents (frequently, but not exclusively water) are consumed and subsequently replenished.

Furthermore, vitamins, health, and dietary supplements in the form of liquids, powders, gels, and solid tablets are becoming increasingly popular and widely consumed. Such supplements and additives are frequently being bought in bulk by consumers since they are using and consuming such supplements and additives on a frequent and long term basis. In addition, such nutritional supplements are frequently dissolved in water for consumption, with different supplements consumed at intervals, several times throughout the day.

However, known portable refillable bottles and other containers have shortcomings.

SUMMARY

This Summary introduces a selection of concepts in a simplified form in order to provide a basic understanding of some aspects of the present disclosure. This Summary is not an extensive overview of the disclosure, and is not intended to identify key or critical elements of the disclosure or to delineate the scope of the disclosure. This Summary merely presents some of the concepts of the disclosure as a prelude to the Detailed Description provided below.

The present disclosure generally relates to hydration systems, methods, and apparatuses. More specifically, aspects of the present disclosure relate to a portable and non-portable hydration container that periodically fully or partially dispenses additives into a liquid consumable or other solute within the container in continuously variable volumes or concentrations, with contextual variables informing type, volume, timing, and the like of the dispensing action.

One embodiment of the present disclosure relates to a portable, self-contained beverage apparatus comprising: a container assembly having a known storage capacity for storing a consumable liquid; a dispensing assembly disposed within the container assembly that dispenses variable, non-zero quantities of additives into the consumable liquid stored in the container assembly, where the dispensing assembly includes a plurality of apertures structured and arranged to retain vessels containing the additives to be dispensed into the consumable liquid.

In at least one embodiment, the portable, self-contained beverage apparatus further includes a controller that controls the dispensing by the dispensing assembly of the variable, non-zero quantities of the additives into the consumable liquid stored in the container assembly.

In at least one embodiment, the controller of the portable, self-contained beverage apparatus controls the dispensing by the dispensing assembly to maintain the targeted concentration of at least one of the additives in the consumable liquid stored in the container assembly, wherein the controlling is based on tracked consumable liquid level and the quantity of the at least one additive.

In at least one embodiment, the portable, self-contained beverage apparatus further includes the vessels retained in the plurality of apertures that contain the additives to be dispensed into the consumable liquid stored in the container assembly.

Also provided herein are methods for obtaining data about the contents of the additive vessels inserted or received in the portable container. Aspects of the present disclosure also relate to methods, systems, and apparatuses for the accurate control of the selection of an additive vessel and accurate control of the amount of additive dispensed therefrom, for example, when there are a number of separate additive vessels available and accessible within the container. Further aspects of the disclosure relate to a system enabling a monitoring person, such as, for example, a sports coach or medical professional, to dynamically adjust a dispensing schedule based on feedback data received from a group of the containers (e.g., used in a context or setting where multiple individuals are involved in a common activity or share similar circumstances).

As described above, one of existing portable bottles and other containers is that the consumable contents contained in such bottles and containers remain essentially unchanged other than in their quantity. The utility of such bottles and containers may be greatly enhanced if the flavor, consistency, and/or the nutritional, chemical or other make-up of the consumable liquid could be altered over some period of time (e.g., hourly, daily, etc.) and/or according to some other cycle based on, for example, the needs or desires of the user, in order to optimize the health and well-being of the user. For example, the consumable liquid may be enhanced with an energy boosting supplement in the morning to facilitate alertness and focus, with vitamin supplements throughout the day, and with a calming nutritional supplement at the end of the day to facilitate quality sleep. Such a daily cycle may be supplemented by an additional longer term cycle of additives dispensed on a weekly, bi-weekly, etc., basis or some other customized time-cycle. As well as nutritional supplements, it may additionally be desirable to dispense other types of substances or additives such as, for example, vitamins, flavorings, pharmaceuticals, and the like, into the contents of portable containers in order to further optimize the health, hydration, recovery, and other benefits to a user, athlete, or patient, for example.

Furthermore, mobile and wearable activity and fitness monitoring devices, as well as remote applications, may communicate with and/or receive data provided from portable bottles and other containers to control and monitor liquid and/or additive consumption and to perform other functions such as, for example, communicating a timely signal to portable and other containers to release all or a pre-defined amount of an additive substance from one of the additive vessels into the consumable contents of the container. Furthermore, such data might modify the dispensing protocol of the additive vessels. Data might function to recommend or otherwise incentivize the discovery, purchase, and and/or consumption of the aforementioned additive vessels.

Since portable hydration containers may typically be filled in the morning and topped-off throughout the day as liquid is consumed, it is neither practical nor desirable to require that a user fill multiple compartments of a container with multiple different consumable liquids or mixtures for consumption throughout the course of the day. Therefore, a more practical and desirable solution is to sequentially dispense a selection, sequence or combination of different additives from one or more additive vessels into a consumable liquid at the appropriate time in response to a signal from a mobile or wearable device, processor or application. Neither is it desirable that a user have to carry around separate additive vessels and insert them into the hydration container when needed at various times throughout the day. An illustrative example of such an additive delivery ecosystem is shown in FIG. 1.

A hydration system such as that illustrated in FIG. 1 provides electrical, electromechanical, and electronic components to enable a number of functions. For example, measuring, monitoring or identifying the amount of liquid in the container at any point in time, determining when the container has been refilled and/or measuring the rate of consumption of the liquid consumable are desirable functions of such a system and require sensing, processing, communication technology and electronic components which may have to be in close proximity to the liquid or other substance within the container in order to monitor the quantity or level. The proximity and/or placement of the aforementioned systems and/or devices is sensitive, in many cases, regardless of whether or not the system directly, indirectly, or inferentially obtains such information. Similarly, electro-mechanical components and/or actuators may be required to dispense an additive into the contents of the container.

To achieve desired consumption temperatures, or to maintain a desired consumption temperature, it may be desirable to refrigerate the liquid container, in which case repeated and sustained exposure to low temperatures and humidity would be harmful to the electronic components. Though it may be desirable that these electronics components and sensors be in close proximity to the liquid container for functional reasons, it is also desirable that they be fully separable to enable thorough cooling of the liquid container, as well as washing.

One or more embodiments of the present disclosure relates to a consumable container having a dispensing module assembly with a number of apertures into which the above described additive vessels can be inserted by a user. Each of these additive vessels can have a passive RFID tag attached to the vessel. An RFID antenna is mounted on the surface of a dispensing module located on the central axis of the consumable container and accesses data about the contents of the additive vessel from the RFID tag. Therefore, the methods, systems, and apparatuses of the disclosure are also designed to access data about the contents of an individual additive vessel. In accordance with at least one embodiment, the antenna and/or other read and/or write capable data modality is oriented in such a way so as to necessitate only one system, as opposed to a static modality that might require a unique instance of the modality on each unique aperture. One having ordinary skill in the art will recognize that although a passive data system such as RFID may be ideal due to its passive nature, read/write capability, and low-cost, that functionally, other methods could accomplish similar results, including but not limited to physical key-based methods, or optical methods.

Another feature of the disclosure is to determine the geo-location of the user and determine whether the dispensing of additives should be adjusted based on some aspect or aspects of this location (e.g., home, gym, office, etc.). One learned in the art will understand that such data, working to inform or otherwise guide a dispensing system, could be directly extrapolated or indirectly inferred.

Another feature is to determine the speed of motion of the user and determine whether the dispensing of additives should be adjusted based on this activity (e.g. walking, cycling, running) This data might further operate to corroborate supporting data feeds, such as those provided by wearable activity trackers and the like.

Another feature is to combine the user's location and the user's speed of motion to predict whether a user is indoors or outdoors and, if outdoors, to access weather, temperature and humidity data and adjust the dispensing of additives according to the needs of those environmental conditions. Such contextual data associated with ambient conditions relevant to dispensing events and/or additive recommendations or purchase does not necessarily need to relate to the user's physical movements however.

In one or more embodiments of the present disclosure, the consumable liquid container may include an array of independently controllable (e.g., by a processor of the container), addressable LEDs, whereby the state (e.g., on/off) of the LEDs can be controlled, and the brightness, color output, flash frequency, and other parameters can be varied in order to communicate information to the user. For example, the LEDs may be controlled to display a pattern and/or temporal sequence of colors which communicates information to a viewer. In another example, the LEDs may be controlled to flash the illuminants with a range of frequencies to communicate information to a viewer. Such an implementation may function primarily as a symbolic user interface. In one example, it might initiate an LED behavior to remind the user to hydrate. In another example, it might initiate another LED behavior to confirm an action. As will be described in greater detail below, the methods, systems, and apparatus of the present disclosure are also designed to present information to a user regarding the additives consumed and/or remaining in the vessels inserted in the hydration container. For example, in accordance with one or more embodiments, the portable container may display (e.g., on a user interface screen of the container) information or generate an alert to the user when one or more of the additive vessels inserted in the hydration container is, or will soon become empty. In another example, the container may be configured to predict a future date when one or more of the additive vessels inserted in the hydration container will become empty. Such a feature serves to recommend and/or automate future purchases. Such a system might also function to adjust or otherwise modify dispensing protocol to ensure that the additive does not become depleted on or before a targeted time.

In accordance with one or more embodiments, the methods, systems, and apparatus described herein may optionally include or be capable/configured to perform one or more of the following: correlate depletion information of additive vessels with purchase history and previous rate of consumption to ascertain when a user will run out of supplies of the additive vessel irrespective of whether they are currently inserted in the container; enable the user to order replacement additive vessels by adding to their shopping cart on an eCommerce site through some type of user action (e.g., pressing a button on the container, interacting with an associated application, etc.).

In accordance with at least one embodiment, the methods, systems, and apparatuses may be designed to provide for direct or indirect communication of an instruction from a central control application to a consumable container. Such a direct or indirect communication may be, for example, an instruction to dispense an additive, may include a dispensing schedule and/or protocol, or may indicate that an additive (e.g., medication, pharmaceutical, or the like) has, or has not, been dispensed by the dispensing apparatus within the container. Data associated with the dispensing event (or lack thereof) might also be collected and communicated directly or indirectly between the dispensing device and the aforementioned central control application. In accordance with at least one embodiment, Bluetooth low energy may be used as the primary transmission method of such data.

In accordance with one or more embodiments, data may be communicated from a container that an additive (e.g., medication, pharmaceutical, or other additive) has, or has not, been added to the consumable contents of the container; data may be communicated from a container that the consumable contents of the container have been fully consumed, partially consumed, or not consumed. Direct or indirect mechanisms might further corroborate or invalidate such information directly or inferentially (e.g. the user has dumped the contents, as opposed to properly consuming them).

Also provided are a method and apparatus for the precise and continuously variable dispensing of a removable additive vessel through the use of a discretely adjustable piston or actuator, the key adjustment variable being stroke length (and therefore displacement volume) by the user, which then by the user's input (in the preferred disclosure's use case, the user's finger) translates into a dispensing event that is precise and repeatable. Passive electronics measuring which additive vessel, and what dispensing quantity, and how many dispensing events are initiated could log the user's consumption activity and behaviors.

Embodiments of some or all of the methods disclosed herein may be represented as instructions embodied on transitory or non-transitory processor-readable storage media such as optical or magnetic memory or represented as a propagated signal provided to a processor or data processing device via a communication network such as, for example, an Internet or telephone connection.

Another feature of the methods, systems, and apparatuses described herein relates to audio engagement processing. Another feature of the methods, systems, and apparatuses described herein relates to situational processing. Another feature of the methods, systems, and apparatuses described herein relates to group engagement processing. Further scope of applicability of the systems, apparatuses, and methods of the present disclosure will become apparent from the Detailed Description given below. However, it should be understood that the Detailed Description and specific examples, while indicating embodiments of the systems, apparatuses, and methods, are given by way of illustration only, since various changes and modifications within the spirit and scope of the concepts disclosed herein will become apparent to those skilled in the art from this disclosure.

BRIEF DESCRIPTION OF THE DRAWINGS

These and other objects, features, advantages, and characteristics of the present disclosure will become more apparent to those skilled in the art upon consideration of the following Detailed Description, taken in conjunction with the accompanying claims and drawings, all of which form a part of the present disclosure. In the drawings:

FIG. 17 shows a GUI 1720 that includes various GUI buttons in accordance with one or more embodiments.

FIG. 19 shows a GUI 1920 that includes various GUI buttons in accord with at least one embodiment.

FIG. 20 is a flowchart showing in further detail the processor performs group processing step 2000 of FIG. 15 in accordance with one or more embodiments.

FIG. 21 shows a GUI 2120 that includes various GUI buttons in accord with embodiments.

FIG. 60 is a table showing a data record 6000 that includes audio trigger events in accordance with one or more embodiments.

FIG. 66 is a flowchart showing in further detail processor performs processing based on observation to determine if consumption threshold has been attained, and based on such observation, performs a mapping to an associated action item step 1820 of FIG. 18 in accordance with one or more embodiments.

FIG. 67 shows data records of thresholds in accordance with one or more embodiments.

FIG. 73 is a flowchart showing in further detail the CPP performs processing to form a group—so as to control dispensing in bottles of member users step 2020 of FIG. 20 in accordance with one or more embodiments.

FIG. 76 is a flowchart showing in further detail the processor performs processing to manage a group, including to manage dispensed events step 2040 of FIG. 20 in accordance with one or more embodiments.

Figure 1:
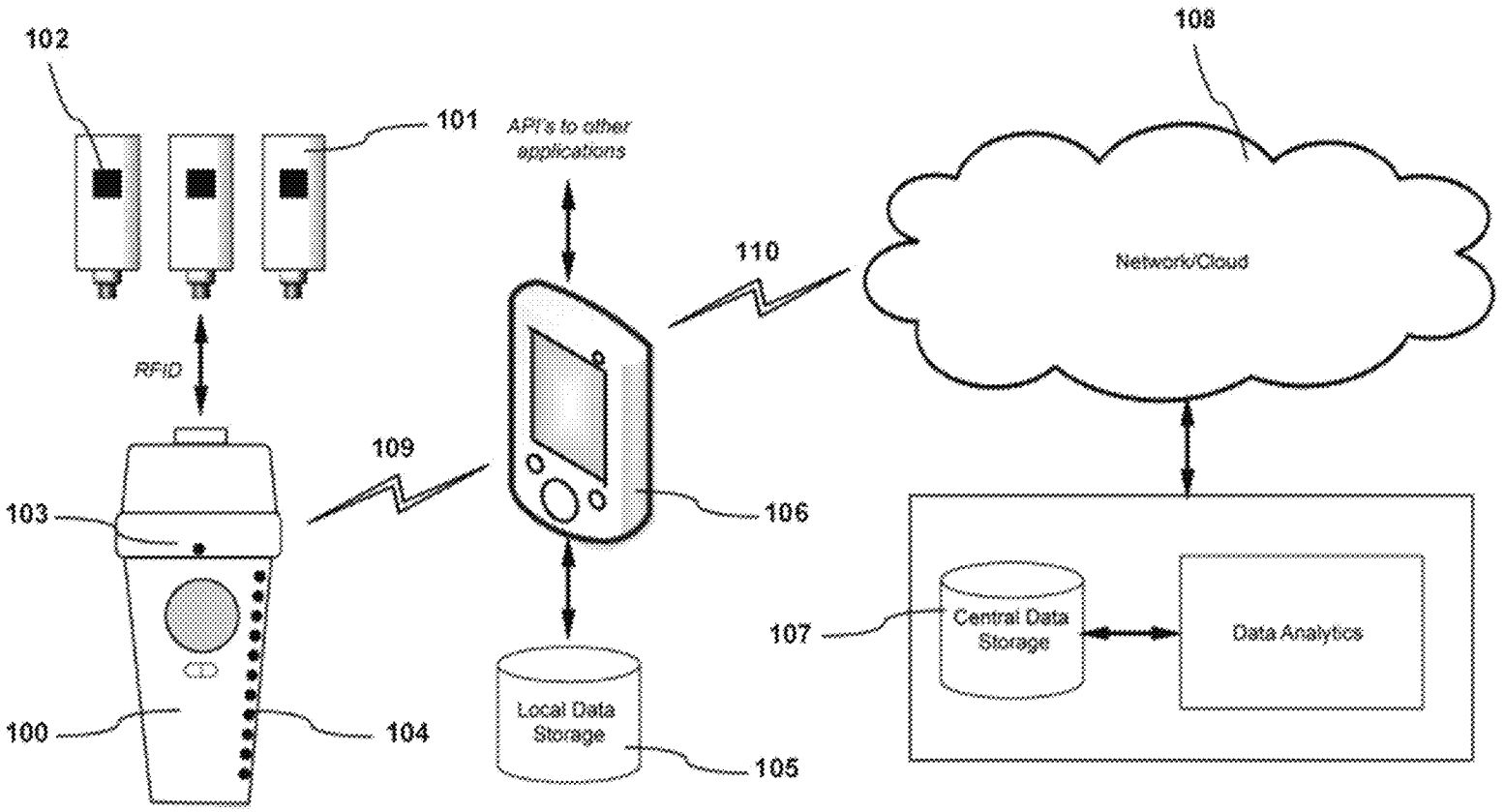
FIG. 1 is a block diagram illustrating an example high-level hydration ecosystem according to one or more embodiments described herein.

The headings provided herein are for convenience only and do not necessarily affect the scope or meaning of what is claimed in the present disclosure.

In the drawings, same reference numerals and acronyms have been used to identify same or similar structure, components or functionality for ease of understanding and convenience.

DETAILED DESCRIPTION

In the following description, references are made to various embodiments in accordance with which the disclosed subject matter can be practiced. Multiple references to "one embodiment" or "an embodiment" do not necessarily refer to the same embodiment. Particular features, structures or characteristics associated with such embodiments can be combined in any suitable manner in various embodiments. Various examples and embodiments will now be described. The following description provides specific details for a thorough understanding and enabling description of these examples. One skilled in the relevant art will understand, however, that one or more embodiments described herein may be practiced without many of these details. Likewise, one skilled in the relevant art will also understand that one or more embodiments of the present disclosure can include many other obvious features not described in detail herein. Additionally, some well-known structures or functions may not be shown or described in detail below, so as to avoid unnecessarily obscuring the relevant description.

In view of the above, it is therefore desirable for a portable hydration container or bottle to have included within it, a number of separate vessels containing various additives that may be chosen and inserted within the hydration container by the user in various different combinations, such that some of the beverages, functional beverages, vitamins, pharmaceuticals, etc., may be periodically dispensed into the liquid contents of the container when required or desired, and consumed by the user.

Such a hydration apparatus or system may communicate with an application (e.g., mobile telephone application, computer program, etc.) that controls and monitors the additive dispensing from the vessels, and adjusts or otherwise modifies the dispensing of those additives according to real-time environmental and contextual variables. Hydration systems and containers such as those described herein also need to be periodically washed or sterilized in order to maintain hygiene levels and to avoid or eliminate cross-contamination between different additives. Furthermore, when a container assembly includes sensitive electronics, it is also beneficial to design the apparatus in such a way that washing, cleaning, or sterilization, or cooling, can be carried out without undue risk of damage to the electronic components. An amount of consumable within a portable hydration container of the disclosure will vary over time as it is consumed. As such, the methods, systems, and apparatus of the present disclosure are capable of varying and/or adjusting the amount of additive to be dispensed into the consumable in order to achieve or maintain a targeted (e.g., optimal) or desired level of concentration of the additive (or additives) in the consumable. In addition, the consumption behaviors of the user related to hydration and the consumption of additives and the like would benefit from tracking and level measurement to provide apparatus-level context for non-zero dispensing, but also for the overall tracking and recommendation of additives and/or additive vessels, present and future.

Furthermore, since such hydration containers are portable and may be carried around to many different places, it would also be beneficial to a user if they could periodically re-order products from an online (e.g., eCommerce, and/or Mobile Application) website, and replenish their supplies of additives, vitamins, etc., directly from the container in which they are used, or from an associated mobile device, at any time and irrespective of the user's location. In addition, while hydration containers such as those described herein are of considerable value to an individual user, a collection of such containers may also be used by a group of users with common interests, such as, for example, a sports team, patients in a medical facility or assisted-living home, participants in clinical trials of a drug, and the like. In such instances it may be of considerable additional value to control, monitor, or otherwise coordinate the dispensing of additives both individually and/or collectively, and/or to monitor the consumption of consumables and additives individually and/or collectively. The following description of examples and embodiments of the methods, systems, and apparatus of the present disclosure provides additional details about many of the above features and functions.

FIG. 1 shows an illustrative block diagram of an overall ecosystem within which one or more embodiments of the present disclosure has application and/or may be implemented. FIG. 1 includes a container 100, generally but not necessarily portable, that may contain a consumable (e.g., a liquid) into which liquid, powder, and/or other forms of consumable additives may be dispensed from one or more separate removable additive vessels 101. Data about the additives within each vessel 101 may be encoded within an RFID or similar active or passive type tag 102 mounted on or otherwise attached to the additive vessel 101. Such data about the additives contained within the vessels 101 can be read from the RFID or similar type tag 102 by, for example, an RFID or similar-type antenna that is a component of the container 100. For example, in accordance with at least one embodiment, the container 100 may include an RFID antenna (not shown) that rotates around a central axis of the container 100 to individually and/or sequentially read data from additive vessels 101 inserted in a circular arrangement around the central axis of the hydration container. In this manner, data about the additives contained in the additive vessels 101 may be collected, analyzed, and/or communicated by the container 100 (e.g., by a processor and/or other components of the container 100), and made available to one or more user devices 106, local storage 105, remote network storage 107 and the like. Such information may also be presented to the user using a display 111 mounted on the container and/or using a display on the user's mobile device 106. Furthermore, in accordance with one or more embodiments, an infrared LED emitter/receiver implementation 103 and an array of infrared LED receivers 104 may be mounted within or adjacent to the chamber within which a consumable liquid may be stored (e.g., contained). The emitter/receiver 103 and the infrared receivers 104 may be configured to determine the level, volume, or quantity (e.g., the amount) of liquid consumable in the container 100 at any given time. As such, data about the consumable liquid in the chamber of the container 100 may be collected, analyzed, and/or communicated by the container 100 (e.g., by a processor and/or other components of the container 100), and made available to one or more user devices 106, local storage 105, remote network storage 107 and the like. Such information may also be explicitly or implicitly presented to the user via a display 111 mounted on the container and/or via a display on the user's mobile device 106. Volumetric implications of a non-linear container, in particular with vertical variance, are accounted for with firmware/software level calculations and/or transformations (e.g. sensor point #3 corresponds to a volume of 16 oz. etc.).

Data about a user of the container 100 may be accessible to and/or obtainable by the container (e.g., by a processor or other component of the container 100). For example, the container 100 may receive (e.g., retrieve, access, request, or otherwise obtain) data about the user that is stored, for example, in one or more databases or storage devices 105 local to the user, within an application residing on a device of the user 106 (e.g., a portable user device, such as a cellular telephone, smartphone, personal data assistant, laptop or tablet computer, etc.), and/or in network/cloud data storage 107, 108. In accordance with at least one embodiment of the present disclosure, the data about the user may include, for example, user demographic information (e.g., age, gender, weight, body mass index (BMI), address, occupation etc.), additive purchase history information, additive usage history information, charge/payment information for purchases, medical and/or prescription history and various other data associated with the user or actions or behaviors of the user. User data may also include sports and fitness activities, fitness schedule/regime, dietary preferences/requirements, allergies, sensitivities, workout schedule and/or preferred locations for fitness training etc. In this manner, such data about the user of the container 100 may be collected, analyzed, and/or communicated by the container 100 (e.g., by a processor and/or other components of the container 100), and made available to the device of the user 106, to one or more other devices of the user, to the one or more databases or storage devices 105 local to the user, to the network/cloud data storage 107, 108, and the like. Such data may be communicated to, and received from, a user device using local wireless network 109 and further communicated to or from the cloud from the user device using wide area wireless network 110. It may also be communicated using Wi-Fi and/or other wired or wireless communications methods known in the art. Such information may also be presented to the user (graphically or symbolically) using a display 111 mounted on the container and/or using a display on the user's mobile device 106.

One or more APIs (Application Programming Interfaces), or other data sharing mechanisms, from a mobile device application associated with, and controlling the container 100 may interface with and access contextual/context data from other applications running on a device of the user (e.g., user device 106), where such context data may include, but is not limited to, geo-location, time, date, weather conditions, temperature, personal schedule (e.g., from a calendar application), travel schedule of the user etc. APIs or other data sharing mechanisms to third party applications may also be used by the container 100 to access user data about the current or past physical activity of the user. For example, data may be obtained from a variety of existing or future personal physical activity tracking/monitoring devices or applications (e.g., Fitbit, Apple Health-Kit, MyFitnessPal, etc.), any of which may furnish various data related to the physical activity of the user. Some non-limiting examples of the type of data that may be obtained from such physical activity tracking/monitoring devices include data about the type of physical activity undertaken by the user, the number of steps taken by the user during a period of time, speed of motion, estimated energy expenditure (e.g., calories burned), heart rate and the like. Accordingly, data about the user's physical activity levels and activity history may be collected, analyzed, and/or communicated by the container 100 (e.g., by a processor and/or other components of the container 100). All or a portion of the data described above may be communicated to or otherwise retrieved by one or more processors which may be located within the consumable container 100 or external to the consumable container (e.g., in the user's mobile device 106, in the cloud network 108, etc.), where various combinations, instances, and/or transformations of that data may be analyzed and used to derive more specific and focused patterns and trends about a user's behavior patterns, activity patterns, additive and consumable purchase and consumption patterns, personal preferences, health and fitness regime and the like.

Figure 2:
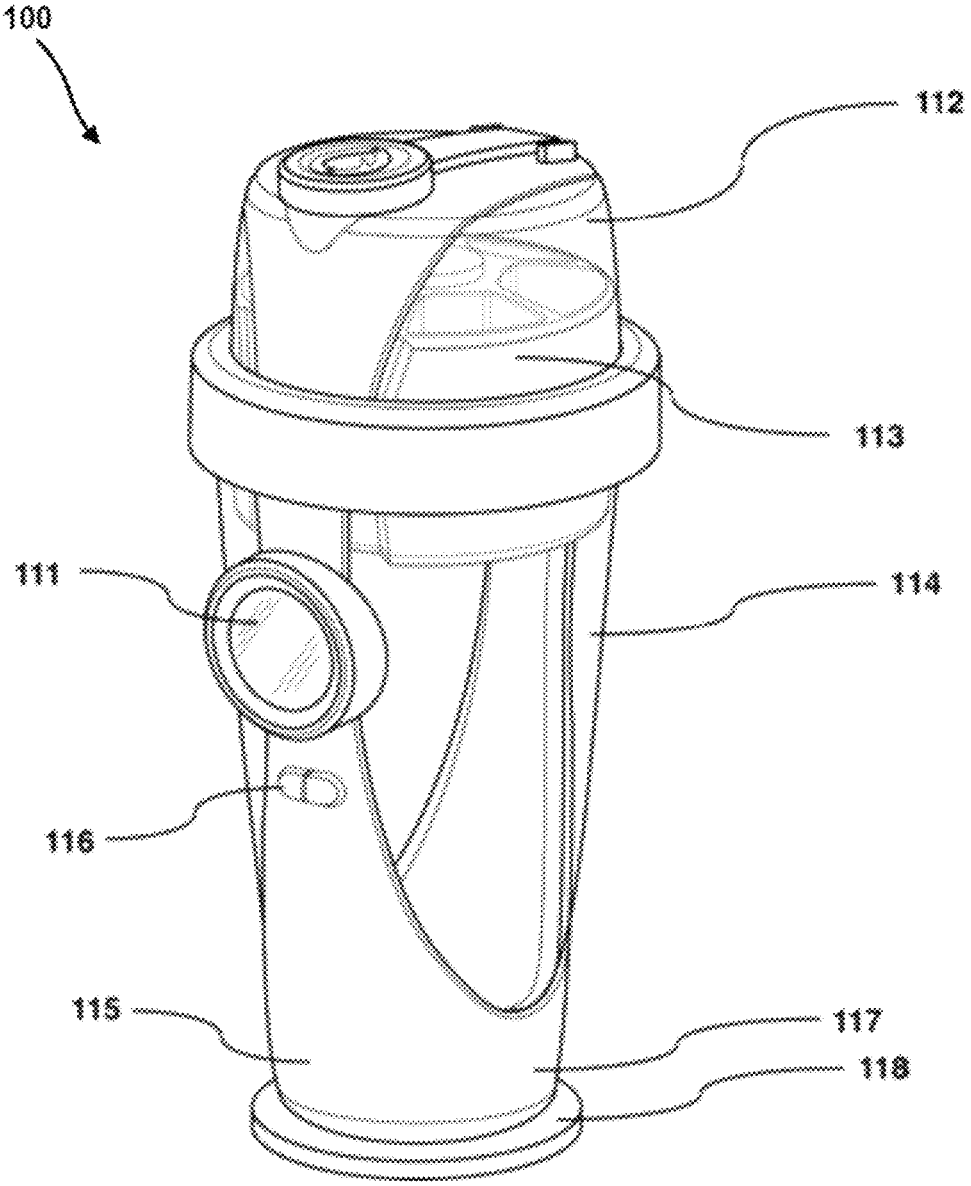
FIG. 2 illustrates an example container assembly according to one or more embodiments described herein.

In accordance with one or more embodiments, the container (e.g., container 100 of FIG. 1) of the disclosure may include multiple modules. It should be understood that although various examples and features are described in the context of a container comprising an assembly of a single liquid chamber and three separate electronic and/or mechanical modules, the scope of the present disclosure is in no way limited to such a configuration. Instead, for example, the container may include one or a plurality of chambers for containing a liquid consumable, and/or one or a plurality of electronic and/or mechanical modules containing one or more components which are water-sensitive and/or temperature-sensitive. For example, one separable electronic module may have wholly housed within it, a component which is not necessarily water or temperature sensitive and requires separation for sufficient washing/sterilization. In accordance with at least one embodiment of the present disclosure, a container assembly (e.g., container 100 in the example system shown in FIG. 1) may include multiple modules, including a consumable container, a separable outer sleeve, a separable lid or cover and an inner dispensing module. FIG. 2 shows a container for consumables 100 comprising a removable top portion or lid 112. A dispensing assembly 113 comprising sensitive electronic components fits within the top portion of the consumable container thereby using gravity to aid in the dispensing and/or general static-equilibration of additives from the additive vessels (not shown) into the consumable in the container and providing easy user access to add, change or configure additive vessels by removal of the lid 112. The dispensing assembly 113 comprises a series of apertures into which additive vessels can be inserted by a user. It is appreciated that a wide range of configurations and aperture quantities are possible. The container 100 is also equipped with a display 111 which may, in some embodiments, display information about the user of the container, the contents of the additive vessels, the contents of the container, and/or the amount, volume or rates of consumption of the additive vessel contents and/or the container contents. The container 100 also has one or more buttons 116 for user input of dispensing instructions and other functions, in an embodiment two buttons are configured for navigation and selection, however this is not a limitation, as it should be obvious that a wide range of interfaces and implementations thereof are possible. The container is equipped with an internal sensor (not visible in FIG. 2) appropriately positioned and configured to detect when the lid or top portion 112 is removed and/or replaced, in the preferred embodiment this may be a Hall Effect sensor however this is not a limitation and many other methods known in the art may be used to detect when the top portion is removed or replaced or when additive vessels are changed, a further example might specify a reed-switch, or a contact switch, to accomplish the same result. The container also comprises a consumable chamber 114 removably fitted within an outer sleeve 115, which may contain electronic or other components for determining the level or amount of consumable in the chamber 114. The electronic components may be powered by a battery 117 in the base of the sleeve, the battery in the present embodiment being inductively charged when placed on a charging coaster 118.

Figure 3:
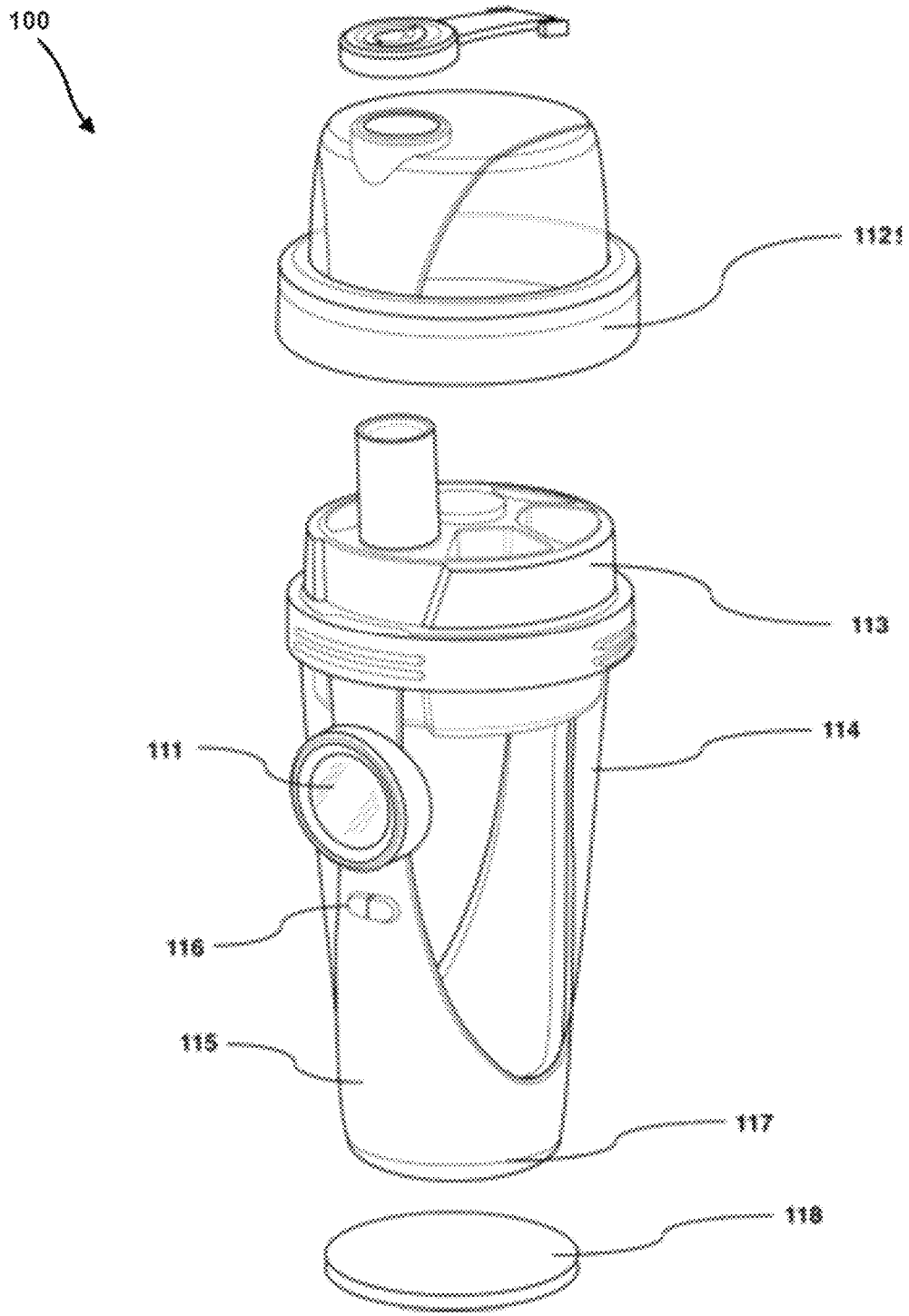
FIG. 3 illustrates an example of a container assembly with top cover removed according to one or more embodiments described herein.

FIG. 3 shows an example of the container assembly 100 with the top cover removed, the dispensing module partially visible and the charging coaster separated. The assembly consists of a chamber 114 containing a consumable liquid (e.g. water) which slide-ably fits within an outer sleeve 115, the outer sleeve containing an IR sensor array or other sensor technology (such as a non-contact capacitive sensing PCB strip) used to measure the level of consumable in the adjacent chamber 114. In order to accurately and reliably measure the liquid level, the removable outer sleeve has to be accurately positioned relative to the consumable container. The outer sleeve may also comprise user interface components including a display 111 and pushbuttons 116. The outer sleeve 115 therefore contains sensitive electronic components and is separable from the consumable container 114 in order that the consumable container can be washed or otherwise sanitized. A dispensing module assembly 113 may also comprise of temperature and/or water sensitive electronic or mechanical components and may be separably located within the container 100 and secured in place and sealed further against leakage by a separable lid or cover 112 which fits over the dispensing module assembly 113. The removable lid 112 (which does not contain sensitive electronics) covers and secures (but is not attached to) the electro-mechanical dispensing module 113 which does comprise of sensitive electronic and electro-mechanical components. The dispensing module 113 consists of both electronic and moving mechanical components and may therefore be damaged by temperature extremes, water, humidity, and mechanical shock, it may be totally separable from the lid so that the lid 112 can be washed. The dispensing module also comprises mechanical actuators which move to apply mechanical pressure to the additive vessels contained therein and dispense the contents of the additive vessels. Accurate positioning of the mechanical actuator is necessary, and it is important that the moulding which retains and positions the additive vessels does not get damaged or warped by hot water.

Figure 4:
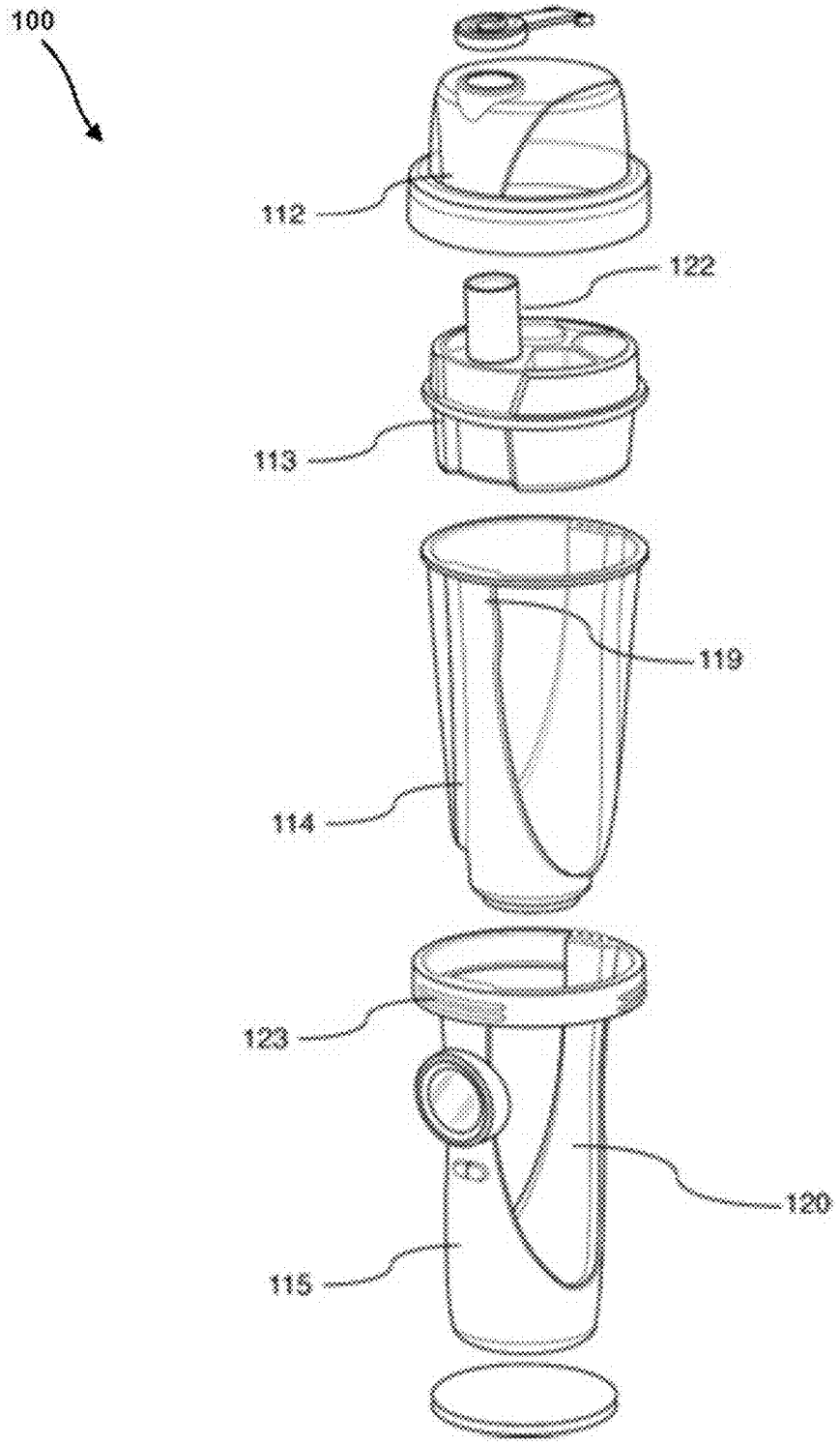
FIG. 4 illustrates an exploded view of the example container assembly shown in FIG. 2 according to one or more embodiments described herein.

FIG. 4 shows an exploded diagram of a number of modules forming a container assembly, in accordance with one or more embodiments described herein. An outer sleeve 115 which contains sensitive electronic components, is separable from an inner chamber 114 enabling the latter to be washed in a dishwasher or the like. Tapering the outer sleeve 115 enables the tapered inner chamber 114 to be positioned within the outer sleeve and to clip securely within it at 119. Secure clipping of the chamber 114 within the sleeve 115 enables sensing components located in an enclosed cavity 120 to be accurately positioned in relation to the chamber 114 and the chamber contents, this being required for accurate and reliable sensing or measurement of the level of, or amount of chamber contents. Such sensing components include, but are not limited to LEDs, infrared emitters and/or sensors, magnetic sensors, capacitive sensing arrays, visual sensors etc. Such sensors may also be positioned on an inner surface of the sleeve.

In accordance with at least one embodiment, the cover or lid module 112 may additionally have passing through it, a drinking channel 122 which may additionally be separable from the lid and/or cover 112 to enable washing. The drinking channel 122 may be part of the dispensing module assembly 113, may be part of another component or module of the container, or may be a separate component of the container altogether. The dispensing module 113 is wholly contained, secured and sealed within the cover module 112 when the cover module is affixed to the outer sleeve 115 using the screw cap mechanism at 123. It contains sensitive electronic and electro-mechanical components and is separable from the cover 112. In the current embodiment an electrical interface connecting the lower components to the upper, separable, components dictates an orientation specific connection further facilitated by an independently rotatable "lock-ring," forcing a uniform-pressure seal without further requiring the dispensing module and/or its housing to rotate, and thereby creating complications for an electrical interface.

A portable hydration container of the disclosure also provides determination of level of liquid in the container. Infrared light emitting diodes (LEDs) are widely used in TV remote controls, in cameras and in many other consumer products and water absorbs the infrared radiation emitted from such emitters. Infrared LEDs are small, inexpensive, have low power requirements and low power consumption, they are therefore well suited to a method for detecting the level of water or other liquid in a portable hydration container. In at least one embodiment, a similarly "mapped" capacitive sensing PCB or equivalent might be oriented in such a way so as to detect the same contrast at which the waterline contained in the vessel makes itself apparent via variation of dielectric constant as measured by a capacitive sensing implementation (contact (probe), and non-contact.)

Figure 10:
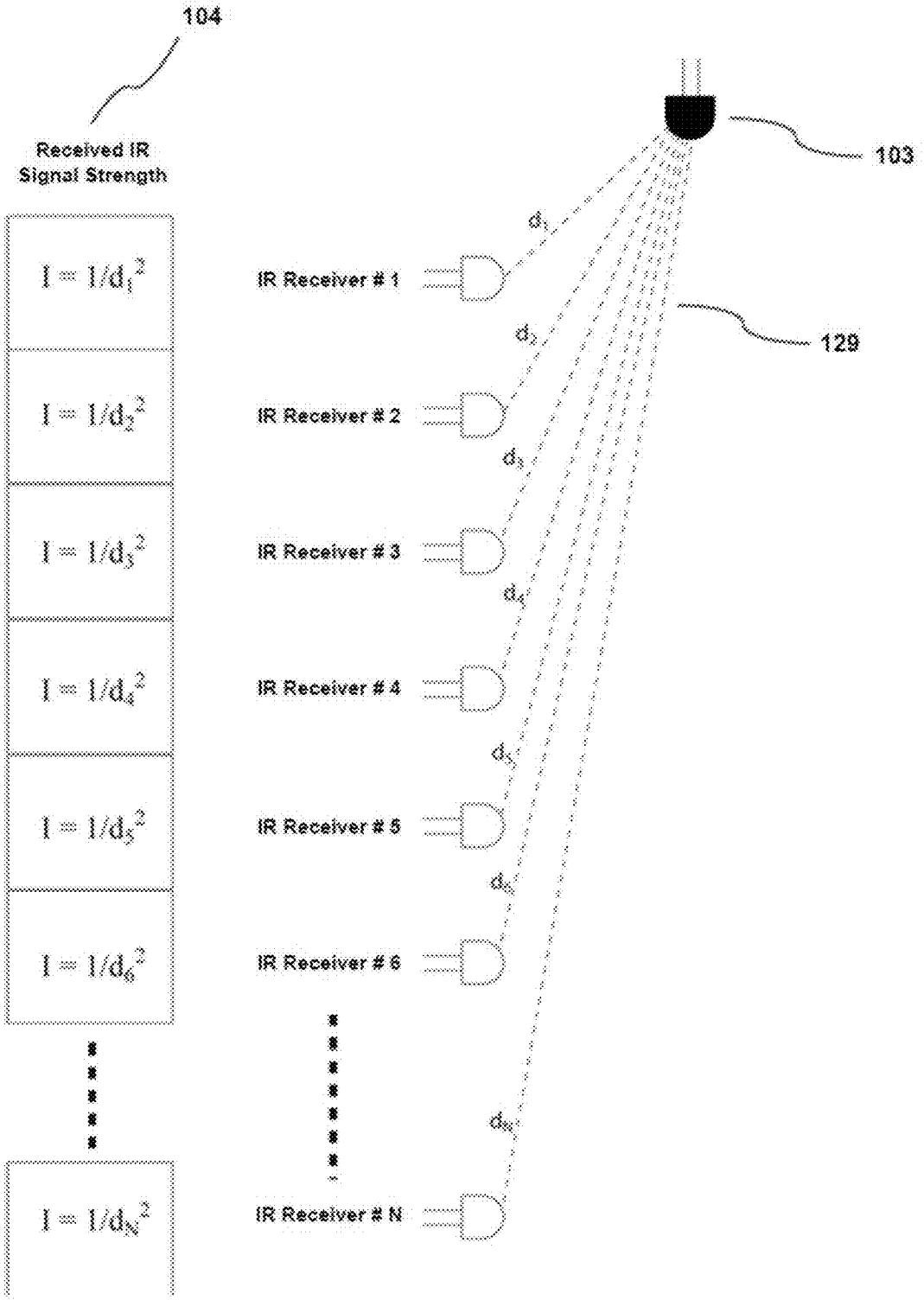
FIG. 10 is a schematic diagram illustrating an example fluid level detection system according to one or more embodiments described herein.

The presence of liquid between an IR emitter and an IR receiver will attenuate the IR signal, and the signal level detected at a receiver diode which is beneath the surface level of the liquid will be substantially less than would be expected based solely on its distance from the emitter. For example, the absorption characteristics of electromagnetic radiation by water are shown in FIG. 10, indicating that maximum absorption occurs at a wavelength of approximately 3 um. Similarly, the dielectric signal measured by a capacitive sensing array positioned and configured in similar fashion would detect a significant value difference between a 'submerged' versus 'exposed' sensor and/or portion/region of the capacitive sensor implementation.

Figure 5:
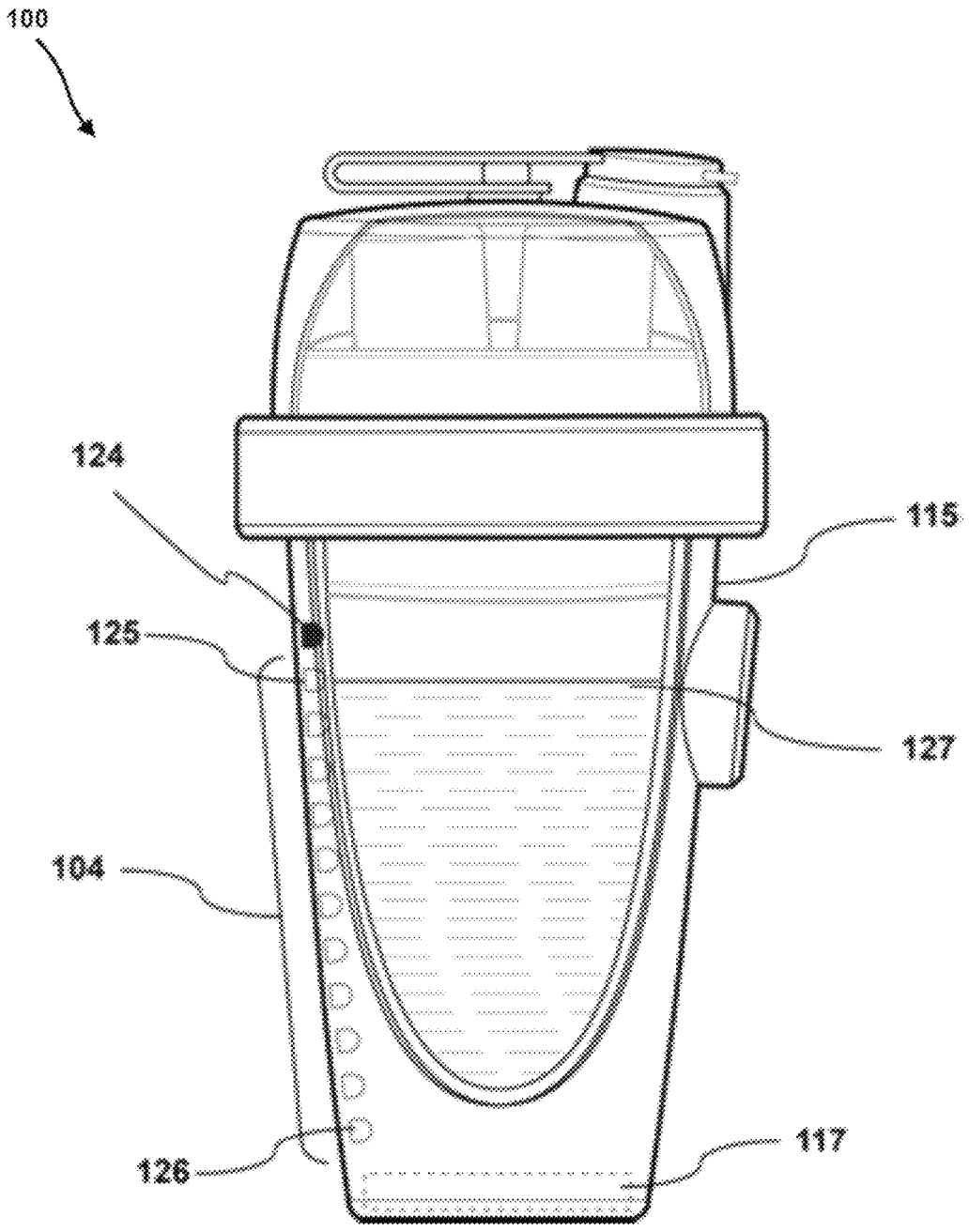
FIG. 5 illustrates an example arrangement of an infrared emitter and infrared receivers according to one or more embodiments described herein.

An embodiment of the liquid level sensing method is now described with reference to FIG. 5. For convenience this will be referred to as the single side emitter embodiment, though more than one emitter may be used. One or more IR LEDs 124 emitting electromagnetic radiation are mounted within a side of the liquid container 115. The IR emission may be at any appropriate wavelength but in a preferred embodiment may be at least 1050 nm in order to be undetectable by the human eye. In this example, the topmost LED 124 in the array is the single side emitter. In addition, one or a plurality of infrared (IR) receivers are oriented vertically 104 at different liquid levels, with the topmost receiving diode 125 positioned to be approximately aligned with the highest liquid level and the lowest receiving diode 126 aligned with the lowest liquid level possible within the container. The emitting diode 103 may be part of the vertical receiver array in the side of the container as shown in FIG. 5, or may be separated from it—and may require only that its emission is sufficient to radiate significantly towards the general direction of the receivers. IR radiation from the emitter will be scattered within the liquid and reflected off the container walls such that it will be detectable, to varying degrees, by each one of the IR receivers. The emitting and receiving LEDs receive power from a battery unit 117 contained within the base of the liquid container 100 or within any other module of the container assembly. In an embodiment, a power system is located in the lowermost portion for coaster-based inductive charging.

When the container is filled completely with liquid, all of the receiving diodes 104 will be submerged, the signal level detected by each of these receiving diodes will be low and there will be minimal differences between the signal strengths detected by each of the plurality of IR receivers. Because the signal level is low, and substantially equal at all receivers, the system determines that the container is full. Similarly when the container is empty, all of the receiver diodes 104 will be exposed and the signal level detected by each receiver diode will be high and there will similarly be minimal differences between the signal strengths detected by each of the plurality of receivers. Because the signal strength is high, and substantially equal across all receivers, the system determines that the container is substantially empty. The difference between a full and an empty container can be further inferred and corroborated by the direction/vector of level-change, as measured by the sensor implementation (e.g., full to empty, leading to empty, necessitates that the uppermost sensors record empty prior to the lower sensors, and vice versa for empty to full, leading to empty, whereby for example, the user might be replenishing the vessel.) As the liquid level 127 in the container decreases, several diodes will become exposed and no longer submerged, as a consequence they will detect a higher level of IR radiation. Information on the physical location of each receiving diode and the signal level detected at each one can then be used to determine a liquid level, and thus volume. In a further embodiment, with data on the shape, size and form of the container, it is additionally possible to infer the volume of liquid in the container. In a further enhancement, measurement of the time elapsed or the number of IR pulses emitted in a period of time by the emitter 124, can be used to determine a rate of depletion (consumption) of the liquid. For example at a first point in time, the liquid level is determined to be level with receiving LED 125, as shown in FIG. 5. At a second point in time, 5 minutes later, the liquid level is determined to be level with receiving LED 126. It is therefore possible to estimate the rate of consumption of the liquid to be the calculated volume of liquid between these two LED positions divided by the elapsed time. If the volume of liquid is assumed (for example) to be 15 oz, then the rate of consumption would have been 3 oz. per min Time measurement may be provided by an onboard clock or timer within the onboard processor or, in an embodiment where the emitting LED is emitting periodic pulses, by counting the number of periodic pulses. For example, to reduce power consumption, the emitting LED may emit an IR pulse at 30 second intervals enabling the liquid level to be determined at 30 second intervals and the rate of consumption more accurately estimated. A shorter measurement interval or higher pulse frequency will result in a more accurate rate of consumption estimate. Similarly, the same method can be used to determine when the container has been re-filled since determination of the rate of consumption of the liquid would, in this case be a high negative rate. In all embodiments of a level sensing technique in this implementation, an inertial sensor (not labelled or drawn) such as, for example, a four-axis accelerometer might provide usage context to activate and/or inactivate the level sensing system, such that it is recording and measuring only when in use. Alternately, such an inertial sensor might trigger a higher sampling-rate of a level sensing system, so as to continuously measure and seek water-level changes, while triggering the more precise high-frequency evaluation of water-level changes when the probability of the user consuming or filling the vessel is significantly higher (as measured by movement.)

The emitting diode 124 may or may not be submerged beneath the liquid surface. Since the IR emission will be scattered by the liquid and reflected off the container walls, and will be substantially the same for all receiving LED's, this will not affect the level measurement.

Figure 6:
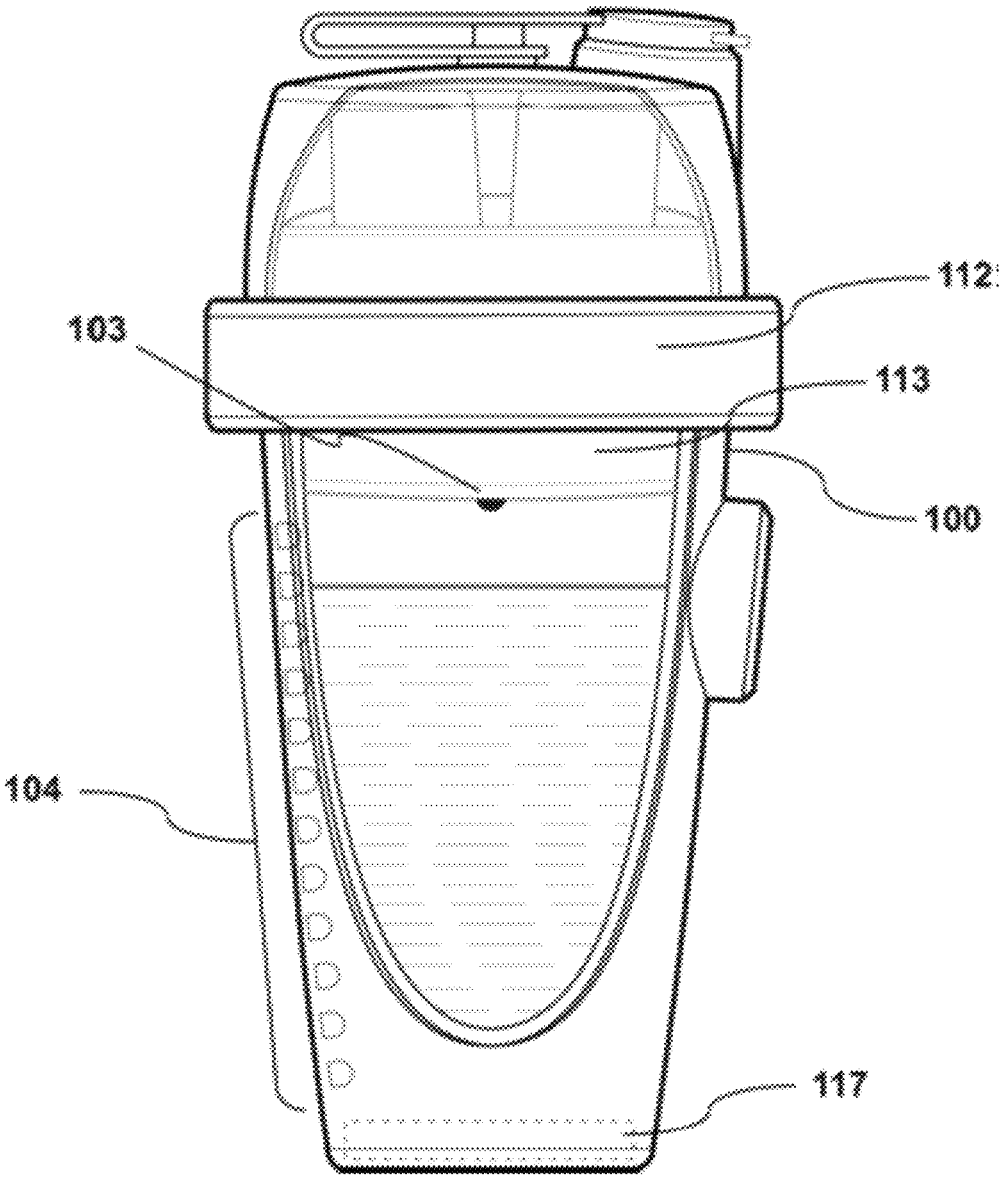
FIG. 6 illustrates another example arrangement of an infrared emitter and infrared receivers according to one or more embodiments described herein.

The LED emitter may be in one of multiple locations within the enclosure. FIG. 6 shows a further embodiment which, for convenience will be referred to as the single top emitter, in which a single emitting LED 103 is mounted at the top of the container preferably within a lid component 112 which may be separable from the container 100. Alternatively it may be in the base of a dispensing module assembly 113 but in a broadly similar location relative to the liquid. Power to the emitter is provided using a connector between the removable lid and the base which supplies power from the battery 117 contained in the base of the liquid container 100. Multiple emitting LEDs may also be used subject to power and space limitations. The array of LED receivers 104 may be positioned vertically within the side of the container similar to FIG. 5.

Figure 7A:
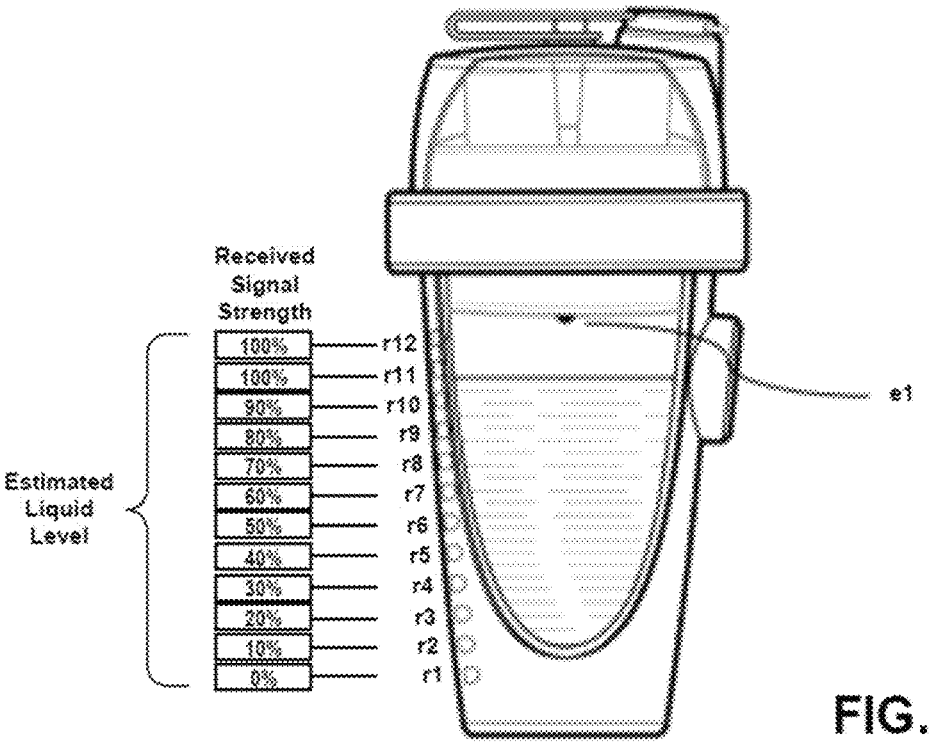
FIGS. 7A and 7B are schematic diagrams illustrating an example process of determining a fluid level in a container assembly having the arrangement of an infrared emitter and infrared receivers shown in FIG. 6 according to one or more embodiments described herein.
Figure 7B:
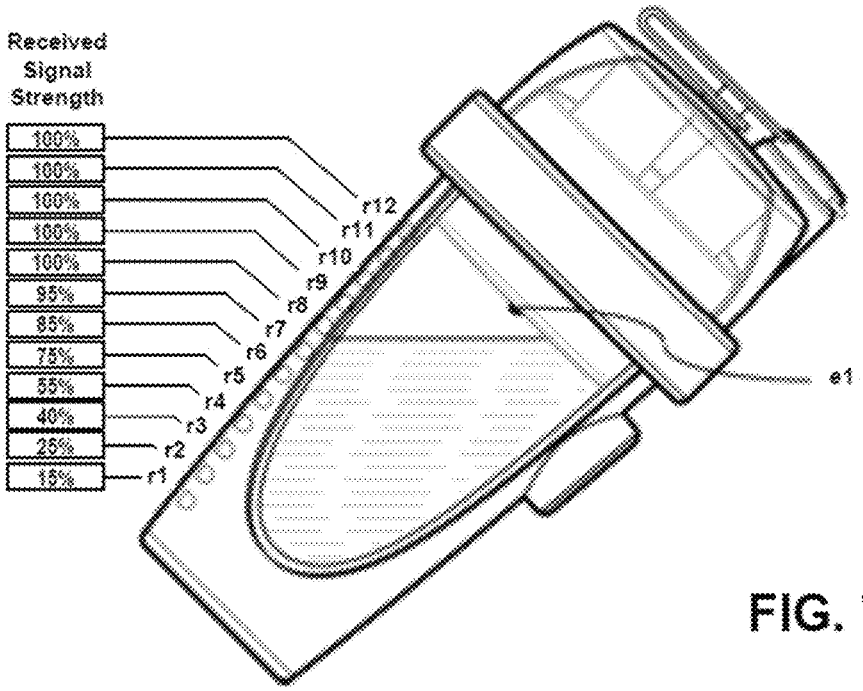

FIGS. 7A and 7B show the single top emitter embodiment in an upright (FIG. 7A) and tilted (FIG. 7B) position. IR radiation is detected at each of 12 receiving LEDs r1 to r12 from an emitting LED e1 mounted in an upper part of the container. In FIG. 7A it will be apparent that the signal strength detected at receivers r12 and r11 will be relatively high, since the IR radiation has not passed through the liquid and been attenuated, while the signal strength detected at receivers r1 to r10 will be considerably lower since it has been attenuated by passing through the liquid. Furthermore, after compensating for the distance between the emitter and the receivers (the inverse square law, explained in more detail in FIG. 7), the signal strengths detected at each of r1 to r10 will be substantially similar. Therefore the method concludes that the liquid level is between r10 and r11.

When the container is tilted as shown in FIG. 7B, the signal strength detected at receivers r8 to r12 will be high and substantially similar, while the signal strength detected at receivers r1 to r7 will be low and substantially similar (compensating for distance). The method would therefore conclude that the liquid level is between r7 and r8, which is the case, but only because the container is tilted, this would be an erroneous conclusion and would lead to an incorrect estimate of liquid level or volume when the container is upright. Consequently this embodiment may additionally require inertial or other sensors to detect when the container is upright and the direction and degree of tilting of the container when it is not upright. Alternatively, inertial sensors may instruct the processor to measure the liquid level only when the container is upright.

Figure 8:
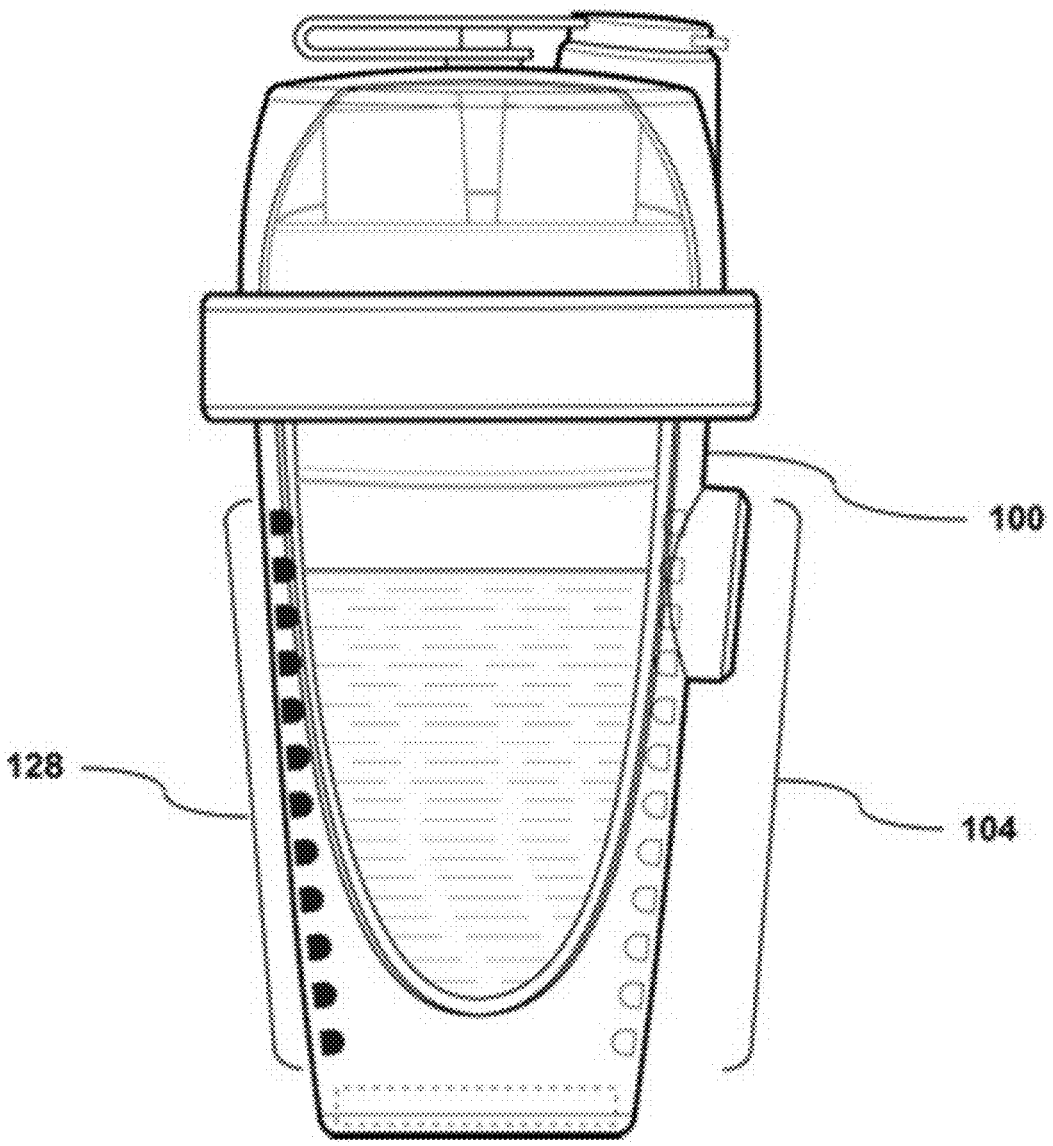
FIG. 8 illustrates another example arrangement of an infrared emitter and infrared receivers according to one or more embodiments described herein.
Figure 9A:
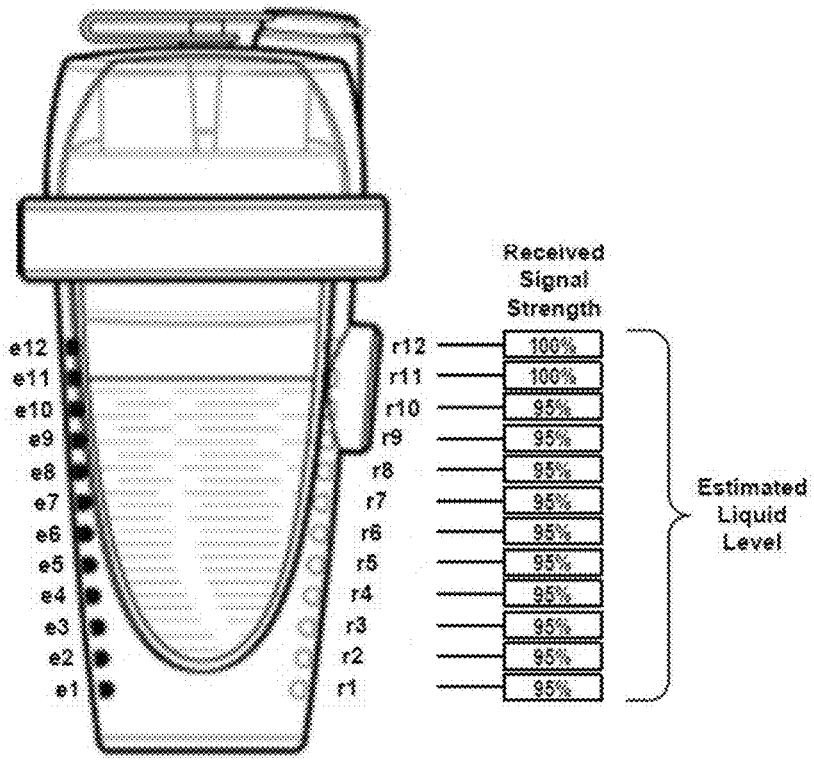
FIGS. 9A and 9B are schematic diagrams illustrating an example process of determining a fluid level in a container assembly having the arrangement of an infrared emitter and infrared receivers shown in FIG. 8 according to one or more embodiments described herein.
Figure 9B:
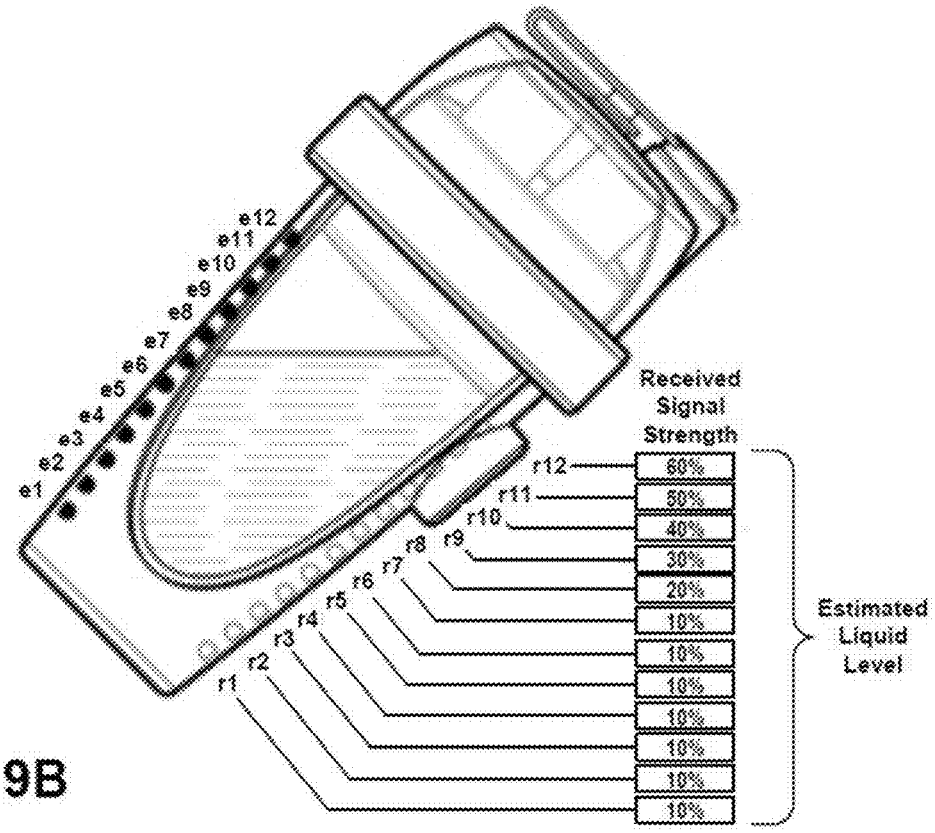

FIG. 8 shows a further embodiment, characterized as multiple side emitters, which may not require inertial sensors, in which a first vertical array of multiple IR emitters 128 may be mounted on one side of the container 100 and a second vertical array of multiple IR receivers 104 mounted on the opposite side of the container such that each emitter is in substantial alignment with a corresponding receiver on the opposite side. This provides the additional capability of determining the volume of liquid in the container when the container is tilted. Though two vertical arrays of sensors are disclosed and illustrated, this is not a limitation and any other number of arrays may be deployed within a container. Similarly, the sensor arrays are not required to be vertical or linear in placement and many other arrangements are possible. In FIGS. 9A and 9B the multiple side emitters shown in FIG. 8 are shown in an upright and in a tilted position. Continuous or intermittent IR pulses are emitted by emitters e1 to e12 in a substantially constrained angle such that the signal emitted by e12 will be detected primarily by receiver r12, the signal emitted by e11 will be detected primarily by receiver r11 and so on. In the following descriptions the received signal strength is represented as a percentage of the emitted signal strength, the percentages are for illustration only and do not necessarily represent actual signal strength.

In FIG. 9A, it will be seen that the received signal strength at r11 and r12 are high, at approximately 100% and at receivers r1 to r10 are relatively low at 15%, and approximately equal. This transition from high to low between r10 and r11 indicates that the liquid is at that level (between r10 and r11) in the container. In FIG. 9B, it will be seen that the IR signal strength detected at receiver r12 is 60% (neither high nor low), having been slightly attenuated by passing through the liquid, the signal detected at receiver r11 will be attenuated to a slightly greater extent (e.g. 55%) since there is a greater volume of liquid between e11 and r11. The signal strength will step down further at receivers r10 to r8 as the amount of liquid between emitter and receiver gradually increases. The signal strengths received at r7 to r1 may be substantially similar (e.g. 15%). The gradually changing signal level indicates that the container is tilted, while the transition between r7 and r8 indicates that the lowest liquid level is approximately at the level of r7/r8. The fact that the signal strengths at r8 to r12 are not close to 100% indicates that liquid is present above r7 and that the equivalent liquid level, if the container were upright would be midway between r7 and a point where the received signal would be 100%. In this case determining that the liquid level would be at approximately r10. In a further embodiment, the container may also contain a tilt sensing device and/or accelerometer to substantially determine the orientation of the container and increase the accuracy of measurement. Percentage signal strengths referred to herein are for purposes of illustration and do not necessarily represent actual received signal strengths.

The use of inertial sensors and/or IR sensors as previously described to determine that the consumable container is tilted may also be used to determine that a user is actually drinking from the container at that time, this information may be used to initiate or prevent a liquid level measurement and/or initiate or prevent a scheduled dispensing event and/or to perform other functions which should preferably take place coincident with the drinking process.

Since infrared is an electromagnetic radiation and subject to the inverse square law, the signal level detected at a receiving diode is dependent on the distance between the emitter and the receiver, as well as any attenuating fluid between. Thus the signal detected at a more distant receiver will be less than that detected at a proximal receiver independently of whether liquid is between them to attenuate the signal. This can be compensated for in the method since the relative locations of all emitters and receivers are fixed and known.

Figure 11:
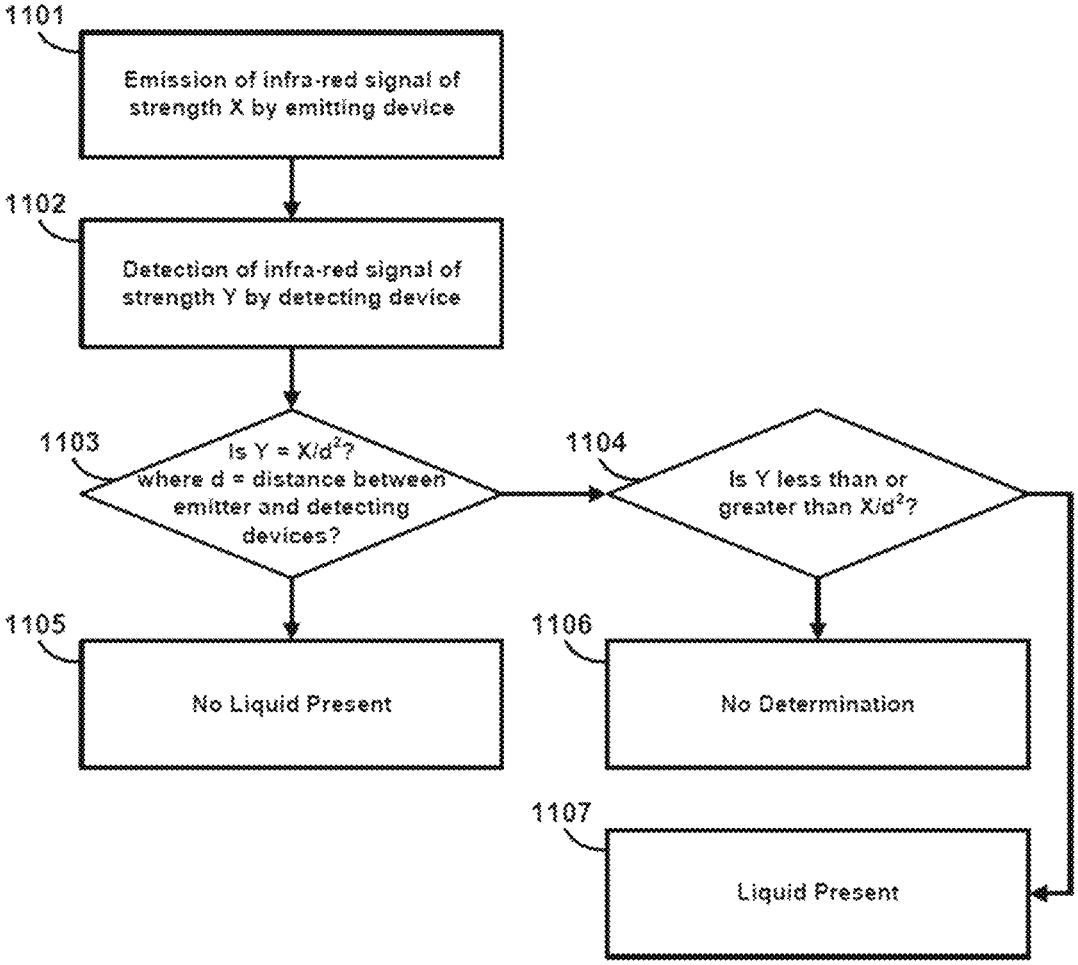
FIG. 11 is a flowchart illustrating an example process for determining a level of liquid within a container according to one or more embodiments described herein.

FIG. 10 shows the detailed method of compensating for the attenuation of infra-red signal due to distance from the emitter (commonly known as the inverse square law), to more accurately determine the level of liquid in a portable container. This is described in the context of the single top emitter embodiment shown in FIG. 6 but applies to all embodiments. An array of IR receivers 104 detects IR radiation from IR LED emitter 103. The distance 129 between the IR emitter and IR receiver 1, is $d_1$, the distance between the IR emitter and IR receiver 2, is $d_2$, the distance between the IR emitter and IR receiver 3, is $d_3$, and so on to IR receiver N 705, at a distance of $d_N$. If there is no attenuation by liquid in the container then the signal strength detected at each of the IR receivers will be subject to the inverse square law and for IR receiver 1, will be $1/d_1^2$, for receiver 2, will be $1/d_2^2$ and so on up to $1/d_N^2$ 704. This is compensated for in the method used to process the received signal strengths to determine a level of liquid in the container. FIG. 11 shows an illustrative process for the determination of liquid level within a portable container. Infrared radiation of signal strength X is emitted by an IR emitting device at 1101 and a signal of strength Y is detected by an IR receiving device at 1102. Processing circuitry, which may be provided, receives data from a plurality of receiving devices and determines whether the detected signal Y is approximately equal to the emitted signal X, divided by the square of the linear distance between the emitter and the detector 1103. If the signal strength is substantially equal, then the processor determines that there is no liquid in the space between that emitter and that receiver. At 1104 the processor determines whether the detected signal Y is less than or greater than the emitted signal X, 1104. If the signal strength is less than the emitted signal X, then the processor determines that there is liquid present in the space between that emitter and that receiver. If the signal strength is greater than the emitted signal X, then the processor determines that there may be an error and no determination of the presence or absence of liquid is made. Since a portable container will be subject to motion, the liquid level will not remain constant, but will be variable depending on the motion. Therefore much of the time, a determination of liquid level could be erroneous. To address this issue, in a further enhancement, the processing circuitry may use a plurality of signal strength measurements taken at various time intervals, for example 10 seconds and combine them together to generate a mean value as the estimate of fluid level in the container during that time period. In this embodiment, the infra-red emission may be continuous, with periodic detection of the received signal or the infra-red emission may be periodic, with continuous detection of a received signal.

Figure 12:
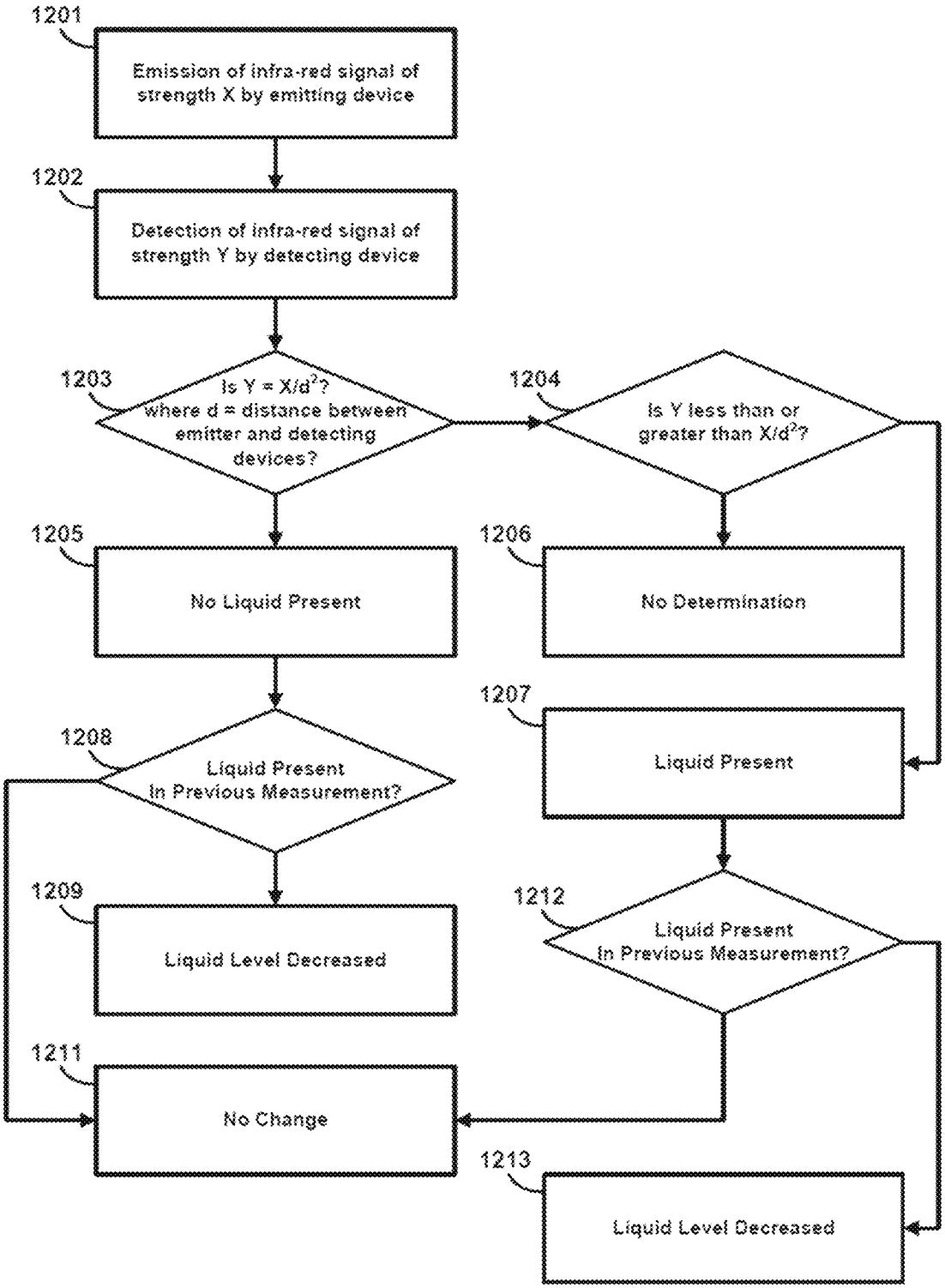
FIG. 12 is a flowchart illustrating an example process for determining a rate of consumption of liquid within a container according to one or more embodiments described herein.

FIG. 12 shows an illustrative process for the determination of the rate of consumption of a liquid within a portable container. The process of steps 1101 to 1104 is as previously described with reference to FIG. 11 in addition, at step 1205, comparison is made between a first and a second signal strength detected at that detection device to ascertain whether the signal strength has changed from that previously detected. If liquid was previously determined to be not present and in the subsequent detection event found to be present, then the system determines that the liquid level has increased 1206. If liquid was previously determined to be present and in the subsequent detection event found to be not present, then the system determines that the liquid level has decreased 1207. By taking account of the time period between the first received signal strength and second received signal strength and/or a plurality of measurement events between, the system determines a rate of consumption of liquid to be the difference between the two measured levels divide by the time between measurements. Such a technique in this instance is nearly identical in a fundamental manner for an alternate embodiment involving a capacitive sensing implementation.

Data on the level or volume of liquid in a portable or non-portable container may be used for a variety of purposes, including but not limited to determining a rate of consumption of the liquid in the container, determining when the container is empty, determining when the container needs to be refilled, and determining when the container has been refilled. Determining the level of liquid may also be used to determine whether a scheduled dispensing event has taken place. For example, if a signal is communicated from a processor to dispense 0.2 oz. of a consumable additive, the level detection system can immediately afterwards carry out a level check to confirm whether the fluid level has increased by an amount substantially in accordance with the introduction of 0.2 oz. of the additive. The aforementioned example assuming that the two or more substances have strictly additive volumes (e.g. 1 oz plus 1 oz equals 2 oz total, etc.), whereby in cases where the respective volumes are non-additive (e.g. 1 oz plus 1 oz equals 1.9 oz total, etc.), a defined adjustment factor would be considered.

In a further embodiment of the disclosure, the system may be used to establish and periodically re-establish baseline IR emission and/or detection thresholds corresponding to when the container is full and empty. The current embodiment of the container additionally comprises of a sensor to determine when the lid is removed for the container to be refilled and subsequently replaced. On detection of the lid removal, the processor may signal an IR emission and detection event to establish threshold signal levels corresponding to an empty container and on subsequent replacement of the lid, the processor may signal an IR emission and detection event to establish threshold signal levels corresponding to a full container. This may be particularly useful to increase the accuracy of level detection within the container and decrease threshold shifts caused by a varying infra-red level in the environment external to the container, or variable absorption/refraction or other forms of disruption of the fluid (e.g. water.) Known electromagnetic spectrum absorption characteristics of water may be used on the processing of the disclosure.

Figure 13:
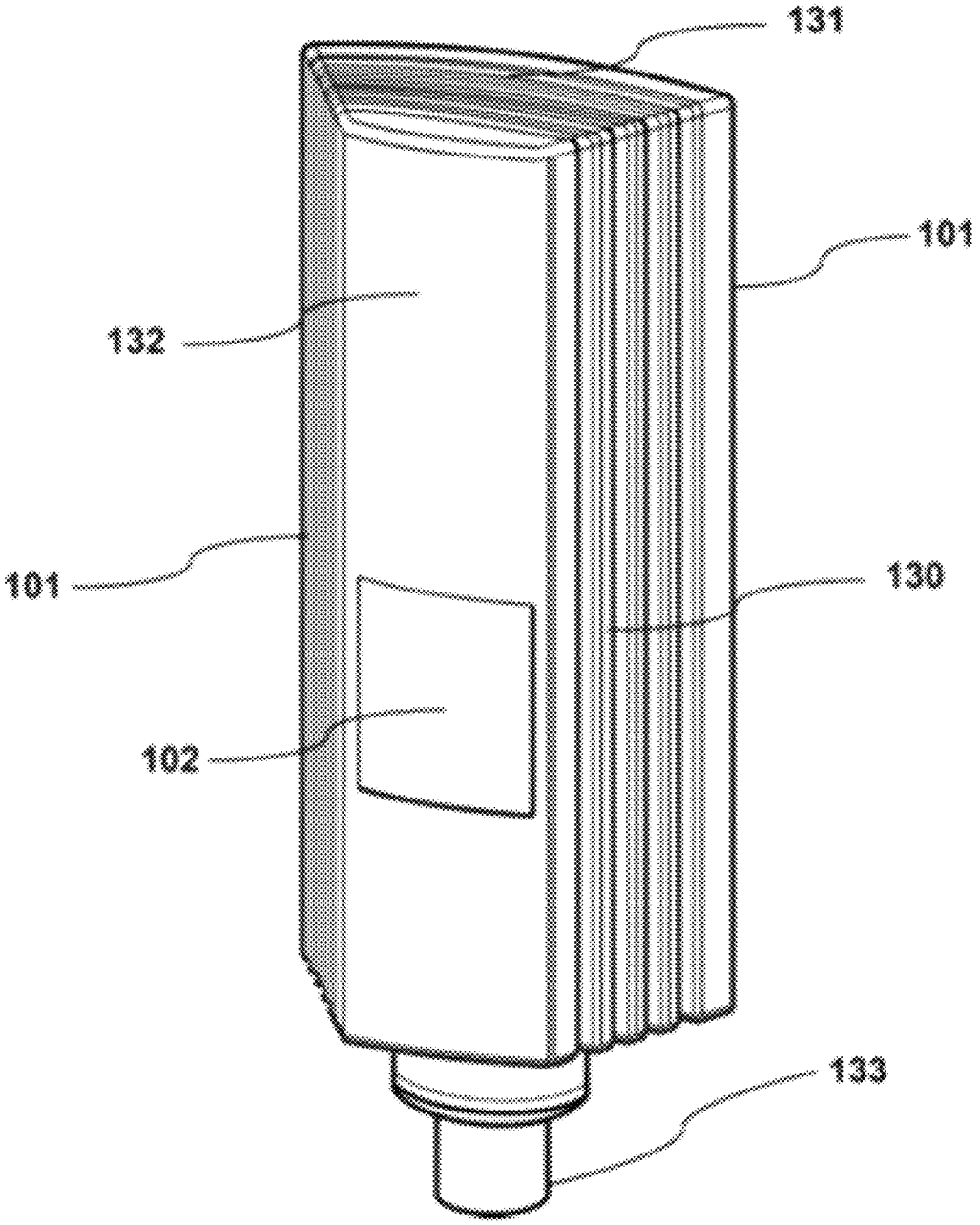
FIG. 13 is a perspective view of an example additive vessel with ridged sidewalls according to one or more embodiments described herein.

FIG. 13 shows a general view of an additive vessel according to one or more embodiments described herein. The example additive vessel may include a substantially airtight vessel 101 manufactured from a compressible, flexible or semi-flexible and recoverable material such as BPA-free LDPE (Low Density Polyethylene). It may be manufactured in such a way that the side walls 130 and top surface 131 of the vessel include corrugated, accordion-like ridges enabling the vessel to be readily compressed laterally, while providing the necessary geometry to facilitate a 'rebound' behavior sufficiently strong and/or reliable to return the vessel to its standard form, shape, and/or pressure. The vessel is configured in the container in such a way so as to reliably constrain it across all but one axis of motion, consistent with the requirement of a correspondingly oriented actuator or other pressurization mechanism. The configuration dictates that all input force from a dispensing mechanism necessarily translates into a force directed towards the ultimate and controlled ejection of the vessels' contents. The vessel may be removably mounted within a dispensing module assembly of a portable hydration container of substantially circular cross-section with the surface 132 facing inward. The additive vessel 101 has a dispensing nozzle 133. The vessel 101 may also have a RFID tag 102. The tag 102 may typically be manufactured from aluminum or other appropriate material and is affixed to the external surface of the vessel in an embodiment. The RFID tag 102 may also be positioned on any other surface or portion of the additive vessel 101 where the tag 102 can be accessed by an RFID antenna.

In accordance with one or more embodiments of the disclosure, the RFID tag 102 may contain information about the contents of the additive vessel 101 to which the tag 102 is attached, including, for example, a name or type of additive in the vessel (e.g., vitamin B, cherry flavor, etc.), a category of the additive (e.g., nutritional supplement, pharmaceutical, energy supplement, etc.), a capacity of the vessel (e.g., 75 drops, 1.5 oz., etc.), a standard serving amount for the particular additive (e.g., 3 drops, 2.5 mL, etc.), dosage or consumption limitations for the additive (e.g., 12 drops per day, 4 drops per hour, 7.5 mL per day, etc.), as well as various other information that may be pertinent to the contents of the vessel 101 and/or the dispensing of the contents.

Figure 22:
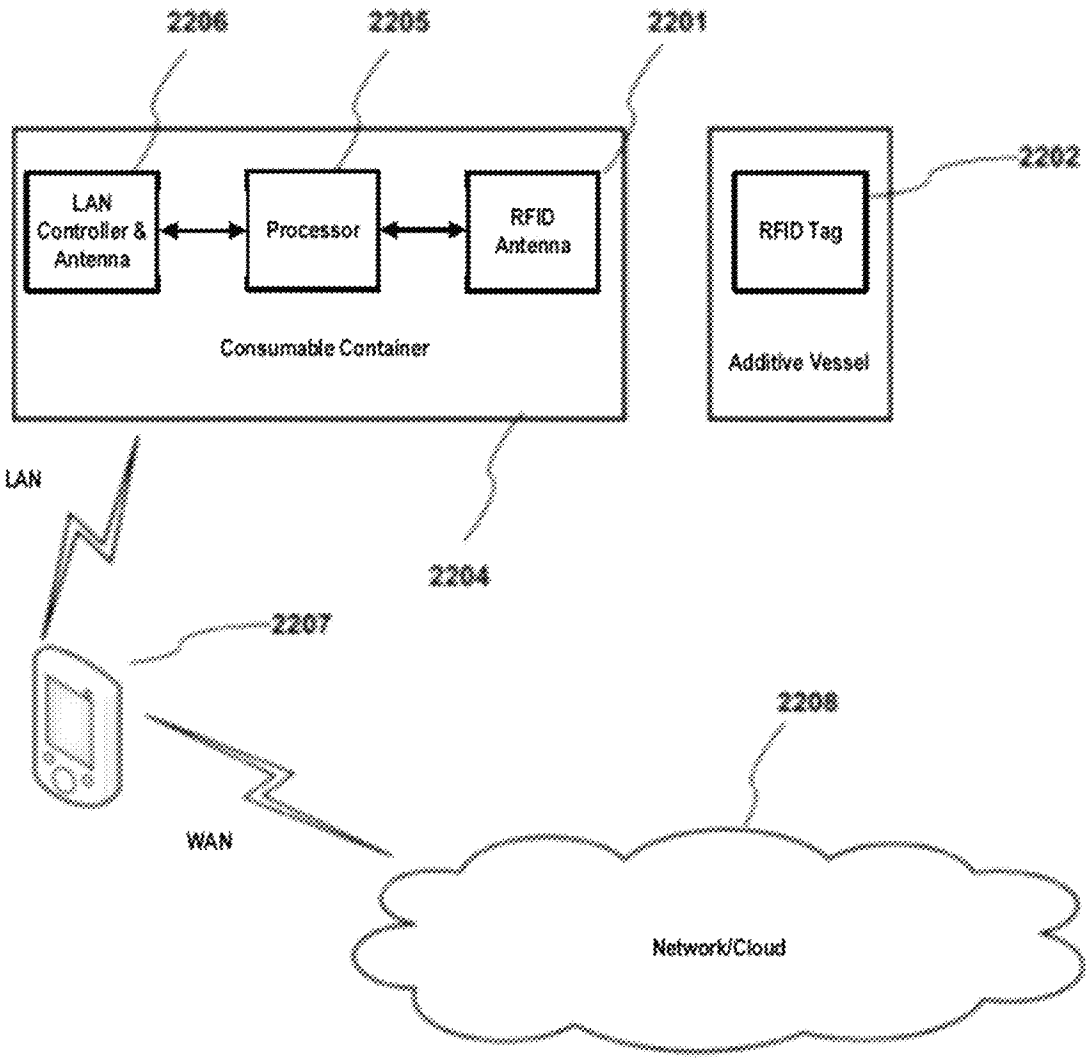
FIG. 22 is a block diagram illustrating example data communications within a data access system according to one or more embodiments described herein.

In accordance with at least one embodiment, data regarding the dispensing of additives may be encoded in any form suitable or appropriate to the dispensing process. (e.g. number of actuations, voltage, frequency, length of actuation, etc.). FIG. 22 is a block diagram illustrating example data communications between various components of the system, in accordance with one or more embodiments. An RFID antenna 2201 mounted on a rotatable dispensing module within a consumable container 2204 reads data encoded on an RFID tag 2202 mounted on or within an additive vessel. Data received at the antenna 2201 is communicated to a processor 2205 which uses that data to determine that the correct additive vessel is to be dispensed and to access other data about the additive vessel contents and/or data about the preferences of the user of the container that may be influencing factors in the subsequent dispensing event. The data is also wirelessly communicated 2206 to an associated user mobile device 2207 via a Local Area Network, such as Bluetooth Low Energy, though other wireless or wired technologies may be utilized. The mobile device 2207 further communicates wirelessly with the cloud 2208 via Wi-Fi, and/or a Wide Area Network (WAN) such as cellular, etc., and is able to communicate the data accessed from the additive vessel to a storage location in the cloud and is also able to access from the cloud additional information or data about the additive vessel or the user of the consumable container (such as user preferences, consumption or usage history, etc.).

Figure 23:
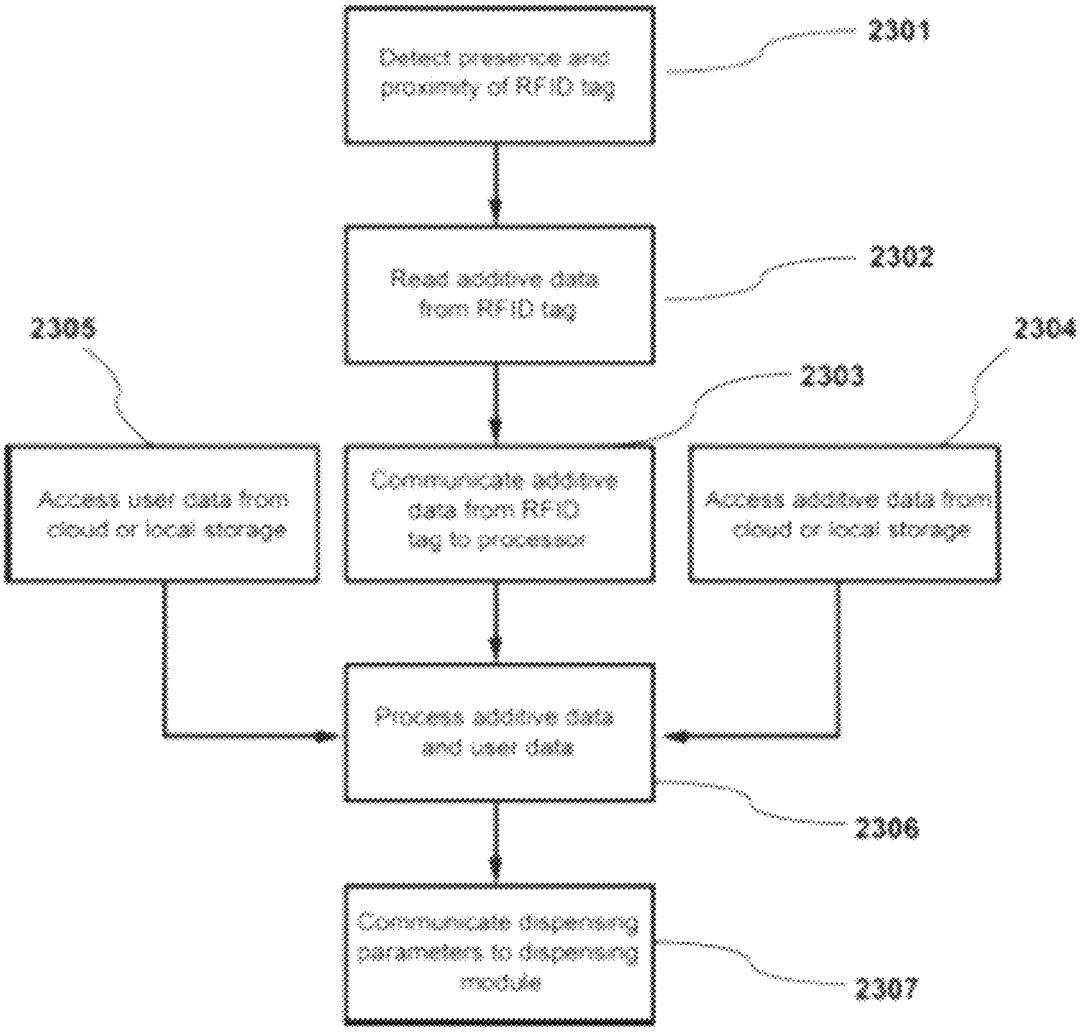
FIG. 23 is a flowchart illustrating an example process for identifying a container and accessing data about the contents of the container and about a user of the container according to one or more embodiments described herein.
Figure 24:
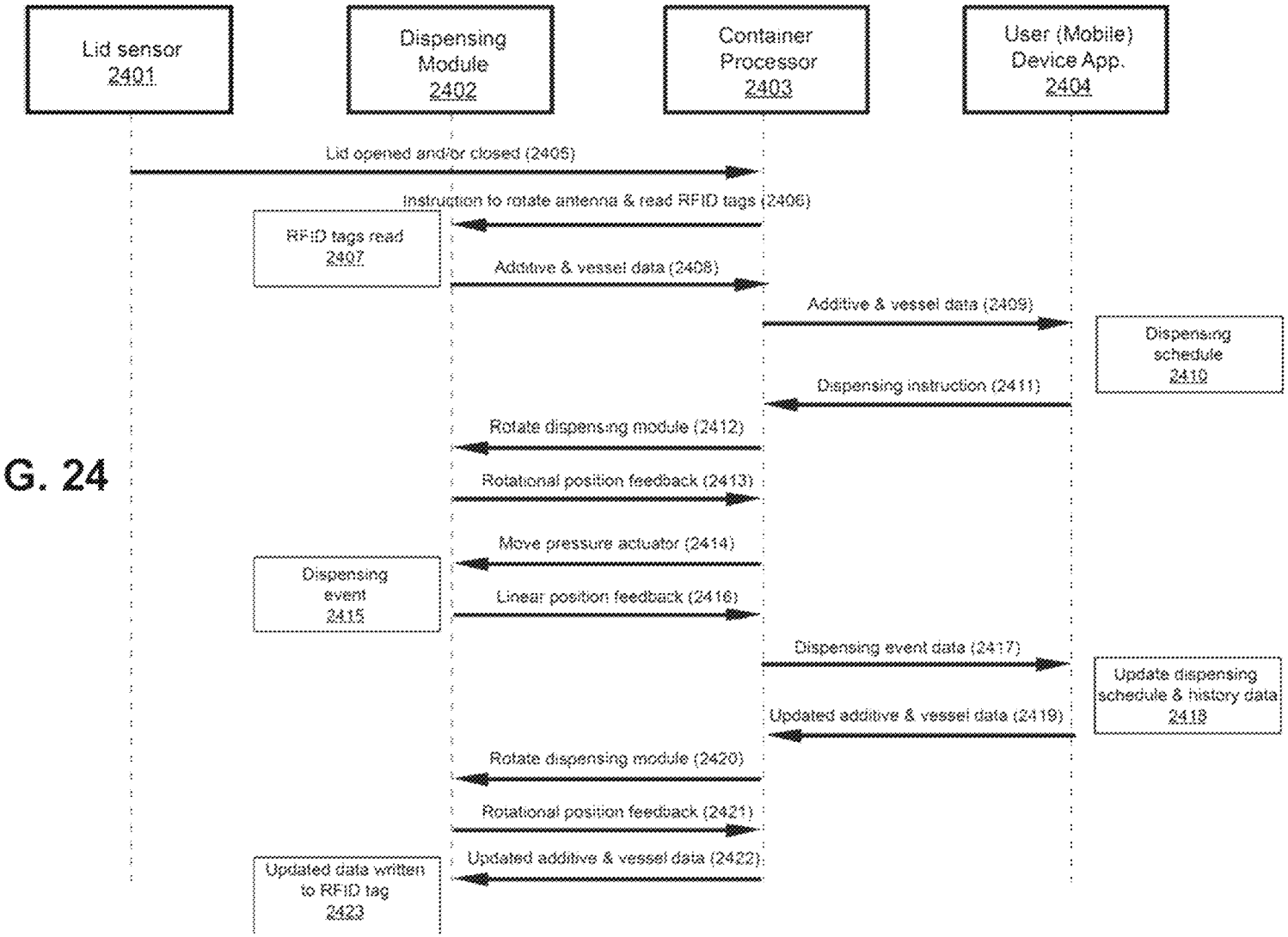
FIG. 24 is a data flow diagram illustrating example data flows between components of a hydration system and a user device in accordance with one or more embodiments described herein.

FIG. 23 is a flowchart illustrating an example process for identifying a container and accessing data about the additive contents within the container, and about a user of the container. At 2301 the system may detect that an additive vessel has an RFID tag and that the RFID antenna is sufficiently close to the tag to read the data encoded thereon. At 2302, the data may be read by the antenna and communicated to an onboard or external processor at 2303. Data about the user of the container may be further accessed at 2305 from a local storage location or from, for example, an associated network cloud, and communicated to the processor. Similarly, supplemental data about the additive in the container may additionally be accessed at 2304 from a local storage location or from the cloud and also communicated to the processor. Data from these three sources may then be used by the processor at 2306 to determine the parameters of a subsequent dispensing event. These parameters are then communicated to the dispensing module at 2307. FIG. 24 illustrates example data flows between components of a hydration system. Example data flows are shown between an application on the user's mobile device 2404, a processor within the portable hydration container assembly 2403, the dispensing module 2402, and a lid open/close sensor 2401. A lid sensor 2401 (e.g., a Hall-Effect switch) communicates to the container processor 2403 that the lid has been opened or closed (2405), the open and close event indicating a likelihood that the user has placed or replaced additive vessels in the container and/or emptied or refilled it with water or other consumable liquid. Irrespective of what change has occurred, the container processor 2403 instructs the dispensing module 2402 to rotate through 360 degrees (2406) enabling the RFID antenna to pass by and/or pause at each of the RFID tags and read the encoded data (2407) about the additives in the additive vessels. This additive data is then communicated (2408) to the container processor 2403 and may be further communicated to an application 2404 on the user's mobile device (2409). The mobile device 2404 stores and/or creates a dispensing schedule (2410) for that user based on the additive vessels loaded into the container and, at the appropriate time, communicates (2411) a dispensing instruction to the container processor. The dispensing schedule may be periodically updated or modified according to user preferences, information, context data, environmental information, and the like which may be communicated from remote storage in the cloud to the user's mobile device application 2404 or from an API to third-party applications on the user's mobile device 2404. A dispensing schedule may also be periodically adjusted based upon updated data read from an RFID tag.

In one or more embodiments of the present disclosure, in response to a dispensing instruction (2411) from the container processor 2403, a first motor rotates the dispensing module (2412) to align with the target additive vessel, and positional information determined by a rotary potentiometer is communicated (2413) back to the container processor 2403 to confirm alignment with the correct additive vessel. Concurrently or subsequently, the container processor 2403 instructs a second motor to rotate and subsequently drive a pressurizing actuator (2414) to apply compressive force to the target additive vessel thereby dispensing the vessel contents (2415) in a controlled fashion. A linear potentiometer confirms the position of the pressure actuator (2416) to the container processor 2403, enabling the processor to determine whether the actuator has moved the correct distance and maintained that position for the correct length of time in order to dispense the correct amount of additive from the vessel. Such processing may be used in the situational processing described below, for example.

The aggregated dispensing event data may then be communicated (2417) to the application on the user's mobile device 2404, and the dispensing schedule and/or dispensing history updated accordingly (2618). Updated information may then be written to the RFID tag on the vessel that was just used for dispensing. This may include information on the quantity just dispensed, the quantity of additive remaining in the additive vessel, the time/date of dispensing, the amount of consumable in the container at the time of dispensing and the like. This data may then be communicated (2419) from the user's mobile device 2404 to the container processor 2403. If this occurs immediately after a dispensing event, then it is likely that the RFID antenna is still aligned with the appropriate RFID tag and the data can be written to the tag. However, there may be dispensing events which require additives to be dispensed from more than one additive vessel, in which case the RFID antenna may not be aligned with the appropriate RFID tag and the dispensing module may need to be rotated back into the correct position (2420), that position being confirmed by the rotary potentiometer (2421), and the updated information then communicated (2422) from the container processor 2403 to the RFID antenna in the dispensing module 2402 and written to the RFID tag (2423). The system is then ready for the next dispensing instruction and/or the next lid open/close event detection.

Figure 25:
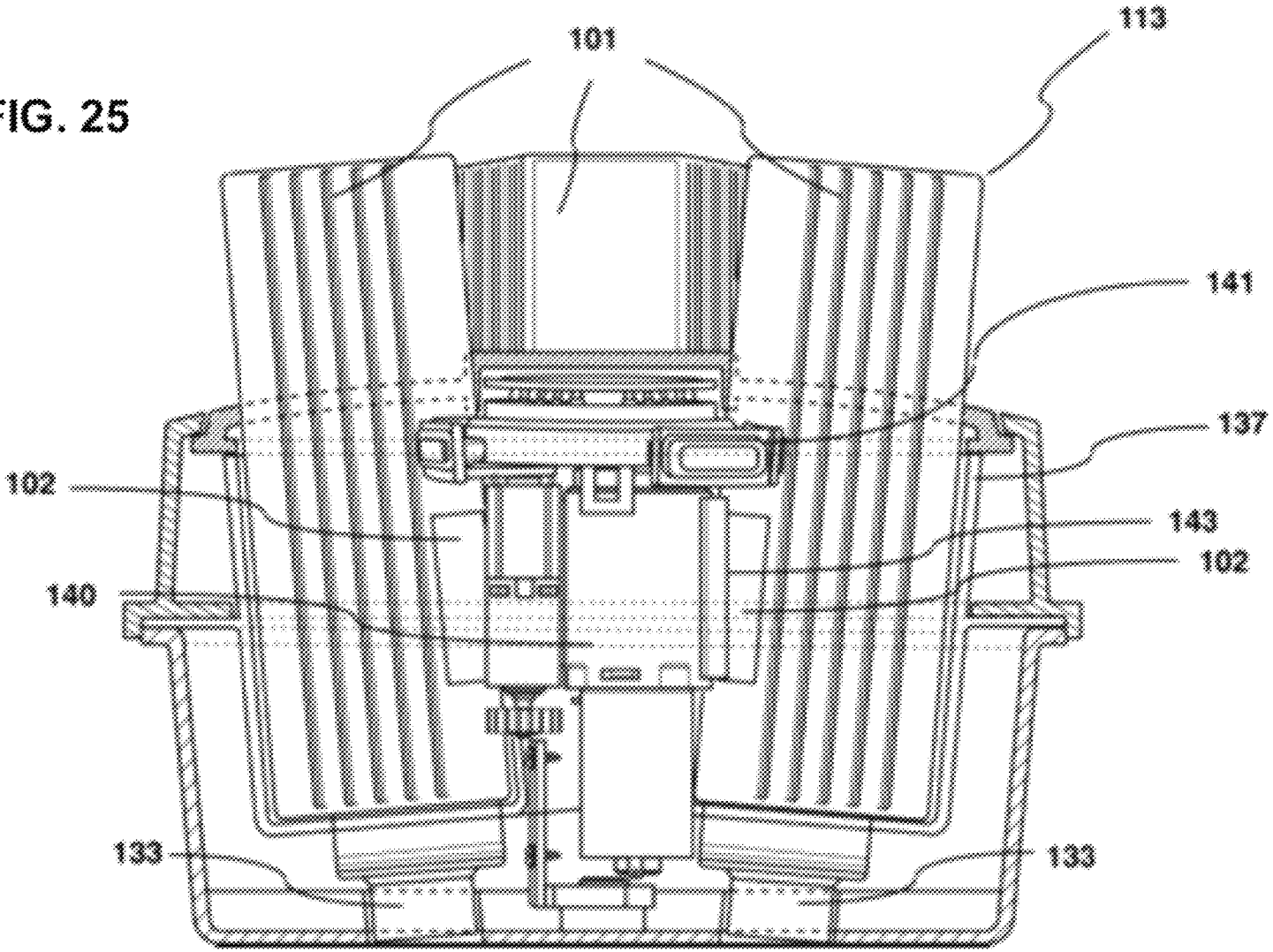
FIG. 25 is a cross-sectional view of a dispensing module assembly with additive vessels removably retained therein according to one or more embodiments described herein.

FIG. 25 shows example components that make up an apparatus of a dispensing module nest 137, in accordance with one or more embodiments. The dispensing module nest 137 comprises one or more additive vessels 101, a vessel nest or ring structure 137, providing apertures into which the multiple additive vessels can be inserted in positions chosen by the user, and a lower nest support structure. The apertures 103 serve an ancillary purpose of constraining the additive vessel in all but one axis, thereby dictating that input force operating on the additive vessel is primarily working to dispense the contents of the vessel. Furthermore, the apertures 103 dictate an orientation-specific configuration of the additive vessels, ensuring accurate placement of the vessel from both a dispensing and a data-read/write standpoint. One portion of the ring structure 137 is occupied by a drinking channel 122 which allows the consumable liquid to pass from the container through the dispensing assembly 113 to the user. Centrally positioned within the dispensing assembly is a dispensing module, equipped with one or more pressure applicators 141. In response to a signal from an onboard or external application or processor, the dispensing module moves the pressure applicator 141 into a position proximal to a selected additive vessel 101 and applies pressure to the inner surface of that additive vessel 101, to cause all or a portion of the additive therein to be controllably released through the bottom of the additive vessel 101 through the dispensing nozzle and into the consumable within the container.

Information about the contents of an additive vessel may be encoded within an RFID tag 102 or similar proximity based read/write memory system mounted on a surface, preferably the inner surface of the additive vessel 101 in close proximity to a self-indexing RFID or other appropriate receiving antenna or sensor 143, in accordance with one or more embodiments. The data tag 102 may be active but is preferably passive, requiring no power source. By identifying the additive vessel 101 within the limited readable range of the antenna 143, additionally provides locational precision and ensures that the information from only one additive vessel 101 is readable in each possible discrete antenna position, and that the antenna alignment additionally coincides with the pressure applicator 141 alignment. Therefore, a dispensing event may be applied only on the additive vessel 101 about which data is currently communicated via the RFID or similar type identification system. Therefore this acts to ensure that dispensing is applied to the correct additive vessel 101 to dispense the correct additive.

Removal and/or replacement of the lid or top portion 112 of the container 100 may be detected by a sensor. A number of alternative technologies are possible, one embodiment being a Hall Effect sensor located in the uppermost part of the consumable container and the lower part of the lid. In response to determining that the lid or top portion has been removed and/or replaced, the system may initiate a scan of the RFID tags 102 on all additive vessels 101 within the top portion of the container using the RFID antenna 143, which is rotated through 360 degrees by the dispensing module 140, thereby reading data from the RFID tags 102 mounted on the inner surface of the additive vessels 101 and communicating this data to an onboard or external application or processor.

The RFID or similar type passive tag 102 communicates information about the additives within the vessels 101 including, but not limited to, the name and/or type volume and/or amount of additive, the dosage, dosage frequency, the maximum, minimum and/or recommended volume or amount to be dispensed, usage guidelines, "use by" dates and/or other information specific to that additive vessel. The tag may additionally comprise information about the dispensing characteristics of the vessel contents, for example whether it is a liquid or powder, mass or viscosity etc. the optimum amount or range of pressure which should be applied by the pressure applicator to dispense the additive and/or the length of time or number of times that pressure should be applied to optimize dispensing of the additive. This information is communicated via the RFID or other antenna to an onboard or remote application or processor. This information is used in conjunction with additional information such as end-user taste preferences, volume of consumable in the container, previous volume/amounts and additives dispensed into the consumable liquid, when the consumable liquid container was last refilled and other information relating to the user and/or the hydration container which is not specific to an individual additive vessel.

In a further embodiment, the RFID antenna may additionally write or encode information to an RFID or similar tag mounted on an additive vessel including, as a non-limiting example, a device ID may be encoded or otherwise programmed to the additive vessel in a dynamic fashion, related to the container within which it is inserted. The device ID may be used to ensure that an additive vessel may only be used in one or a specific type of container, or by a specific user, which may be appropriate for example if the additive in the vessel consisted of, for example, pharmaceuticals and/or other controlled substances. The RFID antenna may write information on user preferences to an RFID tag on an additive vessel, for example to fine-tune the amount of an additive dispensed to the specific personal preferences of a user. It is possible for an additive vessel to be removed from the dispensing assembly and be replaced therein at a later time, this is possible even after one or more dispensing actions have been performed on the vessel, unlike many other approaches known in the art which, after initial puncturing and use, cannot be re-used in a second container or device. This also enables an additive vessel to be transferred to a second dispensing module assembly in a different container, in which case this information can then be transferred along with the additive vessel, for example information about the amount previously dispensed during the period of time that the additive vessel was inserted in a first container or an ID code representing the user of the first container, user preferences and the like.

Figure 26:
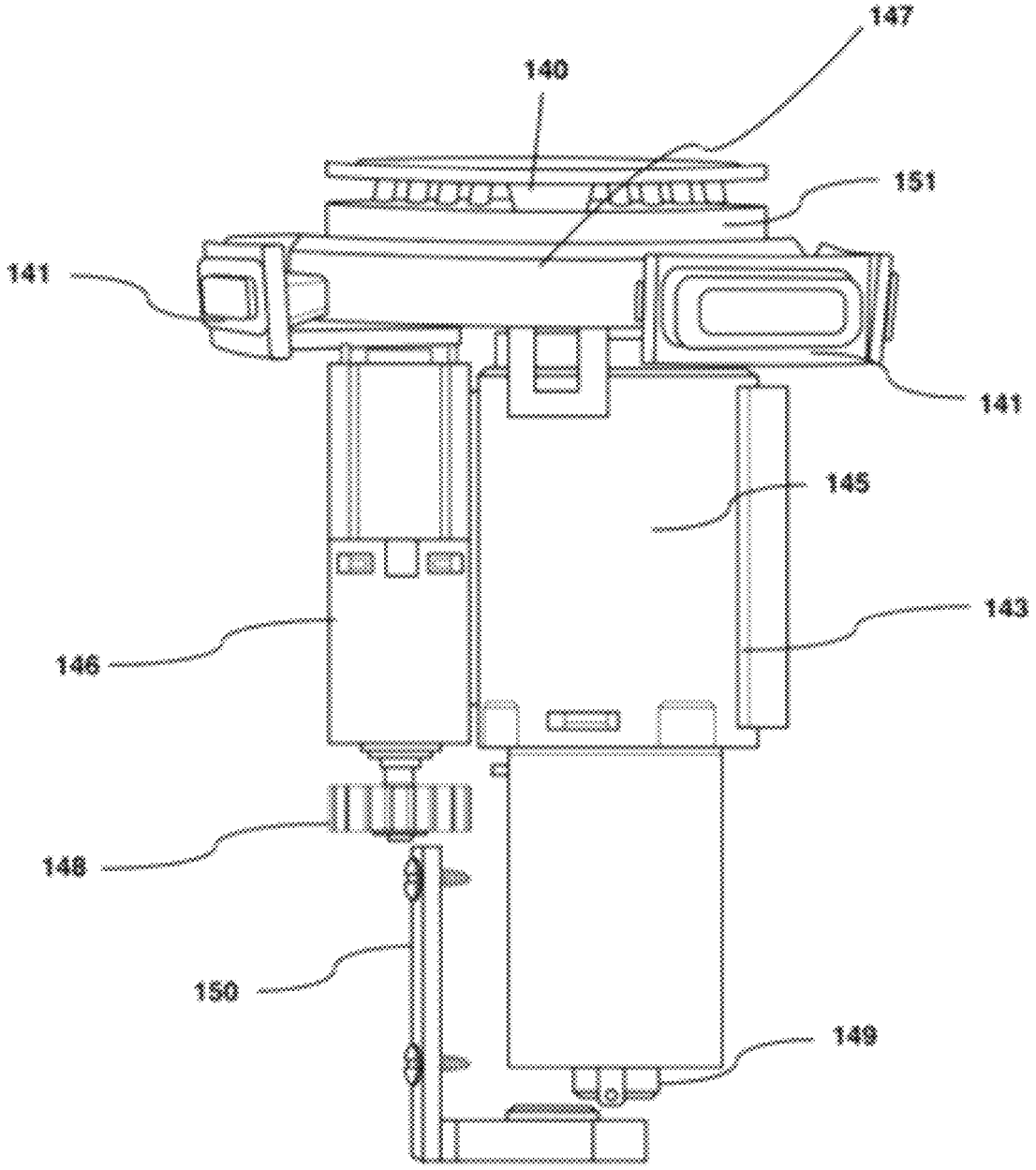
FIG. 26 is an elevational view of a dispensing module according to one or more embodiments described herein.

A dispensing assembly 140 may be centrally positioned and configured to rotate around a central axis to apply mechanical pressure to the correct additive vessel 101. As the dispensing assembly 140 rotates to position the pressure applicator 141, an RFID antenna 143 also rotates so that it is positioned proximal to the RFID tag 102 on the correct additive vessel 101. In accordance with at least one embodiment, the RFID antenna 143 may be designed to have a very limited angle and/or range of read visibility such that it is able to read an RFID tag 102 only if the tag is within a close range to the antenna 143. In this way the method ensures that the pressure applicator 141 is acting on the correct additive vessel 101 since the antenna 143 is unable to detect or read neighboring or adjacent tags that may be located on either side of the correct tag. In accordance with one or more embodiments, when one or more additive vessels are initially inserted into a consumable container, this insertion is detected by a sensor system and the dispensing assembly 140 may rotate through, for example, 360 degrees to scan and read the RFID tags of each vessel newly inserted (as well as previously inserted) to identify what additive vessels and therefore what additives, are in what aperture. The data read from the RFID tags may be stored (e.g., in a memory of the dispensing module or some other component of the container) for future reference. The dispensing assembly fits into a base 144 which retains and positions the additive vessels such that the RFID tags are reliably in alignment with the RFID antenna in accordance with the aforementioned. FIG. 26 shows an illustrative example of a dispensing module 140, the functions of which include rotating the RFID antenna 143 to align with and read the RFID tags on the additive vessels, rotating the pressure applicator(s) 141 to align with the appropriate additive vessel, and providing the physical movement and force required for the pressure applicator 141 to dispense the appropriate amount of additive from the target additive vessel.

In accordance with at least one embodiment, the dispensing module 140 comprises two DC electric motors 145 and 146. A first dispensing motor 145 operates via a planetary-gear drivetrain mated to a rack-and-pinion mechanism 147 to provide controllably linear motion to the pressure applicator(s) 141, the linear motion of which applies pressure to a surface, preferably the inner surface of an additive vessel (e.g., additive vessel 101 as shown in FIG. 1) to release controllably variable amounts of the additive. A second indexing motor 146 operates using a spur-gear mated to a ring-gear 153 (FIG. 27) to enable axial rotation of the dispensing module 140 to achieve alignment of the pressure applicator 141 with an additive vessel. The indexing motor 146 also makes use of a planetary-gear drivetrain 148, thus facilitating much greater passive holding-force to maintain axial position even in a non-powered state, and furthermore, providing for reliable speed reduction facilitating more precise axial positioning. Inner gear 153 may operate within a fixed outer circumferential ring-gear (not shown) such that the outer gear remains stationary relative to the container and the dispensing module rotates within it. In other words, the additive vessels remain stationary and the dispensing module 140 rotates to align itself with the correct vessel. One having ordinary skill in the art will understand that the aforementioned relationship of a stationary retaining body with a dynamic dispensing module could be readily modified to accommodate an inverse relationship between the two general components, whereby the retaining body dynamically rotates and the dispensing module remains in place.

Additionally, a rotary potentiometer 149 is mounted underneath the dispensing module 140, beneath motor 145, and provides axial position information to confirm that the correct additive vessel is being acted upon, while circuit board 150 provides the logic and control for both the indexing motor 146 and the dispensing motor 145, and also houses, in accordance with at least one embodiment, the RFID processing unit (read/write/broadcast.) Similarly, a linear graphite potentiometer 151 (FIG. 26) is mounted within the top portion of the dispensing module 140 to measure and monitor the linear motion of the pressure applicator/actuator 141. This positional information is used to provide feedback to the container processor and/or an application on the user's mobile device, about the linear distance through which the pressure applicator 141 has moved in order to confirm that the correct amount of pressure has been applied and to further enhance the accuracy of additive dispensing.

Figure 27:
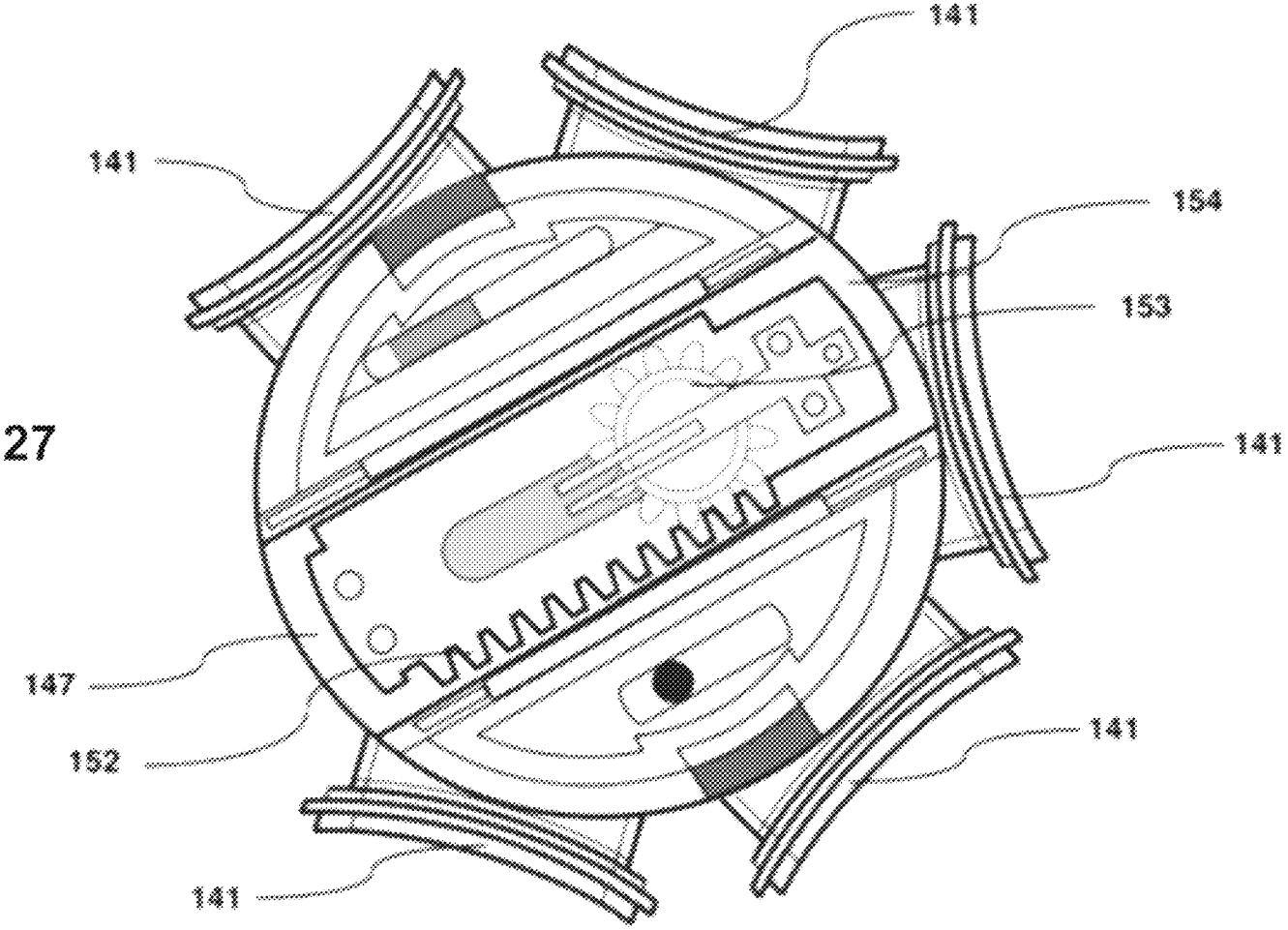
FIG. 27 is a top view of the dispensing module shown in FIG. 26, including a pressure applicator rack and pinion mechanism according to one or more embodiments described herein.

FIG. 27 shows a plan view of a rack and pinion assembly 147 which, in accordance with at least some embodiments of the present disclosure, moves in a linear manner and applies force to a pressure applicator 141 that further applies pressure to the wall of an additive vessel 101. The rack-and-pinion assembly 147 comprises a rack 152 on an inner wall and a gear 153 engaged with the rack 152. When the gear 153 is rotated by the electric motor (e.g., dispensing motor 145) in a counterclockwise direction, it moves the rack 152 and the rack-assembly outward. The rack and pinion mechanism 147 is also rotated into position axially to align with a pressure applicator 141 and additive vessel. Movement of the rack and pinion assembly 147 applies force to the pressure applicators 141 via a surface 154. Five pressure applicators 141 are shown in FIG. 27, consistent with the number of additive vessels in at least one embodiment. However, it should be understood that a greater or lesser number of pressure applicators 141 is also possible. The pressure applicators 141 may be manufactured of a flexible material, enabling expansion when force is applied to the surface 154 and subsequent recovery to a first position when the gear 153 is rotated clockwise and the rack and pinion assembly 147 moves back to its original position.

Figure 28:
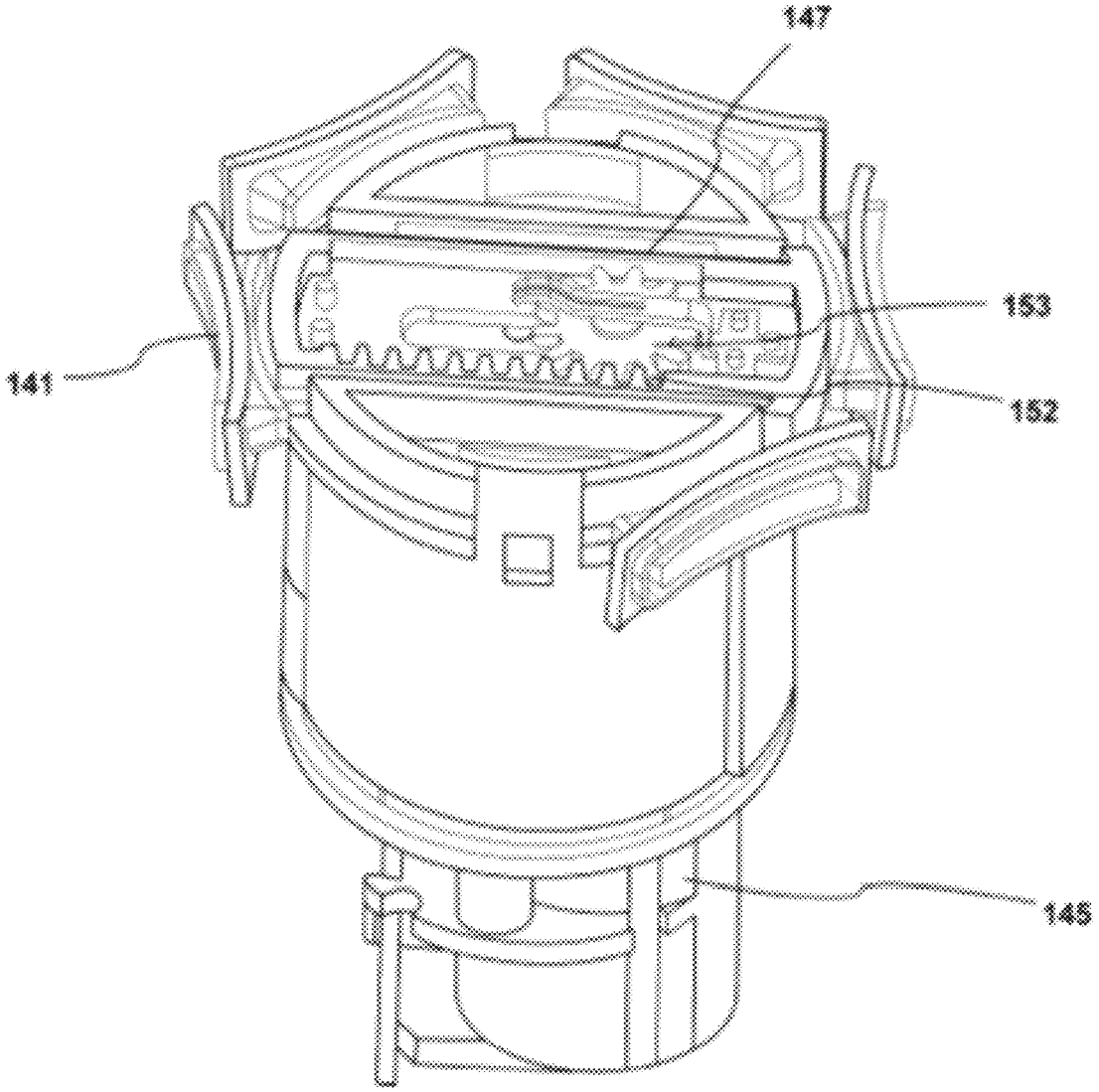
FIG. 28 is a perspective view of the dispensing module shown in FIG. 26 according to one or more embodiments described herein.

A further view of the apparatus for pressure application, the measurement of that pressure application, and monitoring using a linear potentiometer, in accordance with one or more embodiments, is shown in FIG. 28. The motor 145 rotates a circular gear 153 which rotates and moves a linear rack 152 outward from the central axis of the dispensing module 140. The rack unit 152 further applies pressure to an additive vessel (e.g., additive vessel 101) via a pressure applicator 141. Thus, varying the degree of rotation of the circular gear 153 will vary the linear distance moved by the rack 152 and consequently the amount of pressure applied to the additive vessel 101 by the pressure applicator 141. An electrical signal is communicated from or through the linear potentiometer 151 to a processor to determine the distance through which the rack 152 has moved, and length of time that the rack 152 is in a position whereby it would cause the pressure applicator 141 to apply pressure to an additive vessel. This electrical signal is communicated to the container processor 156 and/or an application or processor in the user's mobile device.

Figure 29:
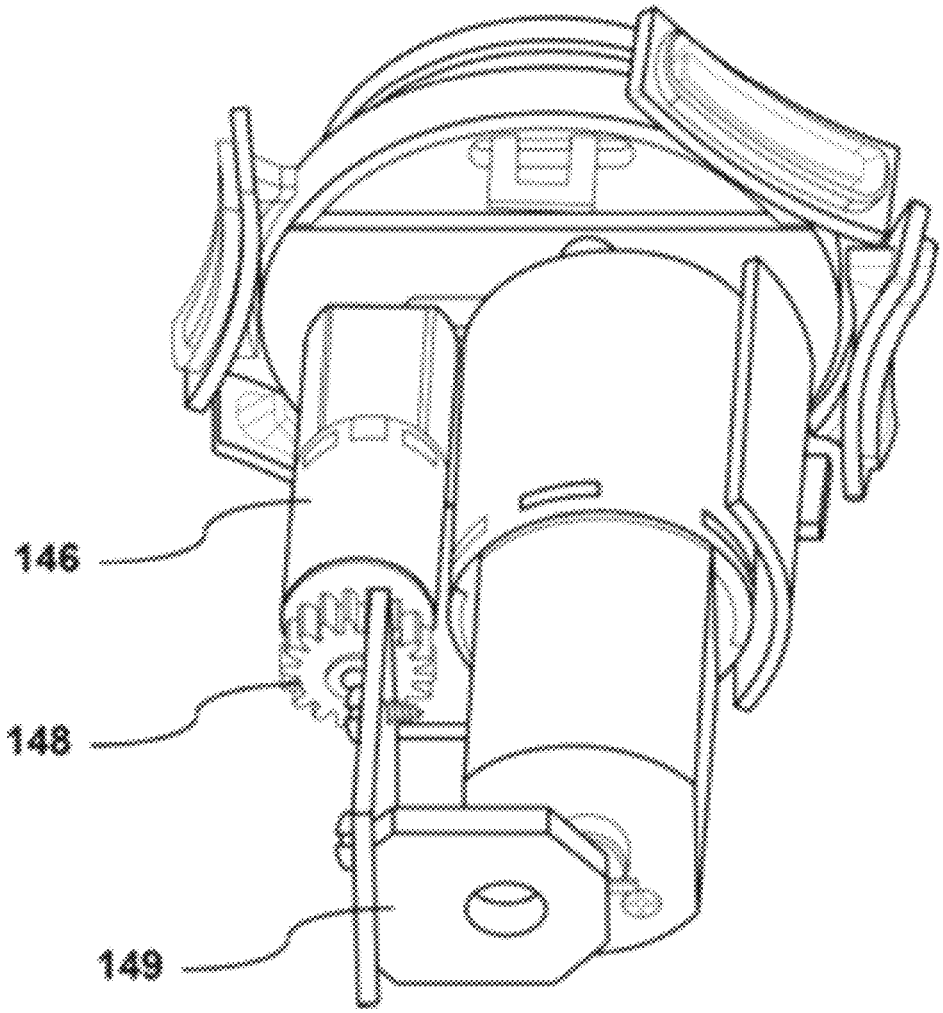
FIG. 29 is a bottom perspective view of the dispensing module shown in FIG. 26, including a dispensing motor and mechanism according to one or more embodiments described herein.

A further view of the apparatus for measuring and controlling the rotational position of the pressure applicator (and RFID antenna), in accordance with one or more embodiments, is shown in FIG. 29, where the motor 146 rotates a spur-gear 148 rotating within the inner circumference of a ring-gear (not shown). A continuous rotary potentiometer 149 moves relative to the container and an electrical signal is communicated from or through the continuous rotary potentiometer 149 to indicate the rotational/axial position relative to the container or the rotational/axial displacement/difference from a previous position. This communicates a signal to the processor to indicate and/or confirm the exact rotational position of the dispensing module 140 and the length of time that the dispensing module 140 is aligned with an additive vessel (e.g., additive vessel 101). The processor furthermore combines the electrical signal data indicating position, from both the linear and rotary potentiometers (151, 149) to determine whether the dispensing module 140 is actively operating on an additive vessel or whether it is "parked" adjacent to it. In accordance with at least one embodiment, the indexing mechanism orients the dispensing mechanism to a "home-point" relative to the housing after each cycle or set of cycles, so as to reduce the significance of cumulative error on the indexing component/s (e.g., the rotary potentiometer mechanism 149), furthermore, in an alternate preferred embodiment, a redundant/supplementary/complementary mechanism might be employed to verify the successful alignment of the "home-point."

Figure 30:
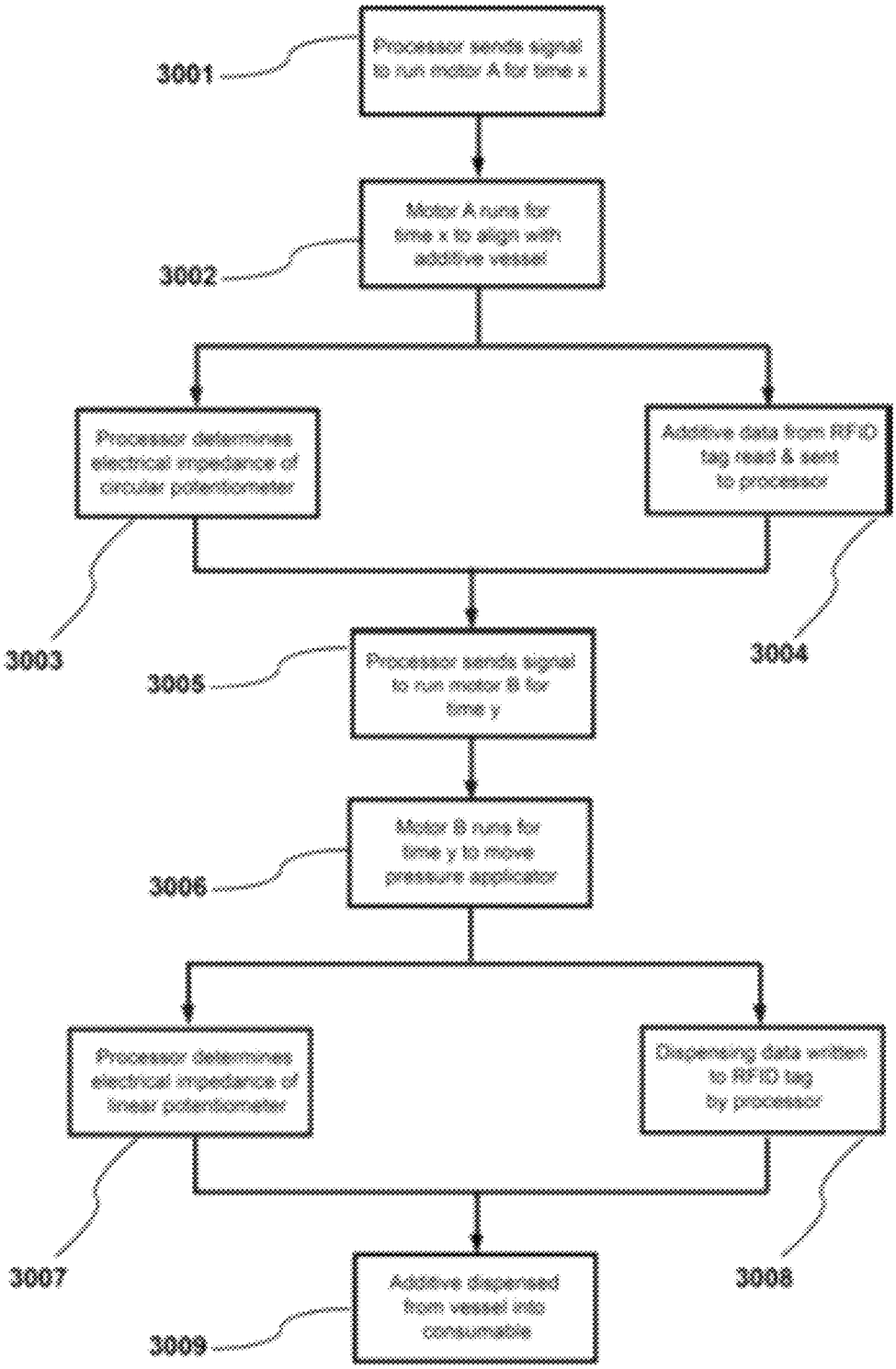
FIG. 30 is a flowchart illustrating an example process for controllably releasing a quantity of an additive according to one or more embodiments described herein.

An example method whereby the above described apparatus operates to achieve the controlled release of a substance is shown in FIG. 30. At 3001, a processor sends a signal to a first motor (e.g., motor 145) to operate for the specific time period required (e.g., "x" seconds, where "x" is an arbitrary number) to rotate the dispensing module (e.g., dispensing module 140) from its current position to the new position needed to align with the appropriate additive vessel (e.g., additive vessel 101). At 3002, the motor operates and rotates the dispensing module, and thus activates the active components of the rotary potentiometer that is a part of the module, and subsequently encodes axial position. At 3003, the electrical impedance of the potentiometer is determined by the processor to confirm that the dispensing module is aligned with the correct additive vessel. If the actuator/pressure-applicator is aligned with the correct additive vessel, then the RFID antenna will also be aligned with the same correct vessel by default. Therefore, at 3004, the system may additionally confirm that the correct additive vessel is aligned by reading the data from the RFID tag on the additive vessel and comparing this data with that previously stored in, or accessible by the processor. Having confirmed that the actuator/pressure-applicator is aligned with the correct additive vessel, at 3005, the processor may then send a signal to a second motor to operate for the specific time required (e.g., "y" seconds, where "y" is an arbitrary number that may or may not be different from "x") to move the rack and, as a result, move the pressure applicator to a position whereby it is applying pressure to the wall of the additive vessel, at 3006. The signal to a second motor may additionally include data on the length of time that the pressure applicator should remain in its pressure applying position before retracting back to a position of rest and/or the number of times that pressure may be applied and/or an oscillation frequency which may be used, for example to agitate a powder additive stored in the additive vessel prior to or subsequent to a dispensing event.

At 3007, the electrical impedance of the linear potentiometer which is part of the dispensing module is determined by the processor in order to confirm that the actuator/pressure-applicator has moved the correct linear distance to apply sufficient pressure to the additive vessel and to dispense additive at 3009. During or subsequent to a dispensing event, the system may additionally write data to the RFID tag on the additive vessel at 3008, including but not limited to data about the dispensing event that has just taken place. Such data may include the date/time and quantity of additive dispensed, a container and/or user identifier and the like.

Figure 31:
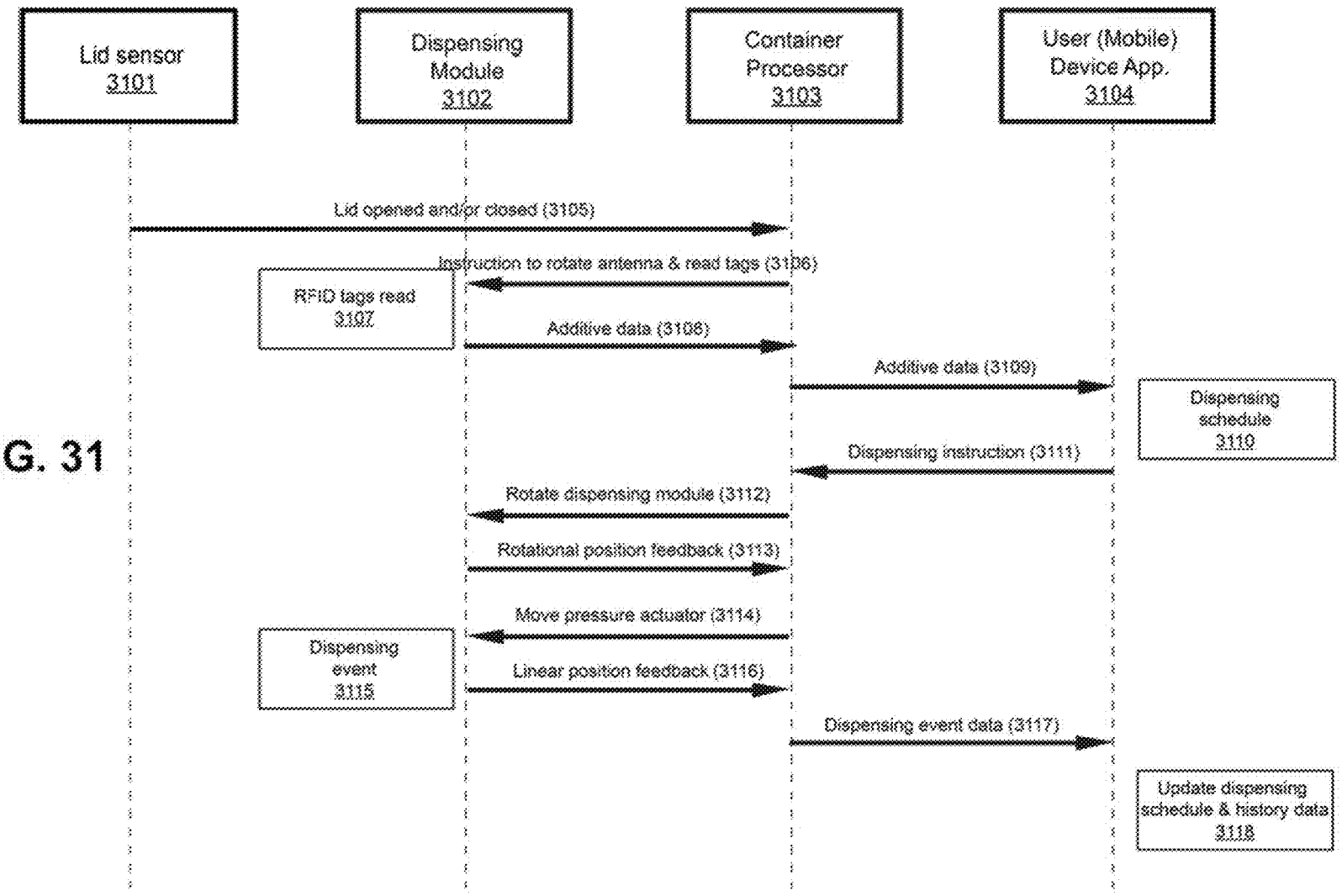
FIG. 31 is a data flow diagram illustrating example data flows between components of a hydration system according to one or more embodiments described herein.

FIG. 31 shows a data flow diagram illustrating example data flows between components of a dispensing module within a hydration system during a dispensing event in accordance with one or more embodiments described herein. Example data flows are shown between an application 3104 on the user's mobile device, a processor 3103 within the hydration container, the dispensing module 3102 and a lid open/close sensor 3101.

The lid or top of the hydration container may be fitted with a sensor to determine when the lid has been opened or closed. The lid sensor 3101, which may be, for example, a Hall-Effect switch, communicates to the container processor 3103 that the lid has been opened or closed (3105), the open and close event indicating a likelihood that the user has placed or replaced additive vessels in the container and/or emptied or refilled the hydration container with water or other consumable liquid. Irrespective of what change has occurred, the container processor 3103 instructs the dispensing module 3102 to rotate through 360 degrees (3106) enabling for an RFID antenna to pass, or pause, by each of the additive vessel apertures, and thus the RFID tags affixed to the additive vessels, and read the encoded data (3107) about the additives in the additive vessels, whereby any changes in contents and/or position would be saved and/or updated to local and/or peripheral memory systems to guide dispensing actions. This additive data is then communicated (3108) to the container processor 3103 and may be further communicated (3109) to an application on the user's mobile device 3104.

The application 3104 installed on the user's mobile device stores or creates a dispensing schedule (3110) for that user based on the additive vessels loaded into the container and, at the appropriate time, communicates a dispensing instruction (3111) to the container processor 3103. The dispensing schedule may be periodically updated or modified according to, for example, user preferences, contextual data, environmental information, previous dispensing data, and the like, which may be communicated from remote storage in the cloud to the user's mobile device application 3104 or from an API to third-party applications on the user's mobile device, or from the container to the user's mobile device.

Figure 32:
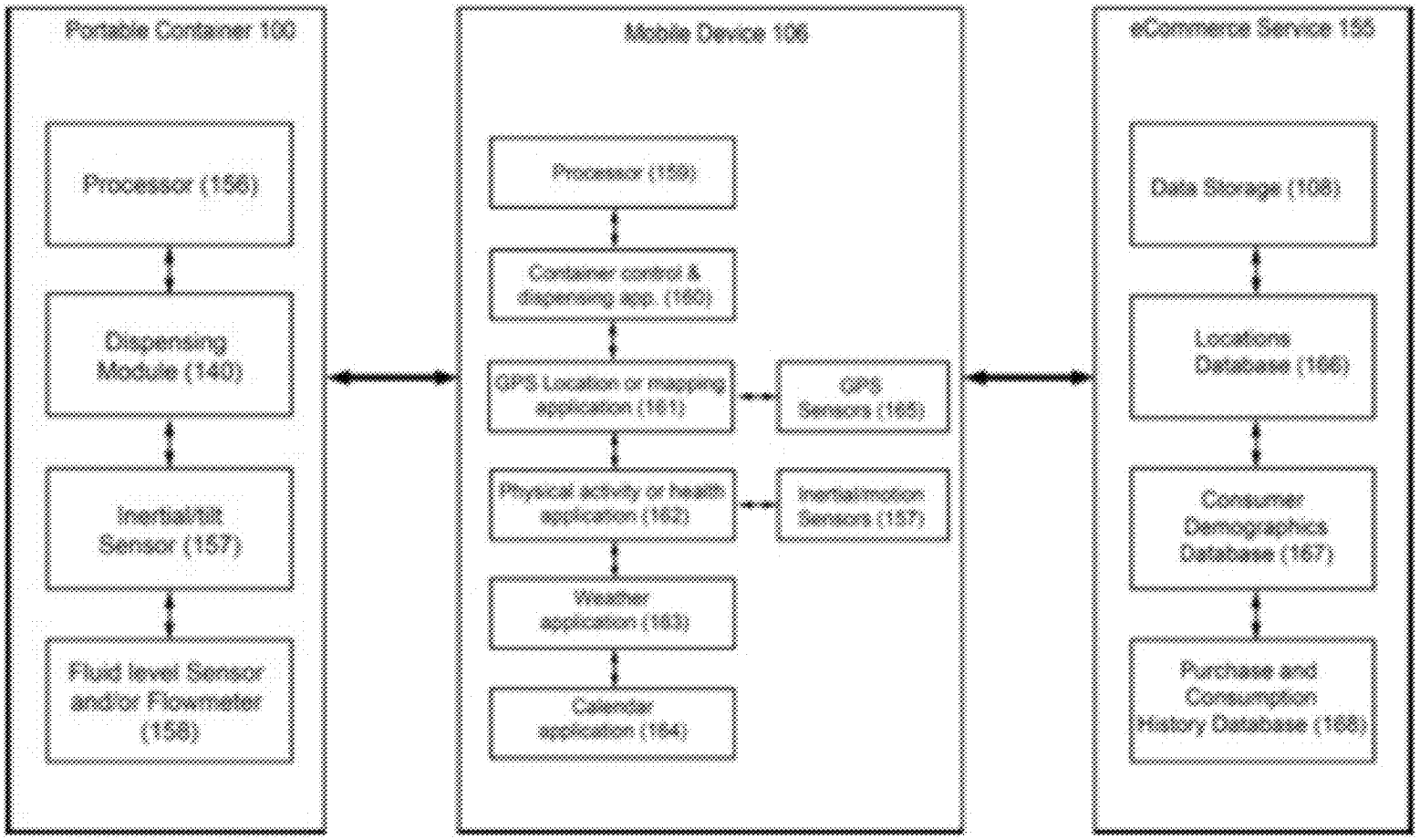
FIG. 32 is a block diagram illustrating an example system for obtaining and using contextual data according to one or more embodiments described herein.

In response to a dispensing instruction (3111) from the container processor (3103), a first motor (of the dispensing module 3102) rotates the dispensing module (3112) to align with the correct additive vessel, and positional information determined by a rotary potentiometer (of the dispensing module 3102) is communicated (3113) back to the container processor 3103 to confirm alignment with the correct additive vessel. Concurrently or subsequently, the container processor 3103 instructs a second motor (of the dispensing module 3102) to rotate and move the pressure actuator linearly (3114) via a rack and pinion mechanism (of the dispensing module 3102) to apply pressure to that additive vessel thereby dispensing the vessel contents (3115). The linear potentiometer (of the dispensing module 3102) confirms the position of the pressure actuator (3116) to the container processor 3103. The container processor 3103 is thereby enabled to determine whether the actuator has moved the correct distance and maintained that position for the correct length of time in order to dispense the correct amount of additive from the vessel. The aggregated dispensing event data may then be communicated (3117) to the application on the user's mobile device 3104 and the dispensing schedule and/or dispensing history updated accordingly (3118). The system is then ready for the next dispensing instruction and/or the next lid open/close event detection. FIG. 32 shows example apparatus, systems, and applications for leveraging context data in accordance with one or more embodiments described herein. A portable hydration container 100 includes a processor 156, a dispensing module 140, inertial and/or tilt sensors 157, and one or more fluid or liquid level sensor 158 and/or flowmeter. The inertial and/or tilt sensors 157 function to detect when the container 100 is tilted, and the level sensors 158 function to detect a change in fluid or beverage level in the container 100. The container 100 may also include a processor 156 and communications device or apparatus to connect to a user's mobile device 106. The user's mobile device 106 may be in two-way wireless communication with the portable hydration container 100 and may include a processor 159 and one or more of the following applications: a GPS location and/or mapping application 161 that uses GPS sensors 165 to determine a location of the user and/or speed of motion; a physical activity application 162 or the like to determine the user's current or previous levels of physical activity such as number of steps taken within a certain time period; a weather application 163 to determine the ambient environmental conditions at a location of the user; and a calendar application 164 to determine the past and future locations and/or activities of the user. The mobile device 106 may also be equipped with inertial/motion sensors 157 to provide the motion data required by a physical activity application 162 and may furnish this data directly to a processor 156 within the portable hydration container 100, or to another application on the mobile device 106 that controls or otherwise communicates with the hydration container 100. Similar data may also be obtained from websites or services using the cellular communications capabilities of the mobile device 106, or via Wi-Fi.

Figure 33:
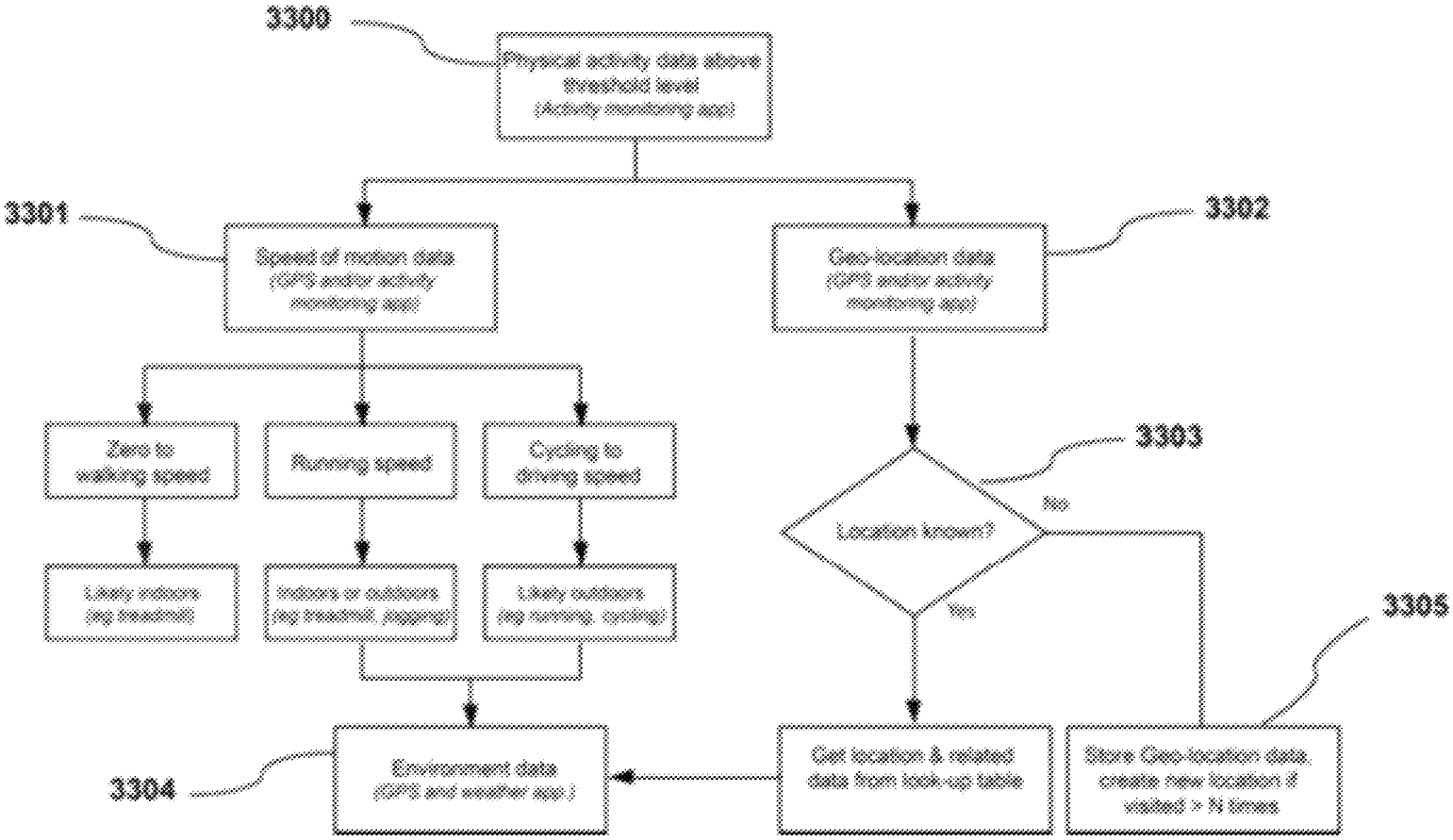
FIG. 33 is a flowchart illustrating an example process for obtaining environmental and contextual data about a user of a portable container according to one or more embodiments described herein.

Some example use cases for the leveraging of context data (as shown in FIG. 32 and described above) are described in the following with reference to FIG. 33. The number of steps taken in a day or week or other time period along with speed of motion data derived from an activity application such as, for example, "MapMyRun", may indicate that a user's level of physical activity has passed above a pre-defined threshold (at 3300), which may suggest that the user is probably exercising. Data on the speed of linear motion of the user can be derived (at 3301) from this and/or from GPS data (at 3302) to provide an estimation of the user's activity and location. For example, if data indicates that the user is at approximately a typical human running speed, the user could be either indoors or outdoors. The GPS data from the user's mobile device 106 might indicate, for example, that the user is at a previously unknown location, at 3303. If there is no mapping data to suggest that the user is at a specific address or building, then it might be inferred that the user is outdoors and environmental data relating to this specific location, such as weather data can be accessed at 3304. Such data may indicate that it is currently 90 degrees Fahrenheit and 90% relative humidity at the location. Depending on how many times it has been determined that the user is at the specific location, location data may be stored at 3305. Further, in at least one embodiment, such data may be processed and translated into dispensing modifications and/or consumption directives, such as increased electrolyte dispensing, combined with higher frequency drinking of the water/electrolyte post-mix beverage.

In the manner described above, it can be determined how far the user has run, at what speed and in what environmental (weather) conditions, therefore it is possible to infer the degree of dehydration of the user. When the activity application 162 determines that the user has paused or stopped running, then a recommendation may be presented to the user about the quantity of water the user should consume, and within what time-period, in order to appropriately re-hydrate. Appropriate additives may additionally be dispensed into the water after the exercise, and if those additives (stored in additive vessels) are not currently inserted in the container, then it might be recommended to the user that they consume them when they next get home. Since the GPS and/or mapping application can also determine when the user is next at home, then a further reminder can be displayed to the user at that time. Such a reminder may be presented via a visual and/or auditory display on the hydration container, and/or via a visual and/or auditory display on the user's mobile device. In accordance with at least one embodiment, since the eCommerce system of the present disclosure also stores data on what additive vessels a user has previously purchased, the process can avoid recommending additives that the user does not have, but may recommend instead that those additives be added to the shopping cart for later purchase from the eCommerce service.

In another example, steps and activity data from a mobile device activity application such as "MapMyRun" or a wearable fitness device such as "Fitbit" at 3301 may suggest that a user is jogging. However, GPS data associated with the user's mobile device 106 may indicate that the user is stationary, which would suggest that the user is likely to be jogging on a treadmill, and therefore most likely to be indoors (and likely therefore to be at typical room temperature of about 70 degrees Fahrenheit).

If there is no known address associated with a GPS location, then the data may be further leveraged to derive an address and this address can then be further used to determine the type of location (e.g., home, gym, hotel fitness-room, yoga studio, etc.). The application (e.g., physical activity application 162) may enable a user to specify (e.g., in the settings part of the application) a preferred criterion whereby a frequently visited location may become defined as a "favorite place" and, if that address is visited more than that specified number of occasions within a certain time period then it may be automatically defined and stored as a "favorite place" at 3305. When the activity application 162 determines that the user has stopped jogging, then a recommendation may be presented to the user about the quantity of water the user should drink, and within what time-period, in order to appropriately re-hydrate. Appropriate additives may additionally be dispensed into the water after the exercise.

In accordance with at least one embodiment, addresses and geo-codes may be stored as "frequently visited places," the user being able to type in descriptive names for these favorite places (e.g., home, gym, office, pub) or to approve/change suggested names that may be automatically generated from web-crawling using the geo-location data or from APIs to other applications. Once stored, the system can associate general activity levels with each location (which might be, for example mostly jogging and cycling when in "gym" location, little activity and some walking when in "office" location, almost no activity when in "pub" location, etc.). This data can be used to anticipate what additives a user might wish to insert in the container in the morning for consumption during the day. For example, a user's calendar application might say "gym" at 8 am, and previous activity data corresponding to that location indicates a generally high level of expected physical activity. Other data associated with that location may include the additives that the user tends to insert and consume before going to the gym. The system may determine that there may be a more appropriate mix of additives for the user, given the levels of activity that the user undertakes at the gym. Consequently, the personal recommendations may be on two levels—a recommendation for today only (based on the additives that the user currently has) and for the future (recommending what additives the user should purchase in the future).

In another example, text in the user's calendar application 164 may include the word "flight" or "travel" and/or a meeting notice in the calendar application may give an exact or approximate location of a meeting, for example. Furthermore, the GPS data may determine that he is presently 3000 miles away from the location he was at 12 hours previously, it is therefore likely that he has flown from city A to city B. It might further be determined from this location data that these locations are 6 time-zones apart. Given that approximate start/end times can be derived from the GPS data and the time zones are known, it will be possible for a specific combination of additives to be recommended and/or a specific dispensing schedule generated, in order to help address jet lag and/or general exhaustion in the days following the user's arrival at the second destination.

Additional dynamic user lifestyle context data may also be obtained from friends and connections such as might be determined from social networking sites such as Facebook, LinkedIn and the like, and also from semantic mining of email and text messages on the mobile device.

Figure 34:
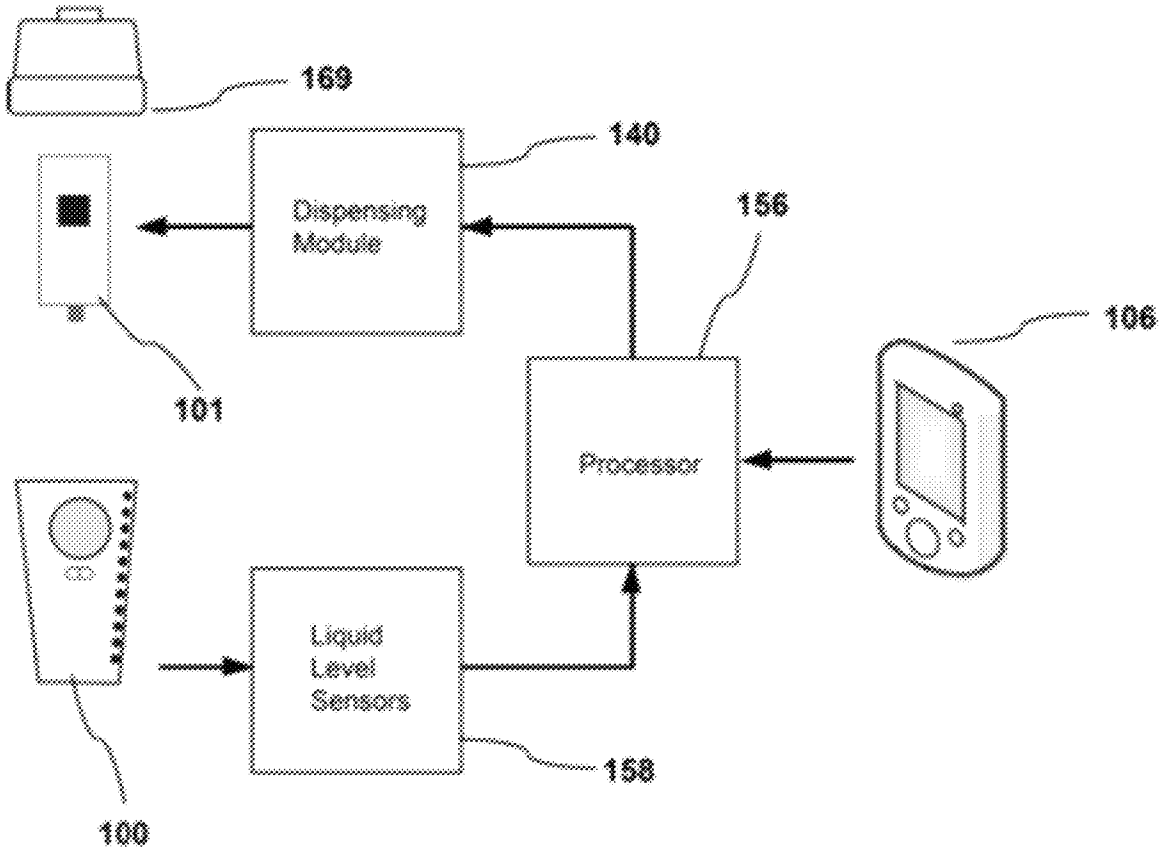
FIG. 34 is a block diagram illustrating example data communications between components of a hydration system according to one or more embodiments described herein.

FIG. 34 shows a summary block diagram of the system, in which a processor 156 (which may be disposed within the container assembly 100) receives a signal, either directly or from a user's mobile device 106, to dispense an additive from an additive vessel 101 into the container assembly 100. One or more liquid level sensors 158 in the container assembly 100 measure the liquid level and the level data is communicated to processor 156 which then determines the amount of additive to be dispensed to achieve a correct level of concentration. The processor 156 further determines action to dispense a correct amount of additive, and communicates this to the dispensing module 140.

Figure 35:
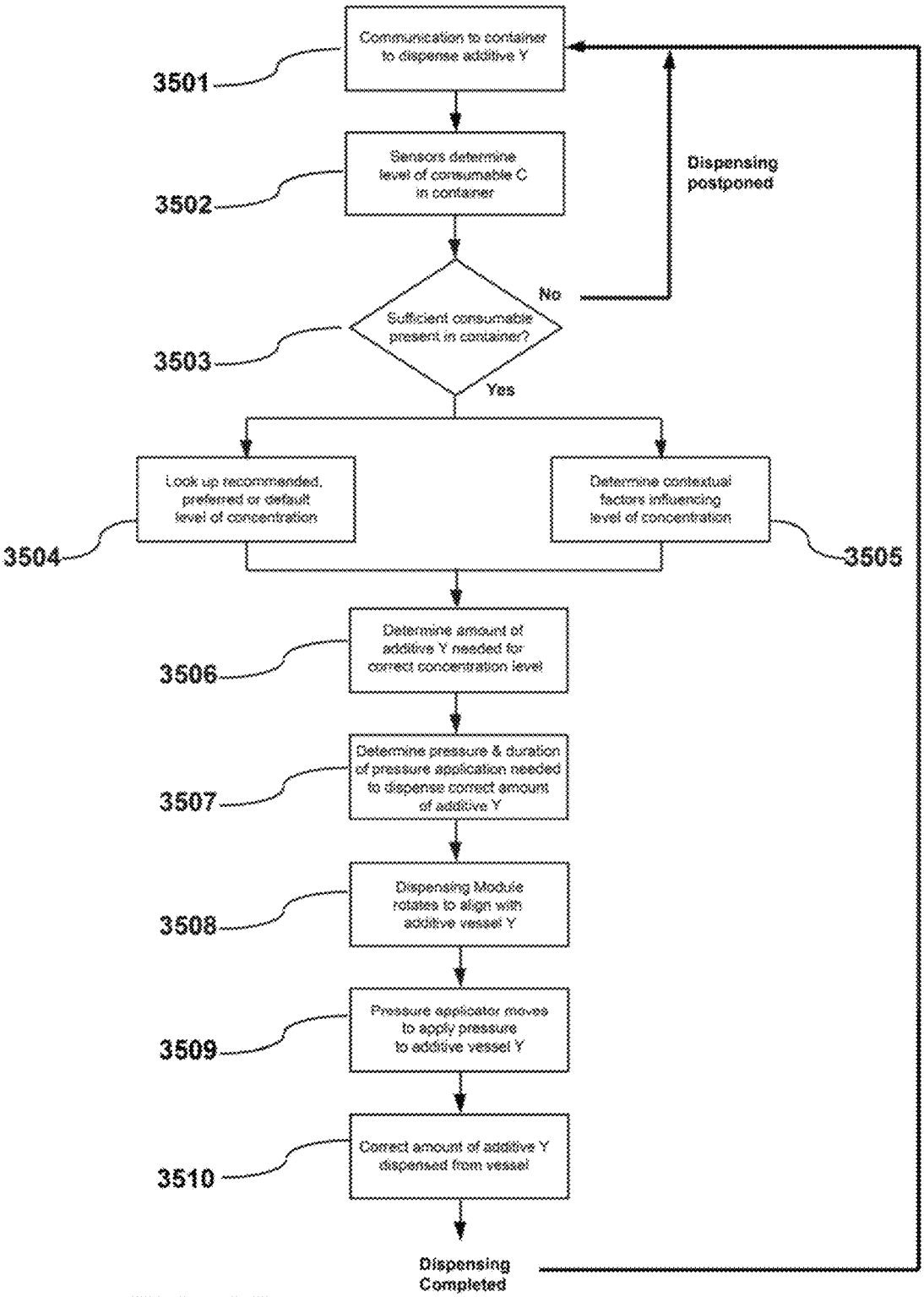
FIG. 35 is a flowchart illustrating an example process for determining a level of a consumable liquid and adjusting an amount of additive dispensed into the consumable liquid according to one or more embodiments described herein.

FIG. 35 shows an example process for controlling (e.g., adjusting, varying, etc.) an amount (e.g., quantity) of additive dispensed into a consumable liquid (e.g., stored in a container assembly) based on a consumable liquid level of the consumable liquid. In at least one embodiment, the consumable liquid level of the consumable liquid may be determined by a level sensor or level sensing device of the container assembly.

In at least one embodiment, the controlling of the dispensing of the additive may also be based on one or more contextual factors. At 3501, a communication is received by the container (e.g., container processor 156) to dispense an additive Y into the consumable liquid (e.g., substrate) stored in the container assembly. For example, the additive may be a cherry flavoring which should ideally be at a concentration of 1 drop per 50 ml of water. At 3502, a level sensor (e.g., an infrared, capacitive level sensing array) disposed in the container assembly may determine the level of consumable C stored in the container assembly, and communicate that level to the processor to determine (at 3503) whether there is sufficient consumable liquid (water, alcohol, and the like) present for the dispensing event to take place. If it is determined that the level of the consumable liquid is zero, or below a pre-defined threshold level (at 3503), then dispensing may be cancelled, postponed, or otherwise modified until such time as the container is fully or partially refilled, at which time the process may re-commence at 3501. It should be noted that in at least one embodiment, the container assembly is equipped with a sensor to detect when the top of the container assembly is removed for refilling. When such a detection is made, the process may repeat at 3501.

If sensors detect the presence of a consumable liquid, the level of liquid is measured and the volume of liquid can then be determined from the known and fixed dimensions of the container. If there is sufficient consumable present, then the amount of additive needed to achieve a targeted level of concentration is determined at step 3504. The processor may additionally access dynamic, historic, or profile-level data about the user of the container and their personal preferences in order to adjust a recommended concentration level upward or downward according to the user's taste or based on other contextual data, consequently the level of concentration may be further adjusted based on contextual factors such as time of day, user activity levels, user preferences, environmental conditions (temperature, humidity etc.), location, previously consumed food, previously consumed beverages, previously consumed supplements, and the like, at step 3505. For example it may be determined that there is 250 ml of liquid in the container therefore 5 drops of cherry flavor are needed. It may also determine that the user has a preference for a stronger flavor which may increase this to 6 drops. Contextual data (e.g. from a 3rd party application) may indicate that the temperature and humidity are very high and therefore a greater level of hydration and lower concentration may be appropriate at this time, which may adjust this downwards to 5.5 drops. In this way the processor determines at 3506, the appropriate amount of additive Y to be dispensed in order to achieve the targeted level of concentration. The method further determines the amount of pressure and the length of time that pressure needs to be applied to the additive vessel (e.g. in order to dispense exactly 5.5 drops of flavoring) at step 3507. This may, within the same step 3507, be defined or communicated to the dispensing module in the form of a linear distance through which a pressure applicator/actuator moves (which applies force to the wall of an additive vessel to trigger a controllably variable dispensing event), and the length of time that it remains in position before retracting, to dispense the additive Y. The dispensing module then rotates to align with the appropriate additive vessel at step 3508 and the pressure applicator moved into position at step 3509 to apply pressure and dispense 5.5 drops of additive Y. The process is completed when the correct amount of additive has been dispensed at a step 3510.

Furthermore it should be noted that the ideal level of concentration may not be a single ratio of additive to consumable but may be a range of ratios, depending on the type of additive. In a further embodiment, if additive Y has been added to a consumable in a container and a further dispensing event for additive Y is received before the container has been emptied and refilled, then the dispensing event may be blocked or the amount adjusted, in order to avoid the concentration level being excessively elevated.

Figure 36:
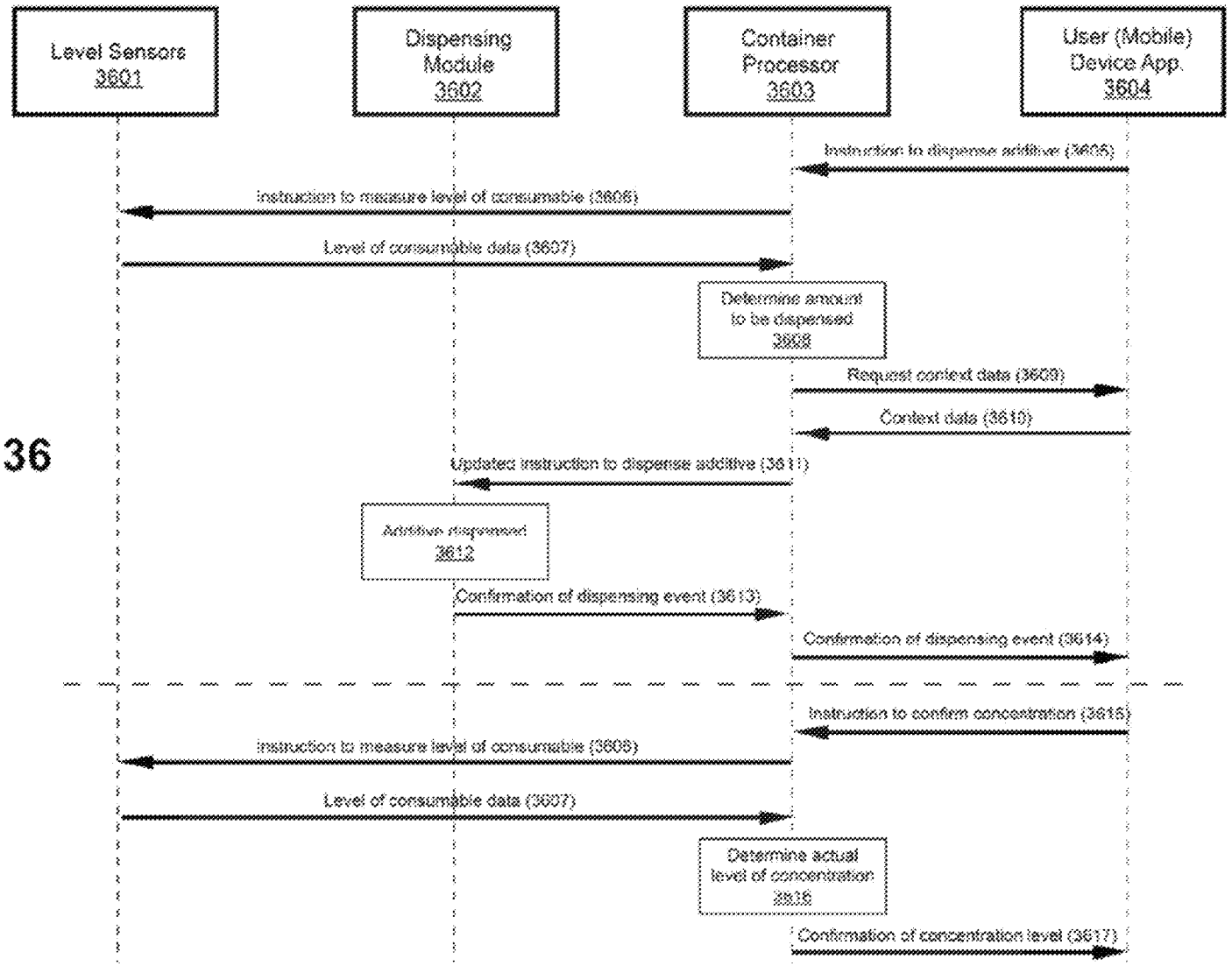
FIG. 36 is a data flow diagram illustrating example data flows between components of a hydration system according to one or more embodiments described herein.

FIG. 36 shows example data communications between components of a hydration system in accordance with one or more embodiments described herein. The data communications shown include those between one or more level sensors 3601, a dispensing module 3602, a container processor 3603, and an application running on a user device 3604.

A signal or instruction to dispense an additive may be communicated 3605) from the user's mobile device 3604 to the container processor 3603. The container processor 3603 may then send an instruction (e.g., query) 3606 to the level sensor 3601 to measure the level of consumable liquid presently stored in the container, and that level data may be communicated (3607) back to the container processor 3603, which may then determine the appropriate amount of additive to dispense (3608). The container processor 3603 may then request 3609 additional context data from APIs to applications running on the user's mobile device 3604, which is communicated 3610 back to the container processor 3603 and used to further adjust the amount of additive to be dispensed if appropriate. A signal or instruction to dispense a more precise amount of additive is then communicated (3611) to the dispensing module 3602 and the additive dispensed 3612. Confirmation of a successful dispensing event may then be communicated 3613 from the dispensing module 3602 to the container processor 3603, and may be further communicated 3614 from the container processor 3603 to the user's mobile device 3604. This may occur immediately after a dispensing event or data may be batched and communicated at some later time.

Optionally, in a further embodiment, an instruction may be sent from the user's mobile device 3604 to confirm the concentration 3615 by measuring the level of consumable immediately following the dispensing event, with an instruction to measure the level 3606 being sent from the container processor 3603 to the level sensors 3601 as before. The level data being communicated 3607 back to the container processor 3603, which may then determine the level of concentration of additive in the consumable 3616). As before, this may be further communicated 3617 from the container processor 3603 to the user's mobile device 3604.

Portable drinking bottles have previously not required a way of communicating with a user since the only relevant information has for the most part been to see how much water there is in the bottle, which is clearly determined by simple observation. More recently, portable water containers and those for other consumable liquids are becoming increasingly sophisticated and connected, some having wireless communications capability with a user's mobile device and/or with Wi-Fi and other methods. Others also have displays to present data or information to a user or viewer of the container and/or LEDs to illuminate the water, however a beneficial function of the current disclosure is that the method of communicating can enable more meaningful, useful and context-relevant information to be communicated to a user since it uses several LEDs whose spectral output and other parameters can be varied and controlled. Furthermore, the hydration container has multiple capabilities, including the ability to periodically dispense additives into the consumable liquid within the container and thereby changing it's composition, there is therefore considerably more relevant and useful information that can potentially be communicated to the user.

Figure 37:
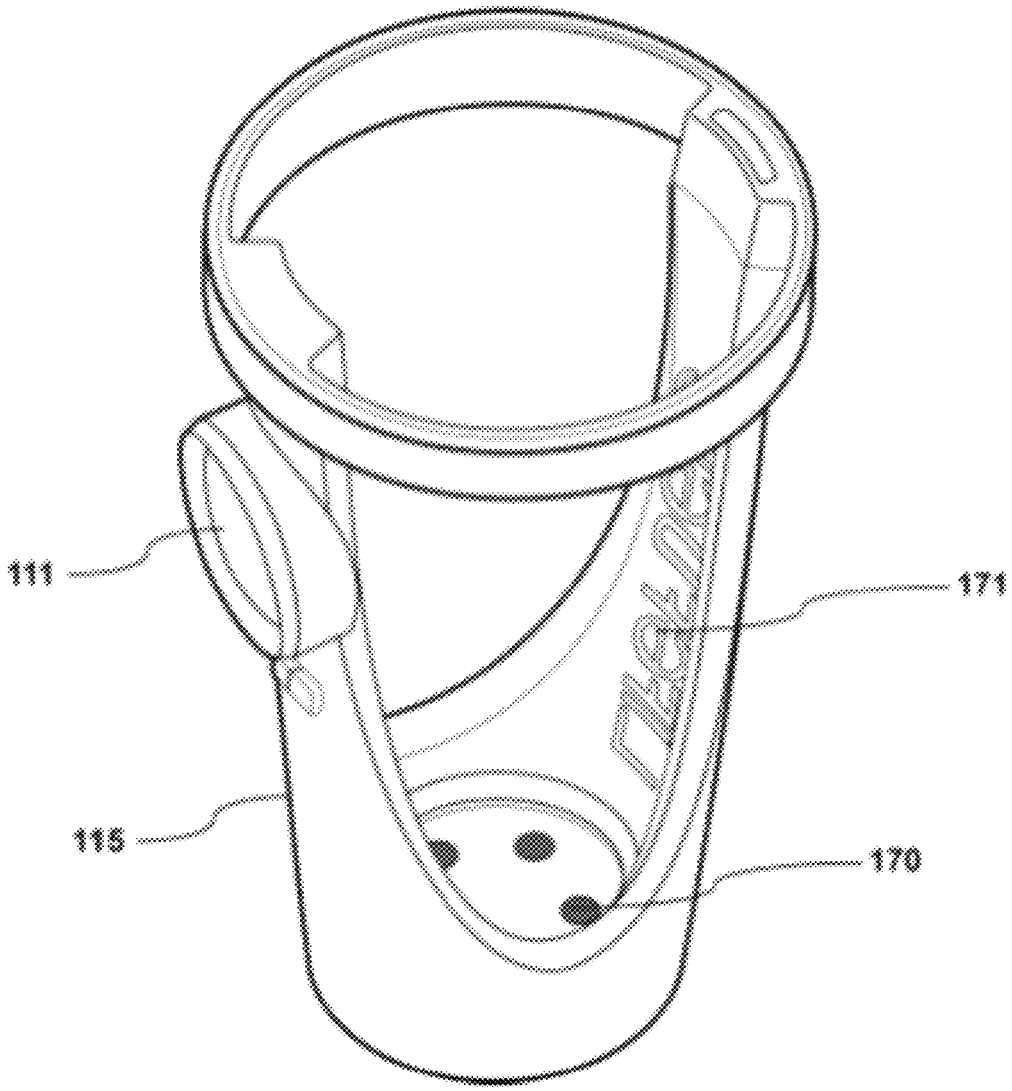
FIG. 37 is a perspective view of a container with multiple communication means for communicating information to a user according to one or more embodiments described herein.

One embodiment of a way of communicating with the user of a container (e.g., container assembly 101) is shown in FIG. 37, which shows the outer sleeve 115 for a portable liquid (e.g., water) container assembly 101 without the other components obscuring the illuminating LED's. The outer sleeve 115 comprises an integrated LCD or similar display 111, an array of illuminating LEDs 170 in the base of the container and a translucent lens 171 vertically oriented along the side of the sleeve 115. A transparent chamber for the consumable liquid fits within this outer sleeve 115. More complex information may be communicated to the user via the display 111. This may not be easily visible from a distance however, and is less attention-grabbing, while illuminating the liquid and the vertical lens 171 using the LEDs 170 in the base would be visible from a greater distance and also considerably more attention-grabbing. A user may not always have the container very close by, for example it may be nearby when running on a treadmill, in a holder on a cycle or to the side in a vehicle's drink holder and so on, so a more visible alert would be beneficial to a user. The liquid contents will scatter the illumination throughout such that it will not be perceived as a series of point source illuminants but as a gentle glow throughout the entire container contents, therefore the illuminated area that is visible to the user will be much larger than the surface area of the LEDs 170. Light from the LEDs 170 will also be internally reflected from the sides of the container assembly and scattered throughout the liquid contents.

Figure 38:
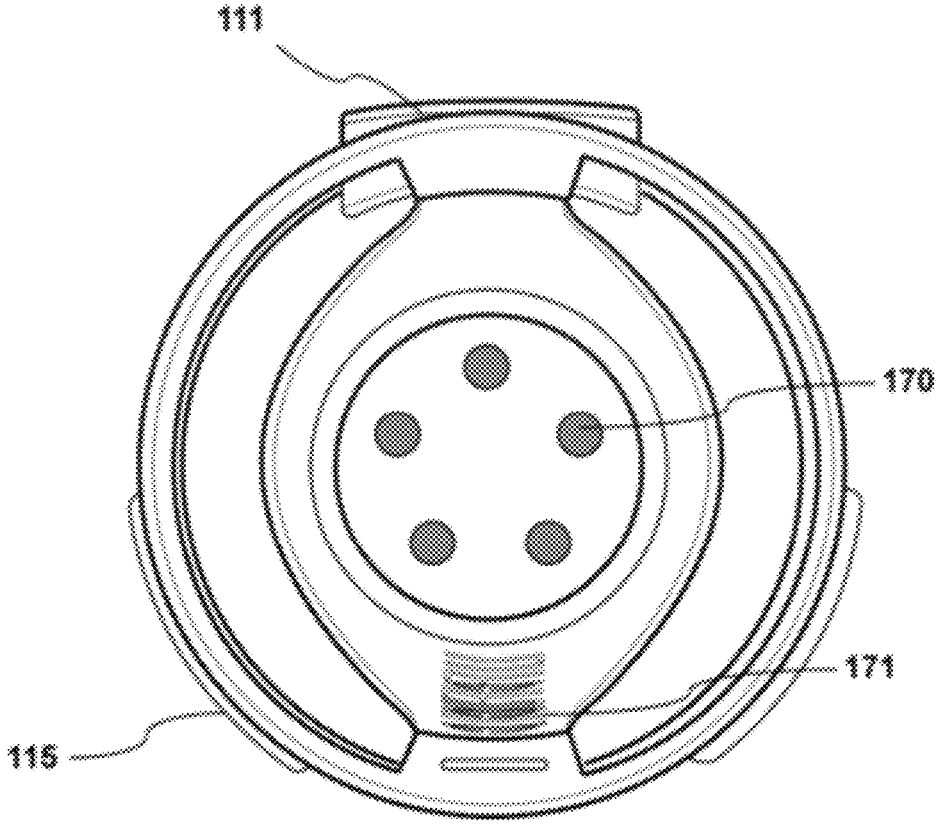
FIG. 38 is a top view of the container shown in FIG. 37 according to one or more embodiments described herein.

A more detailed view of an array of LEDs 170 is shown in FIG. 38, which is a view vertically downward into a container assembly 101 having an externally mounted display 111 and a circular array of LEDs 170 in the base.

Information which could be conveyed using illumination of the liquid in this way includes, but is not limited to, for example, alerting a user that their level of hydration is low and that they need to drink some water, where a container is used to dispense medications it could alert the user that it is time to consume some medication, if a user is drinking water to re-hydrate, the illumination might change color to indicate the point when sufficient quantity has been drunk.

In some implementations of the system, the container may be in communication with a user's mobile device (e.g., user device 106), and therefore the illumination of the liquid may be used to supplement information presented on the screen of the mobile device, such as, for example alerting the user to an incoming text message, email or iOS notification, or notifications from a fitness or activity tracking application, and the like.

Some non-limiting examples of ways in which the LEDs' 170 output may be encoded to communicate such useful information include the following: All LEDs are the same color and there is no flashing; All LEDs are the same color and are flashing slowly ("breathing" effect); All LEDs are the same color and are flashing rapidly (attention getting); LEDs emit a range of colors and there is no flashing (rainbow effect); LEDs emit a range of colors and are flashing; and LEDs emit a range of colors in a sequence (effect of rainbow rotating around the bottle).

There are a very wide range of encoding options and permutations and, though described in the context of a portable hydration container, the methods and apparatuses of the present disclosure may apply to any container containing a liquid or other light scattering substance.

Since data is available to a processor regarding the type, category and/or unique product code of an additive vessel, including the amount of additive originally stored in the vessel (typically, but not necessarily, 1 oz.), and data is also available regarding the amount, frequency and times when a portion of that additive was dispensed into a consumable liquid in the container, the system can determine the amount or level of additive remaining in the vessel at any time. Therefore the system can identify when a vessel is empty, and can also predict when it is likely to become empty given the rate of previous dispensing and the scheduled or predicted future rate of dispensing.

The eCommerce system from which the vessels were purchased may also store information about a user's purchase history, therefore data is available about when a user last purchased additive vessels, what they were and how many were purchased. When correlated to the additive dispensing data, the system can not only predict when a vessel inserted in the container will be depleted, but may also predict when a users' personal supply of that particular additive vessel will run out. The system can therefore additionally alert the user to this via the display on the container and/or via auditory means.

Figure 39A:
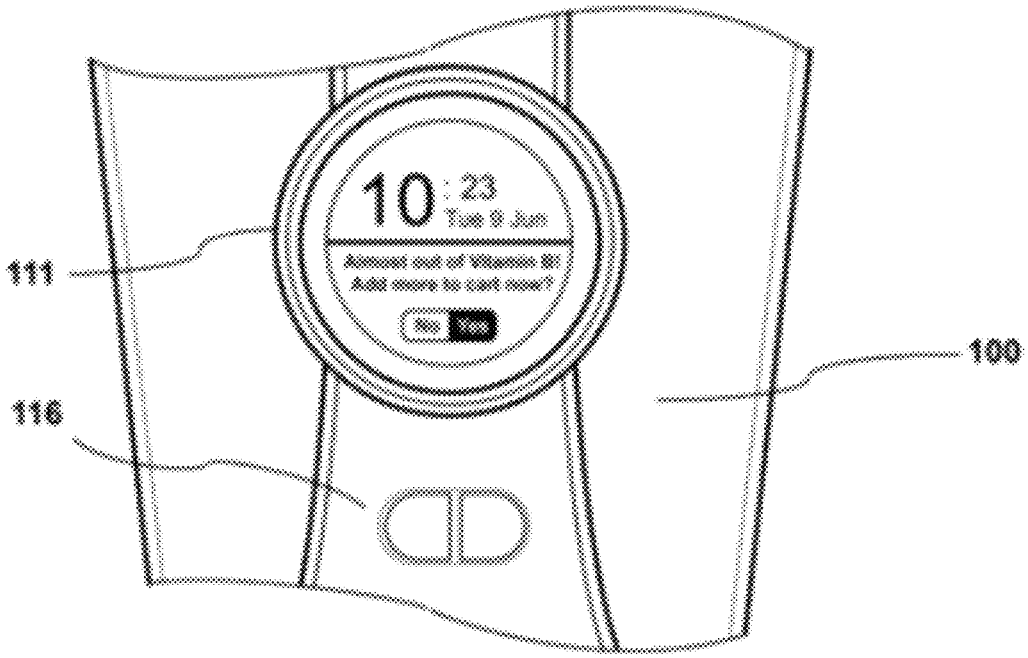
FIGS. 39A and 39B illustrate examples of a visual display and user interface controls for a portable container according to one or more embodiments described herein.
Figure 39B:
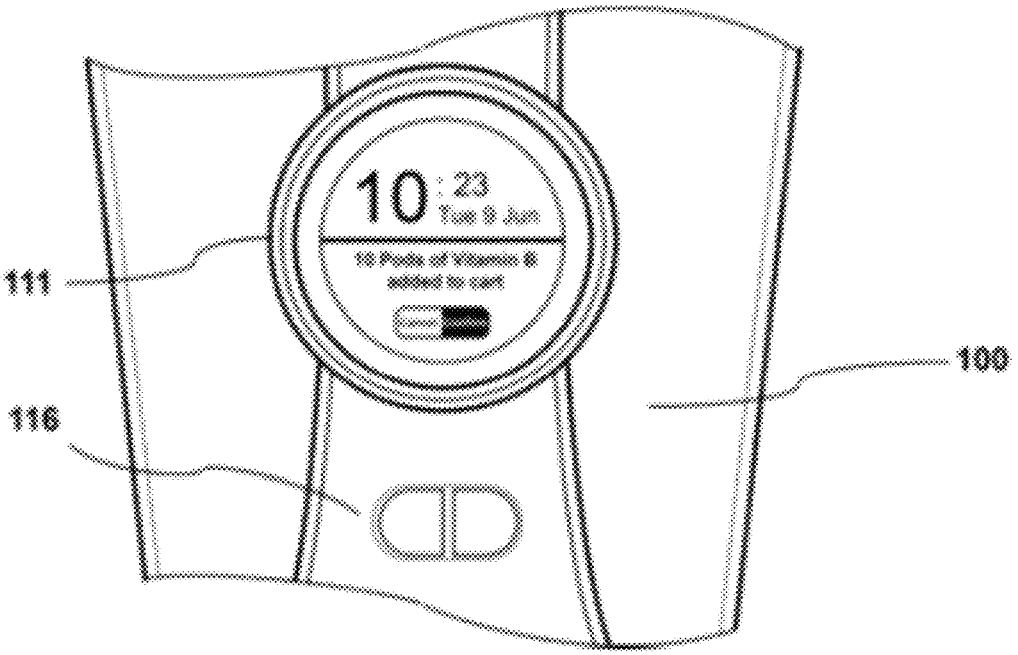

Furthermore, since the container is wirelessly connected to the eCommerce system, either directly or via a user's mobile device, pressing a button on, or otherwise interacting with the container can send a communication directly or indirectly to the eCommerce system to add some of these additive vessels to the user's shopping cart or to automatically order them and have them shipped, depending on the preferences or settings the user has on the eCommerce site. Therefore the user does not have to remember to re-order the additive vessels if they are needed, or check/keep track of stocks in reserve at home, and also has the option to not order them, or to cancel the order later if they change their mind. FIGS. 39A and 39B show illustrative examples of a user interface through which a user may add products to their eCommerce shopping cart directly from a hydration container assembly. The container assembly 101 (a portion thereof is shown) may have a simple user interface comprising of a circular display 111 and two pushbuttons 116. The display 111 may, as shown in FIG. 40A for example, display to the user that "Supplies of Vitamin B are almost out", pressing the right hand button 116 causes a message to be sent to add Vitamin B vessels to the shopping cart. Though confirming this may not actually make a purchase, it may just add them to the shopping cart, it is generally good practice to ask the user to confirm the instruction in a two-step process. Therefore, a confirming display of "Vitamin B added to cart" may be accompanied by the button options to "Cancel" or "Confirm" the request as shown in the display 111 in FIG. 40B.

The purchase transaction may be completed when the user next goes to the eCommerce site. In an alternative embodiment, the user actions may cause the ordered product to be ordered and automatically shipped, or may add several orders to a shopping cart until such time as an order quantity threshold is reached, at which point the order batch may be shipped.

Several soon to be depleted products may be added to the shopping cart (e.g., additives a, b, and c) and since the system is able to predict an earliest time when the user will run out of each of these additives, (e.g., the user will run out of additive b four days sooner than additives a and c), then the batch may be automatically shipped to the user at a time whereby the batch of several products arrives before additive b runs out, taking into account the shipping and delivery schedule. These alternatives may be under the control of and configurable by the user on the eCommerce site either directly, or via the application on the user's associated mobile device.

In accordance with at least one embodiment of the present disclosure, provided is a system capable of caching eCommerce selections and/or directives locally on a portable dispensing device that subsequently communicates the selections and/or directives to relevant databases and eCommerce mechanisms engaged with peripheral and/or connected user devices such as a mobile application. In the aforementioned embodiment, this data "push" from the portable dispensing device related to the repurchase of additive vessels may occur in real-time, or at a later time when a sufficient connection is established between devices, furthermore, the data "push" associated with the on-device purchase instruction might not initiate and/or fulfill immediately, and might be scheduled or postponed in accordance with the user's profile, preferences, consumption history, and other data or factors relevant to the user's consumption of the additive/s.

Figure 40:
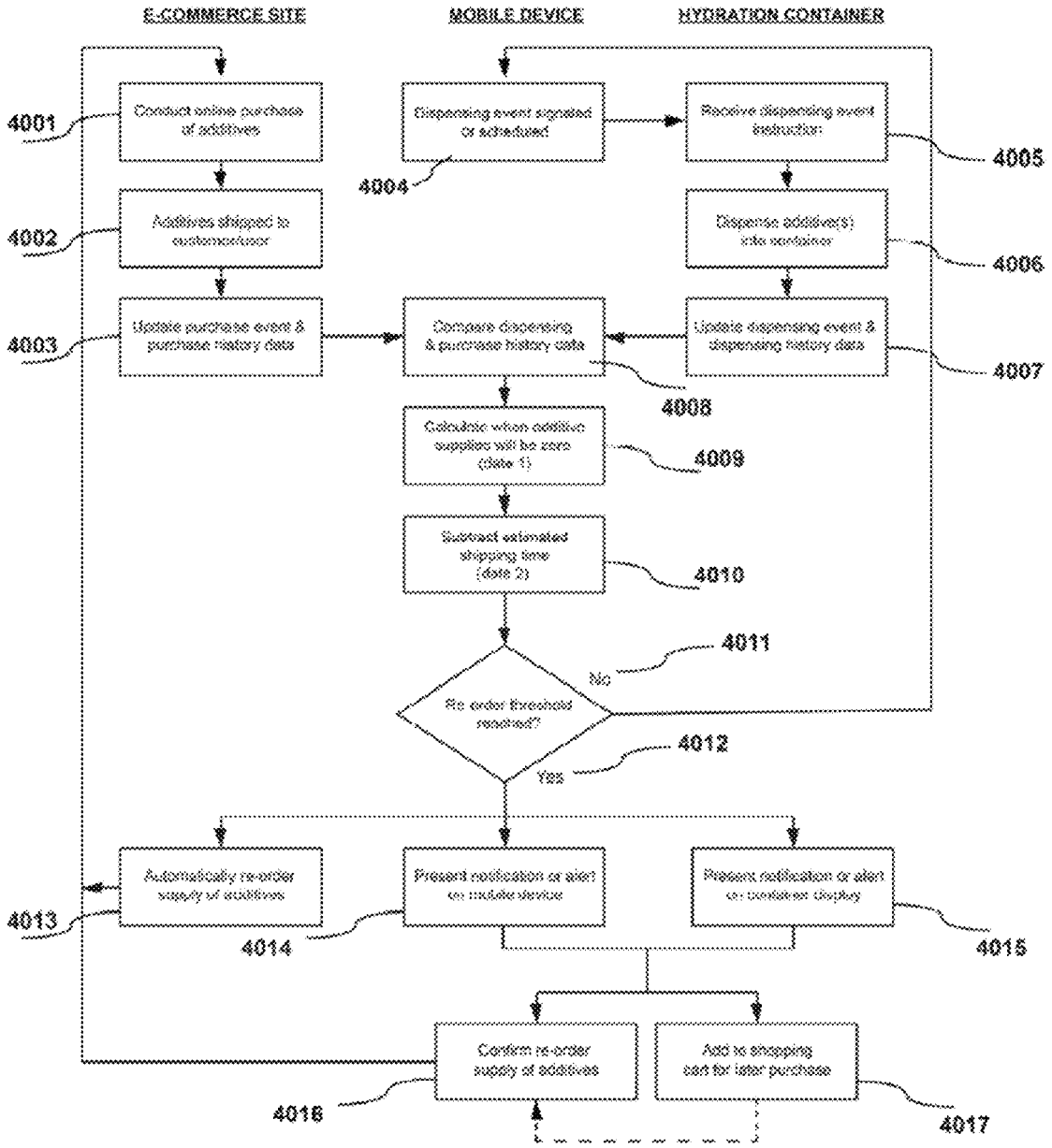
FIG. 40 is a flowchart illustrating an example process for a product ordering transaction according to one or more embodiments described herein.

FIG. 40 shows illustrative processes for an eCommerce transaction directly from a product, in this case, a hydration container assembly. It is assumed that one or more purchases of additives have been made (at 4001), shipped to the customer/user (at 4002) and that some additive vessels are inserted in the container and are in use, while others are stored at home awaiting use. As a consequence of these previous purchases from the eCommerce site, purchase-history data may be stored at a location accessible to the eCommerce system (at 4003). This includes but is not limited to, the amount of each different types of additive purchased over time and the date, time and quantity purchased, shipped and received by the customer/user and the like.

Periodically, an instruction to dispense an additive into the container is sent from an application on the user's mobile device (at 4004) and received by a processor in the container (at 4005), and the additive is dispensed (at 4006). Data about that dispensing event is subsequently sent back to the application on the user's mobile device and the dispensing/consumption history updated accordingly (at 4007). This includes but is not limited to, the amount of each different types of additive dispensed over time and the date, time and quantity dispensed and the like. The additive purchase history data and the additive dispensing history data is then correlated and compared (at 4008) and an estimate derived regarding a date/time when supplies of that additive will be depleted (at 4009). For example, a user may have purchased 10 vessels of Vitamin B, each containing 1 oz. of additive, on 1 March. With standard shipping, the user would have received them on 3 March. The dispensing history on 13 March indicates that a total of 7 oz. of Vitamin B have been dispensed to date and the rate of dispensing averages 0.7 oz. per day. Thus the system would predict that supplies will be depleted on the 17 March (date 1) (at 4009). Given that it takes 2 days to ship the order, then it would be predicted that the re-order threshold would be reached on the morning of 15 March (date 2) (at 4010), when approximately 8.6 oz. of additive have been dispensed. Since additive dispensing and consumption may not be consistent day to day, then this prediction process may be periodically repeated each time that a dispensing event occurs in order to adjust the re-order threshold accordingly (at 4011).

If the dispensing of Vitamin B is fairly consistent then the re-order threshold would be reached on the 15 March (at 4012), and the user duly informed in sufficient time that supplies may be re-ordered and shipped to arrive on or before the point when supplies are depleted. The margin, or amount of advance warning that the system provides may be configurable by the user in the eCommerce account. Similarly, the process preferred by the user in response to receiving an alert or notification, may also be configurable. In one alternative process the user may choose to automatically place a repeat purchase (at 4013) when the threshold is reached in order to maintain uninterrupted continuity of supply. This may occur with or without any notification being presented to the user. In a second alternative process the user may wish to know that supplies are running low and choose if and when to re-order and/or to vary the quantity that is re-ordered. In this instance a notification or alert would be presented to the user on the user's mobile device (at 4014) and/or using the display on the container itself (at 4015). In response to this notification or alert, the user may choose to immediately confirm and place a purchase (at 4016) by selecting the appropriate menu choice, or may choose to add the order to his shopping cart and confirm and place the purchase sometime later (at 4017).

Furthermore, in accordance with the aforementioned, if a user is consuming the additive vessels at a slower-than-expected rate, or not at all, and/or they are consistently 'rating' the additives poorly on the portable container and/or on a peripheral system (e.g. mobile application) a system level prompt might incentivize or otherwise encourage them to give their additive vessels to a social connection (friend) or to exchange them in some other fashion, so as to preserve the value of their experience. In a similar regard, if the additive vessels in question are due to expire in a certain timeframe, the system might similarly prompt the user to more rapidly use/consume the additives, and/or share them so as to reduce the potential for wasted product. Thus prioritizing the dispensing system as such.

Figure 41:
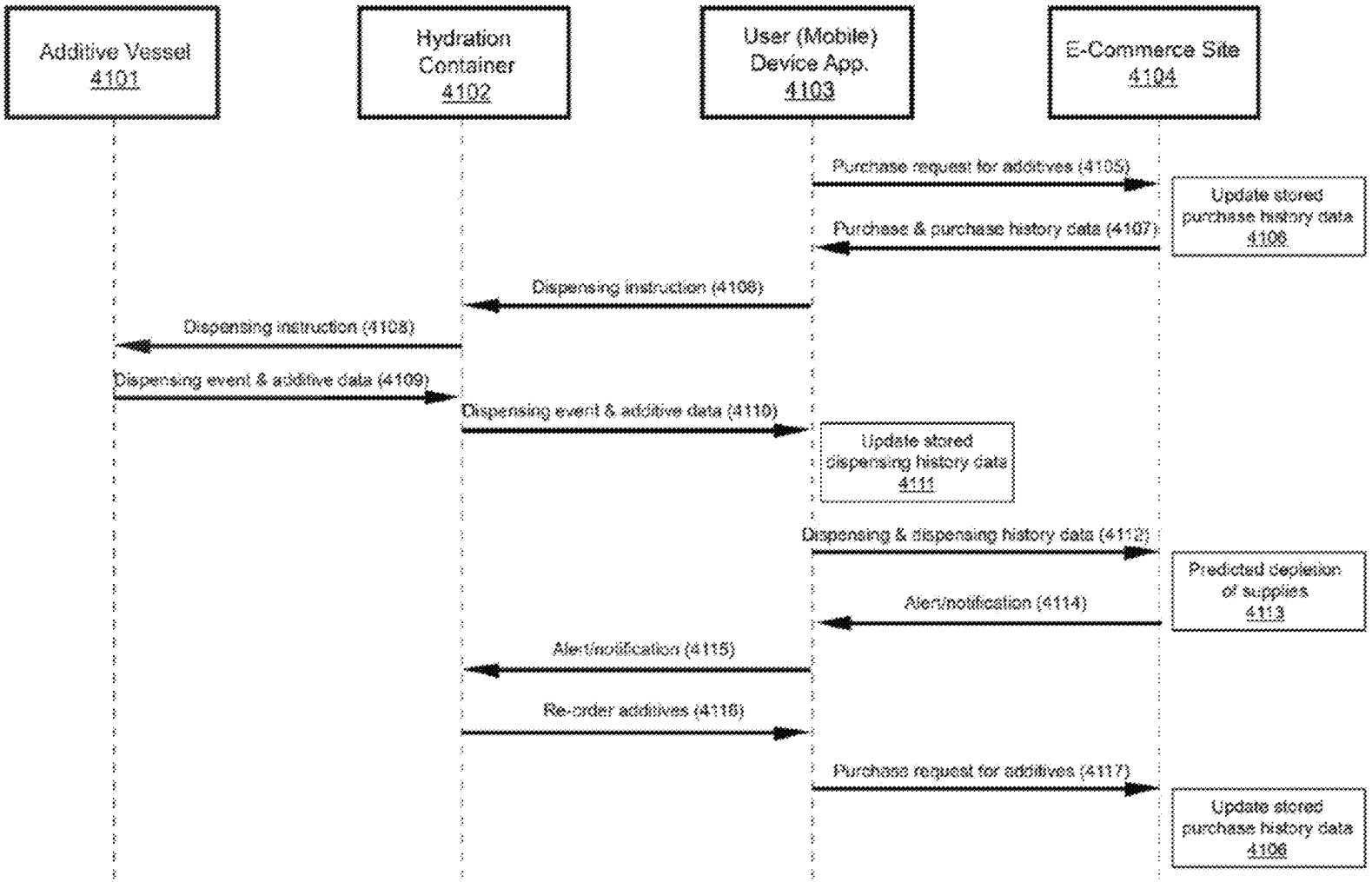
FIG. 41 is a data flow diagram illustrating example data flows between components of a hydration system and a user portal according to one or more embodiments described herein.

FIG. 41 shows an illustrative example of data communications between components of the eCommerce system in accordance with one or more embodiments described herein. An order (4105) for the purchase of additives may be placed via an eCommerce site 4104 from a user's mobile device 4103, from a computer, or from another user device. A history of the user's additive and other purchases on the eCommerce site 4104 is stored therein and is updated with the latest purchase (4106). This updated purchase history data is subsequently communicated (4107) from the eCommerce site 4104 to an application on the user's mobile device 4103 and may be stored on the mobile device. Periodically, an instruction to dispense an additive (4108) may be communicated from the user's mobile device 4103 to a processor within the hydration container 4102, which communicates (4108) with and/or acts upon the additive vessel 4101 to dispense the additive as instructed.

Following a dispensing event, additive data read from passive storage means on the additive vessel 4101, and other data about that event is communicated (4109) to a processor within the hydration container 4102 and may be further communicated (4110) to an application on the user's mobile device 4103. The consumption and dispensing history of that user is then updated (4111) locally on the user's mobile device 4103 and may, immediately, or at some later time, be further communicated (4112) to update the dispensing history data stored at the eCommerce site 4104.

This updated dispensing information may then be used as an input to predict (4113) the date/time when the user's supplies of the additive will be depleted. When a date/time threshold is reached when re-ordering needs to take place in order for the products to be received before existing supplies run out, then a notification or alert may be sent (4114) to the mobile application running on the user's device 4103 for presenting to the user. This may be received by, and presented visually and/or audibly on the user's mobile device and/or further communicated (4115) to the hydration container 4102 and presented to the user visually and/or audibly on the container assembly 4102 itself. In response to the notification or alert, the user may interact with an interface on the hydration container 4102 to re-order supplies of additives (4116), or may interact with an interface on the mobile device 4103 to re-order additives (4417), and the stored purchase history data updated (4106) with this most recent purchase. The process described above may then be repeated periodically as dispensing events and/or purchase events occur.

A hydration container system may be configured to enable a defined and limited group of containers to be securely controlled and monitored by a single, central mobile or fixed device or application with which all containers in the group are in direct or indirect communication, for example, several different containers may be allocated to and used by members of a sports team. An application on the coach's computer, tablet or mobile device may provide a dashboard whereby the consumption patterns and behaviors of each member of the team can be monitored and future instructions or recommendations may be assigned by the coach, or recommended by an application, and communicated back to each individual container and/or individual. It may be, for example that to achieve optimum performance in the days prior to a sports game, players require a strict schedule of ingesting vitamins, nutritional supplements and the like. In addition, the ideal schedule may not be the same for each individual sports player and such a system allows for each individual schedule to be different and to be optimized for that individual. Furthermore, a consumption schedule may also be dynamically adjusted, either automatically by the application or system, or manually by the monitoring person (e.g. team coach) according to the consumption times and patterns communicated to the central application from the containers.

In a further, non-limiting, example, several different containers may be assigned to and used by inpatients in a medical or behavioral facility, or by outpatients. An application on the nurse or doctor's computer, tablet or mobile device may provide a dashboard enabling the medical practitioner to schedule, monitor, control and adjust a medication or pharmaceutical schedule independently for each patient. One example use case is that of gastric surgery for weight loss which requires that the post-operative patent maintain a very strict and tightly controlled regime of intake of nutrients, vitamins and supplements in order to ensure full and timely recovery over a period of several weeks. This is typically difficult for an individual to easily maintain with the required degree of accuracy. Furthermore, the reaction and/or efficacy of the dispensed additives in the aforementioned use-case scenarios might be correlated or otherwise monitored through the combination of supporting data from other devices, such as wearable activity trackers, heart-rate monitors, and the like.

In a further embodiment, where the users of the multiple containers are within a Wi-Fi environment, a system may receive periodic dispensing status updates initiated by and communicated from each one of multiple containers within wireless range including an ID-specific to each container and/or user. Additional data about the time that a medication was dispensed into the container and the time that the container was tilted and/or the level of consumable liquid in the container decreased, enables a medical practitioner to determine whether the patient has consumed some of the liquid after dispensing and how much has been consumed.

Figure 42:
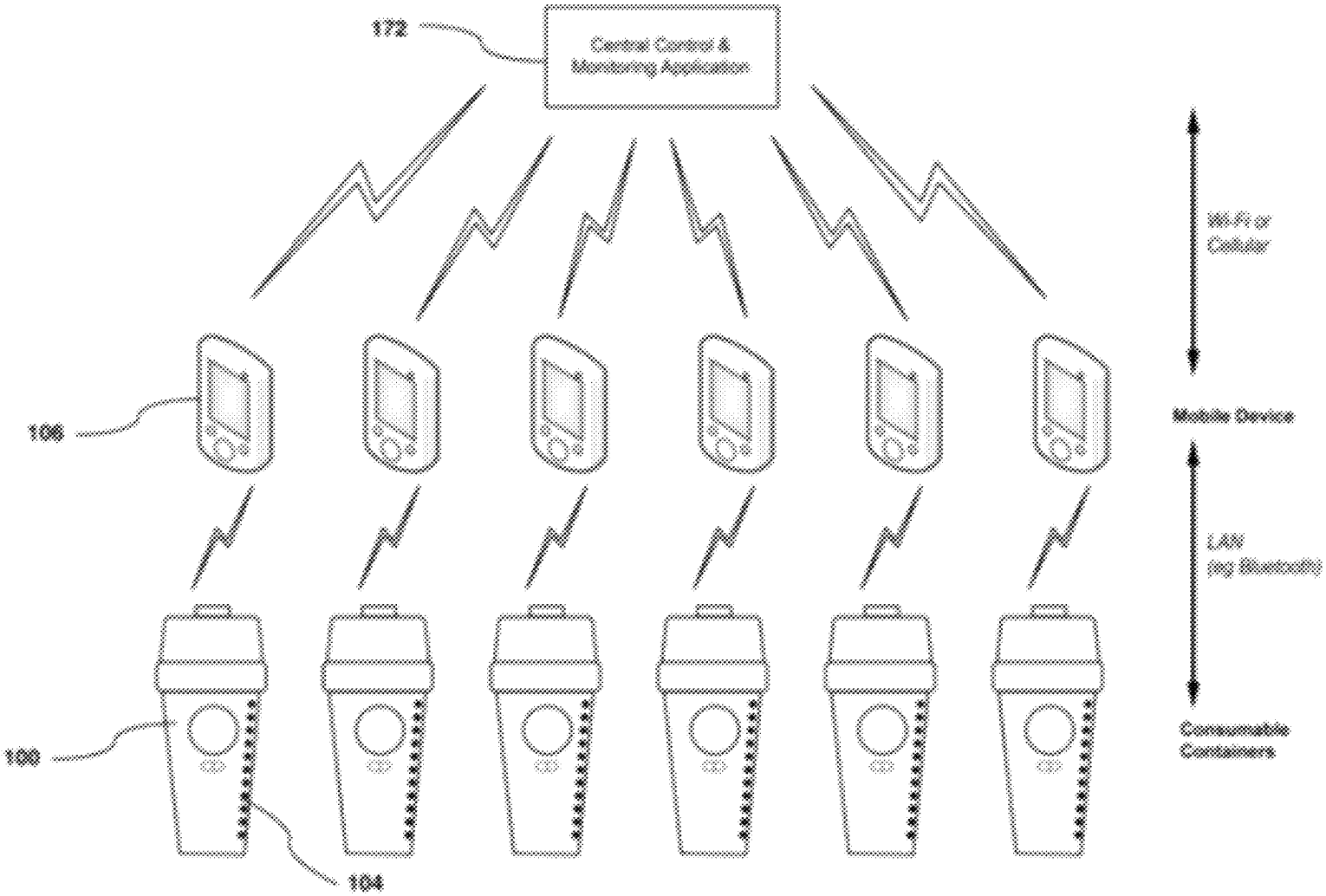
FIG. 42 is a block diagram illustrating an example of a closed group system according to one or more embodiments described herein.

FIG. 42 is an illustrative diagram of a system for controlling and monitoring additive consumption within a closed group of consumers. In a further example, clinical trials of a new drug or pharmaceutical require strict and well controlled schedule of ingestion in order to ensure the scientific accuracy and validity of the results of the trial. In conducting such trials, a system for remotely controlling and monitoring additive dispensing and consumption would be very beneficial. Furthermore, the reaction and/or efficacy of the dispensed additives in the aforementioned use-case scenarios might be correlated or otherwise monitored through the combination of supporting data from other devices, such as wearable activity trackers, heart-rate monitors, and the like. FIG. 42 shows a number of portable container assemblies 100 having level sensors 104 (e.g., infrared or other level sensing means) to determine the level of liquid consumable stored within them. Examples of such level sensors 104 include non-contact capacitive level sensing arrays, ultrasonic range-finder implementations, and/or load-cell implementations. The level sensors 104 are in short range (e.g., Bluetooth Low Energy or similar) wireless communication with the users' mobile devices 106. Each mobile device 106 may be in further wireless communication (e.g., via Cellular or other Wide Area Networks) with a receiving device (e.g., laptop, PC, tablet etc.) having a control and monitoring application 172. The control and monitoring application 172 may transmit dispensing instructions to each of the container assemblies 100 and may also receive data from the level sensors 104, as well as processors within the container assemblies 100. In accordance with at least one embodiment, a user's mobile device 106 may not be needed, and the container assemblies 100 may be in direct wired or wireless communication with the control and monitoring application 172. In at least one embodiment, communication may take place via a charging coaster or other charging module, with the data being stored in memory within the container assemblies 100 and uploaded when in contact with or connected to the charging device. The example system and method presented above with respect to FIG. 42 are further illustrated in FIG. 43 in the exemplary context of medication dispensing.

Figure 43:
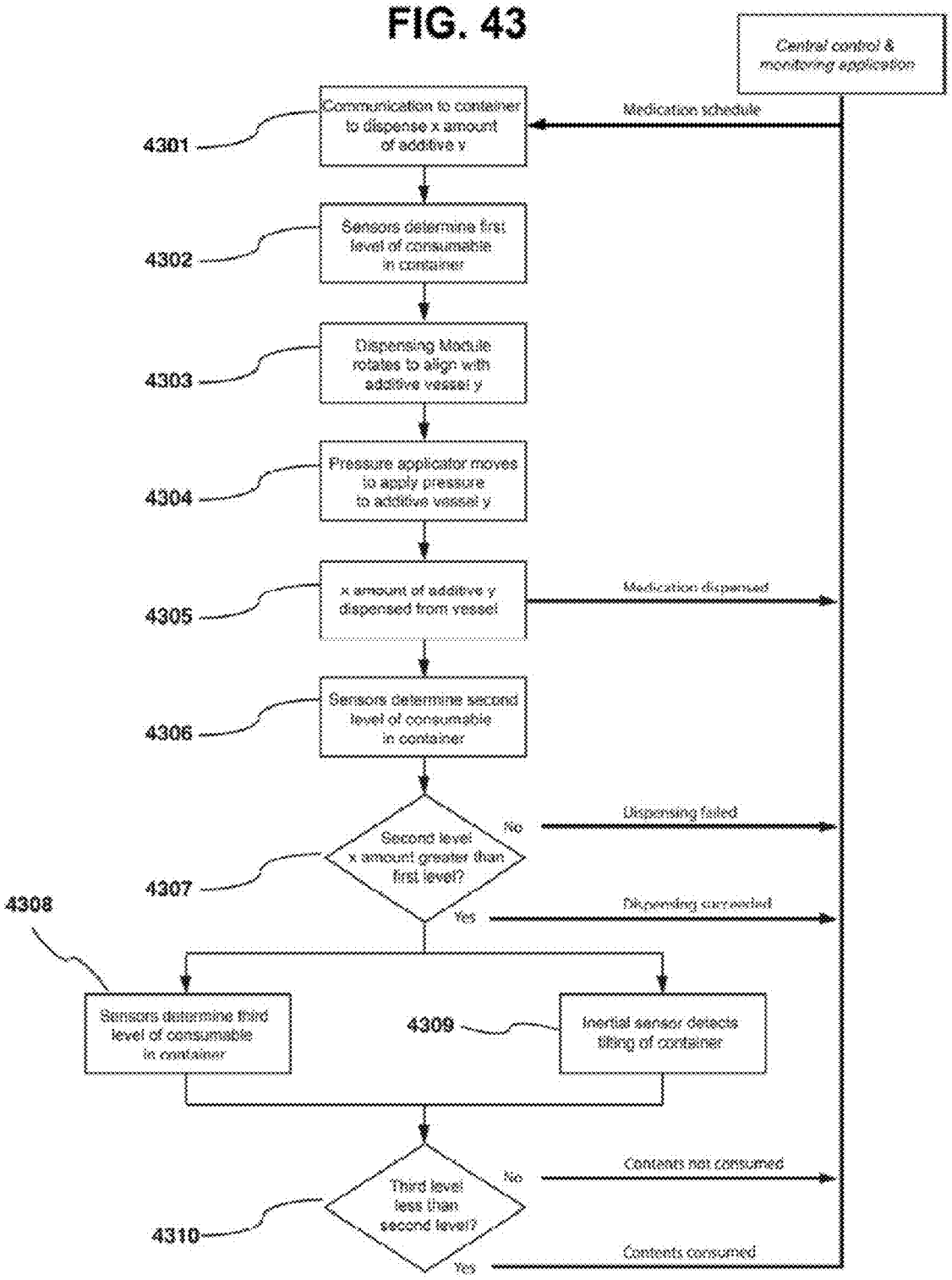
FIG. 43 is a flowchart illustrating an example process for monitoring additive consumption within a closed group of containers according to one or more embodiments described herein.

In a process as shown in FIG. 43 at 4301, an application on a central monitoring device communicates wirelessly to a user's mobile device, or directly to the container, an instruction to dispense X-amount of additive-Y into the consumable within the container. Prior to, or subsequent to this communication IR, capacitive level sensing strip, or other sensors in the container determine a first level of consumable within the container at 4302. If the IR, or capacitive level sensing strip, or other sensors in the container determine that the level of consumable in the container is greater than a specific threshold then a dispensing module within the container rotates to align with the additive vessel-Y at 4303 and a pressure applicator moves to apply pressure to additive vessel-Y, at 4304 to force X-amount of additive-Y out of the additive vessel and into the consumable liquid at 4305. Carrying out a first determination of the level of consumable in the container prior to the dispensing event may avoid additive being dispensed into an empty or near empty container, which could result in too high, or too low a level of concentration of the additive in the consumable. At this time a communication may be sent from the container to a central monitoring device or application to confirm that the additive has been dispensed from the additive vessel, that a dispensing failure has occurred or that the dispensing event was not carried out due to an absence of, or insufficient quantity of consumable in the container.

It should be noted that although in the present example, the level sensing technique focuses on infrared absorption/interference, that the relationship with a dispensing module, and/or additive vessel/s is achievable in different configurations with different technologies. With regard to the aforementioned, such technologies might include ultrasonic range finders, contact-based capacitive level sensing (for example, a probe), non-contact capacitive level sensing (for example, a shrouded printed circuit board assembly with active shielding elements to measure dielectric variation of a container), load-cell or other mass-measuring apparatus (whereby the system would extrapolate volume changes by changes in mass/weight), a float mechanism might also be employed, whereby the level is measured directly by the relative height of a constrained but movable float. The changes in substrate/solute/target-fluid level/quantity ultimately inform trackable hydration targets, dispensing protocol, and/or other user and/or system prompts. The implementation enables dynamic maintenance of the characteristics of the post-mix beverage in cases where the concentration is modified and/or in cases where the post-mix concentration requires adjustment. Furthermore, the approach enables for the dynamic creation of beverages in response to the level of target fluid/solute/substrate, whereby the measured level of the target fluid/solute/substrate informs the dispensing module to modify, postpone, cancel, or otherwise adjust a dispensing protocol, and/or whereby the measured level of the target fluid/solute/substrate informs a peripheral user interface (mobile application etc.) and subsequently prompts a data exchange, user-prompt, and the like.

At 4306, the IR (or other) sensors determine a second level of consumable in the container and, at 4307, the first level is compared with the second level to determine whether the level has changed in accordance with what would be expected due to the introduction of X-amount of an additive-Y, and that the additive has been successfully introduced into the consumable. This confirmation is then sent from the container directly or indirectly to the central monitoring device or application. Since the level of consumable in the container is known to the system, the level of concentration of the additive in the consumable can therefore be determined and may also be communicated to the central monitoring device or application. If the level of consumable has not changed then it may be concluded that a dispensing failure has occurred. If the level changes from zero to an amount consistent with X-amount of additive-Y, then it may be concluded that the additive vessel was empty before the additive was dispensed.

The container has an integrated display and methods of illumination which can be used to communicate to a user, including a message that dispensing has taken place or in about to take place and/or that the contents (additive and consumable) should be consumed. As described below, the next steps in this process are to determine if, when and how much of the consumable contents a user has consumed in response to this communication.

Subsequently, at 4308, the IR (or other) sensors determine a third level of consumable in the container. This may be scheduled to occur after each dispensing event and/or may be initiated by the detection by inertial sensors at 4309, that the container has been tilted. This third level of consumable is compared with the second previous level at 4310 to determine whether the level of consumable has decreased.

If the inertial sensor at 4309 indicates tilting and the level at 4308 is unchanged from the second level, it may be concluded that none of the contents have been consumed. If the inertial sensor at 4309 indicates tilting and the third level of consumable at 4308 has decreased, it may be concluded that the container was tilted for the purpose of drinking and the user has consumed some of the contents and ingested the medication. This determination may be supplemented with the duration of tilting, since mean rates of drinking can be estimated, then the length of time that a container was tilted may be a proxy for the amount of content consumed. In a further embodiment, each individual container may monitor the rates at which the individual user drinks the contents using a flowmeter, flowmeter-valve, or similar, and determine a mean or range for that particular user. In this way, estimates of the amount consumed as determined from the time and duration of tilting could be considerably more accurate.

At this time a communication may be sent from the container to a central monitoring device or application to confirm that the user has consumed the medication. Since the amount of consumable and the amount of additive are known, the concentration can be determined and since the amount that has been consumed is also known, then the amount of medication ingested by the user/patient can be determined.

In accordance with at least one embodiment, the control and monitoring system may be in communication with a container and the dispensing module modified in order to dispense solid substances such as tablets, into a container which may be empty and does not contain a liquid or any consumable. Such a system may, for example control the timing with which tablet or gel-form drugs are administered, preventing a user from taking the drugs at incorrect intervals. Such a system could be particularly beneficial in the case of patients suffering from Alzheimer's Syndrome or other conditions where cognitive capacity or judgment is impaired or for the clinical trials of drugs.

In cases where it may not be possible for a central control device (e.g., computer, tablet, mobile device, and the like) to simultaneously communicate with multiple containers, the method may require the application to sequentially communicate with each container in turn via Bluetooth or similar wireless technology, then disconnecting and pairing with the next one. In this way a full cycle of connect/disconnect can be carried out in a timely manner. The aforementioned embodiment and use-case would be ideal in group settings such as physician monitoring of patients/clients, or in a trainer or coach interfacing with a team of players.

Data exchanges between the container, the users mobile device and the central device or application may also be implemented using cellular communications and/or internet protocol if the client containers are not within the range of a direct peer to peer wireless or Wi-Fi system.

Figure 44:
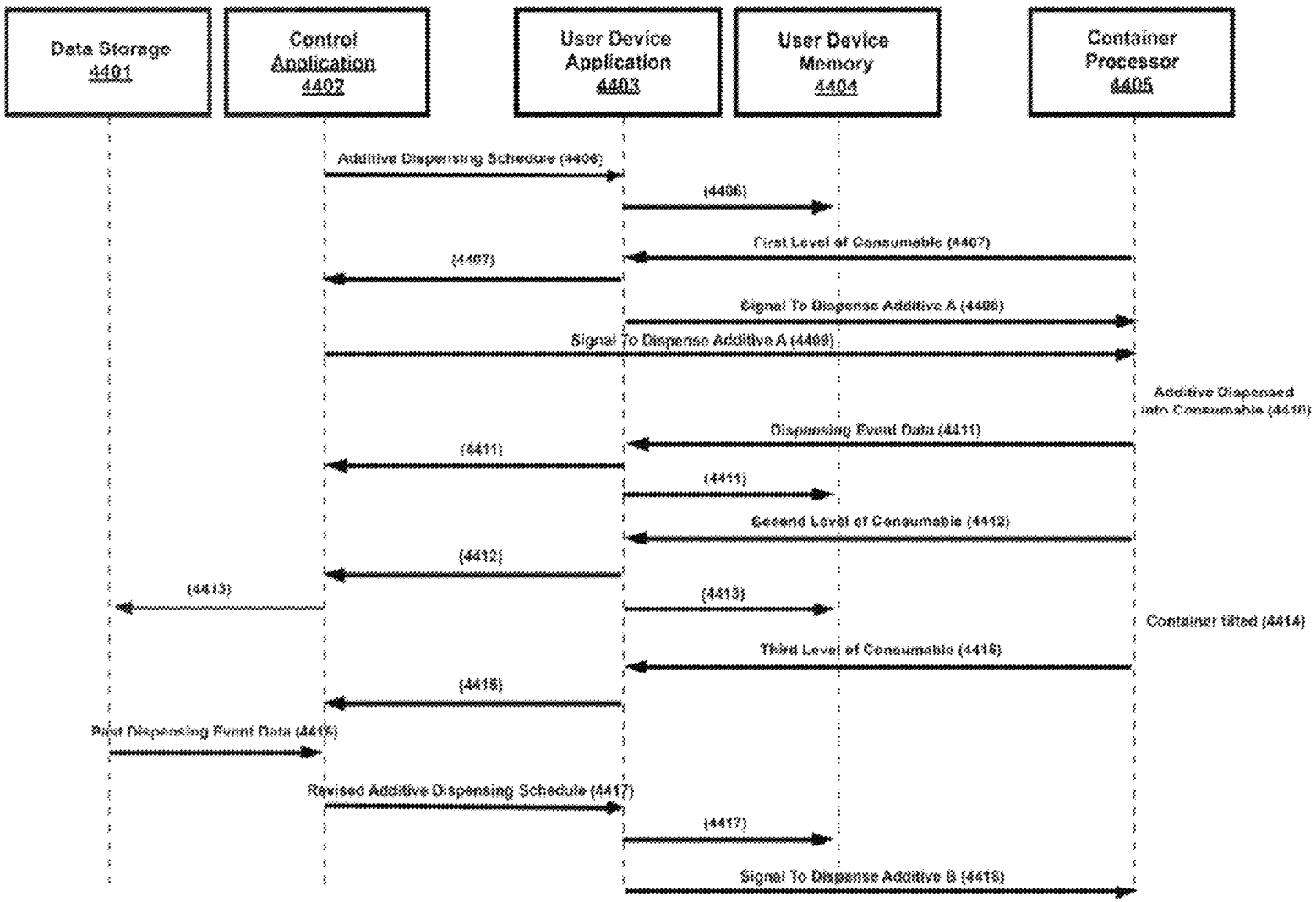
FIG. 44 is a data flow diagram illustrating example data communications between a central controller, a monitoring application, and a portable container according to one or more embodiments described herein.

FIG. 44 shows example data communications between a central control and monitoring application 4402, data storage 4401 (e.g., local, network or cloud based memory), an application installed on a user device 4403, memory of the user device 4404, and a processor 4405 in one of a plurality of remote container assemblies. The central control and monitoring application 4402 may communicate an additive dispensing schedule (4406) or dispensing event to the application on a user device 4403 which is associated with the user's container. This dispensing schedule may then be further communicated to (4406) and stored in memory 4404 associated with the application and may comprise a single dispensing event or multiple dispensing events over a period of minutes, hours, days or longer Immediately prior to a scheduled dispensing event, sensors determine a first level of consumable within the container and communicate that first level 4407 to the application on the user's mobile device, this may be further communicated (4407) to the control application 4402. Periodically, according to the schedule, a signal (4408) may be communicated from the user device application 4403 to the container processor 4405 to dispense an additive from one of the additive vessels.

In an alternative embodiment, the signal to dispense additive (4409) may be communicated directly from the control application 4402 to the container processor 4405. The dispensing event (4410) then takes place and feedback data about that event communicated (4411) from the container processor 4405 to the user device application 4403, and further communicated (4411) from the user device application 4403 to the control application 4402. The dispensing event data may also be communicated (4411) to local memory storage 4404 in the user's device. In an alternative embodiment, feedback data about a dispensing event may be communicated directly from the container processor 4405 to the control application 4402 without requiring a user device as a wireless relay.

Following the dispensing event sensors determine a second level of consumable within the container and communicate that second level (4412) to the application on the user's mobile device 4403. Data about the dispensing event and the level of consumable prior to and following the dispensing event may be further communicated (4412) to the control application 4402 and may be yet further communicated (4413) to local, network or cloud based memory 4401 associated with the control application. This may also be communicated to (4413) and stored in memory 4404 on the user's mobile device. The dispensing event data may include, but is not limited to, the quantity of additive dispensed, the change in level of consumable within the container immediately afterwards, date, time, and the like.

Consequently, historical data about dispensing events may be duplicated and stored both in the user device 4404 and in memory 4401 associated with the control application. Thereby enabling the historical (past dispensing and consumption) data to still be accessible to, and usable by the container processor 4405 to adjust future dispensing if communications between the container 4405 and the control application 4402 are not available. Subsequently, inertial sensors may detect a movement or tilting (4414) of the container assembly, which may prompt the sensors to determine a third level of consumable within the container assembly and communicate that third level (4415) to the application on the user's mobile device 4403. The third level may be further communicated (4415) to the control application 4402. Past dispensing event data may be accessed (4416) from data storage 4401 by the control application 4402 and used to revise a dispensing schedule which is then communicated (4417) to the user device application 4403 and memory 4404. In this example the revised dispensing schedule includes the dispensing of additive B (4418).

Figure 45:
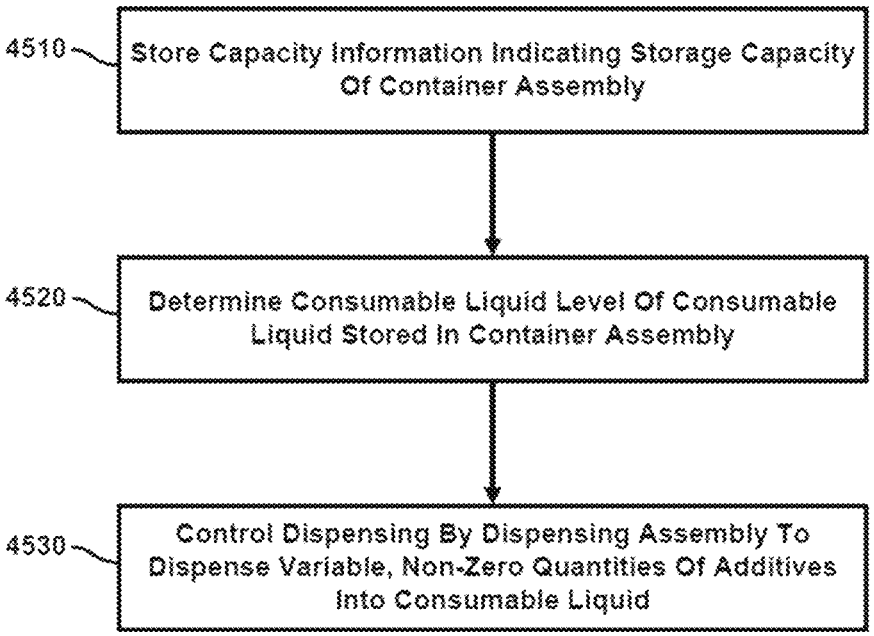
FIG. 45 is a flowchart illustrating an example process for controlling a portable, self-contained beverage apparatus according to one or more embodiments described herein.

FIG. 45 illustrates an example process for controlling a portable, self-contained beverage apparatus. In accordance with one or more embodiments described herein, the process may be performed by or implemented in a beverage apparatus that includes an internally disposed dispensing assembly having a plurality of apertures structured and arranged to receive and retain vessels containing additives to be dispensed into a consumable liquid stored in a container assembly of the apparatus. At 4510, capacity information for the container assembly may be stored, where the capacity information indicates a storage capacity of the container assembly for storing a consumable liquid. At 4520, a consumable liquid level of a consumable liquid stored in the container assembly may be determined. For example, the consumable liquid level may be determined using a sensor device disposed within the container assembly. At 4530, the dispensing assembly may be controlled to dispense variable, non-zero quantities of additives from the vessels retained in the apertures into the consumable liquid based on the determined consumable liquid level of the consumable liquid and the storage capacity of the container.

One or more embodiments of the present disclosure relate to portable containers, specifically, to such containers focused on hydration tracking and the customized and variable dispensing of additives. In at least one preferred embodiment, the aforementioned additives are contained in discrete vessels designed to allow precise, repeatable dispensing of volumes. The methods, systems, and apparatuses described herein should not be understood as limiting, and one skilled in the art will understand that components of the system and apparatuses described may be omitted or expressed more broadly so as to focus on the unique aspects of the disclosure.

In one embodiment, a successful dispense may be ascertained with a mobile application engaging an optical reader to appraise the saturation and/or color of the combined fluid. If the combined fluid is too light and/or under-saturated, a further dispense command may be prompted, in accordance with the existing parameters, to achieve the desired concentration. If, conversely, the fluid is too dark and/or saturated, then a prompt might guide the user to dilute the combined fluid so as to achieve a desired concentration.

In accordance with at least one other embodiment, the system or apparatus may include a lid or other housing oriented upon threads that correspond to a specific, pre-calibrated, compression range. In such an embodiment, a rotary potentiometer or other rotary position sensor or counter may collect data throughout a dispensing event to monitor the quantity or rate of compression (for instance, a quarter twist might correspond to a vertical compression of ⅛th of an inch, and subsequently correspond to 3.5 mL of dispensed volume for a given additive vessel, and/or additive with known characteristics). Such a mechanism allows for an additive vessel with a variable, bursting valve to open temporarily or permanently in a controlled and repeatable fashion. More ideally, the system, apparatus, and method allows for a valve to open and then close, dispensing an additive, while maintaining a pressure equilibrium, thereby preventing water ingress, while maintaining the reliability of the dispensing characteristics of the vessel.

At least one embodiment of the present disclosure allows for real-time modification, creation, and/or maintenance of a functional beverage product based upon contextual data variables, such as weather, physical activity, eating behaviors, and the like. For instance, a recent 'logging' of a meal high in High Density Lipoproteins (HDL) might inform the system that it is now optimal for the user to consume a vitamin mix with a greater density of fat-soluble constituents. Furthermore, if there is a newly realized time-window for a specific additive to be dispensed, the system might dispense that additive into an existing post-mix beverage, thus modifying the beverage, in response to the additional additive, the system might also prompt a dispense event of a 'counter-balance' flavor additive, to retain the same taste and flavor characteristics, in place of or in supplement to the aforementioned step, the system might also prompt the user to fill the container with more fluid so as to sufficiently dilute and/or dissolve the new post-mix beverage to a target level.

Furthermore, one or more embodiments provide a system capable of prompting a user to dispose of a beverage should the ingredients, contents, experience, flavor, taste, or consistency fall outside of a target range, for instance if a degradable supplement is dispensed into a target fluid/solution, and is not consumed within a specific time frame, it may become unpalatable, ineffective, or even harmful to the user, in this case, the system would have information related to the initial dispensing event (the beverage 'creation' time) as well as ambient conditions (such as temperature and humidity) thus providing the system with the necessary insights to formulate a determination as to whether or not the beverage is acceptable, if the beverage is deemed unacceptable, the user could be prompted to dispose of the beverage and to create a new one, or to consume something else as an alternative. The myriad benefits of such a system include: consumer-experience-protection (in so far as the consumer will be less likely to consume a non-optimal beverage, and thus damage their sentiment and/or experience with regard to the beverage brand), improved reliability of nutrition-content tracking (in so far as the consumer will not be improperly tracking nutrients that are no longer viable), and in improved compliance for the beverage makers from a regulatory standpoint (in so far as the created, post-mix beverage is readily adjustable in concentration/strength to precisely and reliably account for ingredient degradation, and thus, create a beverage that reflects the nutrition-facts on the Primary Display Panel (PDP) of the additive vessel).

In alternate embodiments, and/or alternate use-cases, the system enables the guiding of a consumer experience with relation to a dispensing event and to the post-mix beverage that is created by the dispensing event; with prompts either on the portable container itself or on a peripheral device (such as a user's mobile device), the system can instruct the user to add an ice cube or to refrigerate the fluid/water to achieve a target temperature range. This process is accomplished through the placement and/or proximity of thermistors and/or equivalent temperature sensing modalities (such as an infrared system), such that the system is able to measure directly, or infer/extrapolate indirectly, the temperature of the target fluid/water, furthermore, the system is able to execute and present an accurate estimate to guide the user to sufficiently adjust the temperature of the fluid based upon the data it has insights into, the quantity of fluid, the type of fluid (if a dispensing event has occurred), and the Specific Heat Capacity of the fluid, based upon these factors, the system can make an accurate determination as to the exact energy requirements to alter the temperature of the fluid to a specific level. In the aforementioned embodiment, the system can make a determination that the post-mix beverage should be X-degrees cooler, the system also estimates that a standard size ice cube has a capacity to cool this fluid by Y-degrees, and furthermore that a standard size ice cube will dilute the beverage by Z-quantity once melted, the resultant calculation derives that three ice cubes should be added to the beverage to cool it sufficiently, furthermore, the same calculation also derives that the dilutive effect of the added ice cubes will require X-mL of additional additive to counteract the dilutive effect and retain the same flavor/taste profile of the post-mix beverage. In an alternate scenario of the aforementioned, the user might prefer to cool their beverage by placing the post-mix beverage vessel into a refrigerator or freezer, in which case an assumed average cooling rate is applied against the known volume, Specific Heat Capacity of the target fluid, current temperature, and desired temperature, from the preceding variables, the system can derive an estimated length of time that the vessel should be placed in either the refrigerator or the freezer, thus providing the user with the necessary guidance to sufficiently cool their beverage to a targeted point without under- or over-cooling the beverage.

In accordance with aforementioned embodiments, it should be apparent to one of ordinary skill in the art that the methods, systems, and apparatuses of the present disclosure are designed to include a calibrated and repeatable compression of a variably compressible additive vessel, further connected to a direct or indirect measurement mechanism. In the more idealized embodiments, the compression is set in such a way so as to maintain the incrementally compressed state to prevent any water or air ingress, or any other conditional change that would impact the state of the additive and/or future dispensing events. The methods, systems, and apparatuses described herein offer improved performance and user experience over that of existing approaches by specifying user adjustable, and user orientable mechanisms that are guided in some direct or indirect fashion to.

In a more advanced embodiment building upon all the aforementioned embodiments, dispensing events might be recorded or otherwise monitored by a mobile application using acoustic methods. As a non-limiting example, a ratcheted caliper might produce a distinctive 'click' upon being engaged by the user, the click might change in tone, pitch, or volume based upon position and/or dispensing activity, a mobile application monitoring such a sound might be able to subsequently infer to what extent an additive vessel has been dispensed or otherwise acted upon.

In yet at least one embodiment, a mobile application might use a photographic or otherwise optical methodology to record the color, saturation, absorbance, reflection, or other visual property to make an inferential estimation of the target liquids concentration, in this case, as it pertains to taste, nutritional characteristics, and the like.

One or more of the aforementioned embodiments relate to a dispensing system, an adjustable or otherwise personalized dispensing protocol, tracking or otherwise metering of a dispensing event, and user replaceable containers, such that the critical components of the system are interchangeable with various drinking vessels or hydration systems, fitting a user's preferences or use cases.

The above description focuses on an aspect, which is a mechanical feature designed to standardize manual user-input so as to perform a precise, incrementally-defined dispensing event on at least one additive vessel designed for multiple dispensing events and interchangeable use within the same or multiple devices. The system also makes use of an embedded mechanism to track either directly or inferentially, the incremental dispensing, assigning data related and relevant to the dispensing event, such as quantity, rate, volume, place or time of consumption, post-dispense user-adjustments, and the like.

Furthermore, data about a user of the container 100 may be accessible to and/or obtainable by the container (e.g., by a processor or other component of the container 100). For example, the container 100 may receive (e.g., retrieve, access, request, or otherwise obtain) data about the user that is stored, for example, in one or more databases or storage devices 103 local to the user, within an application residing on a device of the user 106 (e.g., a portable user device, such as a cellular telephone, smartphone, personal data assistant, laptop or tablet computer, etc.), and/or in network/cloud data storage 108, 107. In accordance with at least one embodiment of the present disclosure, the data about the user may include, for example, user demographic information (e.g., age, gender, weight, body mass index, etc.), additive purchase history information, additive usage history information, charge/payment information for purchases, and various other data associated with the user or actions of the user. In this manner, such data about the user of the container 100 may be collected, analyzed, and/or communicated by the container 100 (e.g., by a processor and/or other components of the container 100), and made available to the device of the user 106, to one or more other devices of the user, to the one or more databases or storage devices local to the user, to the network/cloud data storage 108, 107, and the like.

Furthermore, one or more APIs (Application Programming Interfaces) from a mobile device application associated with the container 100 may interface with and access data from other applications running on a device of the user (e.g., user device 106), where such data may include, but is not limited to, geo-location, time, local weather conditions, temperature, personal schedule (e.g., from a calendar application), etc. APIs to third party applications may also be used by the container 100 to access user data about the recent physical activity of the user. For example, data may be obtained from a variety of existing or future personal physical activity tracking/monitoring devices (e.g., Fitbit, Apple HealthKit, etc.), any of which can furnish various data related to physical activity of the user. Some non-limiting examples of the type of data that may be obtained from such physical activity tracking/monitoring devices include data about the type of physical activity undertaken by the user, the number of steps taken by the user during a period of time, speed of motion, estimated energy expenditure (e.g., calories burned), etc. Accordingly, data about the user's physical activity levels and activity history may be collected, analyzed, and/or communicated by the container 100 (e.g., by a processor and/or other components of the container 100). All or a portion of the data described above may be communicated to or otherwise retrieved by one or more processors which may be located within the consumable container 100 or external to the consumable container 100 (e.g., in the user's mobile device 106, in the cloud network 108, etc.), where the data may be used to derive more specific and focused patterns and trends about an individual's activity, purchase, and/or consumption behaviors.

Therefore, data about a user's consumable liquid consumption and/or a user's additive consumption may be communicated from the container (or from an associated mobile device) to an eCommerce system. In accordance with one or more embodiments of the present disclosure, such data communicated to the eCommerce system and/or to other systems may include any of the following non-exhaustive and non-limiting examples: (a) Data about the additives including, but not limited to the types of additive, the amount initially in the vessel, the date/time that vessel was inserted in the container, the total amount dispensed, the date/time and frequency with which the additive was dispensed, the concentration levels and limits, the mix of additives typically combined and inserted in container together and the like. (b) Data about the consumable liquid including, but not limited to the level of consumable in the container at any time, the level prior to and after each dispensing event, the amount consumed on an hourly, daily or other time period, variation in consumption rate over a time period and the like. (c) Data about the user of the container including, but not limited to the user's age, gender, weight, the types and quantities of additives previously consumed, user preferences, etc. (d) Data about the context of use, for example, the number of steps the user has walked this day and previous days, geo-location, direction and/or speed of movement of the user (e.g., to identify when the user is walking, jogging, cycling, etc.), time of day, time zone, local weather conditions, etc.

In accordance with at least one embodiment, the eCommerce system may have access to stored data about the user's additive purchase history including, for example, what was purchased, when and in what combinations such purchases were made, the frequency of reordering additives, etc. Furthermore, inertial sensors in the container may additionally communicate data including when a container is tilted for the purposes of drinking and the duration that it was tilted, as an indicator of the volume of consumable consumed.

Accordingly, data from various sources can be processed and combined to track an individual's purchase and consumption patterns. The following presents some exemplary use cases to further illustrate such features of the present disclosure.

A user generally consumes 4 liters of consumable liquid per day but analysis of this data over a period a several days indicates that the consumption level is decreasing and will shortly pass below a recommended threshold level. As a result, an alert indicating that the user should increase consumption may be communicated to the user via, for example, a mobile device associated with the user, or via a display on the consumable container, or the like.

A user generally consumes 5 ounces (oz.) of flavoring A, 2 oz. of vitamin B, and 1 oz. of nutritional supplement C in a certain time period. This relative consumption data may be used to recommend bundled packages of additive purchases which are closely aligned with that user's predicted consumption patterns. As the relative consumption quantities of the user change over time, the bundled packages recommended by the system change accordingly.

A user purchased N additive vessels (where "N" is an arbitrary number) of a certain type on a certain date, and the rate of dispensing of that additive indicates a likelihood that the user will run out of supplies on some date subsequent to the purchase. An alert or message advising the user to order new supplies and providing an immediate way of doing so may be communicated to the user via, for example, a mobile device associated with the user, or via a display on the consumable container, or the like.

A user consumes different additives when in different locations. For example, the user consumes more energy boosting additives when at location A, which is visited on a regular weekly schedule or basis. This might suggest that location A corresponds to a gym or fitness facility. Consequently, tracking location and movements enables more accurate prediction of likely future additive purchase needs. The processor of the container assembly also has access to data about the user such as settings, preferences and personal/demographic data, which may be locally stored in onboard memory within the container and/or in the mobile device memory. The processor may additionally have access to data about other consumables such as snack bars, which the user may eat and this data may be imported into the system independently of the measurement and identification of consumable liquid using an RFID antenna or similar method, by manual input by the user, or by other means.

All of the above listed data may be communicated to a processor associated with an eCommerce site from where the additives were obtained, the processor additionally having access to the user's purchase history stored within. Various combinations of these rich data sources can then be made accessible to a data analytics and recommendation engine to generate recommendations to the user about short term actions for example, drinking more consumable liquid and/or long term actions for example purchase recommendations, which may be communicated to the user via the mobile device, via a display on the portable container or by other means. Individual purchase and consumption data may be aggregated across a population of users and used to determine broader patterns, some exemplary use cases are as follows:

The types of additives generally purchased and consumed may be different in different areas of the country (which might be expected due to various factors including variations in climate for example). This data may be used to influence the advertising and marketing of additives in different regions. Sales of an additive may show a short term spike following an advertising campaign in a specific region of the country. This data can be used to quantify the impact of advertising and marketing campaigns. A proportion of a population may set a concentration level of a flavoring additive higher than that which is recommended, this data suggests that the recommendation should be changed. There may be an increase in the purchase and consumption of certain health supplements at the beginning of winter, this data suggests that the cold & flu season may be starting.

Users who bought additives a, b and c, also tend to buy additives c and d, therefore this correlation may be factored into the additive recommendation engine.

In accordance with one or more embodiments, population trends may be determined according to, for example, one or more of the following: (1) location, such as regional preferences for additives (e.g., at country, state, town, and/or zip code levels), location hotspots for additive consumption (e.g., health club geolocation); (2) time, such as additive consumption trends by time of day, by day of week, seasonal trends by month and long term consumption trends over years, indicating long lifecycle trends and changes in population taste and preference; and (3) time and associated event, such as advertising campaigns, transient health alerts (e.g., pandemics, outbreaks, etc.), flu outbreaks, city marathons and other public sporting events. It should be understood that there are many ways in which the additive, consumable, consumption and user data may be combined with location, activity and other context data and further combined with purchase history data in order to generate purchase recommendations of vale and benefit to the user of a portable container.

Functional beverages increasingly account for a larger portion of revenue share in the global beverage industry. These beverages are characterized broadly in their attributes focused on cause-and-effect nutritional goals, such as energy drinks for example which might exploit B-Vitamins and Caffeine, or relaxation beverages for example, which might exploit Valerian Root and Melatonin, and the like. These beverages exploit ingredients that are in some cases water-soluble, however it is not a limiting factor, as complete or partial emulsions are readily sold, and accepted. In the prior art, systems that segregate the solute from the solution (in this case, active ingredients or degradable vitamins) account for the degradation concerns of the constituent ingredients, which in most cases relates to the biological efficacy and availability of a soluble vitamin complex, whereby the solubilized vitamin components lose their efficacy as a result of being mixed.

What is lacking in the prior art however is a system that allows for multiple functional additives to be stored carried, or otherwise made available for a target solute, and for such functional additives to be variable in a non-zero sense in their dispensing behaviors, specific to the customized creation and/or maintenance of a functional beverage. Whereby functional beverage products are dynamically "created" from non-functional beverage products, in constantly variable ways, without necessitating compromise on product integrity and/or experience. Furthermore, a functional beverage containing degradable products can be dynamically maintained such that the functional contents of a solute maintain their functional characteristics independently of degrading external conditions. The embodiment of the present disclosure relates specifically to such a system, designed to accomplish the aforementioned, as well as to specifically address the dynamic needs of functional products and the like. It should be obvious to one learned in the art, that such a system should not be limited to functional beverage products, and that an identical embodiment would have applicability across a wide range of consumable-oriented scenarios, including but not limited to medicines, supplements, beverages, and the like.

The system of the disclosure allows for dynamic transformation of non-functional beverages into functional beverages, without necessitating reformulation at the bottling site, and without necessitating a change in the user experience of the beverage as it relates to taste, consistency, density. The system thus permits for dynamic creation of functional beverages in customized, personalized fashion, without requiring homogenous system-level reformulation, and without compromising on product integrity.

In at least one embodiment, the disclosure allows for real-time modification, creation, and/or maintenance of a functional beverage product based upon contextual data variables, such as weather, physical activity, eating behaviors, and the like. For example, a recent 'logging' of a meal high in High Density Lipoproteins (HDL) might inform the system that it is now optimal for the user to consume a vitamin mix with a greater density of fat-soluble constituents, thereby prompting the dispensing mechanism in the present disclosure to orient upon the target additive vessel (or vessels) and to further drive the electromechanical elements responsible for delivering a dispense-triggering force in a manner that corresponds, according to the known variables, to a particular dispense volume and corresponding concentration that accounts for the new user conditions.

Furthermore, if there is a newly realized time-window for a specific additive to be dispensed, the system might dispense that additive into an existing post-mix beverage, thus modifying the beverage, in response to the additional additive, the system might also prompt a dispense event of a 'counter-balance' flavor additive, to retain the same taste and flavor characteristics, in place of or in supplement to the aforementioned step, the system might also prompt the user to fill the container with more fluid so as to sufficiently dilute and/or dissolve the new post-mix beverage to a target level.

Furthermore, the system may prompt a user to dispose of a beverage should the ingredients/contents/experience/flavor/taste/consistency fall outside of a target range, for instance if a degradable supplement is dispensed into a target fluid/solution, and is not consumed within a specific time frame, it may become unpalatable, ineffective, or even harmful to the user, in this case, the system would have information related to the initial dispensing event (the beverage 'creation' time) as well as ambient conditions (such as temperature and humidity) thus providing the system with the necessary insights to formulate a determination as to whether or not the beverage is acceptable, if the beverage is deemed unacceptable, the user could be prompted to dispose of the beverage and to create a new one, or to consume something else as an alternative. The benefits of such a system include: consumer-experience-protection (in so far as the consumer will be less likely to consume a non-optimal beverage, and thus damage their sentiment and/or experience with regard to the beverage brand), improved reliability of nutrition-content tracking (in so far as the consumer will not be improperly tracking nutrients that are no longer viable), and in improved compliance for the beverage makers from a regulatory standpoint (in so far as the created, post-mix beverage is readily adjustable in concentration/strength to precisely and reliably account for ingredient degradation, and thus, create a beverage that reflects the nutrition-facts on the Primary Display Panel (PDP) of the additive vessel).

In alternate embodiments, and/or alternate use-cases, the system enables the guiding of a consumer experience with relation to a dispensing event and to the post-mix beverage that is created by the dispensing event; with prompts either on the portable container itself or on a peripheral device (such as a user's mobile device), the system can instruct the user to add an ice cube or to refrigerate the fluid/water to achieve a target temperature range. This process is accomplished through the placement and/or proximity of thermistors and/or equivalent temperature sensing modalities (such as an infrared system), such that the system is able to measure directly, or infer/extrapolate indirectly, the temperature of the target fluid/water, furthermore, the system is able to execute and present an accurate estimate to guide the user to sufficiently adjust the temperature of the fluid based upon the data it has insights into, the quantity of fluid, the type of fluid (if a dispensing event has occurred), and the Specific Heat Capacity of the fluid, based upon these factors, the system can make an accurate determination as to the exact energy requirements to alter the temperature of the fluid to a specific level. In the aforementioned embodiment, the system can make a determination that the post-mix beverage should be X-degrees cooler, the system also estimates that a standard size ice cube has a capacity to cool this fluid by Y-degrees, and furthermore that a standard size ice cube will dilute the beverage by Z-quantity once melted, the resultant calculation derives that three ice cubes should be added to the beverage to cool it sufficiently, furthermore, the same calculation also derives that the dilutive effect of the added ice cubes will require X-mL of additional additive to counteract the dilutive effect and retain the same flavor/taste profile of the post-mix beverage. Furthermore, in an alternate embodiment of the scenario in the aforementioned, the user might prefer to cool their beverage by placing the post-mix beverage vessel into a refrigerator or freezer, in which case an assumed average cooling rate is applied against the known volume, Specific Heat Capacity of the target fluid, current temperature, and desired temperature, from the preceding variables, the system can derive an estimated length of time that the vessel should be placed in either the refrigerator or the freezer, thus providing the user with the necessary guidance to sufficiently cool their beverage to a targeted point without under- or over-cooling the beverage.

The portable beverage creation system described in at least one embodiment of the present disclosure can also account precisely, and adjust or otherwise maintain, with an environmental and time dynamic, the functional characteristics of a beverage that might degrade over time, or upon exposure to particular conditions, lose their efficacy. The system thus dispenses additives and/or functional ingredients in response to the user requirements and/or preferences, but also in response to the chemical sensitivities of the ingredients themselves. In yet at least one embodiment of the aforementioned, the dispensing modality can take into account and adjust for the time degradation of the functional ingredients within readable additive vessels such that a consistent functional concentration can be dispensed reliably whether that requires the dispensing system to dispense a larger or smaller net quantity by volume of the additive, the mechanism would be capable of maintaining the functional characteristics of the ingredient in question. Furthermore, as an additional step of the aforementioned, the system would be capable of addressing flavor aspects of the aforementioned action, for example, if the additive requires an extra 5 mL to maintain its functional properties, said additive might alter the flavor and/or user experience of the composite beverage, in response, the dispensing mechanism would dispense an appropriate and corresponding quantity of the flavor additive.

In accordance with at least one embodiment, the system leverages a read/write capability and interface between the additive vessel and the dispensing system or dispensing module, encoded within the communicable data element of the additive vessel is information relevant to the dynamic qualities of the contents of the additive vessel, such information might include: the bottling date, temperature of storage facilities, time of opening, transit time, local storage conditions, etc. All the aforementioned data points can be reliably encoded in simple, purely numeric form on an RFID tag or equivalent data structure. The RFID tag in the preferred embodiment has information unique and specific to the bottling location, time, date, and the contents of the additive vessel.

Leveraging this data, and reconciling it against known content dynamics, the dispensing system can infer the state of degradation of a particular ingredient or a plurality thereof, and subsequently adjust for said degradation by adjusting dispense-rate and/or dispense-volume. The mechanism adjusts for the degradation two-fold; first by adjusting for gross degradation of the vessel contents itself, thereby adjusting the entire dispensing protocol (in a simple example, an assumed degradation rate of 10% might result in an increase of dispense volume by 10%, thereby neutralizing the impact of the degradation from a potency/effectiveness/functional standpoint.) Building upon the aforementioned, and leveraging a similar protocol, the rate of consumption combined with local conditions might result in a calculation that infers that at least one ingredient in a functional solute has degraded in potency/effectiveness/functionality and subsequently needs adjusting as a result, thus impacting the dynamics of the mixed beverage itself, as opposed to making a gross adjustment accounting for the vessel. It is reasonable that in most cases, both approaches would be deployed to complement one another. Thus, the system would make a general adjustment for an initial dispensing event, and then upon the creation of the mixed beverage, the dispensing system would adjust the beverage to maintain key functional aspects of a degradable ingredient or ingredients.

An element of this embodiment is impact on the supply-chain and storage of functional ingredients. The present approach necessitates the destruction of products that no longer contain the stated daily-values (DV) of a key ingredient or ingredients. This is especially pronounced in FDA regulated vitamins and supplements, whereby a product with 80% DV of Vitamin-E (as an example) would be out of compliance, should the actual DV in a serving fall outside of an acceptable range. In the case where the embodiment of the present disclosure is implemented effectively, the data underlying the system would inform the dispensing mechanism of this degradation, and thus, seamlessly adjust for it. The result being a post-mix beverage of identical functional characteristics, independent of component-level degradation in the additive vessel/s. The embodiment of the present disclosure subsequently enables for significantly decreased waste of products subject to degradation that might render them unsellable despite their ultimate consumable, sanitary state.

In at least one embodiment, the portable container might leverage onboard sensors such as Near Infrared Spectroscopy (NIRS) within the electromagnetic spectrum (generally considered between 700 nm and 2500 nm) In the preferred embodiment, Emitters and Receivers leveraging this technique directly extrapolate hydration, blood oxygenation levels, pulse/heart-rate levels, and blood sugar/glucose levels from a user's hand or lips, providing the device with highly accurate real-time data relevant not only to hydration guidance but also to the recommendation and/or deployment of the additives themselves. The monitoring of the biological markers via NIRS (blood oxygenation, pulse/heart-rate, heart rate variability, and hydration level (absolute tissue saturation, or $StO_2$)) serves a two-fold purpose for providing insight towards dispensing recommendations based upon existing biological state, as well as to track the users' reactions (or lack thereof) to specific ingredients. In the preferred embodiment, NIRS techniques are leveraged as they require little to zero preparation of any sample, and also do not require direct measurement of a mass or liquid. The NIRS spectra in the preferred, and more efficient embodiment does not require a direct process and extrapolation of the spectra, instead, it requires that the spectra be processed and compared against a library of known spectra accounting for distinctive features of targeted variables. Preferred techniques include Partial Least Squares (PLS), PLS Regression, and Principal Components Analysis. NIRS technique emitters and/or receivers are mounted in such a way as to monitor the hand of the user, on the portable beverage container, and/or for the lips of the user by placing the emitters and/or receivers on the drinking spout, oriented in a way to obtain data from the capillary bed on the inside wall of the lower lip, in the ideal embodiment. One learned in the art will understand that identical or equally insightful results could be produced with differing placement of such a system. Furthermore, this aforementioned real-time data would be associated with activities, locations, and/or environmental conditions, identifying validity/invalidity in associated data sets with wearable technology devices and or other activity and/or physiological data trackers or monitoring devices. For instance, the sensors might detect a higher than normal dehydration rate and/or electrolyte loss-rate associated with a specific activity, thus developing the relevant feedback loop to recommend a more precise hydration protocol and/or additive recommendation/purchase/dispense cycle.

In yet at least one embodiment, the portable container might leverage onboard sensors to monitor the inflammatory response of the user to correlate metabolic reaction/response to various ingredients. One with an ordinary understanding of the art will understand that other bio-markers and/or physiological data points could be measured or otherwise monitored, and that such bio-markers and/or data points could be measured or otherwise monitored through a variety of sensor and/or data collection techniques or implementations. Such approaches might include galvanic skin response, heart-rate, temperature, absolute tissue saturation, oxygen saturation, blood-pressure, and the like, depending on what health aspects are being evaluated, and which additives and/or substances are being evaluated, different approaches, techniques, sensors, and/or data sets might be considered. Such a system might then operate to identify nascent, or previously unidentified allergies and/or sensitivities.

Furthermore, in a similar fashion, monitoring the feedback loop between additives consumed and/or logged food, and/or the aforementioned in isolation or combination, against physical activity in a fitness sense, in aggregate, would allow for the system to identify or otherwise make recommendations as to what additives, foods, and the like contribute most effectively to an individual's performance and health, whether correlated and/or extrapolated by fitness data, by sleep data, by self-reporting via the portable container, and/or by a peripheral device (e.g. a user application on a mobile device, etc.) In accordance with the aforementioned, the data loop associated with the device is itself a refinement engine for a recommendations platform for the discovery, recommendation, purchase, dispensing, and/or consumption of additives and/or substances dispensed, tracked, or otherwise utilized by the overall system described herein, these recommendations might be further compared or otherwise evaluated against subsequent use-cases, further refined by user characteristics in the aforementioned, thereby identifying false-positives, false-negatives, true-positives, and true-negatives with regard to recommendations and/or predictions against known data.

In at least one embodiment, the portable container might leverage the capabilities of both the device itself, and the supporting data and network mechanisms to adjust the functional elements of additives and/or beverage products, within contexts of user characteristics, user preferences, user use-cases, environmental conditions, and prior data associated with any of the aforementioned, oriented around predictive recommendations.

Figure 46A:
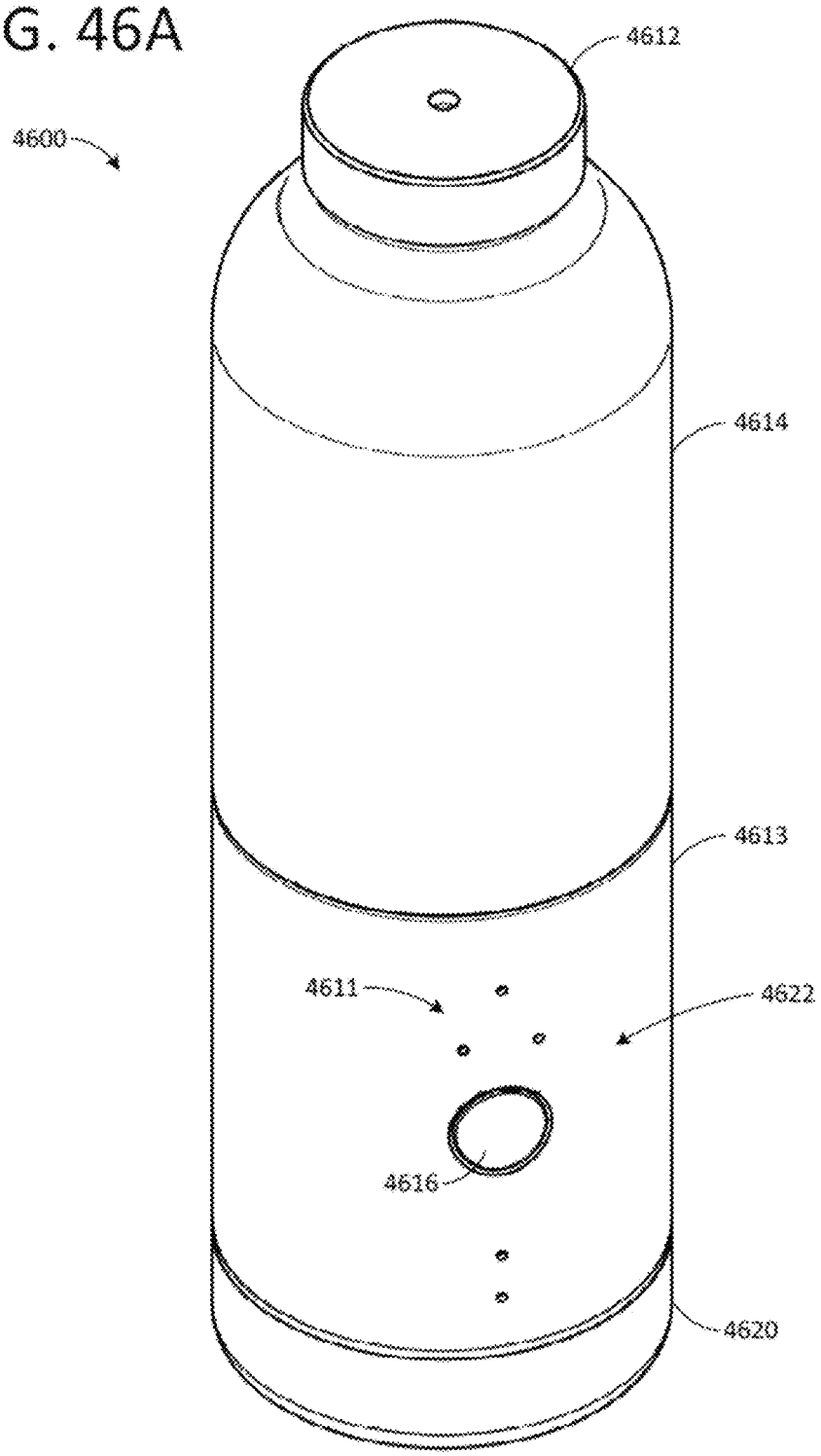
FIGS. 46A and 46B illustrate a beverage container assembly in accordance with one or more additional embodiments.
Figure 46B:
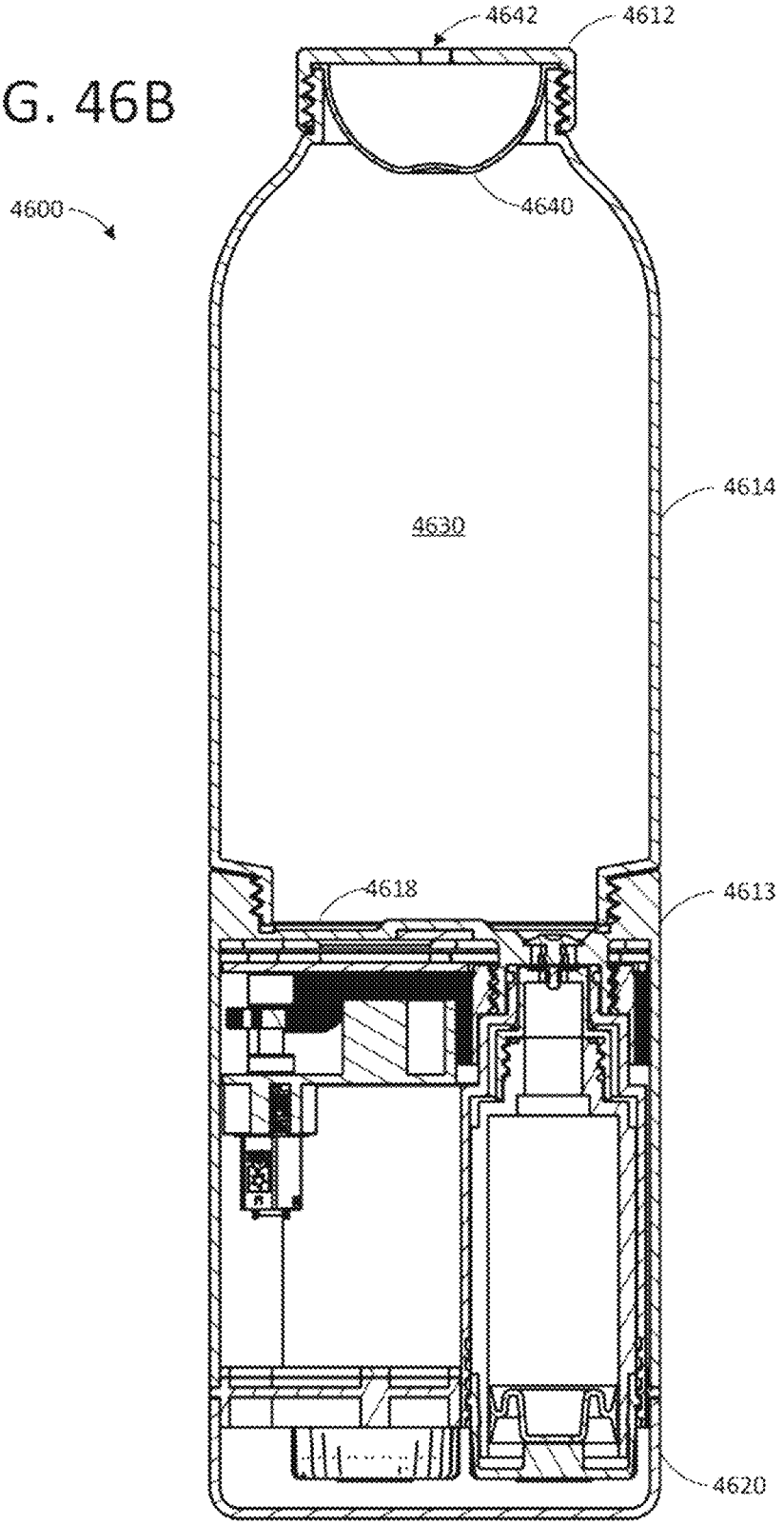

FIGS. 46A and 46B illustrate a beverage container assembly 4600 in accordance with various embodiments that will be shown in further detail in subsequent FIGS. 47-55 and the corresponding further description that follows. As will be understood by one skilled in the art, the various features and functionality described above and elsewhere in this disclosure can be applied, combined and used in conjunction with the container assembly 4600 in accordance with the various embodiments described below.

FIG. 46A illustrates an isometric view while FIG. 46B illustrates a cross section cutaway view of the beverage container assembly 4600, in accordance with one or more embodiments. The beverage container assembly 4600 includes a beverage chamber housing 4614, which forms a portion of a chamber 4630 to contain a beverage. The beverage chamber housing 4614 can be configured with an open threaded base that threads on to a top end of a dispensing assembly 4613. A top portion of the dispensing assembly 4613 can include a platform 4618, which can form a bottom half of the chamber 4630 to contain the beverage. The dispensing assembly 4613 can house containers of additives to be dispensed into the chamber 4630, a dispensing mechanism configured control the addition of the additives, and electronics configured to control the dispensing mechanism. A removable base cover 4620 can be configured to thread on to and off of a bottom end of the dispensing assembly 4613 in order to provide access to insert and remove containers of additives. Consistent with the description above, each of these containers of additives will be referred to below as an additive vessel 4802 (see FIGS. 48A, 49A and 49B).

The container assembly 4600 can include a removable cap 4612, which, in the illustrated embodiment, seals a top opening of a beverage chamber housing 4614 to complete the chamber 4630. The cap 4612 can be configured to thread or snap on to a top end of the beverage chamber housing 4614. Referring to FIG. 46B, in one embodiment, the cap 4612 includes a compressible bladder 4640 formed of silicone or other suitable rubber, that allows for deformation of the bladder so as to accommodate the addition of liquid additives into the chamber 4630 by the dispensing assembly 4613. The cap 4612 also includes an air passageway 4642 to allow air to escape from behind the bladder 4640 so that the bladder can compress to accommodate the addition of the liquid additives.

Referring to FIG. 46A, the dispensing assembly 4613 can be further configured with a user interface 4622, which can include a display 4611 and one or more user input buttons 4616. In the illustrated embodiment of FIG. 46, the display 4611 includes five LEDs, with three LEDs in a triangle that can be configured to indicate selection of one of three additive vessels. Another LED can be configured to indicate a power on or wake up condition of the dispensing assembly, and yet another LED that can be configured to indicate that a dispensing of an additive to the beverage chamber housing 4614 has been selected. The LEDs may use specific lensing or may be embedded behind a micro-perforated material to abstract the user from the physical components of the LEDs. In one embodiment, a single user input button can be configured as a multi-function button to perform different actions depending on the amount of pressure applied to it by the user, by duration of presses and/or by quantity of presses. The button can also be configured to accommodate partial or complete depression of the differentiated by a perceptible detent or click in order further provide varied functionality. The user interface can provide a means for the user to, for example, dispense an additive from an additive vessel or display the current battery level of the system and apparatus.

Figure 47:
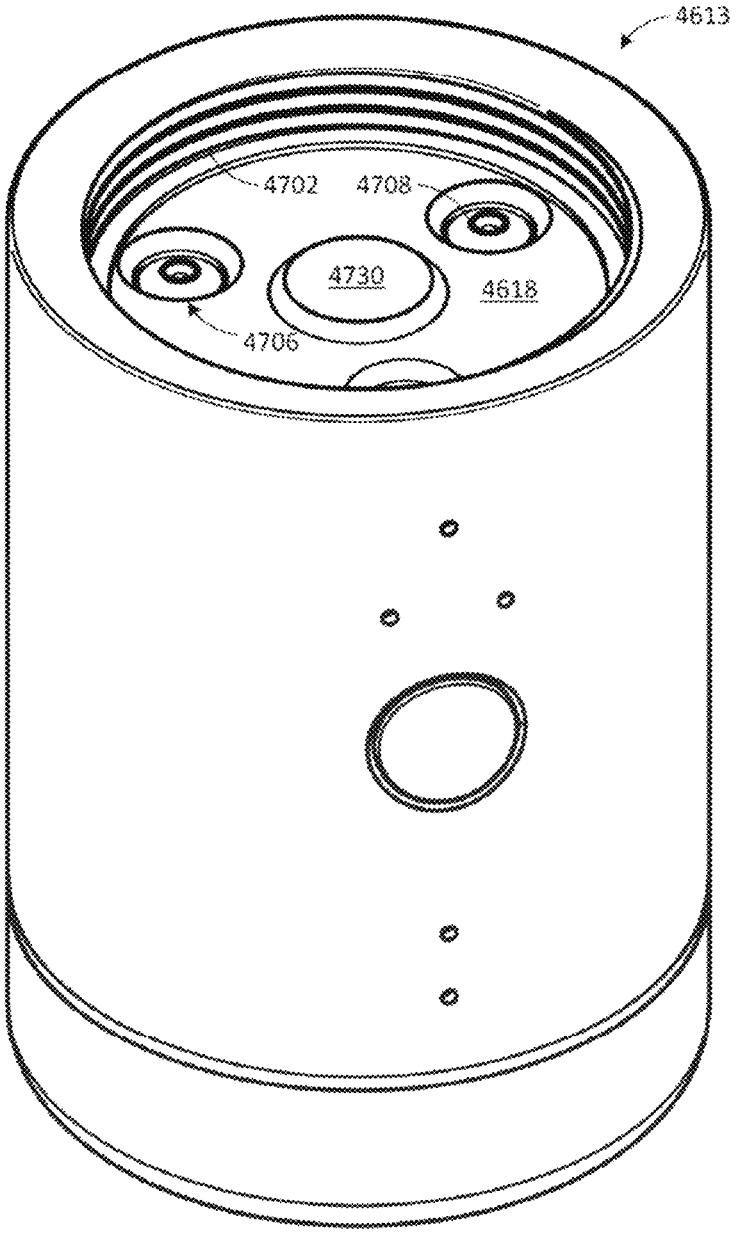
FIG. 47 illustrates a view of a dispensing assembly with a beverage chamber housing removed.

FIG. 47 illustrates a view of the dispensing assembly 4613 with the beverage chamber housing 4614 removed. A top portion of the dispensing assembly 4613 includes an annular wall with threads 4702 that engage with matching threads on the beverage chamber housing 4614. The top portion of the dispensing assembly 4613 can also include the platform 4618 to form a base for the beverage chamber housing 4614 in order to contain the beverage within the chamber 4630. The platform 4618 can include one or more outlet ports 4706 through which additives are added to the beverage in the chamber, and in the illustrated embodiment, three such ports are shown. In one embodiment, each port 4706 can be sealed by a one-way valve 4708 (e.g. an umbrella valve of rubber or silicone) that permits one way passage of a liquid additive into the chamber. As will be discussed below, each one-way valve 4708 can form part of a pumping mechanism 5002 (FIG. 50) that injects liquid additives into the chamber. In one embodiment, the pumping mechanism 5002 is a reciprocating positive displacement pump.

FIG. 47 also illustrates an ultrasonic fluid level sensor 4730 disposed on or within the platform 4618. In accordance with one embodiment, the fluid level sensor 4730 uses round trip time for a reflected sound wave to measure the height of a fluid or water column within the chamber 4630 and thereby infer fill volume.

Figure 48A:
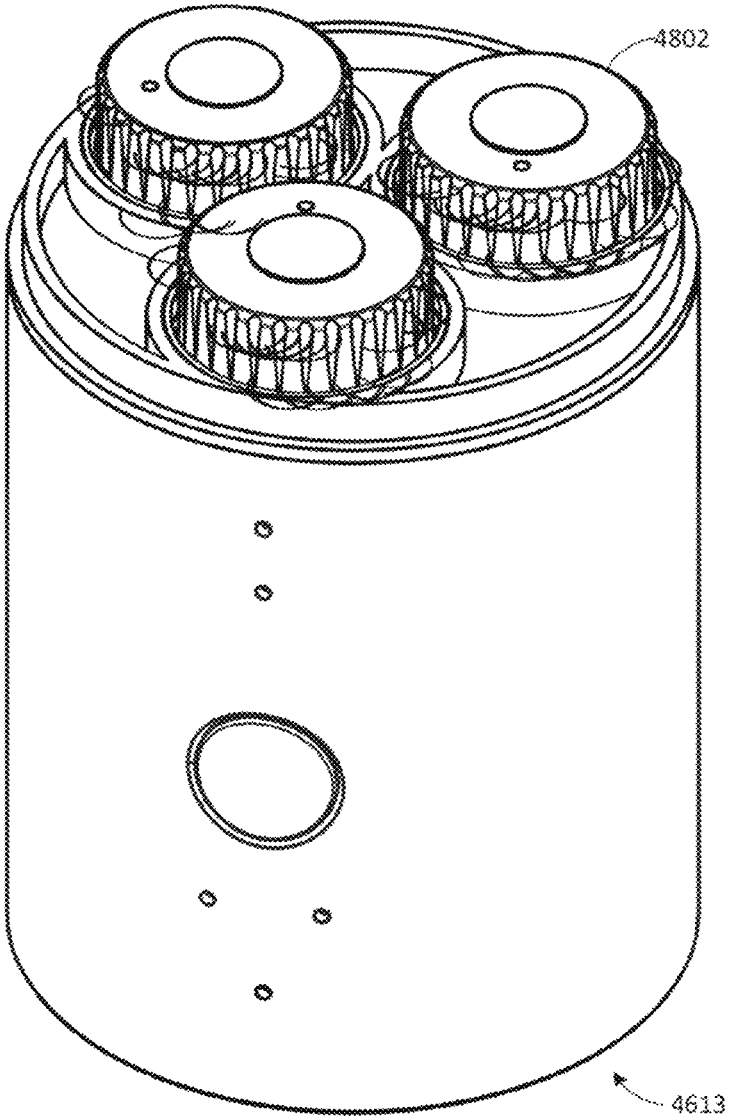
FIGS. 48A and 48B illustrate a bottom view of the dispensing assembly with a base cover removed.
Figure 48B:
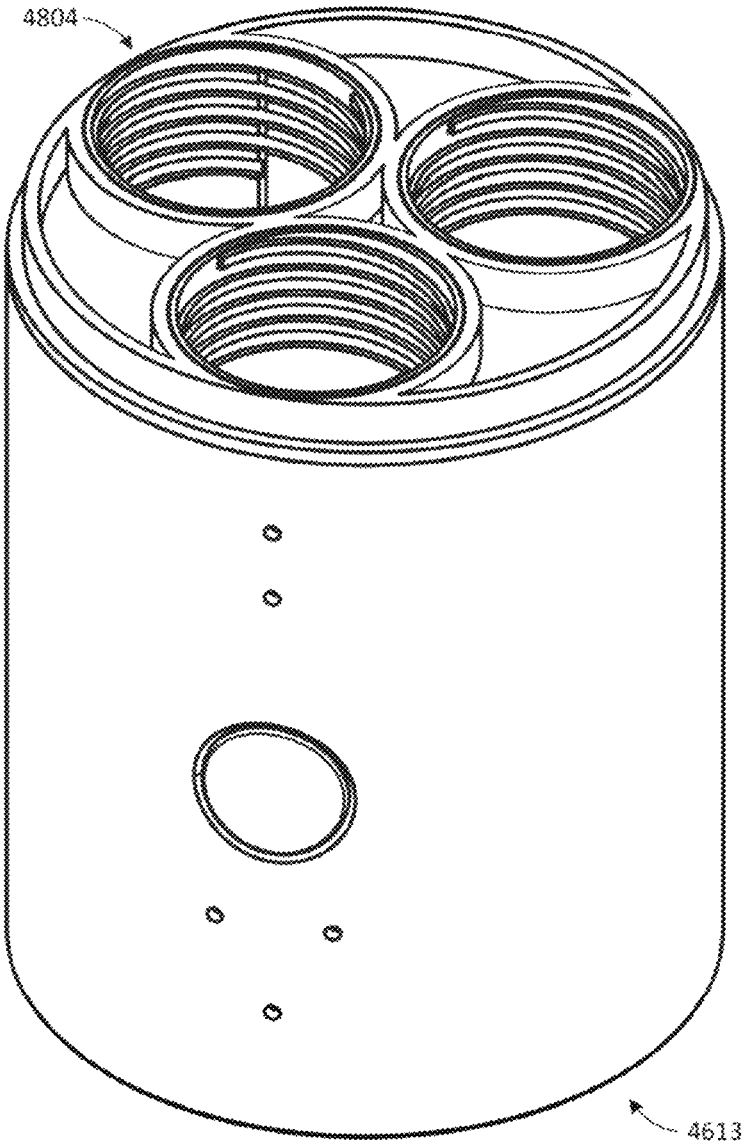

FIGS. 48A and 48B illustrate a bottom view of the dispensing assembly 4613 with the base cover 4620 removed. FIG. 48A shows the ends of each of three additive vessels 4802 that are threaded into three corresponding receptacles or apertures 4804 shown in FIG. 48B. While the term "receptacle" is used in the description that follows, for the purpose of consistency with various embodiments described above, the receptacles 4804 can also be referred to as "apertures".

It should be noted that FIG. 48A shows, near the vessels 4802, a number of semicircular artifacts that could not be easily removed from an available CAD rendering. These artifacts do not form any part of the illustrated embodiment and should be ignored by the reader.

Figure 49A:
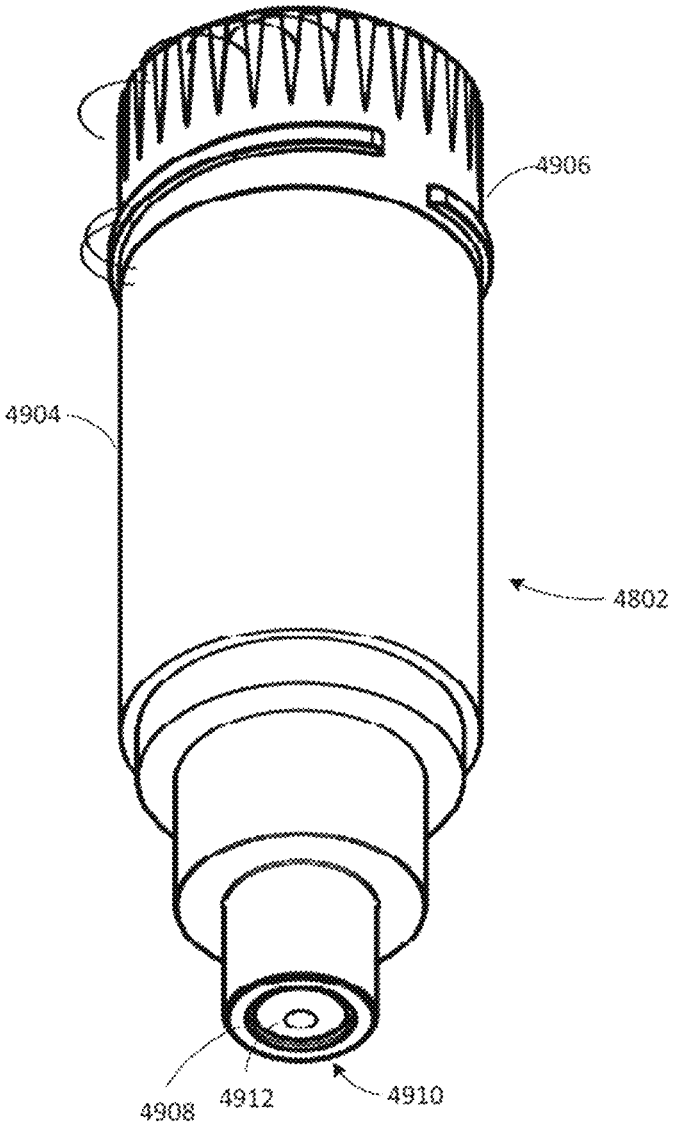
FIGS. 49A and 49B illustrate an isometric perspective view and a cross section cutaway view of an additive container in accordance with one embodiment.
Figure 49B:
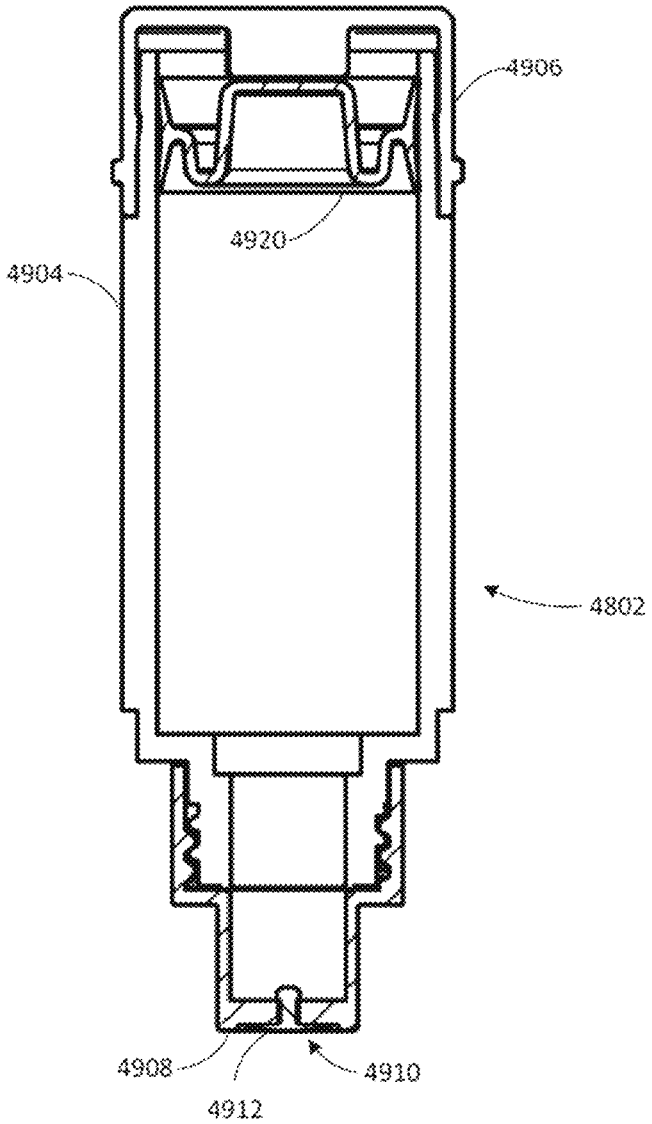

FIGS. 49A and 49B illustrate an isometric perspective view and a cross section cutaway view of an additive vessel 4802 in accordance with one embodiment. The vessel 4802 can include a housing 4904, which can be cylindrical in shape to fit into a corresponding cylindrically shaped receptacle 4804. At a proximal end, the housing 4904 can be covered with a threaded cap 4906, which snaps onto the housing 4904 and the threads of which also engage with receiving threads in a receptacle 4804 to lock the additive vessel 4802 in place within the dispensing assembly 4613. At a distal end, the vessel 4802 includes a piston head 4908 that includes a port 4910 that is capped by another one-way valve 4912 (e.g. an umbrella valve of rubber or silicone). The port 4910 and one-way valve 4912 function to permit additive to flow in only one direction from the vessel 4802 and into a pumping chamber 5011 of the pumping mechanism 5002 (FIG. 50).

Referring to FIG. 49B, a slideable plunger 4920 is disposed within an interior portion of the housing 4904. The interior of the housing and the exterior of the plunger can be a matching cylindrical shape such that the plunger can slide along the length of the housing, from the proximal to the distal end of the housing as additive contained within the housing is dispensed from the vessel. The plunger is preferably formed of soft plastic such as LDPE that seals against the interior of the housing and moves so that no air is allowed into the vessel 4802 during dispensing of the additive.

Figure 50:
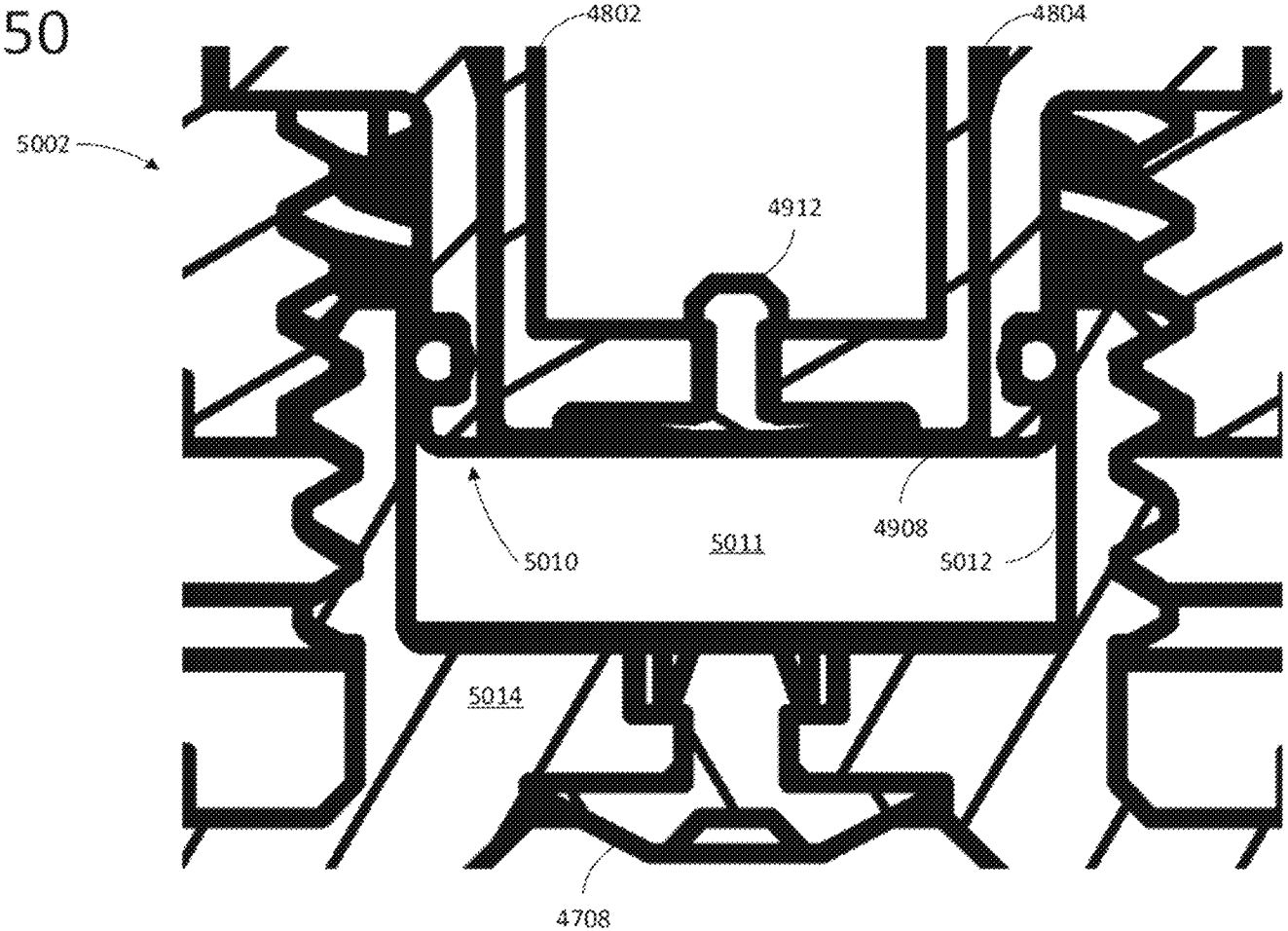
FIGS. 50 and 50A-C illustrate a cutaway cross section of the dispensing assembly showing the operation of a pumping mechanism for an additive container.
Figure 50A:
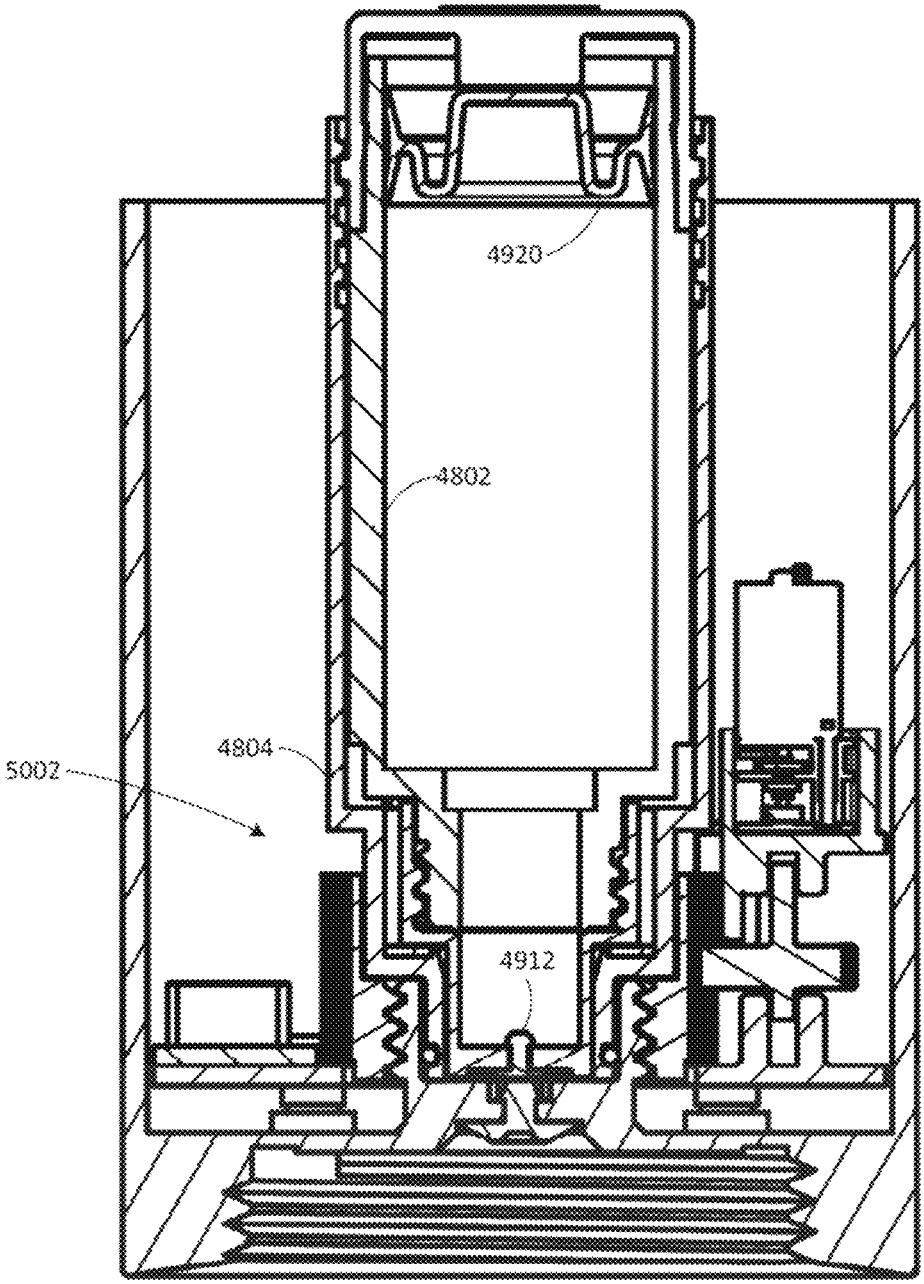
Figure 50B:
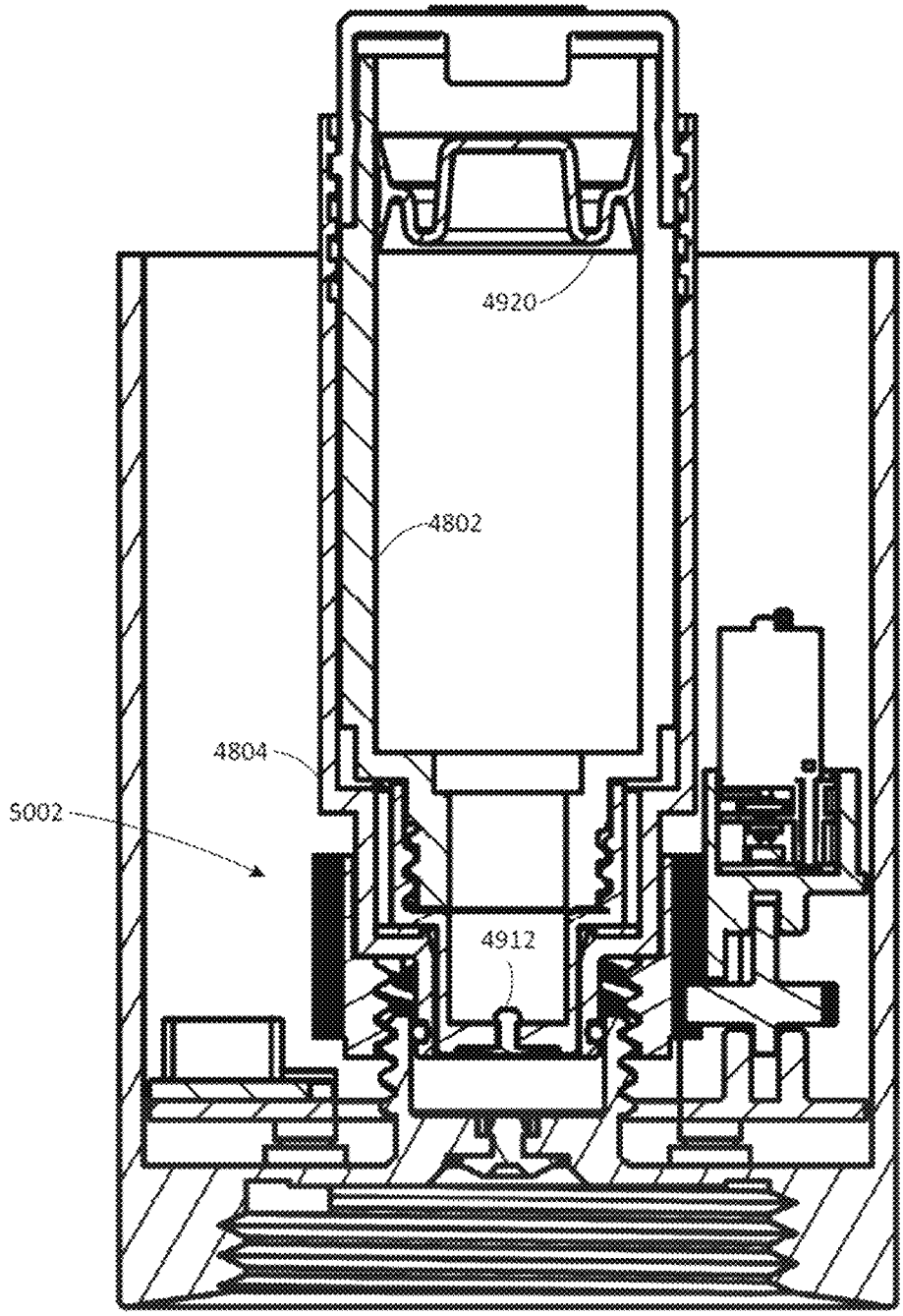

FIGS. 50 and 50A-C illustrate a cutaway cross section of the dispensing assembly showing the operation of the pumping mechanism 5002 for an additive vessel 4802. FIG. 50 shows an enlarged view of a portion of FIG. 50B showing the pumping mechanism 5002 in a partially actuated state. As illustrated, the vessel 4802 is threaded into the receptacle 4804 such that the piston head 4908 of the vessel 4802 engages with a housing of the receptacle to form a piston 5010. The piston 5010 can slide back and forth within a pumping chamber 5011 formed by a cylinder 5012 of a pump housing 5014. As noted above, the piston head 4908 includes a one-way valve 4912 that permits flow from the vessel 4802 into the pumping chamber 5011. At an opposite end of the chamber 5011 from the piston head 4908, the second one-way valve 4708 permits liquid additive to flow from the pumping chamber 5011 into the beverage chamber as the piston 5010 moves forward in the cylinder 5012.

Figure 50C:
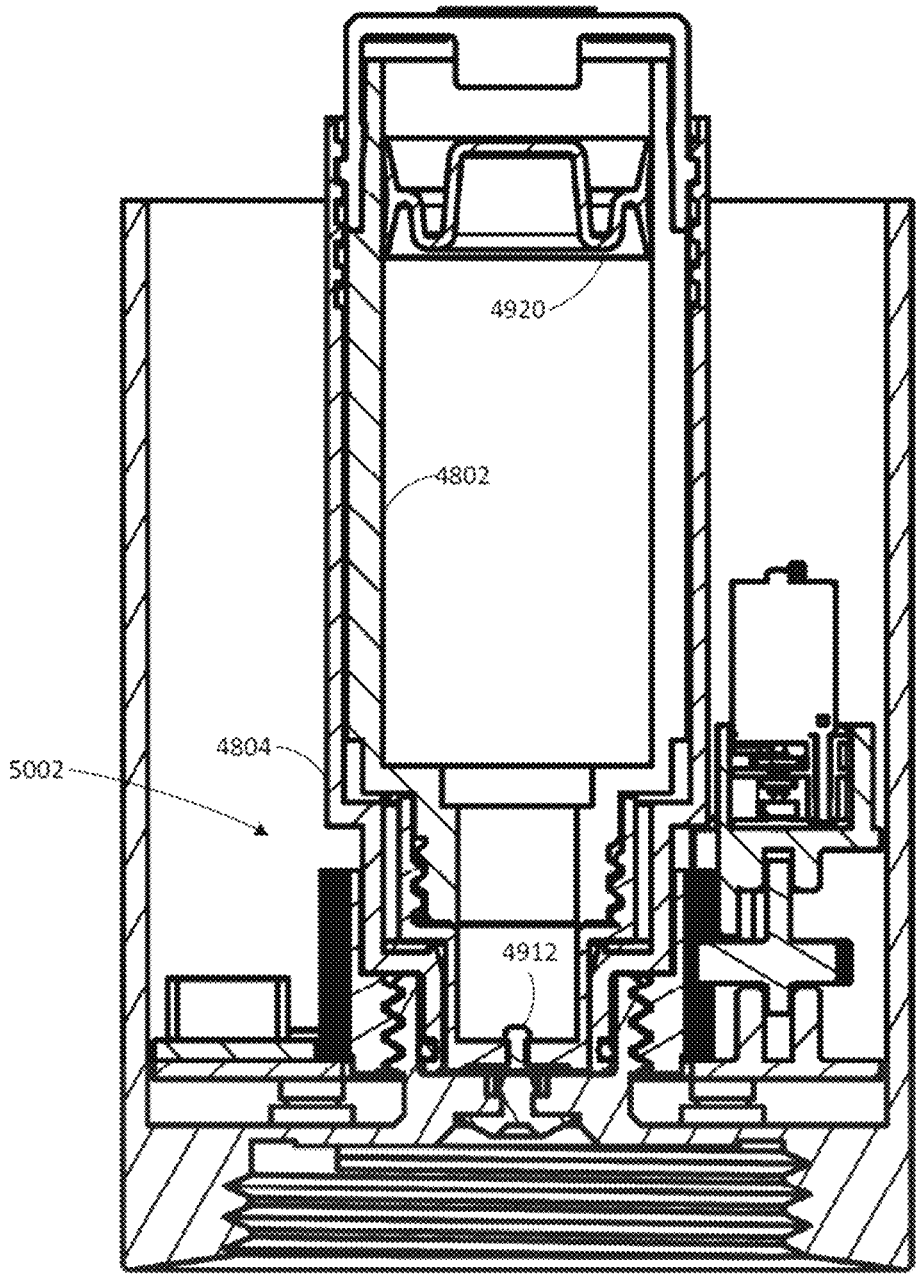

FIG. 50A shows the receptacle 4804 and piston 5010 in a starting position and the plunger 4920 of the additive vessel 4802 in an initial position prior to any additive being dispensed from a full vessel. As shown in in FIG. 50B, the piston 5010 is withdrawn, and the one-way valve 4708 at the outlet port 4706 blocks fluid flow in the reverse direction, creating the vacuum which draws fluid from the additive vessel 4802 through the one-way valve 4912 into the pumping chamber 5011. It should be noted that in FIG. 50B, the plunger 4920 has moved from its staring position illustrated in FIG. 50A to accommodate fluid flow from the vessel 4802 into the pumping chamber 5011. As shown in FIG. 50C, the piston 5010 is driven to back to its starting position, compressing the fluid within the chamber 5011 and forcing it through the one-way valve 4708 at the outlet port 4706 and into the beverage chamber 4630. The one-way valve 4912 blocks the flow of fluid from returning into the vessel 4802. Positive pressure, accordingly, is produced in this compression stoke, dispensing the contents of the pump chamber through the outlet port 4706 into the beverage chamber 4630.

The volume dispensed during a single piston stroke can be modulated linearly by modifying the piston stroke length. Multiple piston strokes can be used to dispense larger quantities. By design, the volume of the pumping chamber can be configured to be as small as practically possible when the piston 5010 is in the starting position to avoid wasting additive liquid when a depleted additive vessel is withdrawn from the receptacle.

Figure 51A:
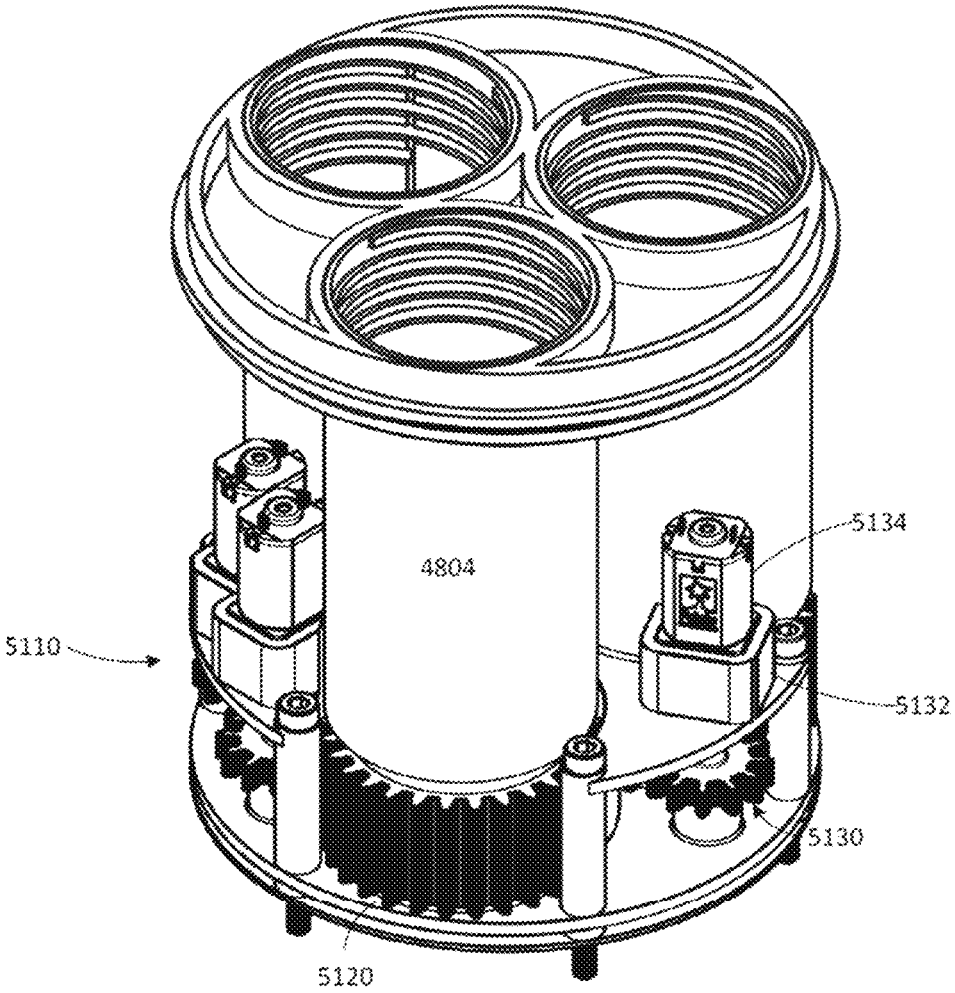
FIGS. 51A and 51B illustrate views a drive mechanism for actuating a receptacle and associated piston of a pumping mechanism.
Figure 51B:
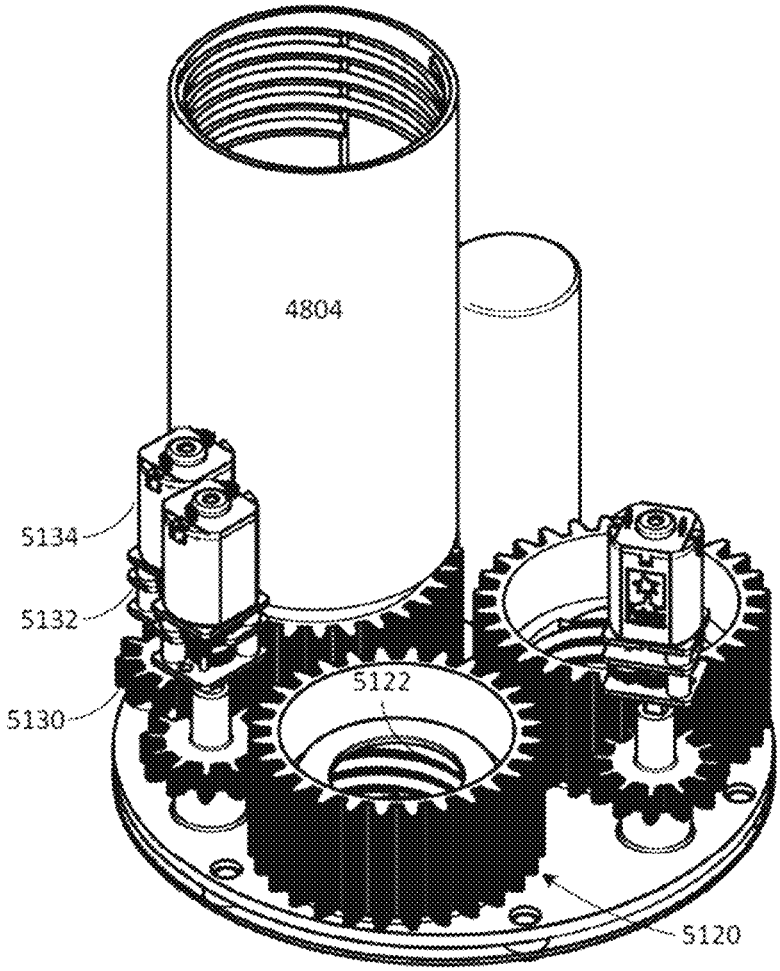

FIGS. 51A and 51B illustrate views a drive mechanism 5110 for actuating the receptacle 4804 and associated piston 5010 of the pumping mechanism 5002. FIG. 51A illustrates an internal perspective view of the dispensing assembly 4613 without an outer cover. FIG. 51B illustrates an additional internal perspective view of the dispensing assembly 4613 without further structure removed to better illustrate certain aspects of the drive mechanism 5110. As illustrated, each receptacle 4804 and its associated piston 5010 (not visible in FIGS. 51A-B) is moved down and up by an internally threaded toothed ring 5120. A set of internal threads 5122 on each internally threaded toothed ring 5120 engage with a threaded extension 5210 (FIG. 52B) of the pump housing 5014. Each internally threaded toothed ring 5120, can be driven by a gear 5130, which in turn can be driven by an optional gearbox 5132, which in turn is driven by an electric motor 5134.

Figure 52A:
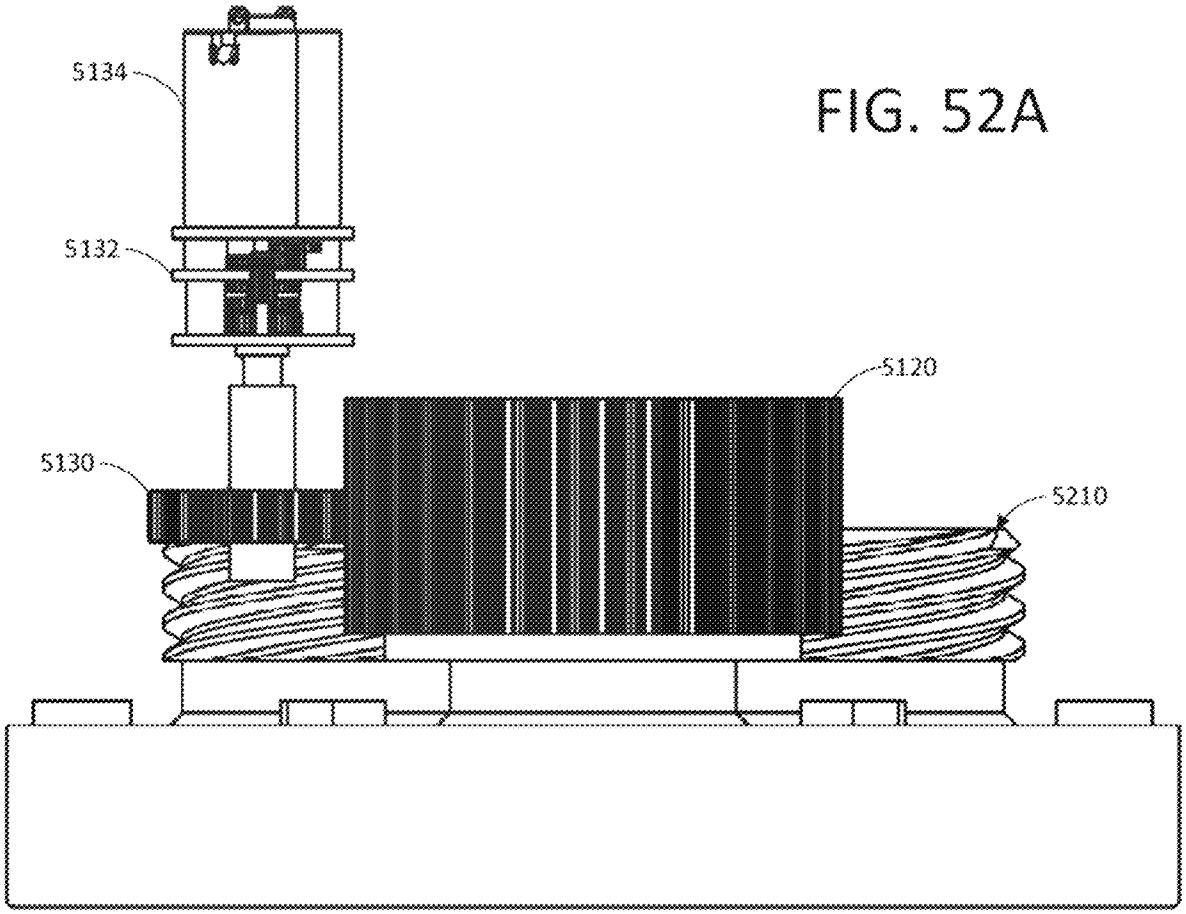
FIGS. 52A and 52B illustrate an elevation view of the drive mechanism with the receptacle in a starting position and in a withdrawn position.
Figure 52B:
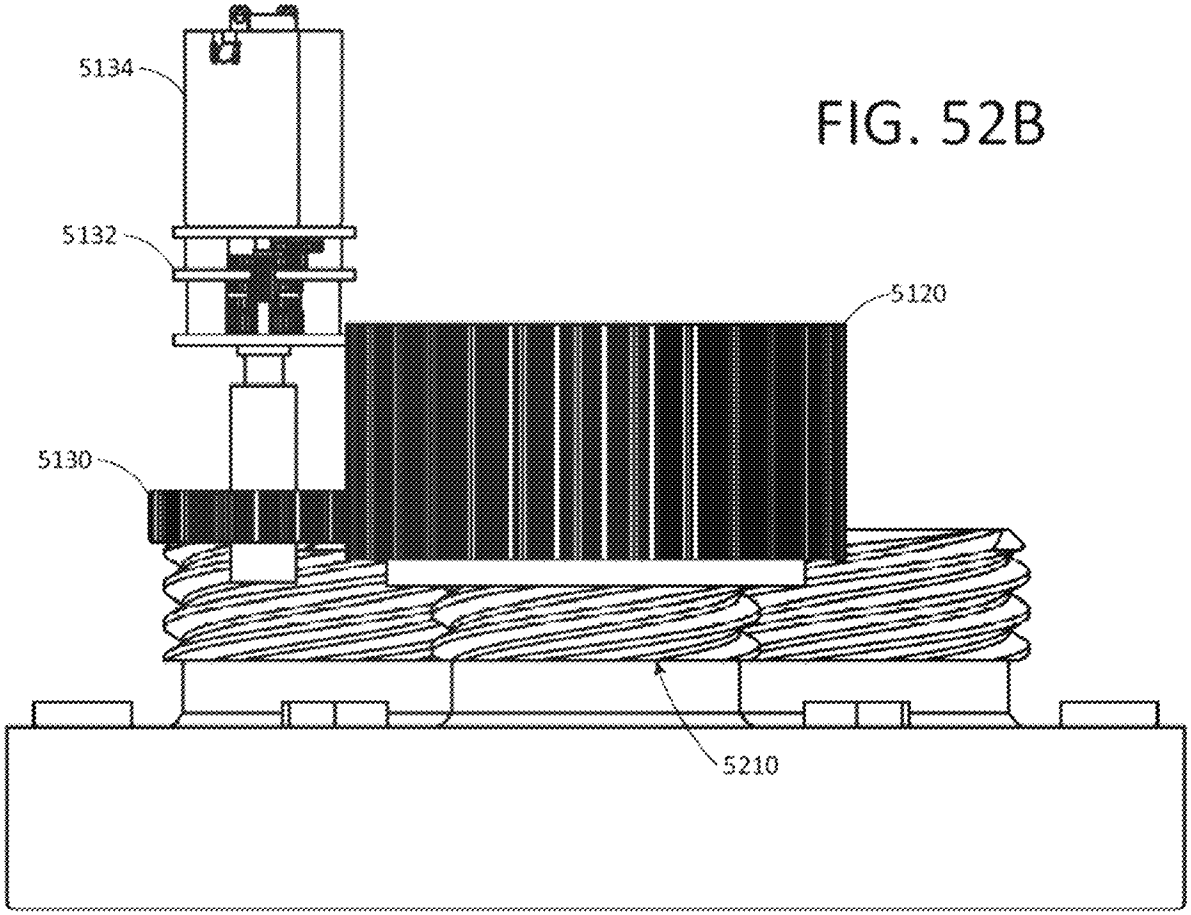

FIGS. 52A and 52B illustrate an elevation view of the drive mechanism with the receptacle in a starting position (52A) and in a withdrawn position (52B). As the toothed ring 5120 rotates, the internal threads 5122 cause the toothed ring to rise and fall on the threaded extension 5210 of the pump housing 5014. The receptacle, which can be snapped into or adhered to the toothed ring 5120, also therefore rises and falls with the toothed ring, causing the piston 5010 to move within the cylinder 5012. In accordance with one embodiment, the threads on the toothed ring 5120 and the threaded extension 5210 are a "fast" 4-start thread that cause the toothed ring 5120 to travel to full linear extension with 180 degrees of rotation. The threads can be configured to have an ACME profile or similar.

Figure 53:
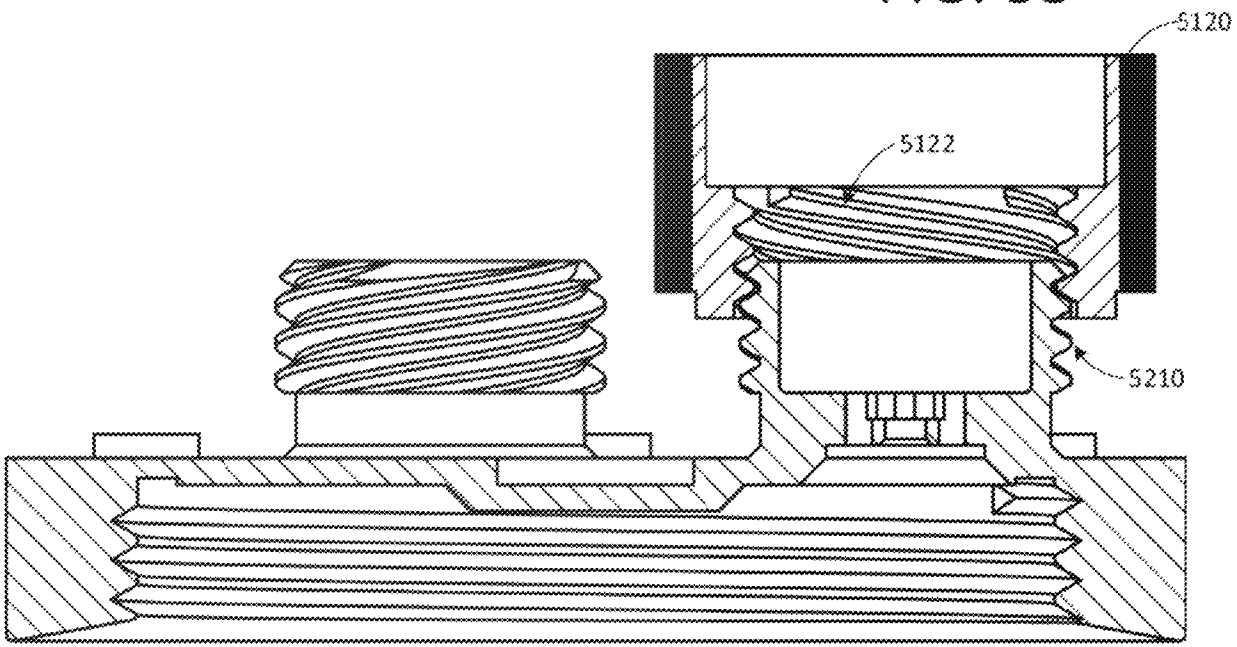
FIG. 53 illustrates a cross section of an internally threaded toothed ring engaged with a threaded extension of a pump housing.

FIG. 53 illustrates a cross section of an internally threaded toothed ring 5120 engaged with a threaded extension 5210 (FIG. 52B) of the pump housing 5014.

Figure 54A:
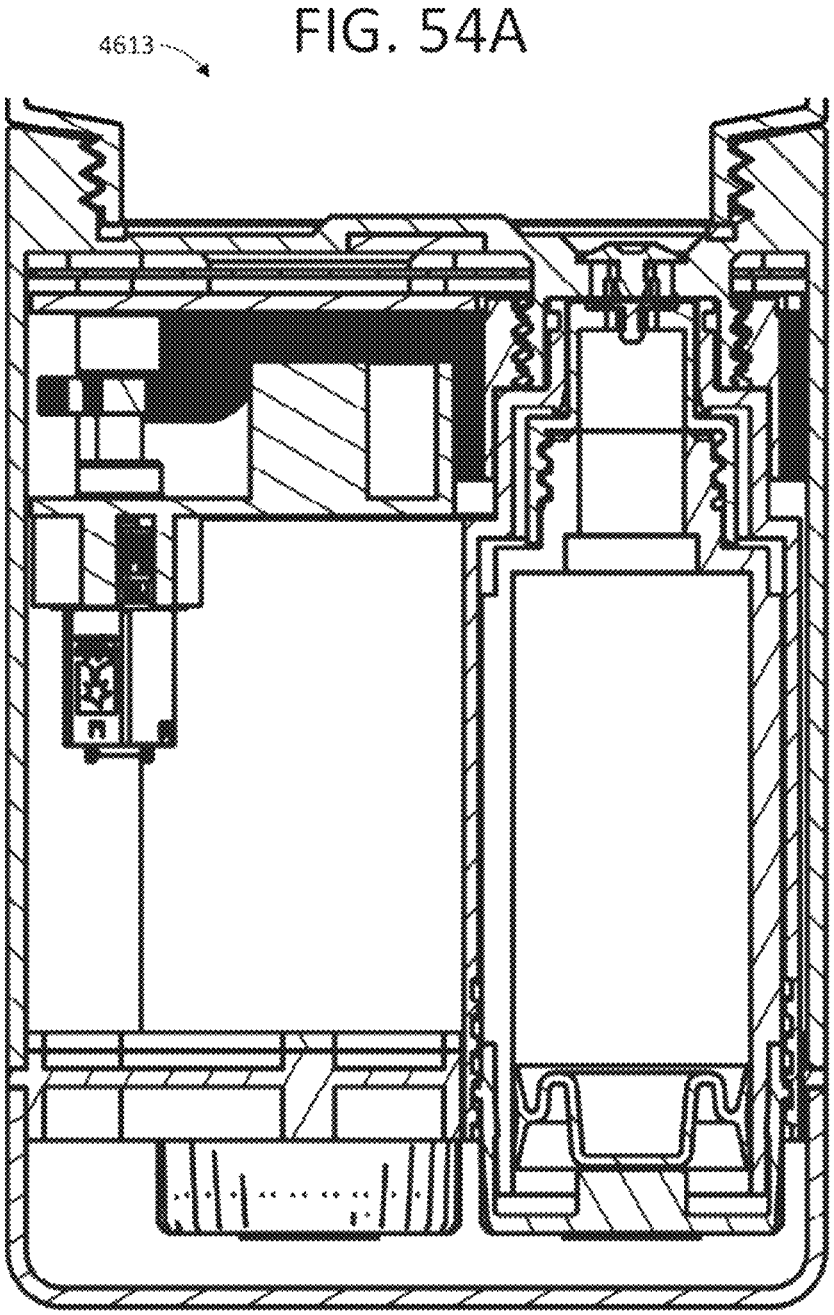
FIGS. 54A-C illustrate cross sectional cutaway views of a dispensing assembly.
Figure 54B:
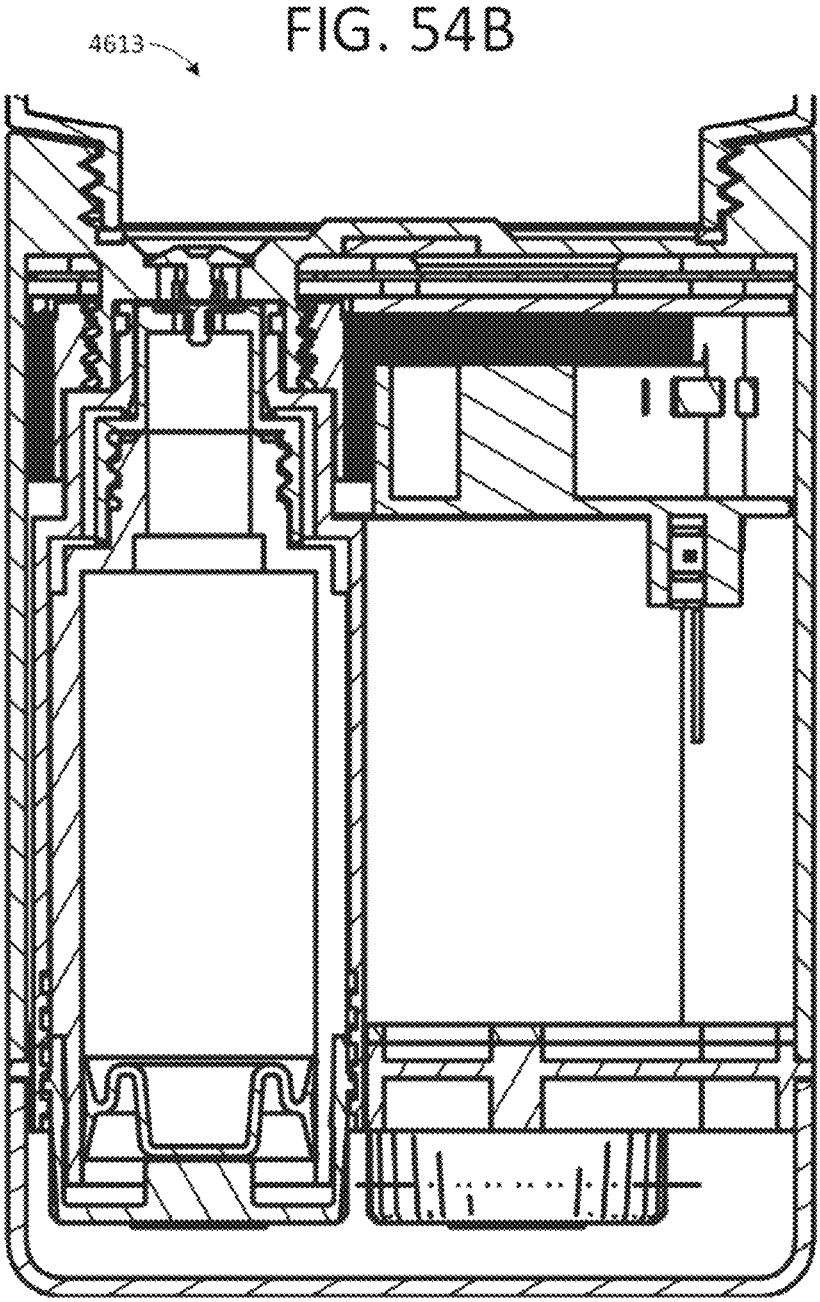
Figure 54C:
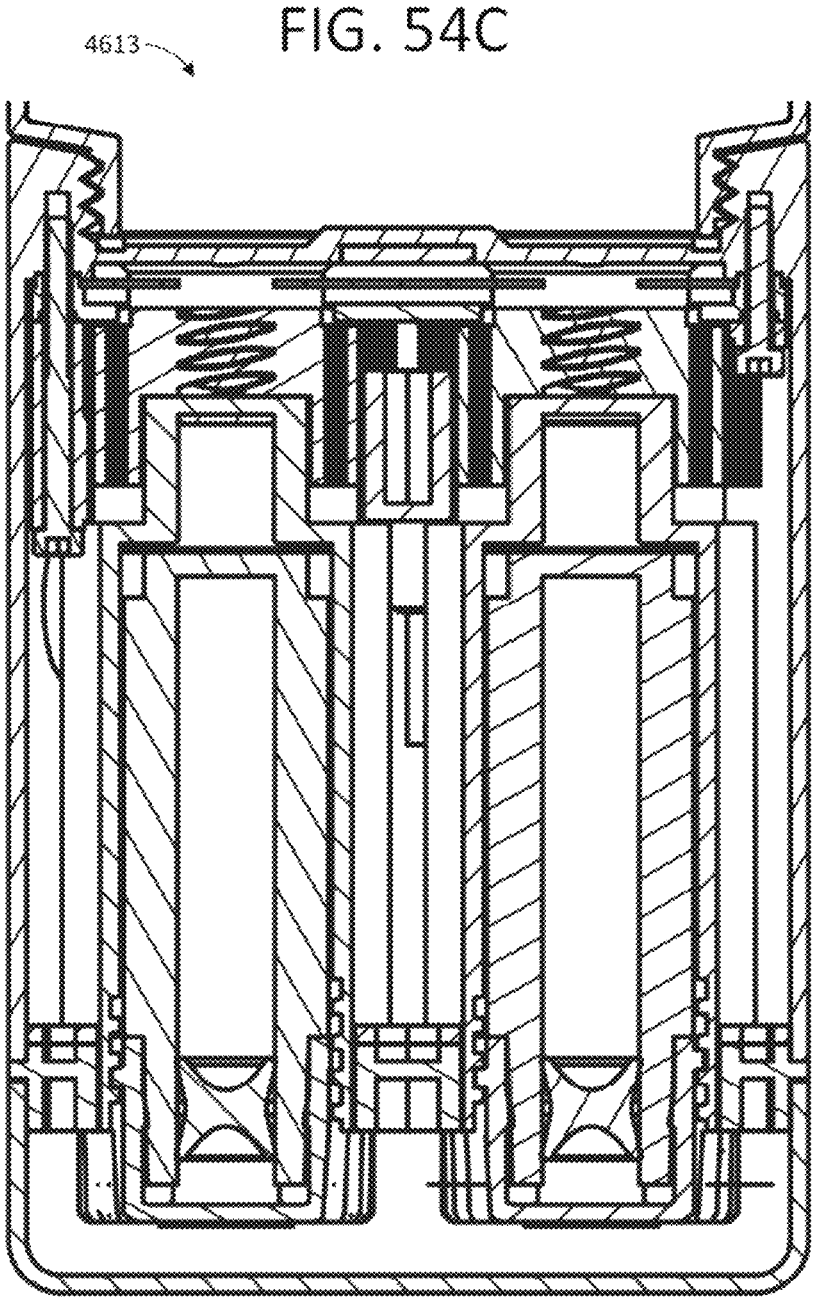
Figure 55B:
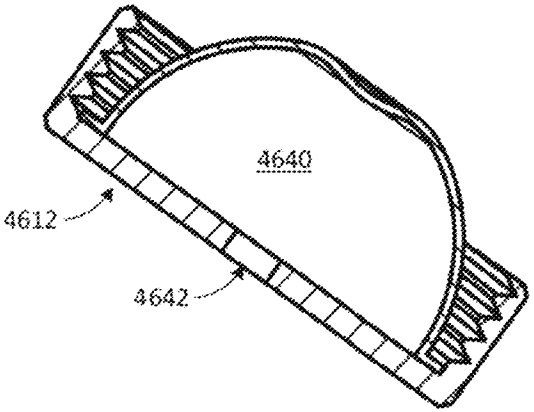
FIGS. 55A-B illustrate isometric and cutaway views of a removable cap.
Figure 55A:
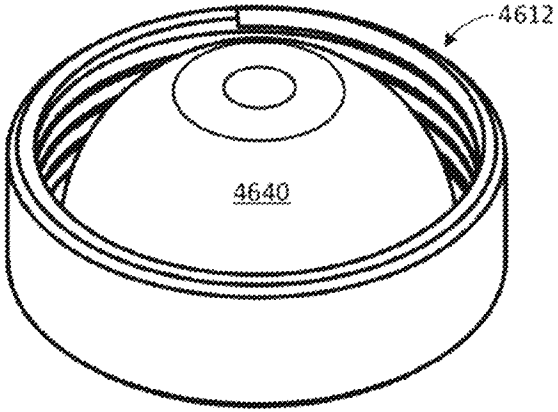

FIGS. 54A-C illustrate three difference cross sectional cutaway views of the dispensing assembly 4613. FIGS. 55A-B illustrate isometric and cutaway views of the removable cap 4612. As discussed above with reference to FIG. 46, in the illustrated embodiment, the cap 4612 seals a top opening of the beverage chamber housing 4614 to complete the chamber 4630. The cap 4612 can be configured to thread or snap on to a top end of the beverage chamber housing 4614. The cap 4612 includes a compressible bladder 4640 formed of silicone or other suitable rubber, that allows for deformation of the bladder so as to accommodate the addition of liquid additives into the chamber 4630 by the dispensing assembly 4613. The cap 4612 also includes an air passageway 4642 to allow air to escape from behind the bladder 4640 so that the bladder can compress to accommodate the addition of the liquid additives. As shown in FIGS. 55A-B, the bladder 4640 can be configured with a dimpled dome shape that yields an approximately linear resistance to deformation.

Figure 56:
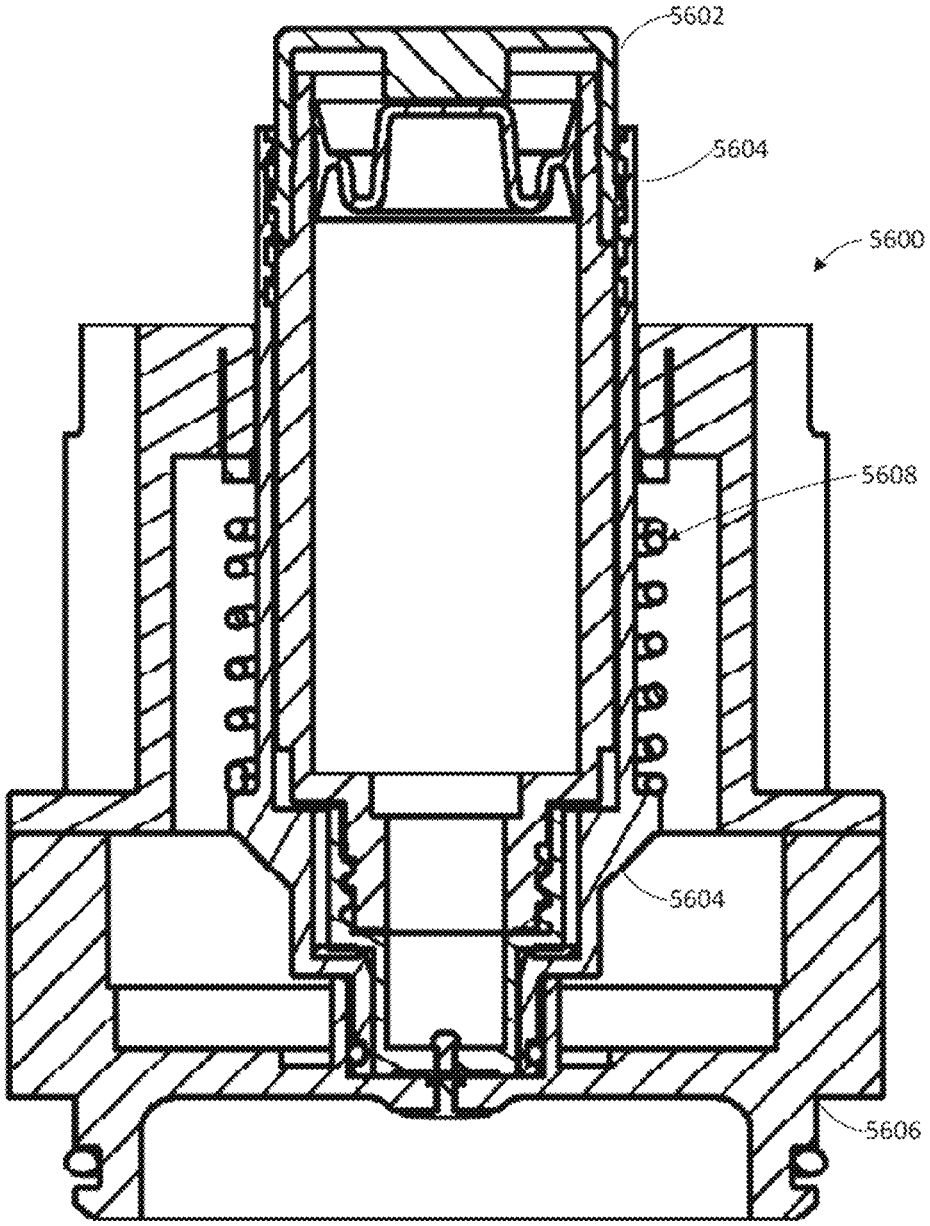
FIG. 56 illustrates a cutaway view of a pumping mechanism in accordance with one embodiment.

FIG. 56 illustrates a cutaway view of a pumping mechanism 5600 in accordance with one embodiment. Similar to the embodiments discussed above with reference to FIGS. 46-55, an additive vessel 5602 is received in a receptacle 5604, which engages within a pump housing 5606. Two one-way valves similarly work together with a sliding piston and cylinder to pump additive liquid through a pumping chamber. In the embodiment illustrated in FIG. 56, however, the receptacle 5604 can be actuated manually, by a user grasping and withdrawing the receptacle from the pump housing 5606, or by another mechanical means. The receptacle 5604 is withdrawn against pressure of a spring 5608, which is biased to press the receptacle back to its start position, such that when the receptacle is released, any additive fluid drawn into the pumping chamber is then automatically ejected into the beverage chamber.

Figure 57A:
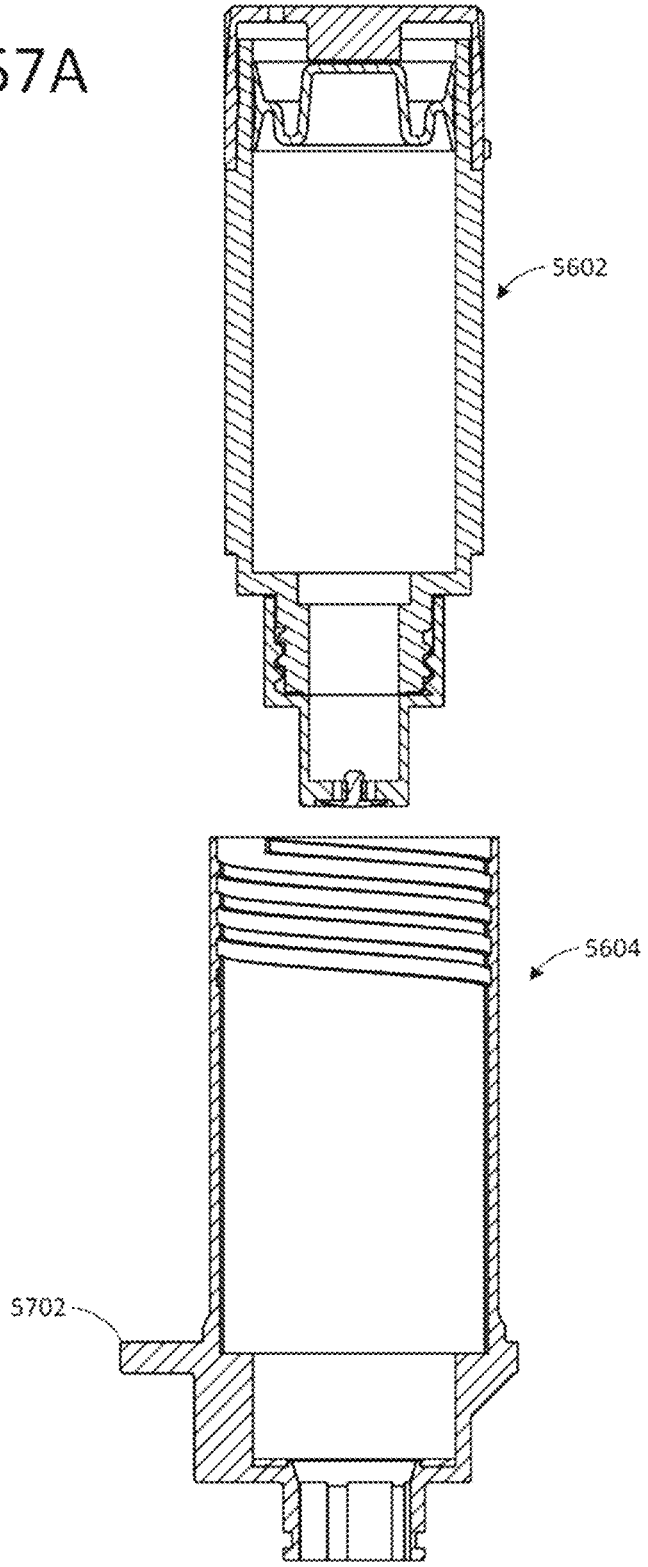
FIG. 57A illustrates a cutaway view of a receptacle of the embodiment of FIG. 56, but shown from a different perspective rotated 90 degrees around a vertical axis.

FIG. 57A illustrates a cutaway view of the receptacle 5604 of the embodiment of FIG. 56, but shown from a different perspective rotated 90 degrees around a vertical axis. The receptacle 5604 includes a tab 5702 that can be used either manually or actuated by a mechanism in order to withdraw the receptacle against the tension of the spring 5608 from the pump housing 5606. FIG. 57A also shows the additive vessel 5602 removed from the receptacle 5604.

Figure 57C:
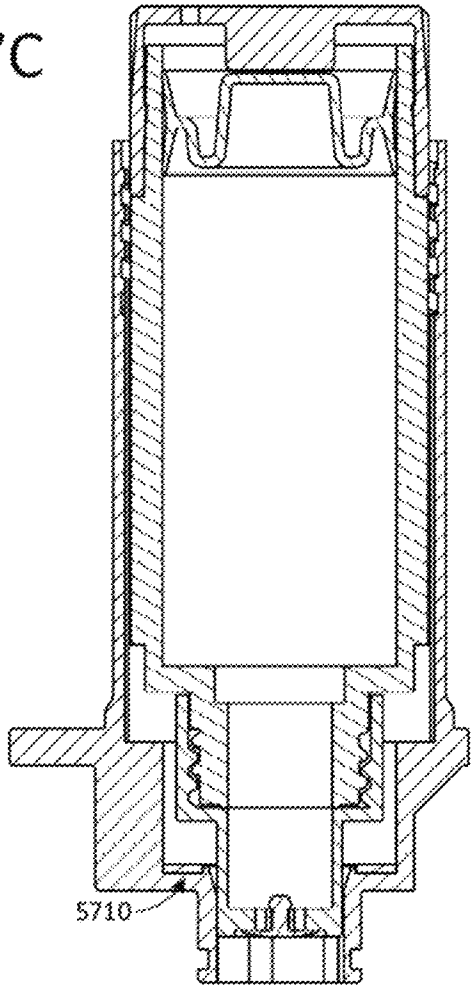
FIGS. 57B and 57C illustrate a seal placed in a shoulder portion of the receptacle that serves a vacuum breaker function as an additive container is withdrawn from the receptacle.
Figure 57B:
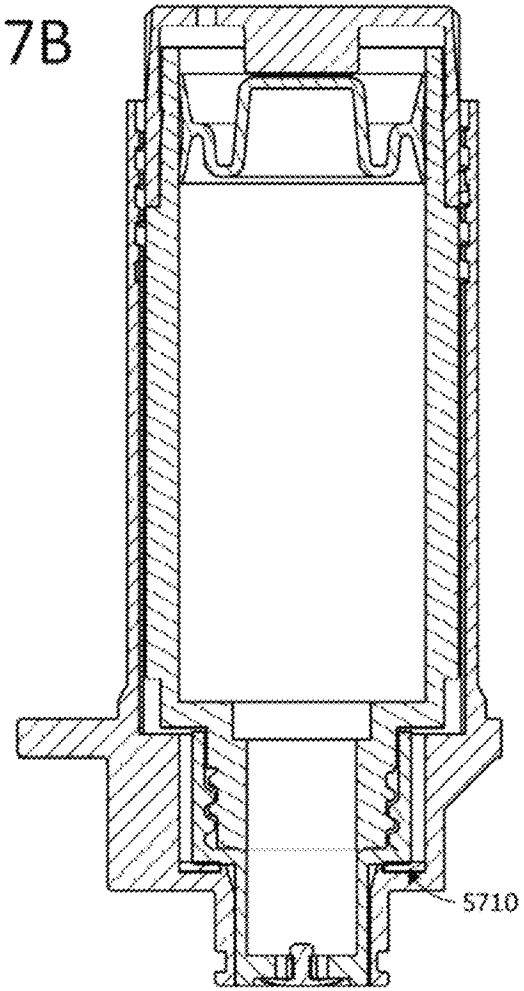

FIGS. 57B and 57C illustrate a seal 5710 placed in a shoulder portion of the receptacle 5604 that serves a vacuum breaker function as the additive vessel 5602 is withdrawn from the receptacle. Once the additive vessel 5602 is withdrawn even a slightest amount, the vessel no longer contacts the seal 5710 and therefore air is allowed to pass into the pumping chamber area as the vessel is withdrawn. If no air were allowed to pass into the pumping chamber, the action of withdrawing the vessel would create a vacuum that would suck additive fluid out of the vessel and into the now open pumping chamber.

Figure 58A:
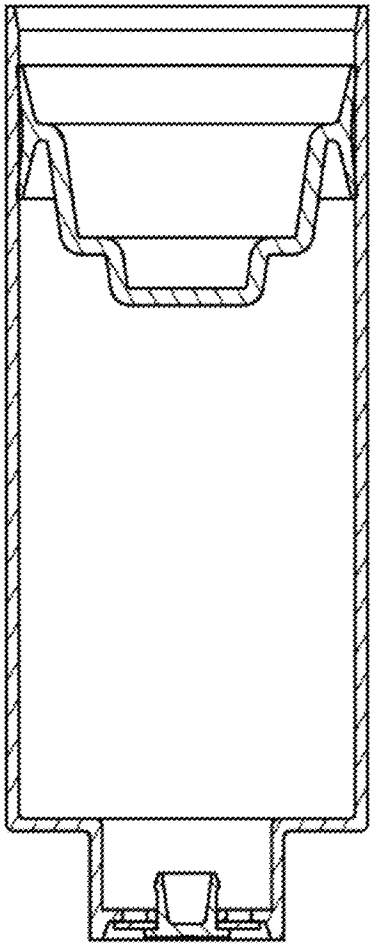
FIGS. 58A-D illustrate different configurations of containers, vessels or pods for liquid additives that can be used in accordance with various embodiments.
Figure 58B:
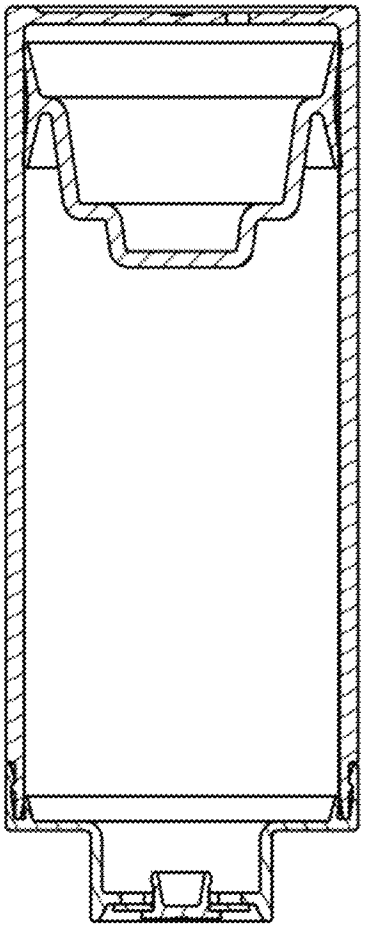
Figure 58C:
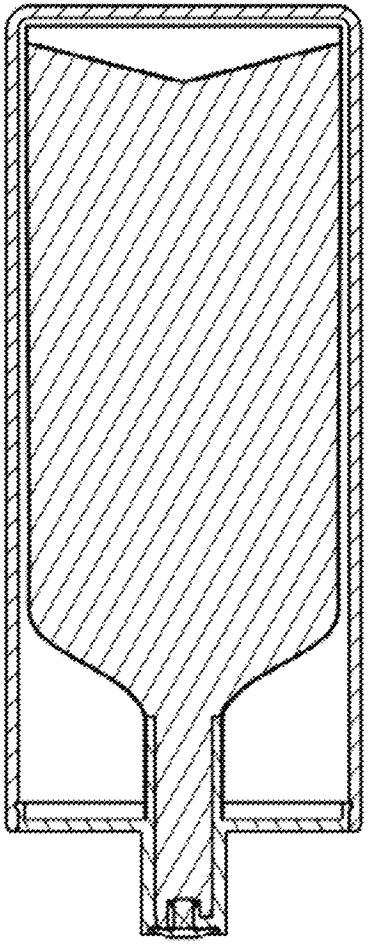
Figure 58D:
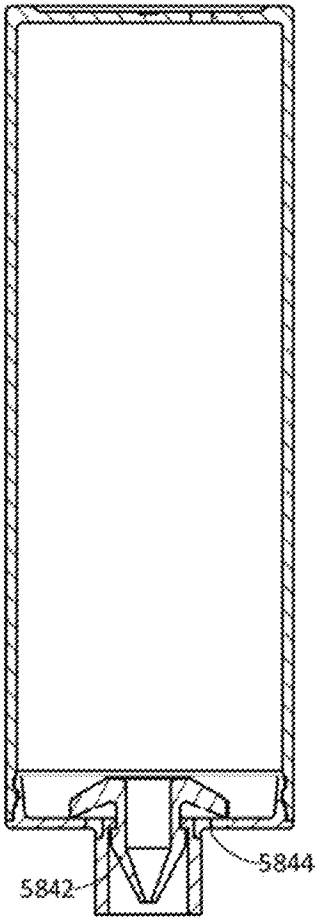

FIGS. 58A-D illustrate different configurations of additive vessels, containers or pods for liquid additives that can be used in accordance with various embodiments. FIG. 58A illustrates an airless or non-vented rear load vessel with a rigid tubular side wall. The additive vessel of FIG. 58A is similar in function to the vessel 4802 illustrated in FIGS. 49A-B, with a plunger 4920 that moves to prevent air from entering the vessel. FIG. 58B illustrates an airless front load vessel with a rigid tubular side wall. FIG. 58C illustrates a collapsible bag or sachet enclosed within an outer container. The collapsible bag makes the plunger unnecessary. FIG. 58D illustrates a vented additive vessel, which allows air to pass back into the vessel to take the place of pumped additive fluid. A two-way valve 5842 allows additive fluid to pass out of the vessel through a center portion of the valve, while air is allowed to enter the vessel through ports 5844 around the periphery of the valve and under an umbrella portion of the valve.

Figure 59:
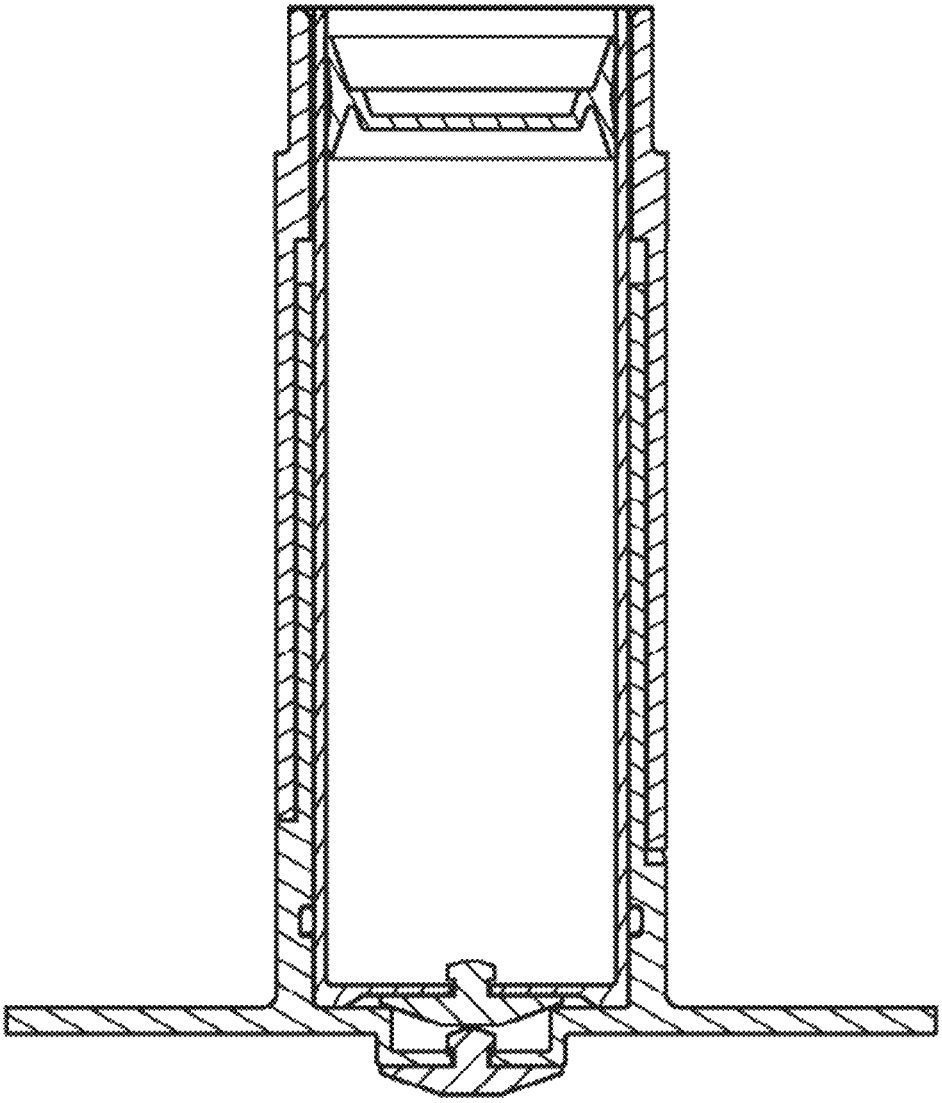
FIG. 59 illustrates a simplified positive displacement pumping mechanism that can be used with various actuation mechanisms in accordance with various embodiments.

FIG. 59 illustrates a simplified positive displacement pumping mechanism that can be used with various actuation mechanisms in accordance with various embodiments.

One benefit of the foregoing described positive displacement pump configurations is that when the additive vessel is withdrawn and when the beverage chamber housing is removed from the dispensing assembly all parts of the pumping mechanism become visible and accessible for cleaning. The pumping chamber is accessible through the receptacle and only a one-way umbrella valve sits in the port between the pumping chamber and the platform which is otherwise also accessible for cleaning. A one-way umbrella valve can be easily removed and cleaned or replaced.

As noted above, the various features and functionality of the embodiments described above with reference to FIGS. 46-55, and further with respect to FIGS. 56-59, can be combined and used in conjunction various features and functionality described earlier with respect to FIGS. 1-45. While such combinations will be apparent to one skilled in the art, certain variations on the embodiments described earlier with respect to FIGS. 1-45 to accommodate the various embodiments of FIGS. 46-59 will nevertheless be described in additional detail below. In general, various features and functionality of the embodiments described herein can be combined and used in conjunction with various features and functionality of other embodiments.

Referring again to FIG. 24, the illustrated flowchart can be modified to accommodate the various embodiments of FIGS. 46-59. For example, the dispensing assembly 4613 illustrated in FIG. 47 can be further configured with an attachment sensor (not illustrated) that monitors whether the beverage chamber housing 4614 is threaded onto the dispensing assembly 4613 before a dispensing event occurs. In the illustration of FIG. 24, the attachment sensor can replace or supplement the lid sensor 2401 and one or both checks can be performed before initiating a dispensing event. Each additive vessel 4802 can be configured with an RFID tag as described above with reference to FIG. 24. In the various embodiments of FIGS. 46-59, each vessel can be configured with its own separate pumping mechanism 5002, in which case steps 2412 and 2413 can omitted. Step 2414, to move a pressure actuator, can be modified to instead drive a motor or other actuation mechanism to move the piston. At step 2416 a linear potentiometer (not illustrated) can be used to determine the position of the pump piston. As noted above, the volume dispensed during a single piston stroke can be modulated linearly by modifying the piston stroke length. Multiple piston strokes can be used to dispense larger quantities.

Referring again to FIG. 30, the illustrated flowchart can be modified to accommodate the various embodiments of FIGS. 46-59. For example, step 3006, to move a pressure actuator, can be modified to instead drive a motor or other actuation mechanism to move the piston. At step 3007 a linear potentiometer (not illustrated) can be used to determine the position of the pump piston. As noted above, the volume dispensed during a single piston stroke can be modulated linearly by modifying the piston stroke length. Multiple piston strokes can be used to dispense larger quantities.

Referring again to FIG. 35, the illustrated flowchart can be modified to accommodate the various embodiments of FIGS. 46-59. For example, step 3501 can be triggered by a user's actuation of a user input button 4616 on the container in order to initiate a dispensing event. Step 3501 can also or alternatively be triggered by a Bluetooth or other communication from a user's mobile device. Step 3507 to determine pressure and duration, can be modified to determine piston stroke length and/or number of strokes needed to dispense the correct amount of additive.

In various embodiments, portions of the pumping mechanism need not be replicated and can be configured to be shared between different additive vessels, such as by using a single motor that is actuated or rotated to engage with different pumping mechanisms for different additive vessels. In this case, steps 2412 and 2413 referred to with respect to FIG. 24 can be configured to rotate or move the shared motor or actuation mechanism to an appropriate position to act on a corresponding pumping mechanism or additive vessel. Similar modifications can be made to steps 3001, 3002 and 3003 of FIG. 30, as well as to step 3508 of FIG. 35.

Figure 14:
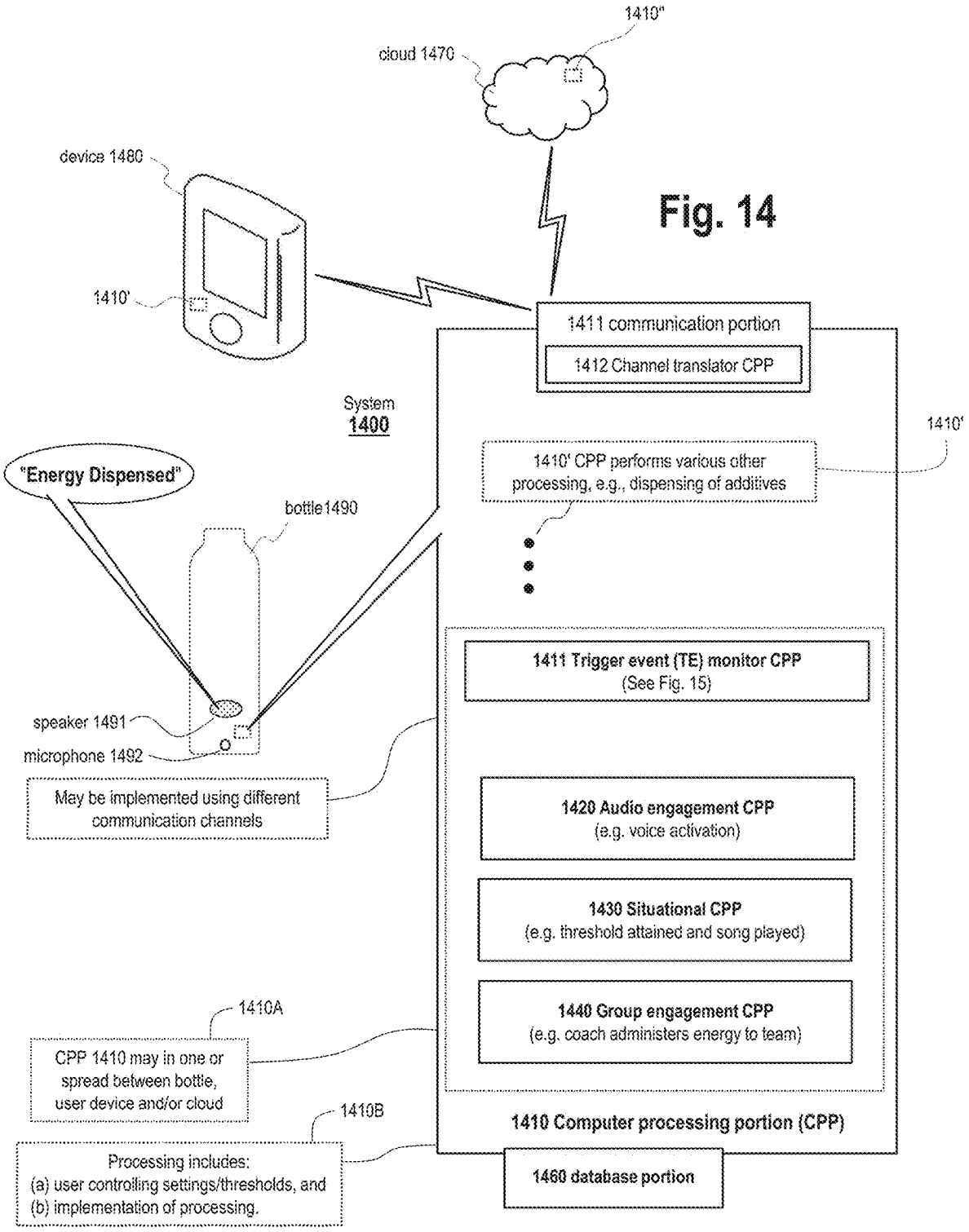
FIG. 14 is a block diagram showing features of a system 1400, in accordance with one or more embodiments.

FIG. 14 is a block diagram showing features of a system 1400, in accordance with one or more embodiments. The system 1400 includes a bottle 1490, a device 1480, and a cloud database resource 1470. The bottle 1490 may be constituted by any of the bottles and containers or other similar devices described herein. The device 1480 may be constituted by an electronic user device such as a cell phone. The cloud 1470 may be constituted by any suitable database arrangement or architecture. The disclosure is not limited to the particulars of the cloud architecture. Rather, other database structures might be utilized.

As shown, the bottle 1490 includes speaker 1491 and a microphone 1492. The speaker 1491 is provided to output audio or sound communications from the bottle 1490. Such audio or sound communications may be generated by a computer processing portion (CPP) 1410. On the other hand, the microphone 1492 is provided to input audio or sound communications into the bottle 1490. Such audio communications may be input into the CPP 1410 and processed as machine language or in some other manner so as to be understood by the CPP 1410.

As noted above, the bottle 1490 also includes the CPP 1410. The CPP 1410 controls operations of the bottle 1490 and provides various functionality associated with the bottle 1490. The CPP 1410 includes, in at least some embodiments of the disclosure, specialized processing components. These specialized processing components include an audio engagement CPP 1420, a situational CPP 1430, and a group engagement CPP 1440. The audio engagement computer processing portion (CPP) or processor 1420 handles various processing associated with inputting voice communications, processing voice communications, and outputting voice communications. The processor 1420 also handles various related processing. The situational processor 1430 handles various processing associated with the situational or situ disposition of the bottle. For example, such situational disposition might include a particular consumption threshold being attained or experiencing a particular environment. Based on a bottle experiencing a particular situational disposition or scenario, the bottle may be provided with settings, configurations, and/or programming that results in certain action being taken. For example, if the bottle is experiencing a particularly cold environment, then the bottle may be programmed to automatically respond with the dispense of a particular additive. On the other hand, if the bottle is experiencing movement, which the bottle recognizes as a jogging pace, the bottle may be configured to respond with the dispense of a particular additive.

Additionally, the processor 1410 includes a group engagement processor 1440. The group engagement processor 1440 handles various processing associated with performing in a group or team environment. That is, a lead user or administrator may be provided with the ability to control dispense from bottles of the various users or member users in a group or on a team. For example, the administrator may provide a plan or configuration in which each member of the team is dispensed a particular additive at a particular time. The administrator may provide configuration in which a particular additive is administered under a particular scenario. For example, if a particular speed or pace of movement of the bottle is observed—then a particular additive might be dispensed.

As shown in FIG. 14, the processor 1410 also includes a database portion 1460. The database portion 1460 includes various data that is used by the various processing portions and/or stores various data that is generated by the processing portions. The database portion 1460 may utilize any of a wide variety of architectures such as a relational database architecture, for example.

Additionally, the processor 1410 includes a trigger event (TE) monitor CPP 1411. Such CPP 1411 may be configured to monitor or watch for any of a wide variety of trigger events that are recognizable by the system. For example, the CPP 1411 may input any of a wide variety of data and, on an ongoing basis, attempt to match such input data with an event that the CPP 1411 recognizes. In particular, a list of events may be maintained or accessed by the CPP 1411 that are actionable events by the CPP 1410. That is, trigger events in response to which the bottle 1411 will take some action. In accord with at least one embodiment, the CPP 1411 may be configured to identify a particular trigger event—and then pass processing (so as to process the trigger) off to one of the more specialized processing portions, such as the processing portions 1420, 1430, 1440. Accordingly, in some embodiments, the CPP 1411 may be dedicated to simply identifying a trigger event and then passing processing off processing to one of the more specialized processing portions.

As shown in FIG. 14, the CPP or processor 1410 may also be provided with a communication portion 1411. The communication portion 1411 may be configured to provide any of the wide variety of communications to and from the CPP 1410. In at least one embodiment of the disclosure, the microphone 1492 is a component of the communication portion 1411. The communication portion 1411 may be configured to provide communications along any channel as may be desired, such as electronic communications over the Internet, electronic communications over other networks, Bluetooth communications, and/or other type of communications. The communication portion 1411 may include or be associated with a channel translator CPP 1412. The channel translator CPP 1412 may be configured to translate between different types of communications. In particular, the channel translator CPP 1412 may be configured to input audio data via the microphone 1492 (sound waves) and translate such data into machine language that is understandable by the CPP 1410.

As shown in FIG. 14, at 1410', the CPP 1410 performs various other processing in the normal routine of operations including dispensing additives into consumable liquid in the bottle. Accordingly, 1410' represents any of a wide variety of processing as is otherwise described herein.

FIG. 14 reflects a situation or architecture in which the CPP 1410 is provided in the bottle 1490. However, it is appreciated that the CPP 1410 may be provided in whole or in part in other processing entities that are associated or in communication with the bottle 1490. For example, some of the processing components to provide the functionality described herein may be provided in the bottle 1490, some provided in the user device 1480 (1480'), and some provided in the cloud architecture 1470 (1410") or other network, as reflected at 1410A. In the situation that the processing is indeed distributed across different operating components, it is of course appreciated that suitable communication may be utilized such that such distributed processing may be effectively performed.

As is shown in FIG. 14, the CPPs 1411, 1420, 1430, 1440 may be characterized as performing "active processing". In accord with one aspect of the disclosure, such active processing may include a user controlling settings, configurations and/or thresholds, as well as implementation of processing or operations that indeed utilize such settings, configurations and/or thresholds, as reflected at 1410B.

Figure 15:
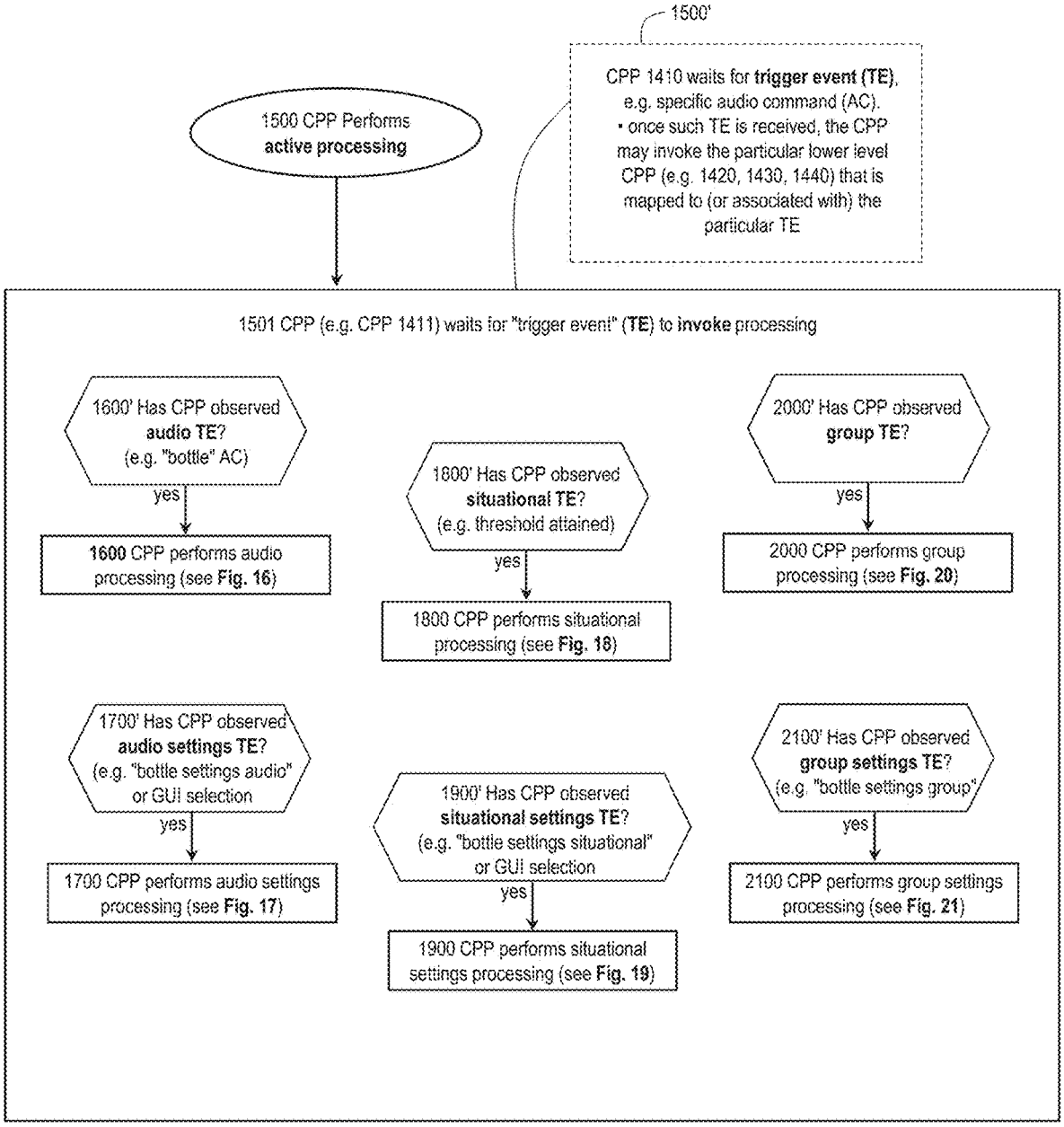
FIG. 15 is a flowchart showing aspects of active processing performed by the CPP, in accordance with one or more embodiments.

FIG. 15 is a flowchart showing aspects of active processing performed by the CPP, in accordance with one or more embodiments. The process of FIG. 15 starts in step 1500 and passes to step 1501. In step 1501, the CPP 1410 waits for a trigger event to invoke processing. More specifically as reflected at 1500', the specialized processing component CPP 1410 waits for a trigger event (TE) to be observed by the CPP 1410. The trigger event might be a specific audio command or a particular threshold obtained, for example. Once such trigger event is received, the CPP may invoke the particular lower-level CPP that is mapped to (or associated with) the particular trigger event. The lower-level computer processing portion may then perform various processing as reflected in FIG. 15.

As shown in FIG. 15, processing in step 1600' may be performed to determine if the CPP has observed an audio trigger event. For example, an audio trigger event might be the audio input of "bottle" as spoken by the human user of the bottle. If such trigger event is observed, then the processing passes from step 1600' to step 1600. In step 1600, the CPP performs audio processing. Further details are described below with reference to FIG. 16.

As shown in FIG. 15, processing in step 1800' may be performed to determine if the CPP has observed a situational trigger event. For example, a situational trigger event might be the observation of a particular threshold being attained or a certain time, time window, or time marker being attained. If such trigger event is observed, then the processing passes from step 1800' to step 1800. In step 1800, the CPP performs situational processing. Further details are described below with reference to FIG. 18.

As shown in FIG. 15, processing in step 2000' may be performed to determine if the CPP has observed a group trigger event. If such trigger event is observed, then the processing passes from step 2000' to step 2000. In step 2000, the CPP performs situational processing. Further details are described below with reference to FIG. 20.

As shown in FIG. 15, processing in step 1700' may be performed to determine if the CPP has observed an audio settings trigger event. For example, an audio settings trigger event might be the audio input of "bottle settings audio" as spoken by the human user of the bottle, or any other command as may be desired. If such trigger event is observed, then the processing passes from step 1700' to step 1700. In step 1700, the CPP performs audio settings processing. Further details are described below with reference to FIG. 17.

As shown in FIG. 15, processing in step 1900' may be performed to determine if the CPP has observed a situational settings trigger event. For example, a situational settings trigger event might be the audio input of "bottle settings situational" as spoken by the human user of the bottle, or any other command as may be desired. If such trigger event is observed, then the processing passes from step 1900' to step 1900. In step 1900, the CPP performs situational settings processing. Further details are described below with reference to FIG. 19.

As shown in FIG. 15, processing in step 2100' may be performed to determine if the CPP has observed a group settings trigger event. For example, a group settings trigger event might be the audio input of "bottle settings group" as spoken by the human user of the bottle, or any other command as may be desired. If such trigger event is observed, then the processing passes from step 2100' to step 2100. In step 2100, the CPP performs group settings processing. Further details are described below with reference to FIG. 21.

It is appreciated the processing shown in FIG. 15 need not be and typically will not be performed in any linear or sequential manner Rather, the processing as depicted in FIG. 15 may be performed as invoked by observed trigger events as such are observed by the CPP 1410.

Figure 16:
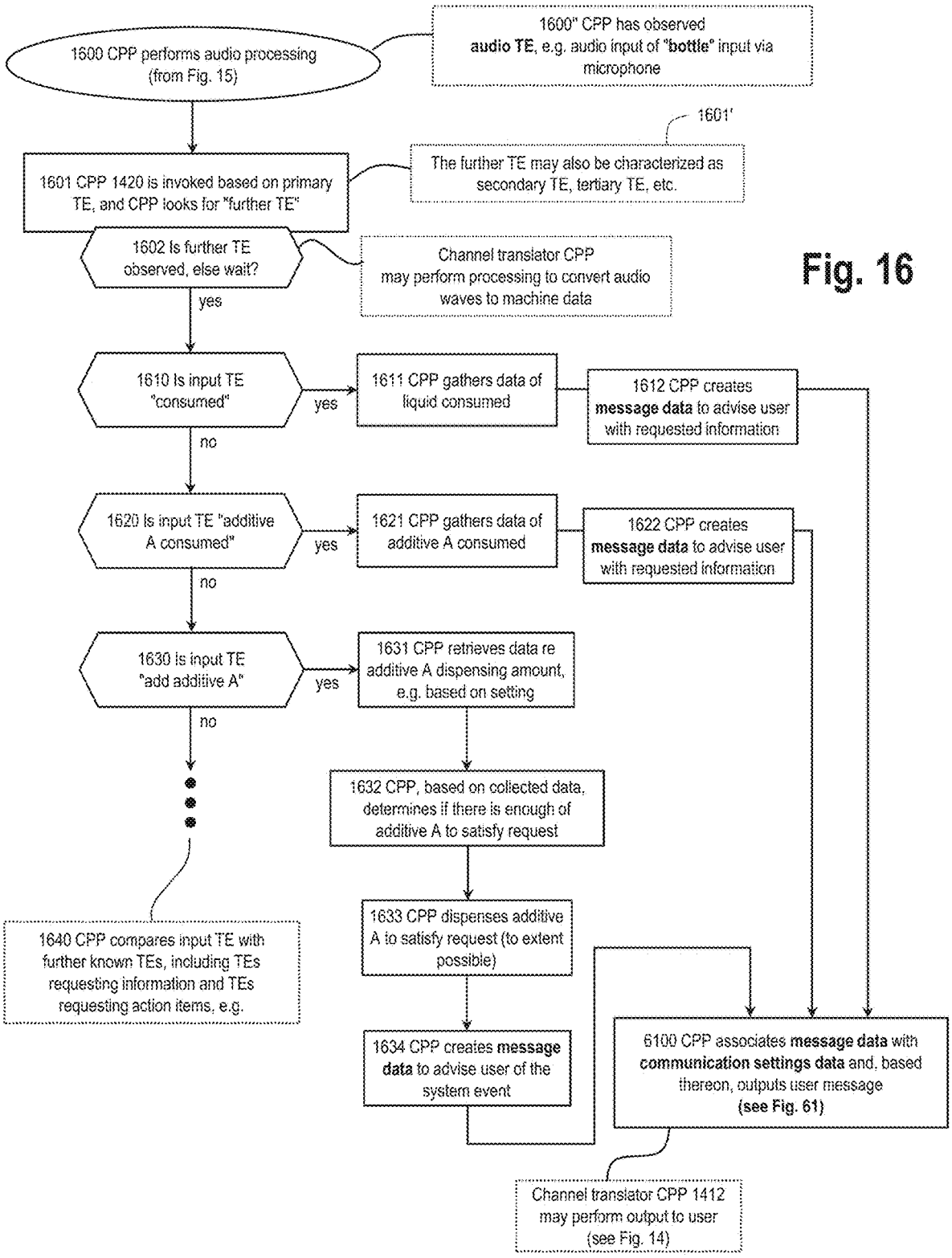
FIG. 16 is a flowchart showing in further detail the CPP performs audio processing step 1600 of FIG. 15 in accordance with one or more embodiments.

FIG. 16 is a flowchart showing in further detail the CPP performs audio processing step 1600 of FIG. 15 in accordance with one or more embodiments. As shown, the process starts in step 1600 and passes to step 1601. As shown in step 1601, the CPP 1420 is or has been invoked based on a trigger event. Step 1601 reflects the processing may include utilization of a primary trigger event and a secondary trigger event, as reflected at 1601'. For example, the primary trigger event might be the spoken word "bottle". Upon the processor 1410 identifying such primary trigger event, the processor 1410 may then "wake up" or become more sensitive to subsequent or $2^{nd}$ level commands. In this manner, processing requirements may be reduced in that the processor 1410 need not be continuously sensitive to any of a wide variety of commands which may number in the tens or hundreds. However, in other embodiments, the processor 1410 need not utilize any hierarchy of commands and the processor may be configured to initially recognize any of a number of predetermined commands That is, in other words, in some embodiments any initial prompt word such as "bottle" need not be utilized. It is appreciated that processing described herein as inputting or outputting "words". However, it is appreciated that such "words" may be interpreted to include any articulation, i.e. noise, sound, such as words, nonsense words, phrases, sequence of Alpha or numeric spoken characters, and/or other spoken indicia. Relatedly, it is appreciated that a single word might be utilized to constitute a command or multiple words might be utilized to constitute a command. As reflected at 1600" of FIG. 16, the processing of FIG. 16 is in general prompted by an observed audio trigger event such as input of "bottle"—that is input via the microphone 1492 of the bottle 1490. As also reflected in FIG. 16, the channel translator CPP 1412 may be utilized to convert sound or audio waves to machine data so as to be understandable by the processor 1410.

Accordingly, with further reference to FIG. 16, at 1602, a determination or monitoring is performed to determine if a further trigger event is observed. In accord with one embodiment, the system waits until a further trigger event is observed, for example after hearing an initial "bottle" input. If a further trigger event is not observed in step 1601 after some predetermined amount of time, then the processing may be terminated—and return to a "wait" status as performed in the processing of step 1501 of FIG. 15.

Upon a further trigger event being observed, the process passes from step 1602 on to step 1610. In step 1610, a determination is performed as to whether the trigger event was hearing, by the processor 1410, the spoken word of "consumed". Such is of course for illustrative purposes and any of a wide variety of spoken commands may be input by the system. If no, then the process passes to step 1620. In step 1620, a determination is performed as to whether the trigger event was hearing, by the processor 1410, the spoken word of "additive A consumed". Such is of course for illustrative purposes and any of a wide variety of spoken commands may be input by the system. If no, then the process passes to step 1630.

In step 1630, a determination is performed as to whether the trigger event was hearing, by the processor 1410, the spoken word of "add additive A". Such is of course for illustrative purposes and any of a wide variety of spoken commands may be input by the system. If no, then the process passes on to further processing. As reflected at 1640, the processor may compare the trigger event with further known trigger events that are recognizable by the system. For example, such further trigger events, which may be constituted by the audio input of words, may include requesting information regarding use of the bottle and/or may include requesting other action items to be performed by the bottle. For example, such action item might be a particular dispense event.

With further reference to FIG. 16 step 1610, the determination may be yes in step 1610. As a result, the process passes to step 1611. In step 1611, the processor gathers data regarding liquid that has been consumed in the bottle. Then, the process passes to step 1612. In step 1612, the processor creates message data to advise or provide the user with the requested information. Then, the process passes to step 6100.

In step 6100, the processor associates such message data with communication settings data, as characterized herein. Based on such combination of data, a user message is generated and sent to the human user. Further aspects and features of such processing are described below with reference to FIG. 61. To explain further, the message data may be constituted by substantive text that contains the information requested by the human user. On the other hand, the communication settings data may be constituted by various data that controls how the message data is sent out. For example, the communication settings data may dictate the particular communications channel, e.g. audio or text message, upon which the message data is communicated to the user. The communication settings data, in general, may contain and dictate any of a wide variety of attributes that are used to control output of message data. Relatedly, it is appreciated that the channel translator CPP 1412, as depicted in FIG. 14, may be utilized to provide any needed translation between communication channels—such as the machine language understood by the processor 1410 vis-à-vis audio output constituted by sound waves generated by the speaker 1491.

With further reference to FIG. 16, the determination of step 1620 might be yes. Accordingly, the process passes to step 1621. In step 1621, the processor gathers data of additive A consumed. Then, in step 1622, the processor creates message data to advise the user with the requested information. Such processing may include any one additive dispensed by the bottle 1490 and/or a collection or aggregation of additives dispensed by the bottle 1490. After step 1622, the process passes to step 6100. The message data generated in the processing of step 1622 may then be output to the user in manner as described above. With further reference to FIG. 16, the determination of step 1630 may be yes. As a result, the process passes to step 1631. In step 1631, the processor retrieves data regarding the amount of additive A, for example, that was dispensed. Such processing may utilize settings or rules that control or dictate the particular amount of additive that should be dispensed in response to such command, i.e. in response to the command "add additive A". Then, the process passes from step 1631 to step 1632. In step 1632, a determination is made whether there is sufficient amount of the particular additive, in this example additive A, to satisfy the request of the human user. The processor then dispenses the additive in step 1633. Then, the process passes to step 1634. In step 1634, the processor creates message data to advise the user of the dispense event. For example, the message data might reflect that the particular additive was dispensed as requested. On the other hand, the message data may reflect that there was insufficient amount of additive to honor the request. Accordingly, the message data may reflect that other action was taken. Such other action might be the dispense of a portion of the requested amount or not dispensing any of the additive. After step 1634, the process passes to step 6100. Processing is then continued as described above.

As related to the audio processing of FIG. 16, FIG. 17 is a diagram showing in further detail the processor performs audio settings processing step 1700 of FIG. 15 in accordance with one or more embodiments, as reflected at 1700'.

FIG. 17 shows a GUI 1720 that includes various GUI buttons. Such GUI may be presented to the user, through user interface, and, upon selection of a particular button, invokes associated processing at the right side of FIG. 17, as reflected at 1720'. The GUI 1720 includes "set communication options" button 1721, "set amount of additive dispensed" button 1722, and "map voice command to functionality" button 1723. In general, as reflected at 1750, the GUI 1720 provides control or adjustment of settings associated with audio related functionality.

The GUI button 1721 is associated with the processing 1701 and 1702. In the processing of step 1701, the processor interfaces with the user to set communication settings that control output of user messages. Further details are described below with reference to the GUI of FIG. 62. In the processing of step 1702, the processor interfaces with the user to set if the bottle and/or system provides user messages that confirm action performed by the bottle. For example, such confirming action might be that the bottle confirms to the user that the bottle has performed a dispense event (which may be in response to a request from the user to perform such dispense event). Further details are described below with reference to the GUI of FIG. 62.

The GUI button 1722 is associated with processing 1703. In the processing of step 1703, the processor interfaces with the user to set the amount of additive that is dispensed in one dispensing or dispense. Further details are described below with reference to the GUI of FIG. 62.

The GUI button 1723 is associated with the processing 1704. In the processing of step 1704, the processor interfaces with the user to map or associate functionality, which is provided by the bottle or system, to a new voice command That is, such new voice command is input from the user and functionality is provided to map such new voice command to functionality existing in the bottle or system. Further details are described below with reference to the GUI of FIG. 63 and the processing of FIG. 64.

The GUI 1720 of FIG. 17 also includes a "go to home" button 1725. In general, it is appreciated that the various GUIs described herein may include functionality such as directing a user to a homepage or some other high-level page or other navigation options.

Figure 18:
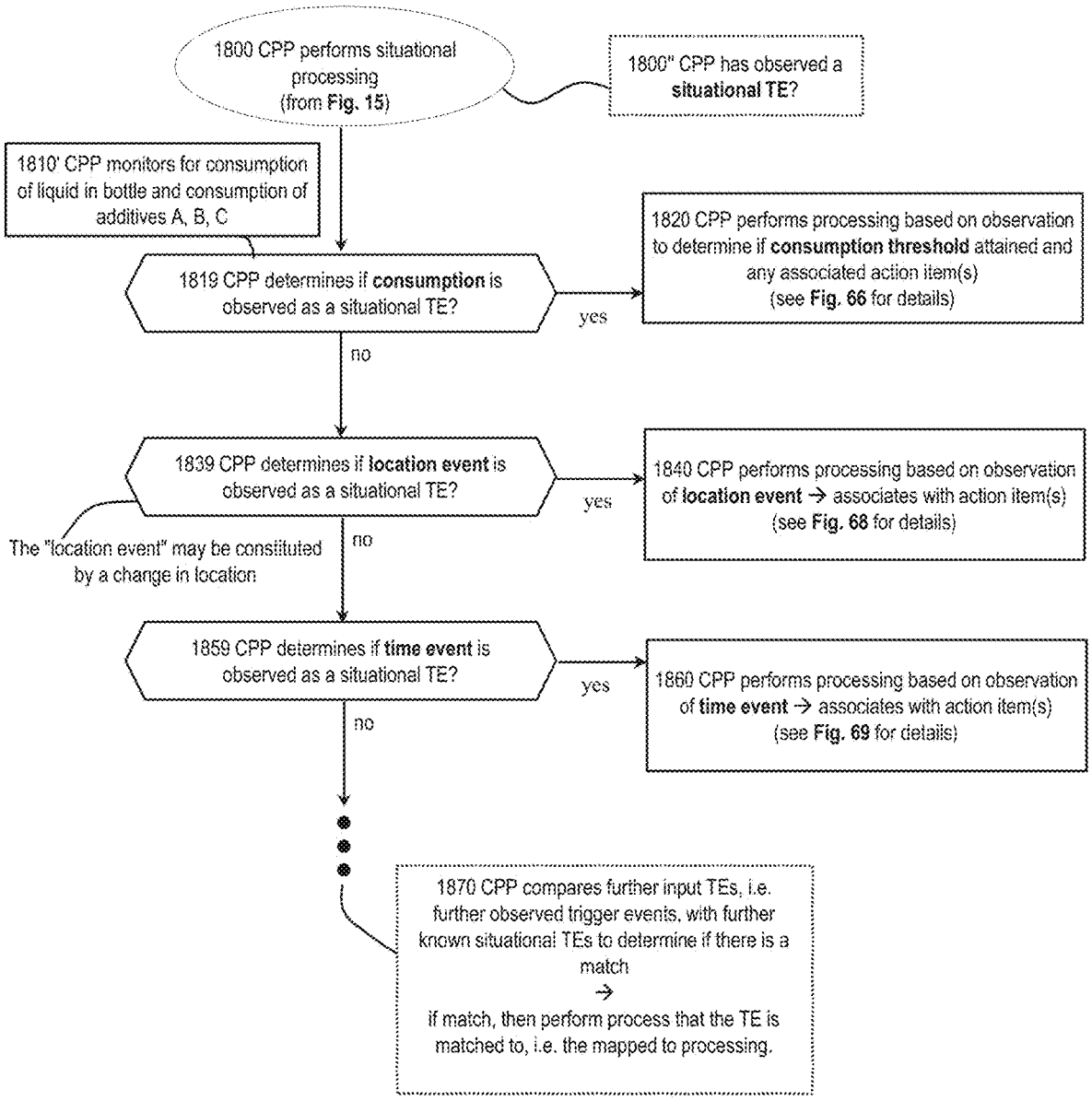
FIG. 18 is a is a flowchart showing in further detail the processor performs situation processing step 1800 of FIG. 15 in accordance with one or more embodiments

FIG. 18 is a flowchart showing in further detail the processor performs situational processing step 1800 of FIG. 15 in accordance with one or more embodiments. As shown, the process starts in step 1800 and passes to step 1819. To further explain, as reflected at 1800" of FIG. 15, the processor has determined that a situational trigger event has been observed. As a result of such observation, the processing of step 1800 is invoked. It is in the processing of step 1800, in accordance with one or more embodiments, that the specific trigger event is identified and corresponding action is taken (based on the observation of such trigger event).

Accordingly, with reference to FIG. 18, in the processing of step 1819, the processor determines if consumption is the situational trigger event. As reflected at 1810', the processing of step 1810 monitors for consumption of liquid in the user's bottle as well as monitors for consumption of the various additives in the user's bottle. It may be determined in step 1819 that consumption was not the observed trigger event. As a result, the process passes to step 1839.

In step 1839, the processor determines if a location event is the observed situational trigger event. For example, the location event may be constituted by a change in location of the user's bottle. If no in step 1839, the process passes to step 1859. In step 1859, the processor determines if a time event is the observed situational trigger event. If a determination of no is found in step 1859, then further processing may be performed so as to specifically identify the particular situational trigger event. As reflected at 1870, the processor may compare further input trigger events with further known situational trigger events. Based on this comparison, the processor determines if there is a match between what was observed and, based on the data available to the processor, what is known to be a situational trigger event. In the case of a match, as reflected at 1870, then the processor may perform the particular process or action item that the trigger event is matched to. In other words, upon a known trigger event being matched (with the observed trigger event) the known trigger event is mapped to one or more action items. With further reference to FIG. 18, it may be a yes determination in the processing of step 1819. As result, the process passes to step 1820. In step 1820, the processor performs processing based on the observation to determine if any consumption thresholds have been attained and, as a result, any associated or mapped to action item should be performed. For example, a consumption threshold might be constituted by a particular amount of liquid being consumed and/or a particular amount of additive being consumed. Further details of such processing are described below with reference to FIG. 66.

With further reference to FIG. 18, it may be determined in step 1839 that the observed situational trigger event is indeed a location event, i.e. yes in step 1839. As a result, processing passes from step 1839 to step 1840. In step 1840, the processor performs processing based on the observation of a location event. In particular, the processor may map or associate such observed event to a particular action item. Further details are described below with reference to FIG. 68. For example, the processing of step 1839 may provide functionality in which the bottle can identify that the user is walking or the bottle can identify that the user is jogging. As a result of such observation of the "situation" of the bottle/user, the bottle may then take appropriate action such as dispensing a particular amount of additives into the liquid.

With further reference to FIG. 18, it may be a yes determination in the processing of step 1859. In such case, the process passes from step 1859 to step 1860. In step 1860, the processor performs processing based on the observation of a time event. Specifically, the processor attempts to match or associate an action item to the event that was observed. Details are described below with reference to FIG. 69.

As related to the situational processing of FIG. 18, FIG. 19 is a diagram showing in further detail the processor performs situational settings processing step 1900 of FIG. 15 in accordance with one or more embodiments, as reflected at 1900".

FIG. 19 also shows a GUI 1920 that includes various GUI buttons. Such GUI may be presented to the user, through user interface, and, upon selection of a particular button, invokes associated processing at the right side of FIG. 19, as reflected at 1920'. The GUI 1920 includes "set consumption event—for bottle to take action" button 1921, "set geo-location—for bottle to take action" button 1922, and "set change in geo-location—for bottle to take action" button 1923. In general, as reflected at 1950, the GUI 1920 provides control or adjustment of settings associated with situational related functionality.

The GUI button 1921 is associated with the processing 1901. In the processing of step 1901, the processor interfaces with the user to set consumption settings that can dictate action items performed based on consumption of liquid or additive, or a combination of liquid or additive. Further details are described below with reference to the GUI of FIG. 70 and related FIG. 66.

The GUI button 1922 is associated with processing 1902. In the processing of step 1902, the processor interfaces with the user to set settings that dictate action items performed based on location of the bottle. Further details of the processing of step 1902 are described below with reference to the GUI of FIG. 71 and related FIG. 68.

The GUI button 1923 is associated with the processing 1903. In the processing of step 1903, the processor interfaces with the user to set the settings that can dictate action items performed based on a location change of the bottle, e.g. upon a bottle traveling into a location or traveling from a Pt location to a $2^{nd}$ location, for example. For example, a change in location from a $1^{st}$ location to a 2nd location might be associated with a walking activity or a jogging activity. In response, the bottle may be configured or programmed to dispense a particular amount of additive. Further details are described below with reference to the GUI of FIG. 72 and the processing of FIG. 68.

As described herein, configuration or programming of the bottle may utilize one or more settings imposed by the user. In other embodiments or illustrations of the disclosure, to provide or perform a "setting" may be understood to be akin or similar to configuring or programming particular functionality.

FIG. 20 is a flowchart showing in further detail the processor performs group processing step 2000 of FIG. 15 in accordance with one or more embodiments. As shown, the process starts in step 2000 and, in accord with at least one embodiment, passes to both step 2019 and step 2080. Progression of such processing to step 2019 reflects formation, management, data distribution, data review, and other related processing. On the other hand, progression of such processing to step 2080 reflects group processing being performed based on settings of the lead user and/or member users who belonged to the particular group. Accordingly, the former relates more to the administration and management of group processing—whereas the latter relates more to the actual implementation of group processing as experienced by a member user whose bottle is subscribed to, or participates in, the group processing.

As shown in FIG. 20 and reflected at 2000', in accordance with at least one embodiment of the disclosure, group processing may include two types of users. The $1^{st}$ type of user is a lead user or administrator. The $2^{nd}$ type of user is a member user. The lead user may form the group and control dispensing activity, etc., to member users in the group. On the other hand, member users are users in the group who have a bottle that is opted into the particular group. For example, the member users may be on the same sports team and the lead user is the coach, trainer, or nutritionist of such sports team.

With further reference to FIG. 20, in step 2019, the processor determines if the particular trigger event (which was identified in step 2000' of FIG. 15) is constituted by a request by or from the lead user to form a group of users. If no, then the process passes to step 2039. In step 2039, the processor determines if the trigger event is a request by the lead user to manage the group. For example, such management might be constituted by managing dispense events. If no in step 2039, the process passes to step 2059. In step 2059, the processor, i.e. CPP, determines if the trigger event is a request by the lead user to review data associated with the event. If still no, then the process passes to step 2070. Step 2070 reflects that any of a variety of further group processing may be performed. Such further group processing may include other interface with the lead user who might also be characterized as a group leader.

If yes in step 2019 of FIG. 20, the process passes to step 2020. In step 2020, the processor performs processing to form a group so as to control dispensing (in bottles) of member users in the formed group. Such processing may also include the creation or establishment of a new lead user. Further details are described below with reference to FIG. 73.

With further reference to FIG. 20, the determination in step 2039 may be yes. Accordingly, the process passes from step 2039 to step 2040. In step 2040, the processor performs processing to manage the group. Such processing may include the management of dispense events. Thus, once a group is formed in the processing of step 2020, then such group may be managed in the process of step 2040. Further details are described below with reference to FIG. 76.

With further reference to FIG. 20, it may be determined in step 2059 that the trigger event is indeed a request for the lead user (or other user such as an administrator) to review data associated with an observed event and/or with the activities of the group. Accordingly, the process passes from step 2059 on to step 2060. Step 2060 reflects processing in which data may be distributed or otherwise accessed for the group. For example, the processing of step 2060 may be constituted by a detailed output to the lead user.

It is appreciated that various data processing may be performed in conjunction with the group processing as described herein. Such data processing may also be performed in conjunction with other collections or groups of users and/or the performed with regard to any activity or action as described herein. Such data processing may include data distribution, review of data, and/or data analytics, for example. Such data processing may relate to attributes or parameters of when a member's bottle performs, action requested by the user, and other activities. Such data processing may include a ranking of consumption, of liquid and/or additives, amongst a group of users. Other data processing may be provided.

As related to the group processing of FIG. 20, FIG. 21 is a diagram showing in further detail the processor performs group settings processing step 2100 of FIG. 15 in accordance with one or more embodiments. FIG. 21 shows a GUI 2120 that includes various GUI buttons. Such GUI may be presented to the user, through user interface, and, upon selection of a particular button, invokes the associated processing at the right side of FIG. 21, as reflected at 2120'. The GUI 2120 includes "available for group processing" button 2121, "set limits on group control of additive dispensing" button 2122, and "set group control time window" button 2123. In general, as reflected at 2150, the GUI 2120 provides control or adjustment of settings associated with group related functionality.

The GUI button 2121 is associated with the processing 2101. In the processing of step 2101, the processor enables the user bottle to interface or participate with group processing. For example, such functionality may provide the ability for the user to opt into specific groups while not opting into other groups.

The GUI button 2122 is associated with processing 2102. In the processing of step 2102, the processor interfaces with the user to set limits on control—that a group leader, administrator, or lead user as characterized herein—has on a particular member user's bottle. For example, the user of the particular bottle may be provided with a setting or configuration option that dictates a prescribed level of an additive—and such a setting will override or trump a setting (to the same parameter) that is attempted to be imposed by a lead user. Accordingly, such functionality may allow a user to participate in a group, which is controlled by a lead user, but control, constrain or limit the control that a lead user possesses (over the particular member user's bottle).

The GUI button 2123 is associated with the processing 2103. In the processing of step 2103, the processor allows a member user to set a time window in which a lead user may control the member user's bottle. Outside of such time window, group control is not allowed or provided. Accordingly, such a setting or configuration allows a user to succumb to a lead user's control—but only for a prescribed time. For example, group control over a particular member user's bottle may be limited to a workout time for the particular member user. For example, the workout time might be 4 to 6 PM weekdays.

As reflected at 2120A, a group can include only two persons that include the leader user, i.e. one who set up the group, and member user. Such arrangement can allow synching of bottle activity between such two users. As reflected at 2150', the settings of FIG. 21 may be characterized as directed to higher level or control settings.

Hereinafter further aspects of audio related processing will be described.

FIG. 60 is a table showing a data record 6000 that includes audio trigger events in accordance with one or more embodiments. For example, the audio trigger event(s) may be the trigger events that the processor attempts to identify a match—in the processing of step 1600' of FIG. 15 and/or step 1601 of FIG. 16. As shown, the data records include an audio trigger event, the processing portion that will perform processing based on identification of the trigger event, the functionality invoked as a result of the trigger event, and related attributes. As shown in FIG. 60, the functionality invoked may also include a functionality or function ID. The data contained in the data records 6000 may be utilized to perform the processing of FIGS. 15 and 16, to provide information to the user in conjunction with such processing, or for other related purposes, for example.

Figure 61:
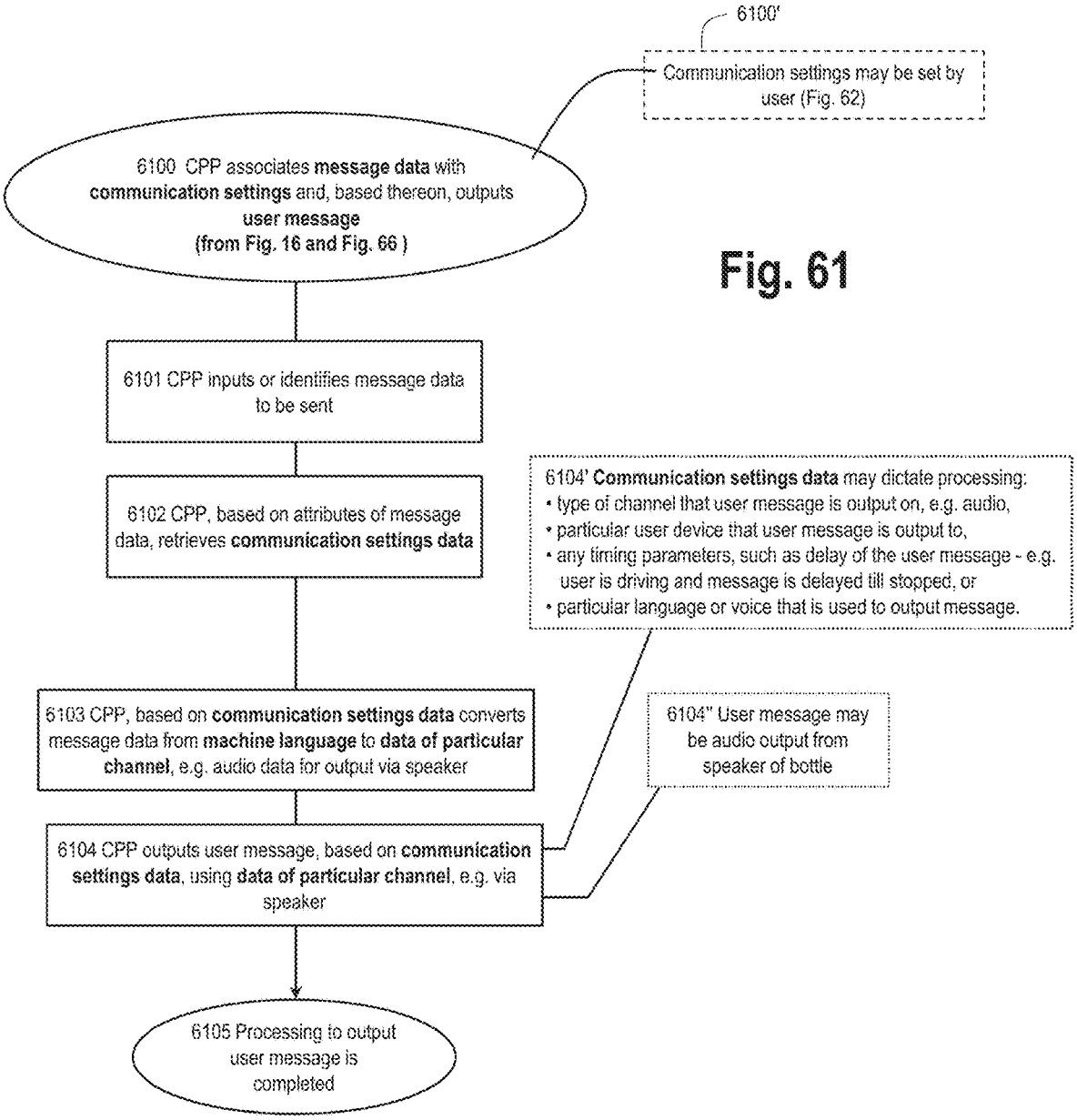
FIG. 61 is a flowchart showing in further detail the processor associates message data with communication settings and, based thereon, outputs user message in accordance with one or more embodiments.

FIG. 61 is a flowchart showing in further detail the processor associates message data with communication settings and, based thereon, outputs user message. Such processing can be utilized in FIG. 16, as well as FIG. 66 described below. The processing starts in step 6100 and passes to step 6101.

In step 6101, the processor inputs or identifies the particular message data to be sent. In other words, such particular message data may be the substantive content or text that is to be conveyed to the user. Such substantive content or text might be the amount of liquid or additives that has been consumed by the user. Then, the process passes to step 6102.

In step 6102, the processor, based on attributes of the message data, retrieves communication settings data. Then, in step 6103, the processor, based on the communication settings data (which as reflected at 6100' can be set by the GUI of FIG. 62) converts the message data from machine language to data conducive to the particular channel upon which the user message is to be sent. For example, the particular channel might be constituted by audio output in which case the message data is converted from machine language to audio data for output via the speaker 1491, as reflected at 6104". Then, in step 6104, the processor outputs the user message, based on communication settings data, using the data of the particular channel.

As reflected at 6104', the communication settings data may dictate processing including the type of channel that the user message is output on, the particular user device that the user message is output to, any timing parameters, and/or a particular language or voice that is used to output the message, for example. For example, timing parameters might include a constraint that the message will not be output or pushed out to the user while the user is driving a vehicle.

After the processing of step 6104, the process passes to step 6105. In step 6105, the processing to output the user message is complete. Accordingly, the processing is stopped or terminated.

Figure 62:
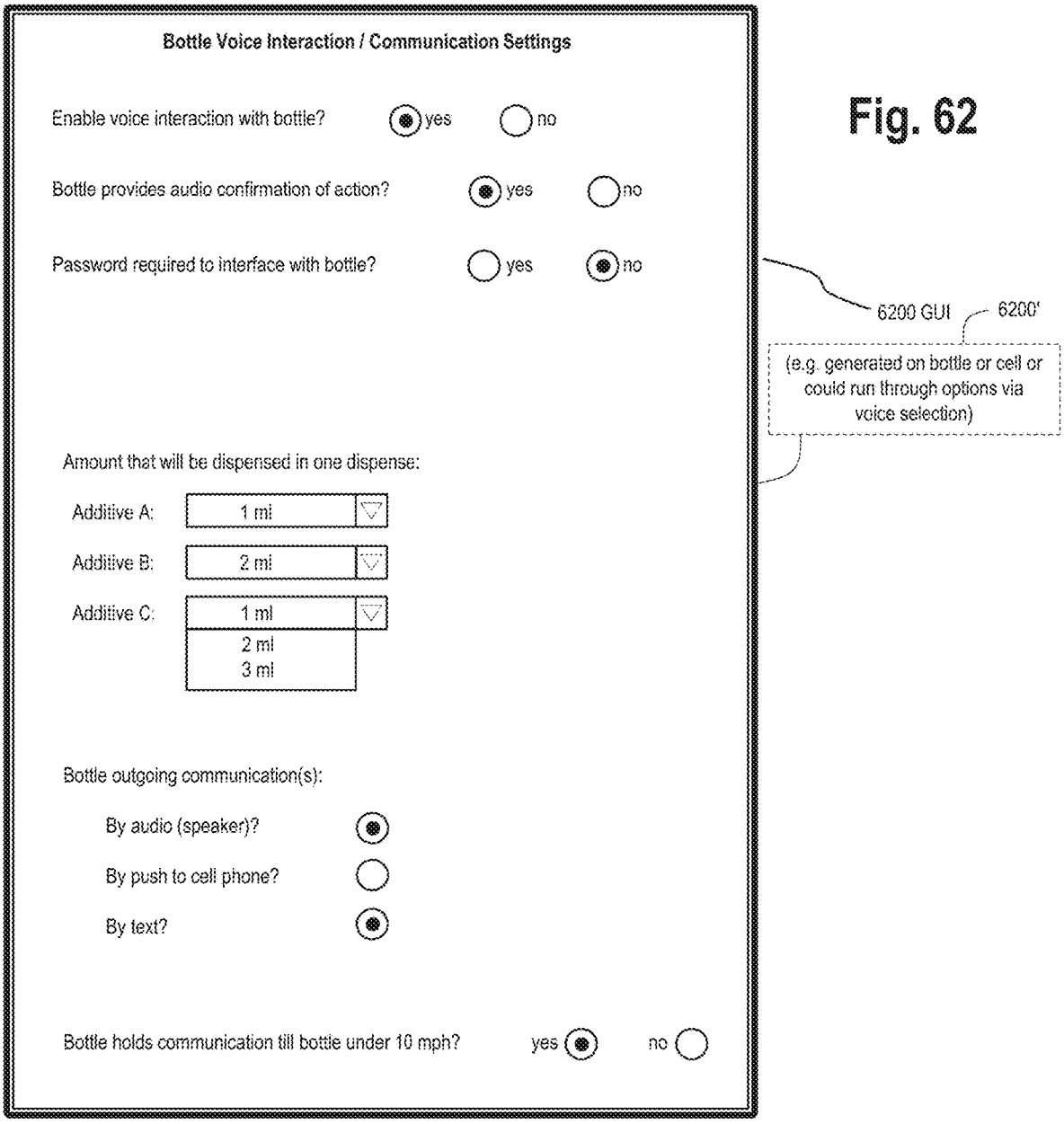
FIG. 62 is a diagram showing a GUI 6200 in accordance with one or more embodiments.

FIG. 62 is a diagram showing a GUI 6200 in accordance with one or more embodiments. For example, the GUI (as with other GUIs described herein) might be generated on bottle 1490 or might be generated on a user device 1480, or can be provided as options via voice selection, for example, as reflected at 6200'. In particular, the GUI 6200 relates to bottle voice interaction and communication settings, as well as related settings. The GUI 6200 in accordance with one or more embodiments provides the user with the ability to toggle between allowing voice communication and not allowing voice communication, for example. As shown in FIG. 62, the "yes" is checked—and accordingly voice interaction with the bottle will be enabled. On the other hand, if the no button was instead checked, then voice interaction with the bottle would not be enabled.

The GUI 6200 also provides the user the ability to enable or disable audio confirmation of action. As shown in FIG. 62, audio confirmation of action is checked yes and thus will be enabled. For example, such functionality relates to a situation in which the bottle 1490 takes some action, such as dispensing an additive, and outputs an audio message via speaker 1491 that such action has been taken. Some users may find it helpful to receive such confirmation whereas other users do not wish to receive such confirmation. The GUI 6200 also allows the user to toggle between requiring a password to access the bottle or not requiring a password. This functionality may also apply to user interface with user device 1480 in terms of an "app" or functionality/interface that is associated with use of the bottle 1490. The GUI 6200 also provides for the user to set or configure the amount of additive that will be dispensed in one dispense. For example, as shown in FIG. 62, 1 ml of additive A will be dispensed in one dispense. Additionally, functionality may be provided on the GUI 6200 so that the user may set the communication channel for outgoing communications. Illustratively, FIG. 62 shows that the user may select communication channels including audio, push to cell phone, and text. In the setting or configuration as shown in FIG. 62, the user will receive communications via audio and text, but not by push to cell phone. Using a similar interface or setting, the user might also be provided with functionality to control the particular communication channels upon which incoming communications may be input to the bottle 1490 or to the device 1480 (for bottle related functionality). Further, it should be appreciated that the user may be provided with functionality to constrain outgoing and incoming communications to the bottle. In the example of FIG. 62, the user is provided with functionality to control whether the bottle holds or delays sending of a communication until the bottle speed is under 10 mph. Such functionality, for example, might be useful to preclude outgoing audio communications when the user is driving or when the user is running.

Figure 63:
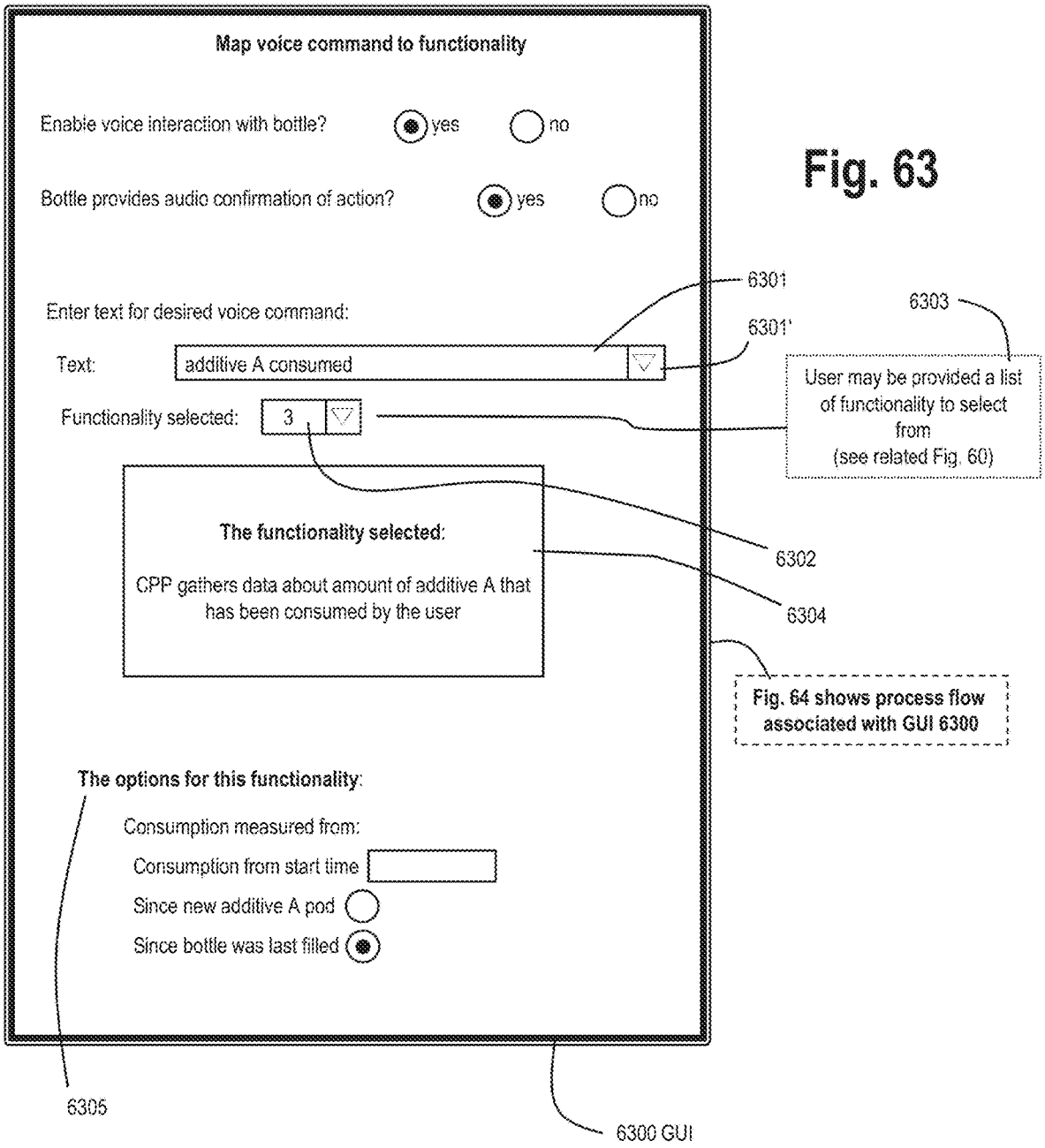
FIG. 63 is a diagram showing a further GUI 6300 in accordance with one or more embodiments.

FIG. 63 is a diagram showing a further GUI 6300 in accordance with one or more embodiments. For example, the GUI might be generated on bottle 1490 or might be generated on user device 1480. The GUI 6300 also provides a setting or configuration to allow a user to control whether voice interaction with the bottle is enabled. The GUI 6300 also provides a setting to control whether audio confirmation of action is enabled. The GUI 6300 relates to functionality provided by the system in which an audio command (preselected by the user) is mapped or associated with functionality provided by the bottle. As shown in FIG. 63, the GUI 6300 includes a text box 6301. The user enters or types into the text box 6301 her choice (of audio command) to which functionality will be mapped. Such text box may also use the drop-down menu functionality 6301'. Hand in hand, the user selects the particular functionality that is mapped to—via selection box 6302. In the case of FIG. 63, the functionality selected is functionality (3) that corresponds to an item as shown in FIG. 60. A user may be provided a list of functionality as reflected at 6303 of FIG. 63. Upon selection of particular functionality, the bottle or system may generate a description of such functionality via window 6304 of FIG. 63. Such may be helpful to allow clarity and confirmation of which function the user is selecting.

Further, the GUI 6300 may be provided to allow the user to select options 6305 for the particular functionality selected in window 6302. Accordingly, as the functionality selected in window 6302 changes the displayed options 6305 for the functionality would or can correspondingly change or "update". The illustrative options 6305 shown in FIG. 63 relate to "when consumption is measured from"—in accordance with one or more embodiments.

Figure 64:
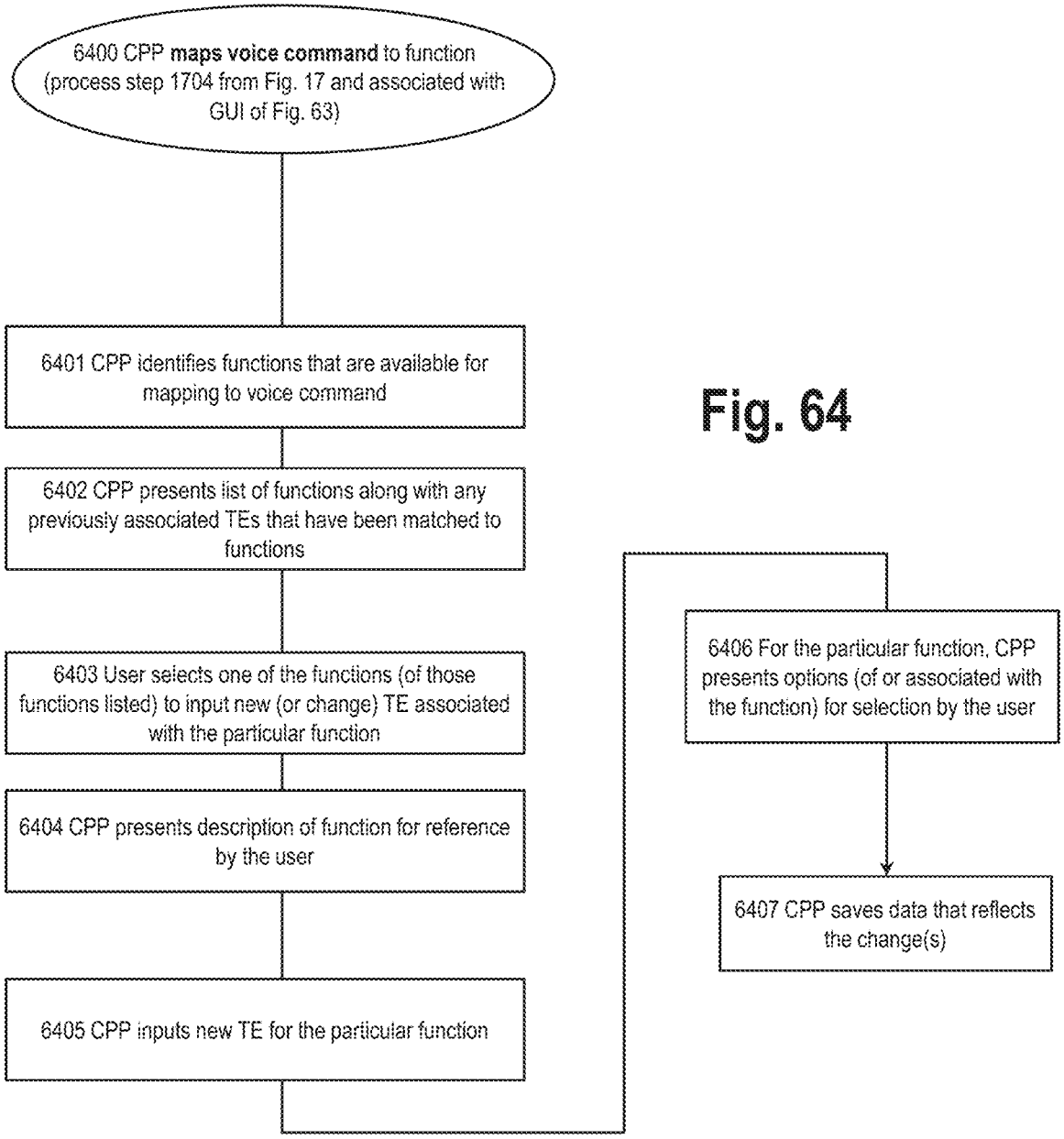
FIG. 64 is a flowchart showing details of the processor maps voice command to function step 1704 of FIG. 17 in accordance with one or more embodiments.

FIG. 64 is a flowchart 6400 related to the GUI 6300. FIG. 63. Specifically, FIG. 64 is a flowchart showing details of the processor maps voice command to function step 1704 of FIG. 17 in accordance with one or more embodiments. In step 6401, the processor identifies functions that are available for mapping the voice command. In step 6402, the processor presents a list of functions along with any previously associated voice commands, i.e. triggered events, that have previously been matched to functions. In step 6403, the user selects one of those functions (of those functions listed) to input a new triggered event or change a triggered event that is associated with a particular function. That is, to further explain, such triggered event can be constituted by the text command entered by the user in the text box 6301 of FIG. 63. In step 6404, the processor presents description of the particular function for reference by the user, as illustrated in display 6304 of FIG. 63. In step 6405 of FIG. 64, the processor inputs the new triggered event for the particular function. In step 6406, for the particular function selected, the processor presents options (of or associated with the particular function) for selection by the user. Then, in step 6407, the processor saves the data that reflects the changes. As noted above, if or as the user switches the functionality selected 6302, then the processor will update the description 6304 of the functionality as well as the options 6305 of the functionality.

Figure 65:
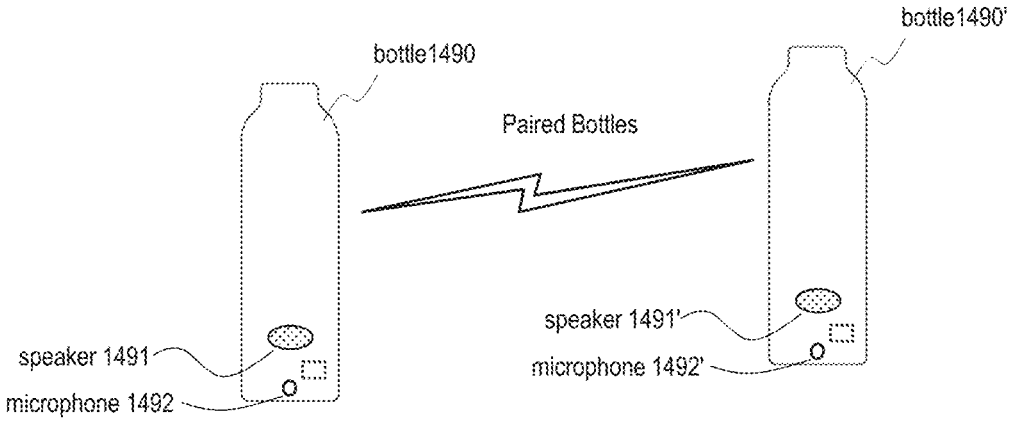
FIG. 65 is a diagram showing two user bottles in a paired configuration in accordance with one or more embodiments.

FIG. 65 is a diagram showing two user bottles 1490, 1490' in a paired configuration in accordance with one or more embodiments. Such figure reflects functionality that may provide communication between two or more bottles that may be desirable under certain circumstances. Such pairing allows data communication between such paired bottles. Data communication may be desirable in the situation of a single user possessing multiple bottles. Data communication may be desirable in a situation where multiple persons, having respective bottles, wish to coordinate their additive intake in some manner, for example. Such communication between such paired bottles might utilize any communication channel described herein or known, such as Bluetooth communication. The bottle 1490 can include a speaker 1491' and a microphone 1992', in similar manner to the bottle 1490.

FIG. 66 is a flowchart showing in further detail processor performs processing based on observation to determine if consumption threshold has been attained, and based on such observation, performs a mapping to an associated action item or items of step 1820 of FIG. 18 in accordance with one or more embodiments. In step 1821 of FIG. 66, the processor retrieves the observed consumption that was identified in step 1819 of FIG. 18. Then, in step 1822, processor determines if the observed consumption was constituted by a consumption of liquid in the user's bottle. If yes, then in step 1823, the processor retrieves data regarding consumption of thresholds of liquid and determines if any threshold or thresholds have been attained. If no, then the process effectively terminates and passes back to step 1800' of FIG. 15. If yes in step 1823, then the process passes to step 1832. In step 1832, based on the attained threshold, the processor maps into associated action items taking into account any imposed constraints. For example, such imposed constraints might be the processing is contingent on bottle status, bottle arrangement, or some disposition of the bottle structure. FIG. 67 includes a data record 6700A of the illustrative consumption thresholds in accordance with one or more embodiments. Then, in step 1833, the action item that was mapped to (and not constrained by any applicable constraints) is performed. Then, in step 1834, message data is generated regarding the action performed. Then, in step 6100, the processor associates message data with communication settings data, as described otherwise herein.

On the other hand, a determination of no may be determined in step 1822 of FIG. 66. Accordingly, the process passes to step 1825. In step 1825, the processor determines if the consumption was of additive A. If yes, then the process passes to step 1826. In step 1826, the process retrieves data regarding consumption thresholds of the additive A and determines if any thresholds have been attained. If no, then the process effectively terminates and passes back to step 1800' of FIG. 15. If yes in step 1826, then the process passes to step 1832. Processing then continues as described above.

On the other hand, a determination of no may be determined in step 1825. Accordingly, the process passes to step 1828. In step 1828, the process determines if the consumption was a consumption of additive B. If yes in step 1828, then the process proceeds in similar manner to that of a yes determination in step 1825, onto step 1829 and 1830. On the other hand, if no in step 1828, then the process passes to step 1831. Illustratively, step 1831 reflects a determination that the consumption was emptying of the bottle either via the user consuming all the contents or via the user emptying the bottle. The process then passes from step 1831 to step 1834. In step 1834, the processor generates message data regarding the event and the action item, if any, that was performed. For example, such message might be desirable for record-keeping purposes so as to allow the user to identify or record the particular time that his or her bottle was empty.

As described above, FIG. 67 shows threshold records 6700 according to principles of the disclosure. FIG. 67 shows data records 6700A of consumption thresholds. Each data record 6700A can include a threshold item, a threshold, a reset of count, i.e. what event resets an associated count, an action item, and illustrative constraints. FIG. 67 shows data records 6700B of location thresholds. Each data record 6700B can include an item type, a trigger, reset data, i.e. what event resets an associated count, and an action item.

Figure 68:
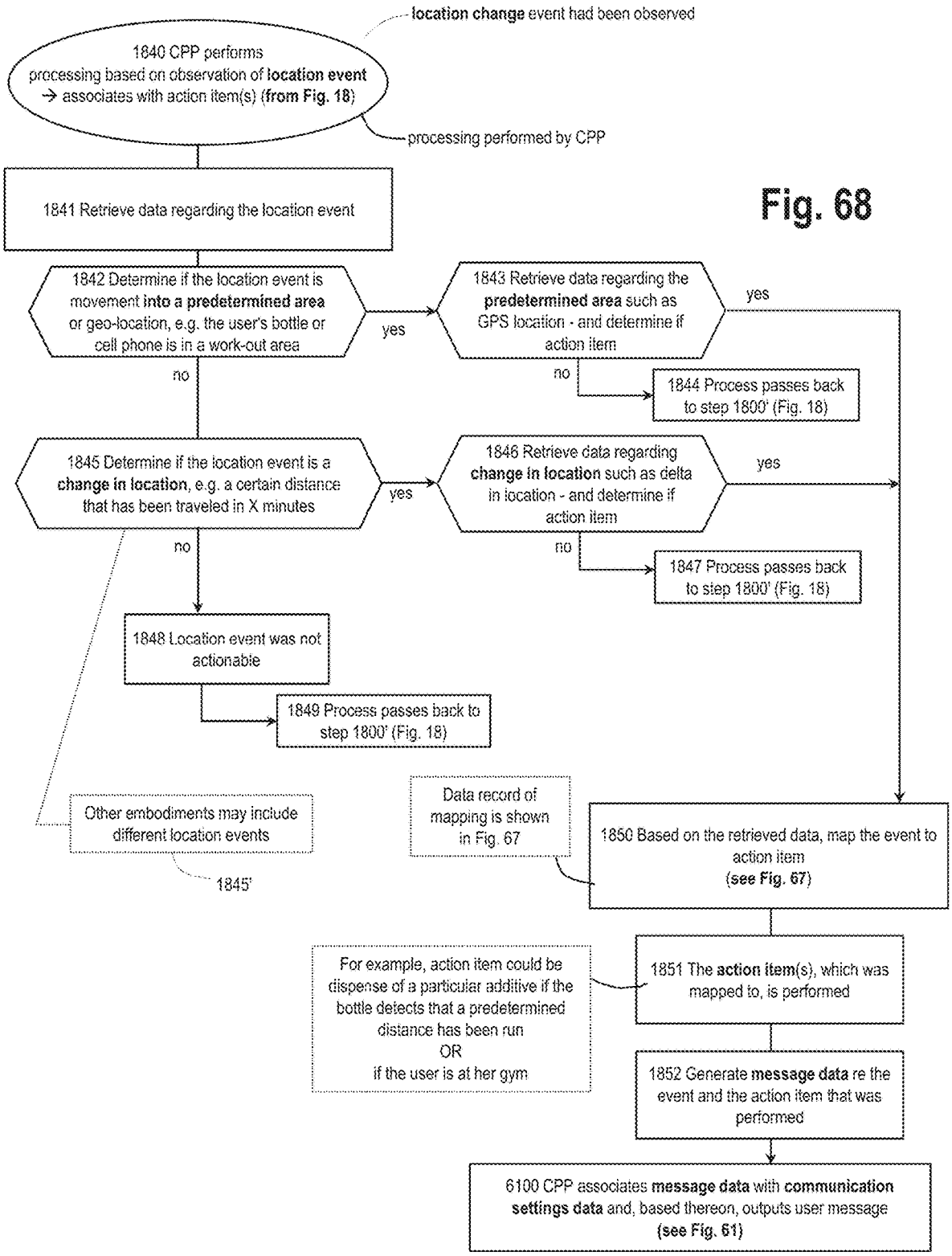
FIG. 68 is a flowchart showing in further detail the processor performs processing based on observation to determine if a location event has been observed, and based on such observation, perform a mapping to an associated action item or items step 1840 of FIG. 18 in accordance with one or more embodiments.

FIG. 68 is a flowchart showing in further detail the processor performs processing based on observation to determine if a location event has been observed, and based on such observation, perform a mapping to an associated action item or items step 1840 of FIG. 18 in accordance with one or more embodiments. In step 1841 of FIG. 68, the processor retrieves the location observation that was identified in step 1839 of FIG. 18. Then, in step 1842, the process determines if the location event is movement into a predetermined area or geolocation. For example, the movement might be into a workout area. If yes, then the process passes to step 1843. In step 1843, the processor retrieves data regarding the predetermined area using GPS, for example. Also, the processor determines if there is an action item associated with such area. If there is no action item associated with the area into which the bottle was moved, for example, then a no determination is yielded in step 1843. As a result, the process terminates in step 1844—with a return to step 1800' of FIG. 18.

On the other hand, the determination of step 1843 may be yes. As a result, the process passes to step 1850. In step 1850, based on the retrieved data, the location event is mapped to an action item. FIG. 67 includes a data record 6700B of illustrative location thresholds in accordance with one or more embodiments. After step 1850, the process passes to step 1851—in which the action item, which was mapped to, is performed. Then, the process passes to step 1852. In step 1852, the processor generates message data regarding the event and the action item that was performed as a result of observation of the event. Then, processing passes to step 6100. Processing then continues in manner similar to that described above.

Alternatively, a no determination may be determined in step 1842. As a result, the process passes to step 1845. In step 1845, illustratively, a determination is made if the location event is a change in location. Such a change in location might be constituted by a certain distance that has been traveled in a particular amount of time. It is appreciated other embodiments may include various other location events as may be desired, as reflected at 1845'. If yes in step 1845, then the process passes to step 1846 and continues in manner similar to processing subsequent to step 1842, with steps 1847 or 1850. If no in step 1845, then the process passes to step 1848.

In step 1848, the system determines that the location event was not actionable. As a result, the process passes back to step 1800' of FIG. 18.

Figure 69:
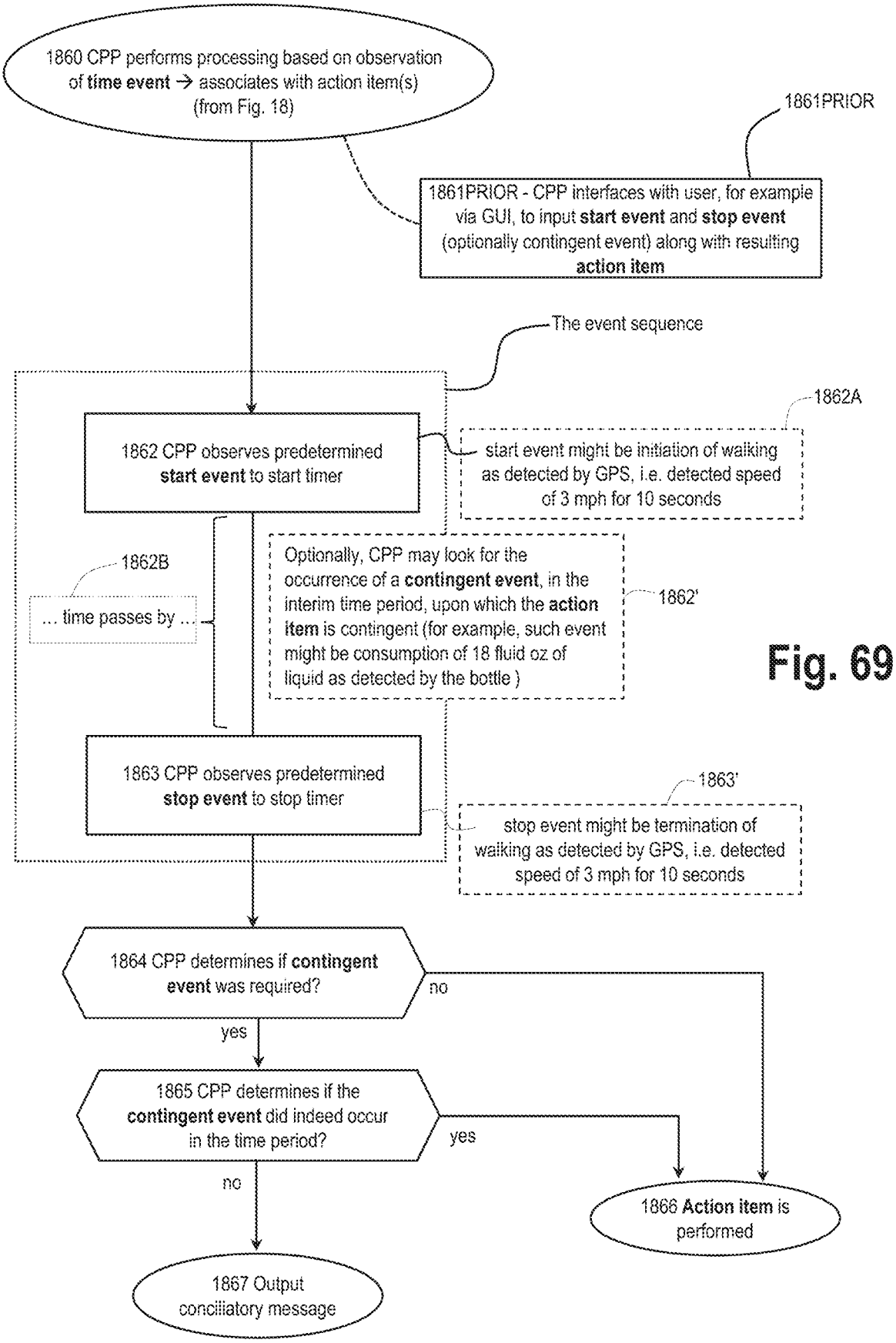
FIG. 69 is a flowchart showing further details of the processor performs processing based on observation of a time event so as to associate such observation with one or more action items step 1860 of FIG. 18, in accordance with one or more embodiments.

FIG. 69 is a flowchart showing further detail of the processor performs processing based on observation of a time event so as to associate such observation with one or more action items step 1860 of FIG. 18, in accordance with one or more embodiments. Related to the processing of FIG. 69, it is appreciated that at some prior time the user performed the processing of step 1861PRIOR. In such processing, the user established the start event and stop event, for example, that are utilized in the processing of FIG. 69. Specifically, the user is provided functionality to (prior to the processing of step 1860) set up a start event, stop event, and associated action item. That is, functionality is provided such that an occurrence of such start event and stop event will result in a particular action item being performed. Optionally, contingencies or a contingent event may be built into such functionality. That is, even if the start event and stop event occur—the action item may not be performed if the contingent event is not observed by the processor.

Accordingly, in FIG. 69, the process starts in step 1860 and passes to step 1862. In step 1862, the processor observes the predetermined start event. As a result, the processor may start a suitable timer, for example. For example, the start event might be the initiation of walking as detected by the processor, as reflected at 1862A. Then, as reflected in FIG. 69 at 1862B, time passes by. Then, in step 1863, the processor observes the predetermined stop event and, as result, stops the timer. For example as reflected at 1863', the stop event might be termination of walking as detected by GPS. The detection of the start of walking, the detection of the stop of walking, and other detected movement may be based on observing a sequence of GPS locations over a demarcated time interval and matching such observed pattern with known patterns. As reflected at 1862', the processor may look for the occurrence of a contingent event. In this example, that contingent event is consumption of a particular amount of liquid.

Subsequent to the stop event being determined in step 1863, the process passes to step 1864. In step 1864, the process determines if a contingent event was required. If no, then the process immediately passes to step 1866 and the action item is performed. On the other hand, if yes in step 1864, then the process advances to step 1865 so as to determine if the contingent event did indeed occur in the time period. If yes, then the process again passes to step 1866 and the action item is performed. On the other hand, if no in step 1865, then the process passes to step 1867. In step 1867, an appropriate message is output to the user. The nature of such message might be conciliatory in nature and encouragement to consume your target amount of water, with your next event.

In general, any function described herein may be voice activated. Such includes, for example, any request by a user (input via microphone, e.g.) and response from the bottle (output via speaker, e.g.) regarding a status or disposition of the bottle, for example. An input or output described herein as performed by a bottle/container may alternatively be input or output by an associated user device. An input or output described herein as performed by a user device may alternatively be input or output by an associated bottle/container. Functionality may be provided to perform one to many communications, such as a coach to a team. Data as described herein may be collected, presented and/or aggregated as may be desired. Such data might be presented in the voice of a coach or trainer to a team via communication to each team member's bottle, for example. For example, data regarding one person's goal or team goal information might be output in the voice of the coach.

Figure 70:
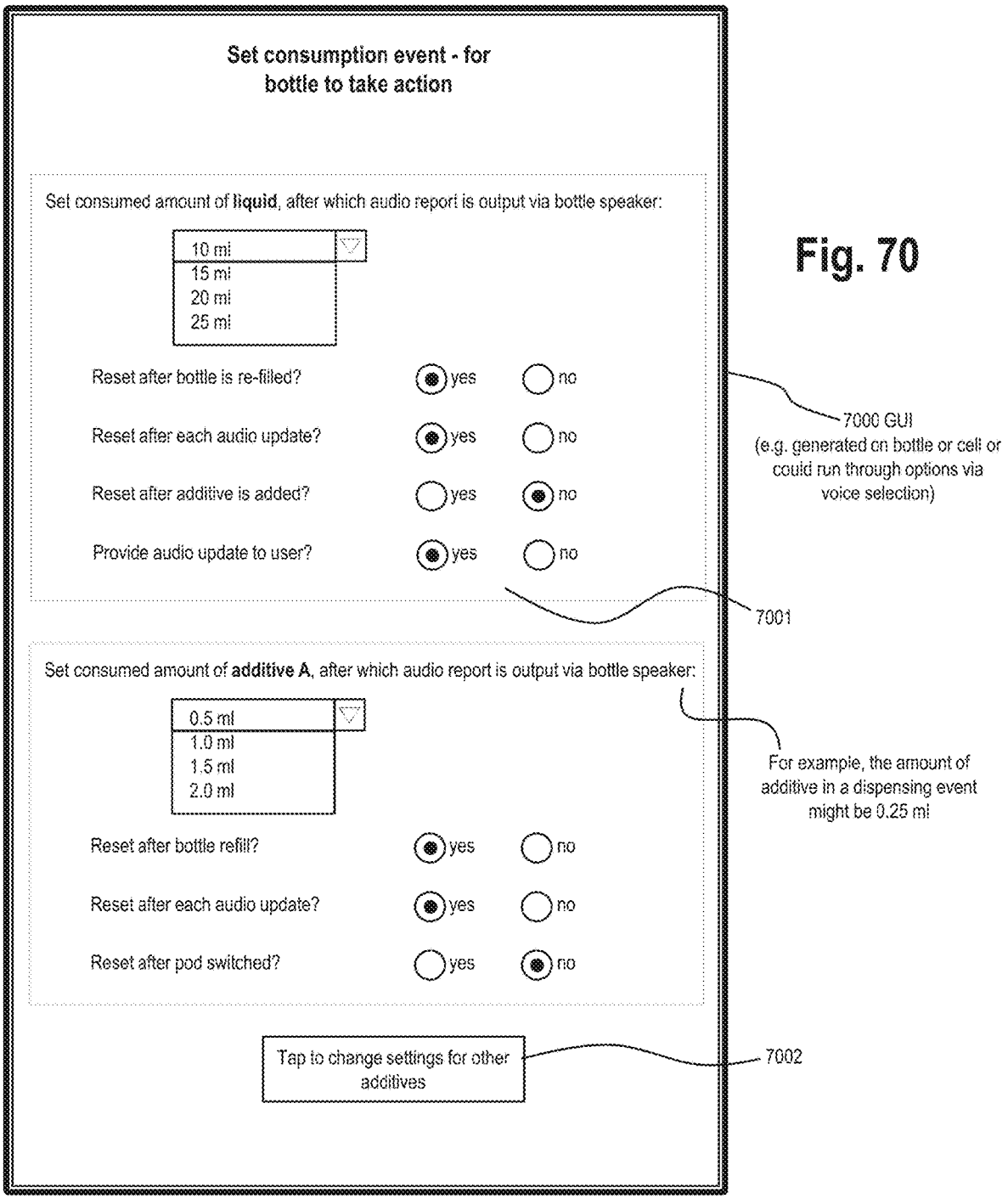
FIG. 70 is a diagram showing a GUI 7000 directed to setting a consumption event for the bottle to take action in accordance with one or more embodiments.

FIG. 70 is a diagram showing a GUI 7000 directed to setting a consumption event for the bottle to take action in accordance with one or more embodiments. For example, the GUI 7000 allows a user to set a consumed amount of liquid, after which an audio report is output to the user via speaker 1491 of bottle 1490. The user may set the consumed amount of liquid to trigger such event. The user may also set or configure options relating to when a reset occurs. That is, a setting may be provided by which the user controls whether monitoring of consumption is reset after the bottle is refilled, reset after each audio update, or reset after an additive is added, for example. Also, an option may be provided as to whether the bottle should provide an audio update to the user. The selection of such options may be provided via suitable selection functionality, such as the radio buttons 7001 shown in FIG. 70. The GUI of FIG. 70 also, in similar manner, allows the user to set a consumed amount of a particular additive, after which an audio report may be output to the user via speaker, for example. Such functionality also provides reset options. A button 7002 may be provided so as to allow the user to access settings for other additives.

With regard to the GUI 7000 in FIG. 70, as well as other GUIs described herein, it is appreciated that the processor is provided with instructions and/or programming to provide the described functionality.

Figure 71:
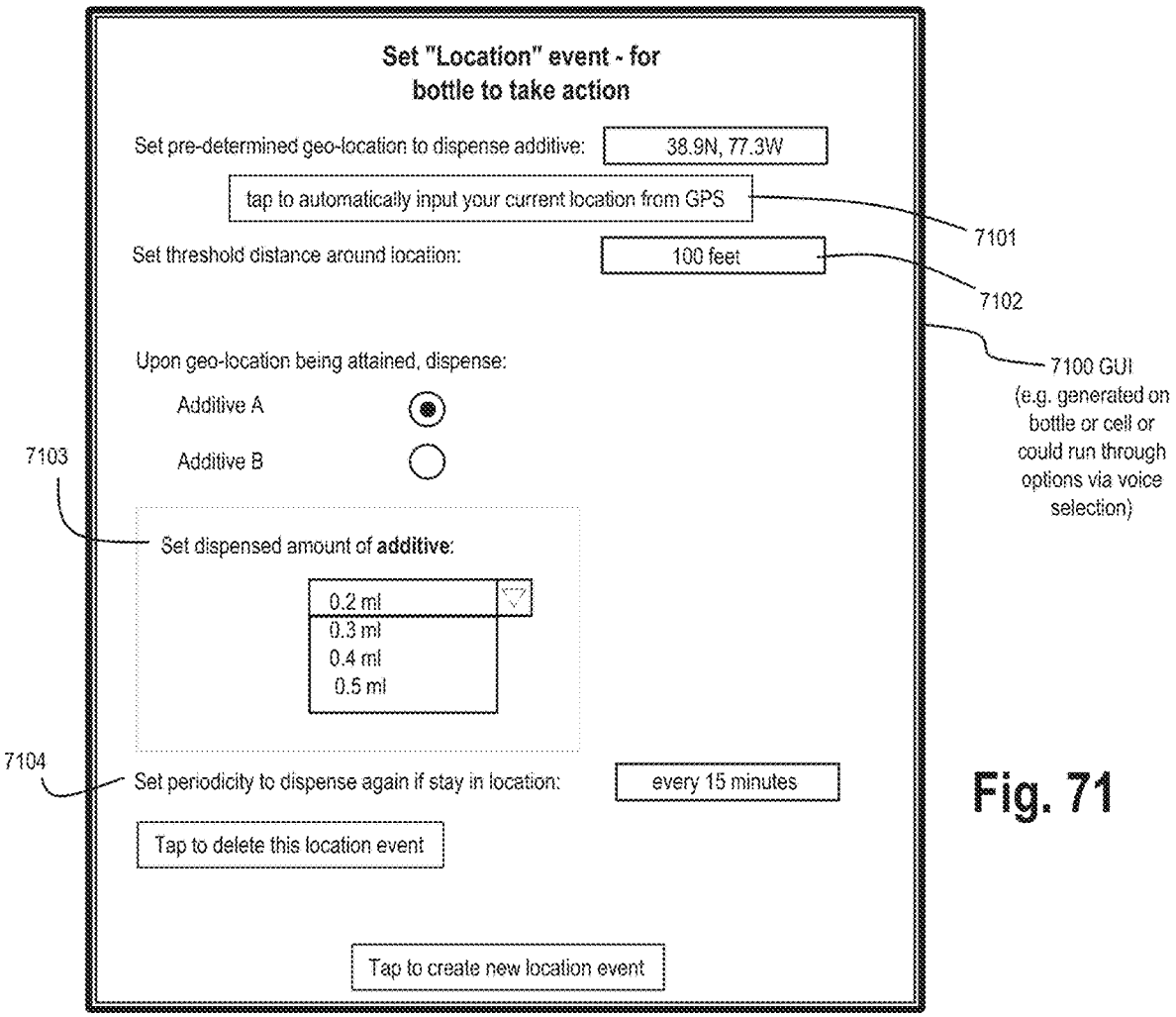
FIG. 71 is a diagram showing a GUI 7100 directed to setting a location event for the bottle to take action in accordance with one or more embodiments.

FIG. 71 is a diagram showing a GUI 7100 directed to setting a location event for the bottle to take action in accordance with one or more embodiments. The GUI of FIG. 71 allows a user to set a predetermined geolocation to dispense a selected additive. Accordingly, based on such selection, the bottle may be configured or programmed to dispense a particular additive or additives upon the arrival to a particular location (or in a predetermined proximity to a particular location as reflected by button 7102 of FIG. 71). An option may be provided for the user to simply input their current location—as reflected by button 7101. An option 7103 may be provided to set a dispensed amount of additive. An option 7104 may be provided to dispense an additive over a particular periodicity (if the user stays in the particular location). Options may also be provided to delete the particular location event and to create a new location event.

Figure 72:
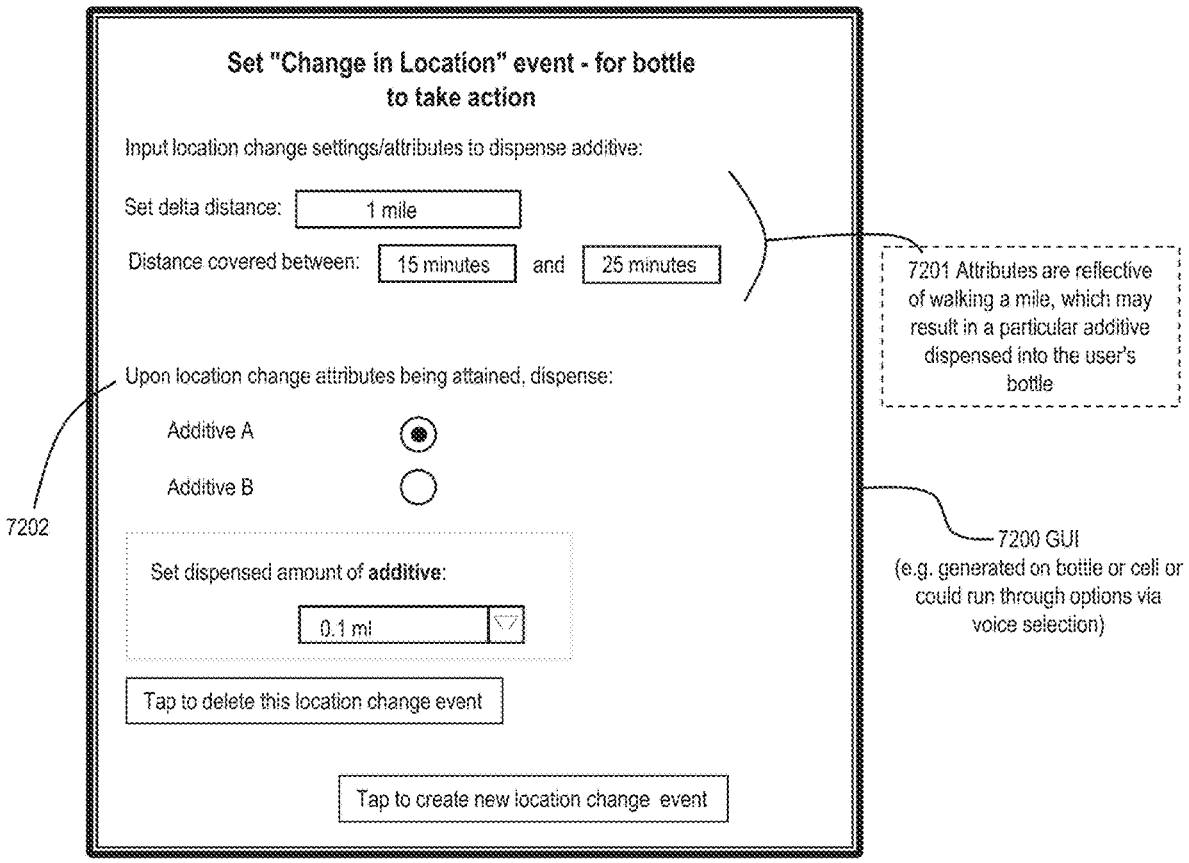
FIG. 72 is a diagram showing a GUI 7100 directed to setting a "change in location" event for the bottle to take action in accordance with one or more embodiments.

FIG. 72 is a diagram showing a GUI 7200 directed to setting a "change in location" event for the bottle to take action in accordance with one or more embodiments. The GUI of FIG. 72 allows a user to create an event relating to a particular change in location or movement—that, upon observation, will result in a particular additive or additives being dispensed—or other action taken. For example, as reflected at 7201, the GUI and related processing of the processor allows a user to set a particular delta distance and set a time interval time window in which such distance is to be traveled. If movement of the user, and specifically the bottle 1490, satisfies the distance specified in the time specified, then such will result in the dispense event. As shown at 7202, the particular additive that will be dispensed may be controlled. Additionally, the dispensed amount of additive may be controlled. Options may also be provided to delete the particular event or create a new event.

FIG. 73 is a flowchart showing in further detail the CPP performs processing to form a group—so as to control dispensing in bottles of member users step 2020 of FIG. 20 in accordance with one or more embodiments. The process starts in step 2020 and passes to step 2021. In step 2021, the processor establishes interface with a visitor user device via web browser. Then, in step 2022, the processor establishes the identity credentials of the visitor as a lead user, is characterized herein. Such is performed in conjunction with the retrieval of account information for a prior lead user or the establishment of account information for a new lead user, as reflected at 2022'. Accordingly, such processing reflects that the system 1400 may require a lead user to log on or sign in before administering or managing her group or groups.

Relatedly, in step 2023, decisioning is performed as to whether the visitor is a known user. If no, such reflects that the visitor is a new lead user. Accordingly, the process passes to step 2026. In step 2026, the processor interfaces with the visitor to establish a profile of the visitor as a new lead user. Such processing may be performed in conjunction with the GUI of FIG. 74. Then, the process passes to step 2027. In step 2027, the processor presents a display, to the lead user, to create preferences. Such processing may be performed in conjunction with the GUI of FIG. 74 and specifically window 7420. Then, the process passes to step 2028.

On the other hand, the processing and decisioning of step 2023 may yield a yes determination. As a result, the process passes from step 2023 to step 2024. In step 2024, the processor interfaces with the lead user to change profile information of the lead user, in this illustrative example. Such functionality may be provided by the GUI of FIG. 74. Then, in step 2025, the processor presents a display to the lead user to change his or her preferences. Such functionality may be provided by the GUI of FIG. 74 also. After step 2025, the process passes to step 2028. In step 2028, the processor presents a GUI to the lead user to create and populate a group. For example, such group may be constituted by a sports team. Such processing may be performed in conjunction with the GUI of FIG. 75. Then, process passes to step 2029. Collected data is saved to a suitable data record, which is associated with the lead user. Step 2030 reflects the creation or update of a group, associated with the lead user, is complete. As reflected at 2028', processing and generation of GUIs can be in response to user selection and/or options selected by the user, for example. As reflected at 2029', updated data can be pushed to the user's device and/or bottle, for example.

Figure 74:
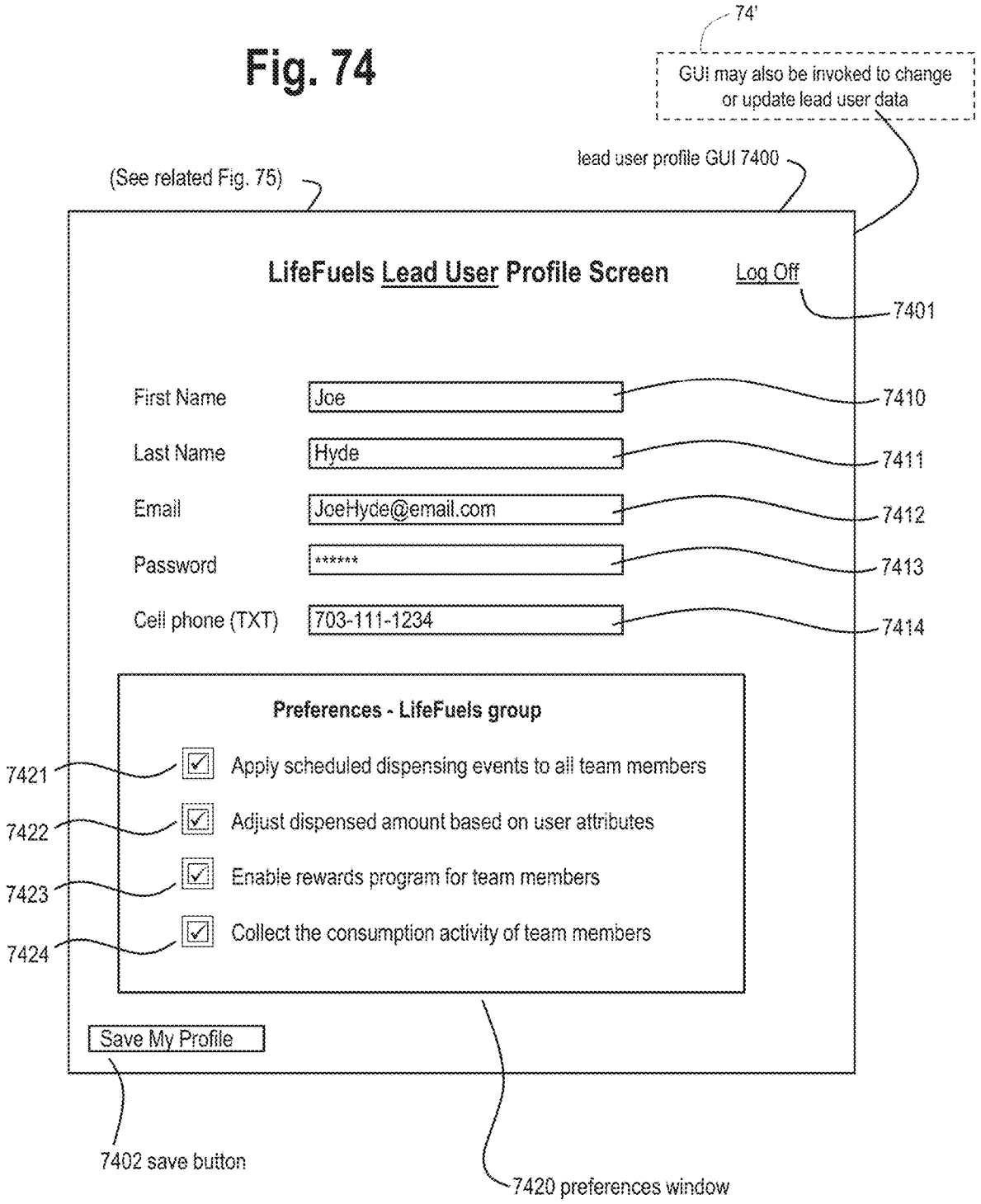
FIG. 74 is a diagram showing a GUI 7400 displaying a lead user profile screen in accordance with one or more embodiments.

FIG. 74 is a diagram showing a GUI 7400 displaying a lead user profile screen in accordance with one or more embodiments. The GUI 7400 may include various text boxes 7410, 7411, 7412, 7413, 7414, which may be populated with particulars of the lead user or to change lead user data, as reflected at 74'. Additionally, various preferences 7421, 7422, 7423, 7424, may be selected by the lead user via a preferences window 7420. It is appreciated that such are illustrative and various other preferences may be provided as desired. Preferences may include whether or not scheduled dispensing events are applied to all team members. Relatedly, options may be provided including a list of users and more individualized preferences associated with each respective user. An option may be provided to adjust a dispensed amount based on user attributes. For example, dispensed amount might be based on the member user's weight, anticipated level of activity, anticipated environment, or other parameters. It is appreciated that the lead user may control whether a member user is opted in or participates in some rewards or incentive program. For example, a rewards program might relate to particular behavior, which may include particular consumption or pattern of consumption, being rewarded with a particular additive dispensed. Further, the preferences window 7420 may include an option of whether or not to collect the consumption activity of team members. Button 7420 can be used to save profile data.

Figure 75:
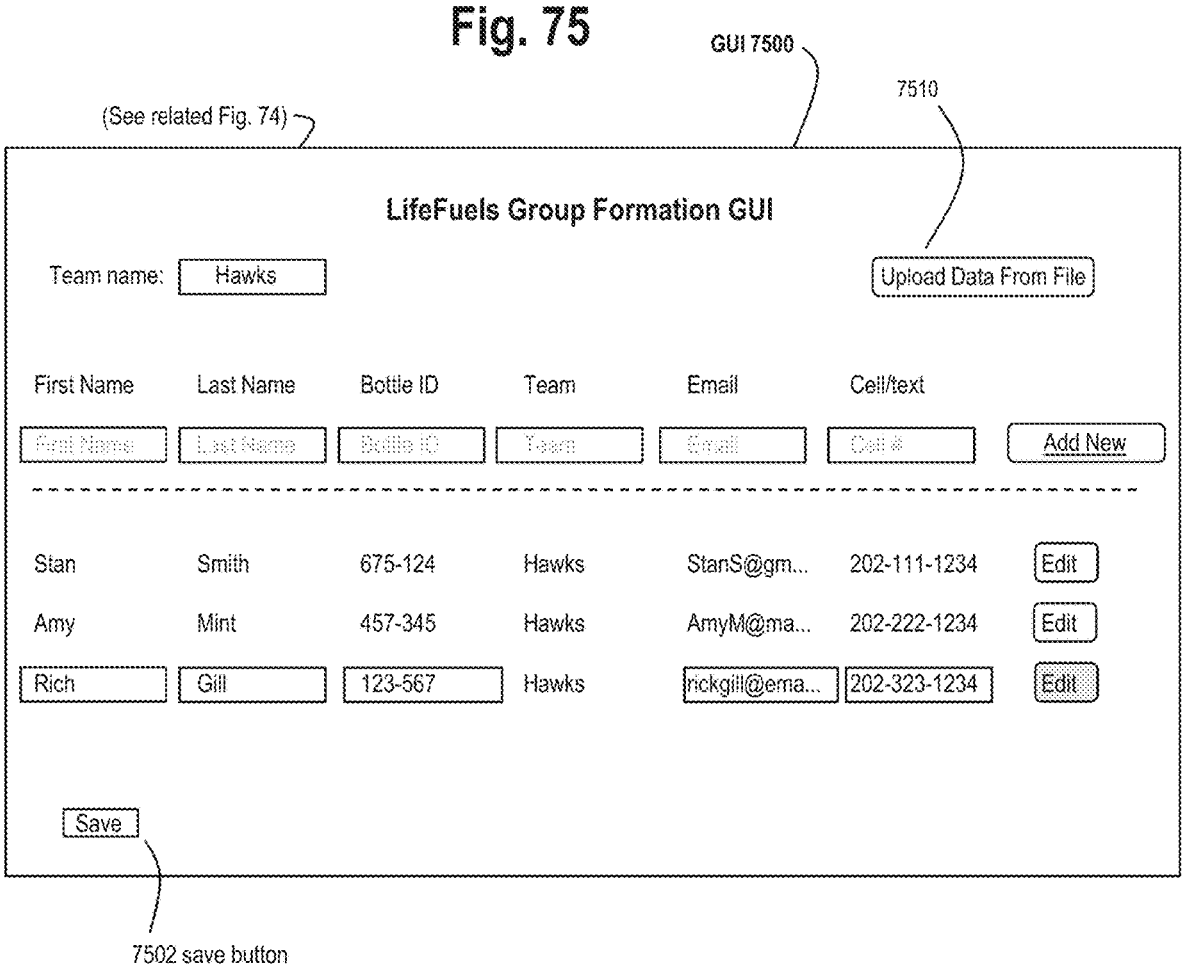
FIG. 75 is a diagram showing a GUI 7500 displaying a group formation screen in accordance with one or more embodiments.

FIG. 75 is a diagram showing a GUI 7500 displaying a group formation screen in accordance with one or more embodiments. Such GUI 7500 may include various attributes of a group or team associated with a particular lead user. Accordingly, the lead user may utilize the GUI 7500 to add a new member user to the group or to edit the information or disposition of a member user of the group. Such edit of a member user may include the deletion or change in status of a member user. Further, various particulars of member users may be provided. As reflected by button 7510 of FIG. 75, various information including data records may be uploaded from a suitable file or database. For example, such information might be a list of opted in member users. Button 7502 can be used to save data of the GUI.

FIG. 76 is a flowchart showing in further detail the processor performs processing to manage a group, including to manage dispensed events step 2040 of FIG. 20 in accordance with one or more embodiments. As shown, the process starts in step 2040 and passes to step 2041. In step 2041, the processor interfaces with the lead user to identify a group, which the lead user wishes to manage. In particular, such management may include the creation or modification of a dispensing event for the group. Then, in step 2042, the processor confirms the lead user has authority to manage the particular group selected. The processor may then report data or retrieve data regarding the particular group. In step 2043, the processor presents data to the lead user, for example in the form of the GUI, regarding a particular group. Such information may include, for example, the GUI of FIG. 75. Then, the process passes to step 2044.

In step 2044, via GUI interface with the processor, the lead user may create and adjust dispense events for the group. FIG. 76 shows illustrative processing. In the processing of step 2046, the processor interfaces with the lead user to create a dispense event for the group. Such processing may be performed in conjunction with the GUI of FIG. 77. In step 2047, the processor interfaces with the lead user to change a scheduled dispense event for the group. Such processing may be performed in conjunction with the GUI of FIG. 77. In step 2048, the processor interfaces with the lead user to adjust a dispense event for respective users in the group. Such processing may be performed in conjunction with the GUI of FIG. 77. In step 2049, the processor interfaces with the lead user opt-out a member user from a dispense event. Such processing may be performed in conjunction with the GUI of FIG. 77. In step 2050, the processor interfaces with the lead user to adjust a dispense event based on ambient environment, attributes of a user's particular bottle, or other impacting factors. Such processing may be performed in conjunction with the GUI of FIG. 78. As reflected at 2040', the CPP may output, via the lead user's bottle, updates regarding consumption or other activity or events associated with the team. As reflected at 2044', the CPP can provide various functionality, to the lead user, that may be applied to the group.

Figure 77:
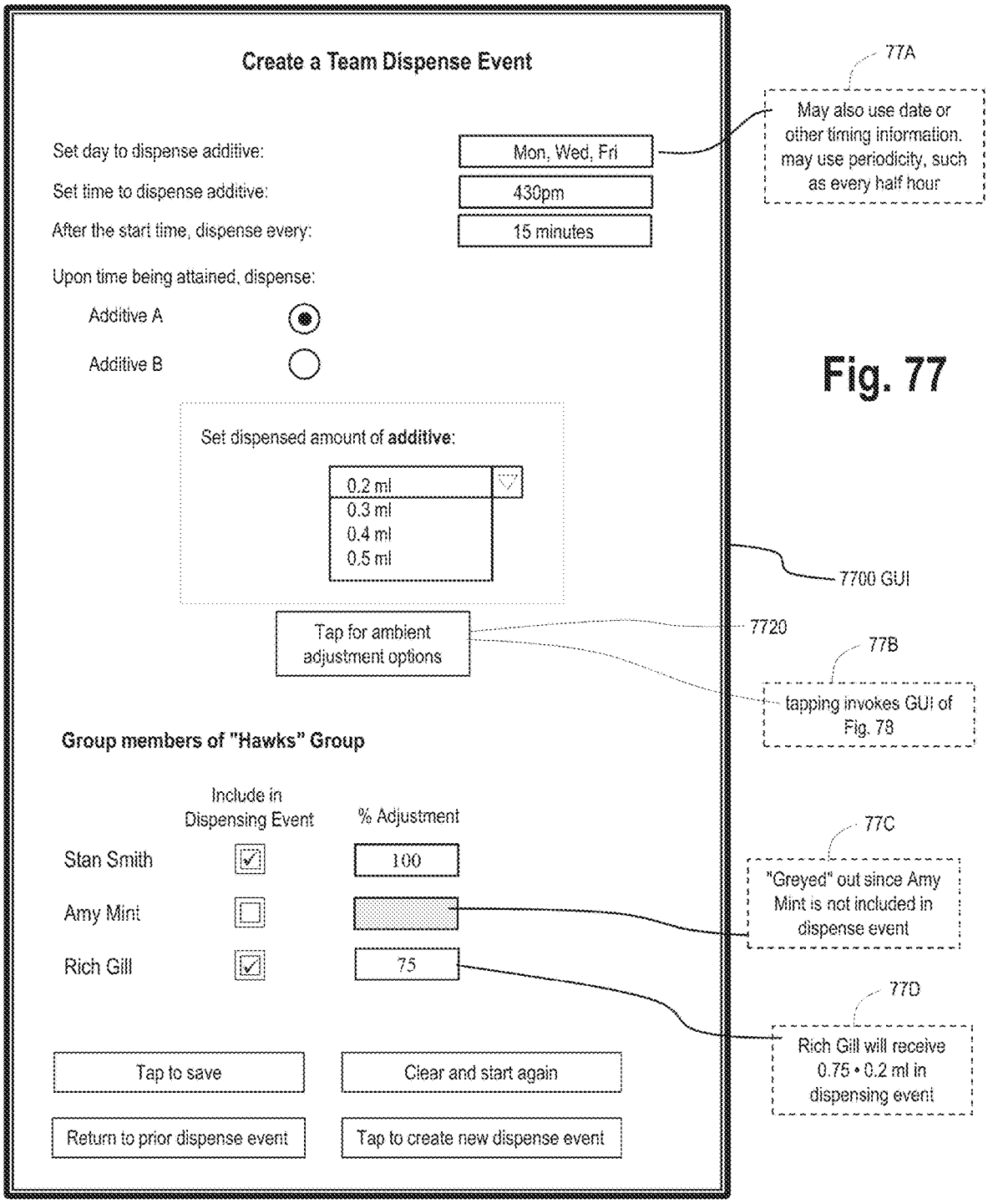
FIG. 77 is a diagram showing a GUI 7700 displaying a team dispense event screen in accordance with one or more embodiments.

FIG. 77 is a diagram showing a GUI 7700 displaying a team dispense event screen in accordance with one or more embodiments. In particular, the GUI 7700 allows a lead user to set, configure, or program, one or more dispense events for the group. Particulars that may be adjusted include the day and time to dispense, time interval for repeated dispense, the particular additive that is dispensed, the amount of the additive, and other parameters, as reflected at 77A.

As reflected in the GUI 7700, the team dispense event screen also allows a lead user to control which member users are included in a particular dispensing event. In the illustrated example of FIG. 77, Stan Smith and Rich Gill are included, whereas Amy Mint is not included, as reflected at 77C. Also, functionality is provided to provide a percent adjustment for user members of the group. As illustratively shown in FIG. 77 at 77B, Rich Gill will receive 75% of the 0.2 ml dispensed amount. Various other options may be provided including save and clear options, navigation options, and create new dispense options.

Figure 78:
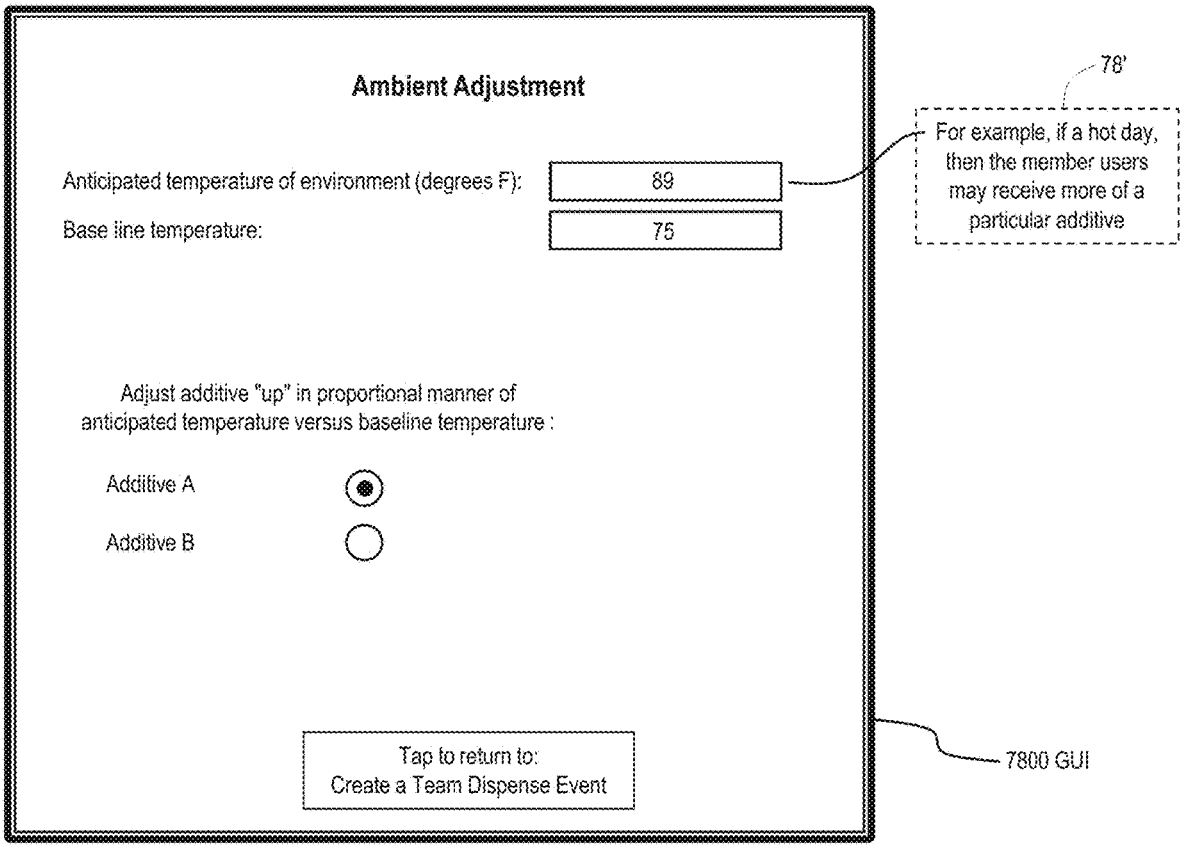
FIG. 78 shows a GUI in accordance with one or more embodiments.

FIG. 77 also includes an option 7720 to adjust for ambient conditions. By tapping such button 7720 as reflected at 77B, the user is redirected to the GUI 7800 of FIG. 78. The GUI 7800 and functionality to support such provided options relate to the adjustment of one or more dispense events based on ambient conditions or other impacting conditions. For example, as illustratively shown in FIG. 78, such ambient condition might be temperature. A particular baseline temperature may be utilized in such processing. For example, a particular dispense amount may be input by the user based on a baseline temperature, such as 75° F. as illustrated in FIG. 78. A dispense amount may then be proportionately adjusted, with respect to the baseline temperature, to accommodate an adjusted temperature. In general, it is appreciated that functionality may be provided to proportionally adjust a dispense amount off some base line value—to provide a value that would be more appropriate given ambient conditions (or other impacting conditions), for example, as reflected at 78'.

Figure 79:
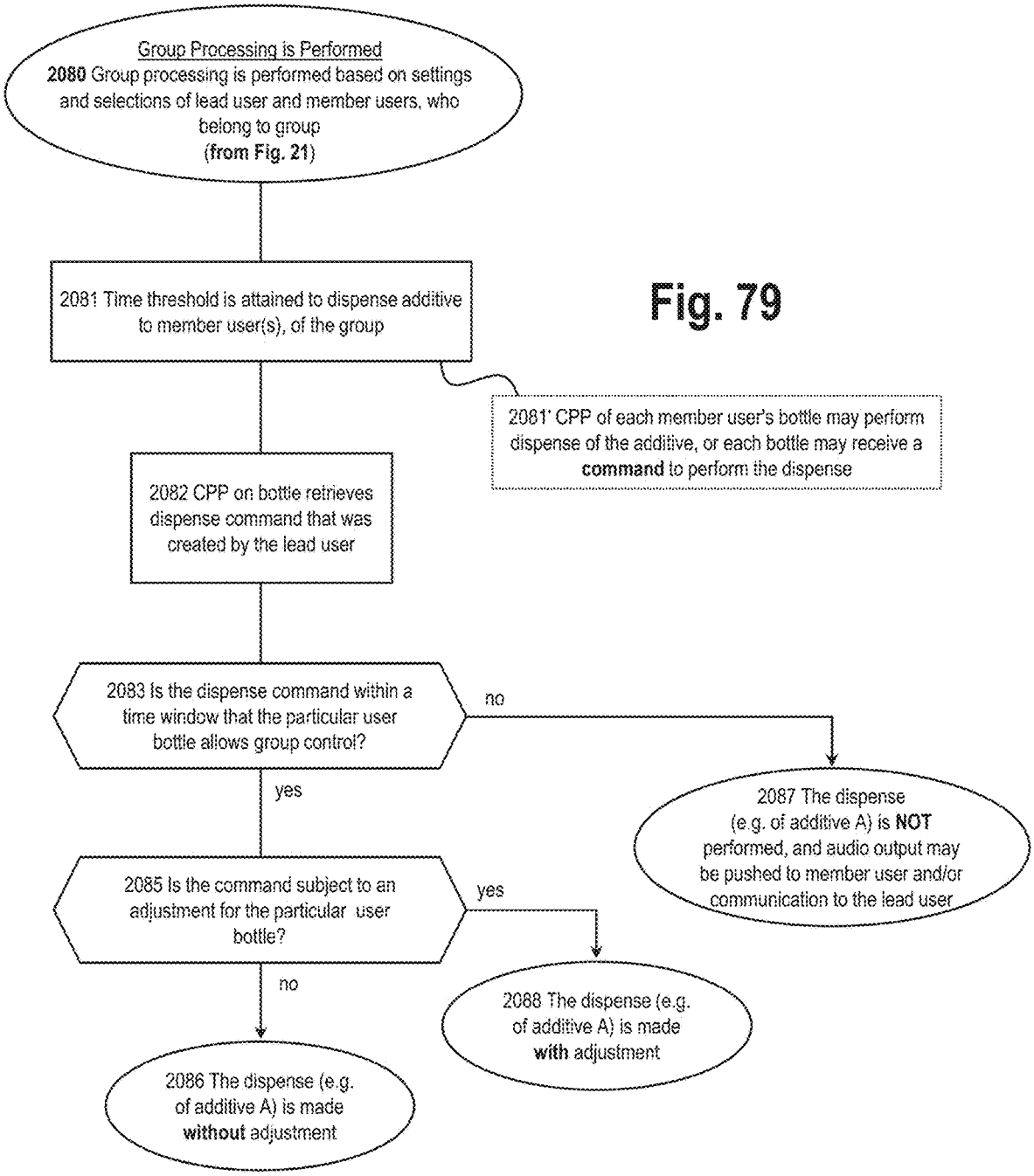
FIG. 79 is a flowchart showing group processing is performed based on settings and selections of lead user and member users step 2080 of FIG. 20 in accordance with one or more embodiments.

FIG. 79 is a flowchart showing group processing is performed based on settings and selections of lead user and member users step 2080 of FIG. 20 in accordance with one or more embodiments. As shown, the process starts in step 2080 and passes to step 2081. In step 2081, in this illustrative example, a time threshold is attained to dispense additive to a member user or member users of the group. In general, it is appreciated that processing of FIG. 79 may utilize one or more triggered events other than the time threshold illustratively described. Additionally, the processing of FIG. 79 may take into account various preferences or adjustments of member users. As reflected at 2081', the processor of each member user's bottle may perform the dispense of the particular additive, or each bottle may receive a dispense command, for example, from the bottle or from another processing system. For example, in embodiments, a user device may push a command to the bottle so as to dictate a dispense amount of a particular additive.

In the example of FIG. 79, after step 2081, the process passes to step 2082. In step 2082, the processor on the bottle retrieves a dispense command that was created by the lead user, in manner as described above, for example. Then, in step 2083, a determination is made by the processor of whether the dispense command is within a time window in which the particular user bottle allows group control. If no in step 2083, then the process passes to step 2087. In step 2087, the dispense is not performed. An audio output may be pushed to the member user and/or the communication sent to the lead user advising them of the disposition of such dispense event. On the other hand, step 2083 may result in a yes determination. Accordingly, the process passes to step 2085. In step 2085, a determination is made of whether the command is subject to an adjustment for the particular user bottle. If yes, then the process passes to step 2088. In step 2088, the dispense is performed with the adjustment dictated. On the other hand, the processing of step 2085 may yield a no determination. As a result, the process passes to step 2086. In step 2086, the dispense of the additive, as prescribed by the lead user, is performed without adjustment. As is also otherwise described herein, it is appreciated that features of one embodiment of the disclosure may be utilized in conjunction with other embodiments as may be desired. Processing as described herein relating to audio engagement processing, situational engagement processing and group engagement processing may be associated with particular features of a user's bottle, characteristics of a user's bottle, disposition of a user's bottle, orientation of a user's bottle, structure of a user's bottle, and/or other attributes of a user's bottle.

According to principles of the disclosure, in an embodiment 1A, a container assembly can comprise: (a) a container having a known storage capacity for storing a liquid; (b) a dispensing assembly, the dispensing assembly dispensing variable, non-zero quantities of one or more additives into the liquid stored in the container; (c) one or more vessels that each contain one of the additives, of the one or more additives, to be dispensed into the liquid; (d) a database that includes data that represents known trigger events, each of which is associated with a respective action event dataset; and (e) a processing portion, associated with the database, that performs processing including: processing first data that represents an observed event; comparing the first data with the known trigger events to determine if the first data constitutes a trigger event of the known trigger events; determining that the first data does constitute such trigger event of the known trigger events; retrieving, from the database, an associated action event dataset, of the action event datasets, that is associated with the trigger event; and performing an action event that is dictated by the associated action event dataset.

An embodiment 2A can include the features of embodiment 1A in which, the observed event, as represented by the first data, relates to a consumption of a first additive, of the one or more additives.

An embodiment 3A can include the features of embodiment 2A in which, the action item includes playing a song.

An embodiment 4A can include the features of embodiment 1A in which, the action item includes playing a song.

An embodiment 5A can include the features of embodiment 1A in which, the processing portion performing further processing including: (a) determining if the action event is subject to an imposed constraint; (b) determining that the action event is not subject to an imposed constraint; and (c) based on that the action event is not constrained, performing the action event that is dictated by the associated action event dataset.

An embodiment 6A can include the features of embodiment 5A in which, the determining if the action event is subject to an imposed constraint includes checking an orientation of the container assembly.

An embodiment 7A can include the features of embodiment 1A in which, the associated action event dataset is disposed in the database in the form of a data record that is stored in the database of the container assembly.

An embodiment 8A can include the features of embodiment 1A in which, the observed event, as represented by the first data, relates to an observed location of the container assembly.

An embodiment 9A can include the features of embodiment 8A in which, the processing portion interfacing with the user to input the observed location, including distance threshold information so as to establish the observed location.

An embodiment 10A can include the features of embodiment 8A in which, the processing portion interfacing with the user to input the observed location, including at least one selected from the group consisting of (a) movement into a location, and (b) change in location.

An embodiment 11A can include the features of embodiment 1A in which, the observed event, as represented by the first data, relates to an observed time event.

An embodiment 12A can include the features of embodiment 1A in which, the one or more vessels, that each contain one of the additives, is constituted by a plurality of vessels.

An embodiment 13A can include the features of embodiment 1A in which, the processing portion interfacing with the user to input a trigger event, of the known trigger events.

An embodiment 14A can include the features of embodiment 13A in which, the interfacing with the user to input a trigger event is performed via a graphical user interface (GUI) on a user device of the user, the user device in communication with the container assembly, so as to interface with the user.

An embodiment 15A can include the features of embodiment 13A in which, the interfacing with the user to input a trigger event is performed via a graphical user interface (GUI) on the container assembly.

An embodiment 16A can include the features of embodiment 1A in which, the processing portion performing further processing including: (a) interfacing with a user device, associated with a user of the container assembly, to input attributes of a trigger event, to be one of the known trigger events; (b) mapping the input attributes of such trigger event to a stored action event so as to generate a mapping; and (c) storing the mapping in an associated action event dataset that is associated with such trigger event. According to principles of the disclosure, in an embodiment 1B, a group processing system can comprise: (A) a control processing portion (CPP) that performs processing; (B) a system database that contains data used by the CPP; (C) a container assembly that is associated with a first member user, the container assembly comprising: (a) a container having a known storage capacity for storing a liquid; (b) a dispensing assembly, the dispensing assembly dispensing variable, non-zero quantities of one or more additives into the liquid stored in the container; (c) one or more vessels that each contain one of the additives, of the one or more additives, to be dispensed into the liquid; (d) a container database; and(e) a processing portion, associated with the container database, that performs processing including performing dispensing that dispenses at least one of the additives into the liquid; and (D) the CPP performing processing including: (a) interfacing with a lead user including establishing the lead user based on input of credentials from the lead user; (b) interfacing with the lead user to form a group, and the group including at least the first member user; (c) interfacing with the lead user to input a dispense command; (E) the processing portion retrieving the dispense command; (F) the processing portion performing the dispense command to dispense an additive, of the one or more additives.

An embodiment 2B can include the features of embodiment 1B in which, the interfacing with the lead user includes interfacing with a lead user device.

An embodiment 3B can include the features of embodiment 1B in which, the processing portion performing the dispense command includes the processing portion: (a) determining whether the dispense is subject to an adjustment; (b) determining that the dispense is subject to an adjustment; and (c) performing the dispense command based on the adjustment.

An embodiment 4B can include the features of embodiment 1B in which, the interfacing with the lead user to form a group includes interfacing with the lead user to add a plurality of member users into the group, the plurality of member users including the member user and other member users.

An embodiment 5B can include the features of embodiment 4B in which, the CPP outputting the dispense command to respective container assemblies associated with each of the other member users.

An embodiment 6B can include the features of embodiment 4B in which, the CPP inputting use data, from each of the plurality of member users, regarding consumption of additives of the plurality of member users.

An embodiment 7B can include the features of embodiment 4B in which, the CPP interfacing with the lead user to input the dispense command includes generating a schedule for a dispense of an additive, of the one or more additives.

An embodiment 8B can include the features of embodiment 7B in which, the CPP interfacing with the lead user to input the dispense command includes interfacing with the lead user to opt-out the first member user from at least one dispense event, while maintaining the dispense event for the other member users.

An embodiment 9B can include the features of embodiment 1B in which, the processing portion, of the container assembly of the first member user, inputting factor data regarding at least one impacting factor; and adjusting the dispense command based on the factor data.

An embodiment 10B can include the features of embodiment 9B in which, the at least one impacting factor includes ambient environment related data that includes temperature of the ambient environment.

An embodiment 11B can include the features of embodiment 1B in which, the processing portion, of the container assembly of the first member user, interfacing with the first member user to input a time window, and the time window controlling when the lead member can control, in performing the dispense command, the container assembly of the first member user.

An embodiment 12B can include the features of embodiment 1B in which, the dispense command to dispense an additive includes data regarding both timing of a dispense event and quantity of additive dispensed, in the container assembly of the first member user.

An embodiment 13B can include the features of embodiment 1B in which, the dispense command to dispense an additive includes data regarding timing of a dispense event in the container assembly of the first member user.

An embodiment 14B can include the features of embodiment 1B in which, the processing portion performing the dispense command includes the processing portion outputting a communication to the first member user regarding the dispense.

An embodiment 15B can include the features of embodiment 14B in which, the outputting a communication to the first member user regarding the dispense includes an audio output, via a speaker of the container assembly, that is pushed to the first member user.

The foregoing detailed description has set forth various embodiments of the systems, devices, and/or processes via the use of block diagrams, flowcharts, and/or examples. Insofar as such block diagrams, flowcharts, and/or examples contain one or more functions and/or operations, it will be understood by those within the art that each function and/or operation within such block diagrams, flowcharts, or examples can be implemented, individually and/or collectively, by a wide range of hardware, software, firmware, or virtually any combination thereof.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

Thus, particular embodiments of the subject matter have been described. In some cases, the actions described in accordance with one or more of the embodiments may be performed in a different order and still achieve desirable results. In addition, the processes depicted in the accompanying figures do not necessarily require the particular order shown, or sequential order, to achieve desirable results. In certain implementations, multitasking and parallel processing may be advantageous.

It is appreciated that the systems and methods of the disclosure may use various known communication techniques such as third party natural language processing, natural language provider services, and/or software development kits (SDKs), for example. Natural language processing may be used to translate or convert natural language to machine language. Natural language processing may be used to convert sound or audio information input into the system (via microphone, for example) to machine language that is understandable by a processor as described herein. Natural language processing may be used to convert machine language that is understandable by a processor as described herein to sound or audio information output by the system (via speaker, for example). It is appreciated that the systems and methods of the disclosure may use various known communication techniques such as third party processing, provider services, and/or SDKs, for example, to convert or translate between other communication channels, as may be needed or desired.

It is appreciated that a feature of one embodiment of the disclosure as described herein may be used in conjunction with features of one or more other embodiments as may be desired.

As used herein, "data" and "information" have been used interchangeably.

Any motorized structure as described herein may utilize gears, linkages, sprocket with chain, or other known mechanical arrangement so as to transfer requisite motion and/or energy.

Hereinafter, further aspects of implementation of the systems and methods of the disclosure will be described.

As described herein, at least some embodiments of the system of the disclosure and various processes, of embodiments, are described as being performed by one or more computer processors. Such one or more computer processors may be in the form of a "processing machine," i.e. a tangibly embodied machine. As used herein, the term "processing machine" is to be understood to include at least one processor that uses at least one memory. The at least one memory stores a set of instructions. The instructions may be either permanently or temporarily stored in the memory or memories of the processing machine. The processor executes the instructions that are stored in the memory or memories in order to process data. The set of instructions may include various instructions that perform a particular task or tasks, such as any of the processing as described herein. Such a set of instructions for performing a particular task may be characterized as a program, software program, code or simply software.

As noted above, the processing machine, which may be constituted, for example, by the particular system and/or systems described above, executes the instructions that are stored in the memory or memories to process data. This processing of data may be in response to commands by a user or users of the processing machine, in response to previous processing, in response to a request by another processing machine and/or any other input, for example.

As noted above, the machine used to implement the disclosure may be in the form of a processing machine. The processing machine may also utilize (or be in the form of) any of a wide variety of other technologies including a special purpose computer, a computer system including a microcomputer, mini-computer or mainframe for example, a programmed microprocessor, a micro-controller, a peripheral integrated circuit element, a CSIC (Consumer Specific Integrated Circuit) or ASIC (Application Specific Integrated Circuit) or other integrated circuit, a logic circuit, a digital signal processor, a programmable logic device such as a FPGA, PLD, PLA or PAL, or any other device or arrangement of devices that is capable of implementing the steps of the processes of the disclosure.

The processing machine used to implement the invention may utilize a suitable operating system. Thus, embodiments of the disclosure may include a processing machine running the Windows 10 operating system, the Windows 8 operating system, Microsoft Windows™ Vista™ operating system, the Microsoft Windows™ XP™ operating system, the Microsoft Windows™ NT™ operating system, the Windows™ 2000 operating system, the Unix operating system, the Linux operating system, the Xenix operating system, the IBM AIX™ operating system, the Hewlett-Packard UX™ operating system, the Novell Netware™ operating system, the Sun Microsystems Solaris™ operating system, the OS/2™ operating system, the BeOS™ operating system, the Macintosh operating system, the Apache operating system, an OpenStep™ operating system or another operating system or platform.

It is appreciated that in order to practice the method of the disclosure as described above, it is not necessary that the processors and/or the memories of the processing machine be physically located in the same geographical place. That is, each of the processors and the memories used by the processing machine may be located in geographically distinct locations and connected so as to communicate in any suitable manner Additionally, it is appreciated that each of the processor and/or the memory may be composed of different physical pieces of equipment. Accordingly, it is not necessary that the processor be one single piece of equipment in one location and that the memory be another single piece of equipment in another location. That is, it is contemplated that the processor may be two pieces of equipment in two different physical locations. The two distinct pieces of equipment may be connected in any suitable manner Additionally, the memory may include two or more portions of memory in two or more physical locations.

To explain further, processing is described above is performed by various components and various memories. However, it is appreciated that the processing performed by two distinct components as described above may, in accordance with a further embodiment of the disclosure, be performed by a single component. Further, the processing performed by one distinct component as described above may be performed by two distinct components. In a similar manner, the memory storage performed by two distinct memory portions as described above may, in accordance with a further embodiment of the disclosure, be performed by a single memory portion. Further, the memory storage performed by one distinct memory portion as described above may be performed by two memory portions.

Further, as also described above, various technologies may be used to provide communication between the various processors and/or memories, as well as to allow the processors and/or the memories of the disclosure to communicate with any other entity; i.e., so as to obtain further instructions or to access and use remote memory stores, for example. Such technologies used to provide such communication might include a network, the Internet, Intranet, Extranet, LAN, an Ethernet, or any client server system that provides communication, for example. Such communications technologies may use any suitable protocol such as TCP/IP, UDP, or OSI, for example.

As described above, a set of instructions is used in the processing of the invention on a processing machine, for example. The set of instructions may be in the form of a program or software. The software may be in the form of system software or application software, for example. The software might also be in the form of a collection of separate programs, a program module within a larger program, or a portion of a program module, for example. The software used might also include modular programming in the form of object oriented programming. The software tells the processing machine what to do with the data being processed.

Further, it is appreciated that the instructions or set of instructions used in the implementation and operation of the invention may be in a suitable form such that the processing machine may read the instructions. For example, the instructions that form a program may be in the form of a suitable programming language, which is converted to machine language or object code to allow the processor or processors to read the instructions. That is, written lines of programming code or source code, in a particular programming language, are converted to machine language using a compiler, assembler or interpreter. The machine language is binary coded machine instructions that are specific to a particular type of processing machine, i.e., to a particular type of computer, for example. The computer understands the machine language.

A suitable programming language may be used in accordance with the various embodiments of the disclosure. Illustratively, the programming language used may include assembly language, Ada, APL, Basic, C, C++, COBOL, dBase, Forth, Fortran, Java, Modula-2, Pascal, Prolog, REXX, Visual Basic, and/or JavaScript, for example. Further, it is not necessary that a single type of instructions or single programming language be utilized in conjunction with the operation of the systems and methods of the disclosure. Rather, any number of different programming languages may be utilized as is necessary or desirable.

Also, the instructions and/or data used in the practice of the invention may utilize any compression or encryption technique or algorithm, as may be desired. An encryption module might be used to encrypt data. Further, files or other data may be decrypted using a suitable decryption module, for example.

As described above, the invention may illustratively be embodied in the form of a processing machine, including a computer or computer system, for example, that includes at least one memory. It is to be appreciated that the set of instructions, i.e., the software for example, that enables the computer operating system to perform the operations described above may be contained on any of a wide variety of media or medium, as desired. Further, the data that is processed by the set of instructions might also be contained on any of a wide variety of media or medium. That is, the particular medium, i.e., the memory in the processing machine, utilized to hold the set of instructions and/or the data used in the invention may take on any of a variety of physical forms or transmissions, for example. Illustratively, as also described above, the medium may be in the form of paper, paper transparencies, a compact disk, a DVD, an integrated circuit, a hard disk, a floppy disk, an optical disk, a magnetic tape, a RAM, a ROM, a PROM, a EPROM, a wire, a cable, a fiber, communications channel, a satellite transmissions or other remote transmission, as well as any other medium or source of data that may be read by the processors of the disclosure.

Further, the memory or memories used in the processing machine that implements the invention may be in any of a wide variety of forms to allow the memory to hold instructions, data, or other information, as is desired. Thus, the memory might be in the form of a database to hold data. The database might use any desired arrangement of files such as a flat file arrangement or a relational database arrangement, for example.

In the systems and methods of the disclosure, a variety of "user interfaces" may be utilized to allow a user to interface with the processing machine or machines that are used to implement the invention. As used herein, a user interface includes any hardware, software, or combination of hardware and software used by the processing machine that allows a user to interact with the processing machine. A user interface may be in the form of a dialogue screen for example. A user interface may also include any of a mouse, touch screen, keyboard, voice reader, voice recognizer, dialogue screen, menu box, list, checkbox, toggle switch, a pushbutton or any other device that allows a user to receive information regarding the operation of the processing machine as it processes a set of instructions and/or provide the processing machine with information. Accordingly, the user interface is any device that provides communication between a user and a processing machine. The information provided by the user to the processing machine through the user interface may be in the form of a command, a selection of data, or some other input, for example. As discussed above, a user interface is utilized by the processing machine that performs a set of instructions such that the processing machine processes data for a user. The user interface is typically used by the processing machine for interacting with a user either to convey information or receive information from the user. However, it should be appreciated that in accordance with some embodiments of the systems and methods of the disclosure, it is not necessary that a human user actually interact with a user interface used by the processing machine of the disclosure. Rather, it is also contemplated that the user interface of the invention might interact, i.e., convey and receive information, with another processing machine, rather than a human user. Accordingly, the other processing machine might be characterized as a user. Further, it is contemplated that a user interface utilized in the systems and methods of the disclosure may interact partially with another processing machine or processing machines, while also interacting partially with a human user.

It will be appreciated that the effects of the present disclosure are not limited to the above-mentioned effects, and other effects, which are not mentioned herein, will be apparent to those in the art from the disclosure and accompanying claims.

Although the preferred embodiments of the present disclosure have been disclosed for illustrative purposes, those skilled in the art will appreciate that various modifications, additions and substitutions are possible, without departing from the scope and spirit of the disclosure and accompanying claims.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present disclosure.

Spatially relative terms, such as "lower", "upper", "top", "bottom", "left", "right" and the like, may be used herein for ease of description to describe the relationship of one element or feature to another element(s) or feature(s) as illustrated in the figures. It will be understood that spatially relative terms are intended to encompass different orientations of structures in use or operation, in addition to the orientation depicted in the figures. For example, if a device in the figures is turned over, elements described as "lower" relative to other elements or features would then be oriented "upper" relative the other elements or features. Thus, the exemplary term "lower" can encompass both an orientation of above and below. The device may be otherwise oriented (rotated 90 degrees or at other orientations) and the spatially relative descriptors used herein should be interpreted accordingly.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to diagrams and/or cross-section illustrations, for example, that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of components illustrated herein but are to include deviations in shapes that result, for example, from manufacturing.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect and/or use such feature, structure, or characteristic in connection with other ones of the embodiments.

It will be readily understood by those persons skilled in the art that the present disclosure is susceptible to broad utility and application. Many embodiments and adaptations of the present disclosure other than those herein described, as well as many variations, modifications and equivalent arrangements, will be apparent from or reasonably suggested by the present disclosure and foregoing description thereof, without departing from the substance or scope of the disclosure.

Accordingly, while the present disclosure has been described here in detail in relation to its exemplary embodiments, it is to be understood that this disclosure is only illustrative and exemplary of the present invention and is made to provide an enabling disclosure of the invention. Accordingly, the foregoing disclosure is not intended to be construed or to limit the present invention or otherwise to exclude any other such embodiments, adaptations, variations, modifications and equivalent arrangements.

What is claimed is:

1. A container assembly comprising:

a container having a known storage capacity for storing a liquid;

a dispensing assembly, the dispensing assembly dispensing variable, non-zero quantities of one or more additives into the liquid stored in the container, and the container is attached onto the dispensing assembly;

one or more vessels that each contain one of the additives, of the one or more additives, to be dispensed into the liquid;

a communication portion that inputs external communication and, based on the external communication, generates first communication data;

a database that includes data that represents known trigger events, each of which is associated with a respective action event dataset; and a processing portion, associated with the database, that performs processing including:

comparing the first communication data with the known trigger events to determine if the first communication data constitutes a trigger event of the known trigger events;

determining that the first communication data does constitute such trigger event of the known trigger events;

retrieving, from the database, an associated action event dataset, of the action event datasets, that is associated with such trigger event; and performing an action event that is dictated by the associated action event dataset.

2. The container assembly of claim 1, the external communication including audio input, and the first communication data being machine data, and the generates the first communication data including the communication portion converting the audio input to the machine data.

3. The container assembly of claim 2, wherein:

the trigger event including an amount request that represents a request for an amount of the liquid; and the action event including the processing portion gathering and outputting information regarding the amount of the liquid.

4. The container assembly of claim 3, the outputting information regarding the amount of the liquid includes the container assembly outputting an audio output regarding amount of liquid in the container assembly.

5. The container assembly of claim 4, wherein the container assembly further includes a speaker, and the outputting the audio output is performed via the speaker.

6. The container assembly of claim 3, the outputting information regarding amount of the liquid includes the container assembly outputting an electronic communication, to a user device, regarding amount of liquid in the container assembly.

7. The container assembly of claim 6, the electronic communication is a communication configured to be received by a smart phone.

8. The container assembly of claim 1, wherein the trigger event includes a consumed additive request that represents a request for amount of additive consumed; and the action event including the processing portion gathering and outputting information regarding the amount of the additive consumed.

9. The container assembly of claim 8, the one or more vessels, that each contain one of the additives, is constituted by a plurality of vessels; and the consumed additive request includes data regarding to which one, of the plurality of vessels, the request relates.

10. The container assembly of claim 1, the action event including the processing portion outputting information to a user, of the container assembly, on a predetermined communication channel.

11. The container assembly of claim 10, the predetermined communication channel being based on settings in the database, and the processing portion including a translator portion that translates further data into a communication for transmission, of the information, over the predetermined communication channel.

12. The container assembly of claim 10, the predetermined communication channel including audio output through a speaker.

13. The container assembly of claim 1, the action event including the processing portion outputting information, in response to observing the trigger event, to a user on a predetermined communication channel.

14. The container assembly of claim 1, wherein the trigger event includes an add additive request that represents a request to add one of the additives, of the one or more additives; and the action event including the processing portion controlling the dispensing assembly to add the one of the additives to the liquid.

15. The container assembly of claim 14, the controlling the dispensing assembly to add the one of the additives to the liquid includes:

dispensing a set amount of the one of the additives into the liquid, and the set amount being stored in the database.

16. The container assembly of claim 15, the action event further including the processing portion outputting information, regarding the one of the additives added, to a user, of the container assembly, via an audio communication, and the audio communication being output through a speaker of the container assembly.

17. The container assembly of claim 15, the set amount of the additive being input from a user, of the container assembly, through a communication between the container assembly and a user device of the user, and the communication including data, output by the container assembly, to generate a graphical user interface (GUI) on the user device of the user, so as to interface with the user.

18. The container assembly of claim 1, the processing portion performing further processing including:

interfacing with a user device, associated with a user of the container assembly, to input attributes of a further trigger event, to be one of the known trigger events; and mapping the input attributes of such further trigger event to a stored action event so as to generate a mapping; and storing the mapping in a further associated action event dataset that is associated with such further trigger event.

19. The container assembly of claim 1, the communication portion is a microphone.

* * * * *